US009228786B2

(12) United States Patent
Sullivan et al.

(10) Patent No.: US 9,228,786 B2
(45) Date of Patent: Jan. 5, 2016

(54) QUICK BARREL CHANGE FIREARM

(75) Inventors: Leroy James Sullivan, Prescott, AZ (US); Robert Lloyd Waterfield, Prescott, AZ (US); Alan H. Ostrowski, Prescott, AZ (US); Paul N. Latulippe, Jr., Chino Valley, AZ (US); Hyunjung Samuel Eyssautier, Prescott, AZ (US)

(73) Assignee: ArmWest, LLC, Prescott, AZ (US)

( * ) Notice: Subject to any disclaimer, the term of this patent is extended or adjusted under 35 U.S.C. 154(b) by 238 days.

(21) Appl. No.: 13/350,156

(22) Filed: Jan. 13, 2012

(65) Prior Publication Data

US 2012/0180354 A1 Jul. 19, 2012

Related U.S. Application Data

(60) Provisional application No. 61/433,115, filed on Jan. 14, 2011, provisional application No. 61/524,138, filed on Aug. 16, 2011.

(51) Int. Cl.
*F41A 21/48* (2006.01)
*F41A 3/26* (2006.01)
(Continued)

(52) U.S. Cl.
CPC ... *F41A 3/26* (2013.01); *F41A 3/64* (2013.01); *F41A 3/66* (2013.01); *F41A 3/70* (2013.01); *F41A 3/72* (2013.01); *F41A 3/84* (2013.01); *F41A 5/18* (2013.01); *F41A 5/24* (2013.01); *F41A 5/26* (2013.01); *F41A 5/28* (2013.01); *F41A 11/00* (2013.01); *F41A 11/04* (2013.01); *F41A 15/14* (2013.01); *F41A 17/00* (2013.01); *F41A 17/30* (2013.01); *F41A 17/64* (2013.01);
(Continued)

(58) Field of Classification Search
CPC ..... F41A 21/48; F41A 21/481; F41A 21/484; F41A 21/487
USPC ..... 42/75.01, 75.02, 75.03, 75.04; 89/191.01, 191.02, 192, 193, 170
See application file for complete search history.

(56) References Cited

U.S. PATENT DOCUMENTS 804,986 A 11/1905 Stamm
980,980 A 1/1911 Maggio
(Continued)

FOREIGN PATENT DOCUMENTS

CH 37247 5/1907
CH 199224 8/1938
(Continued)

OTHER PUBLICATIONS

Anonymous: "Magazine Feed Liptool," Internet Article, http://www.brownells.com/.aspx/pid=25049/Product/Magazine-Feed-Liptool, Retrieved from the Internet on Jul. 3, 2012.

*Primary Examiner* — Bret Hayes
*Assistant Examiner* — Derrick Morgan
(74) *Attorney, Agent, or Firm* — Haynes and Boone, LLP

(57) ABSTRACT

A firearm can have a backbone, a barrel, a swinging wedge, and a barrel latch, in accordance with one or more embodiments. The barrel latch can be in mechanical communication with the swinging wedge. The barrel latch can have a first position and a second position and the swinging wedge can be configured to maintain attachment of the barrel to the backbone when the barrel latch is in the first position and is configured to release the barrel from the backbone when the barrel latch is in the second position. Thus, the firearm can provide quick barrel changes. Other features enhance the reliability and utility of the firearm.

22 Claims, 107 Drawing Sheets

(51) Int. Cl.

| | |
|---|---|
| ***F41A 3/64*** | (2006.01) |
| ***F41A 3/70*** | (2006.01) |
| ***F41A 3/72*** | (2006.01) |
| ***F41A 3/84*** | (2006.01) |
| ***F41A 5/18*** | (2006.01) |
| ***F41A 5/24*** | (2006.01) |
| ***F41A 5/26*** | (2006.01) |
| ***F41A 11/00*** | (2006.01) |
| ***F41A 15/14*** | (2006.01) |
| ***F41A 17/00*** | (2006.01) |
| ***F41A 17/64*** | (2006.01) |
| ***F41A 19/10*** | (2006.01) |
| ***F41A 19/13*** | (2006.01) |
| ***F41A 19/42*** | (2006.01) |
| ***F41A 19/43*** | (2006.01) |
| ***F41A 19/46*** | (2006.01) |
| ***F41A 35/02*** | (2006.01) |
| ***F41C 23/04*** | (2006.01) |
| ***F41C 23/20*** | (2006.01) |
| ***F41A 3/66*** | (2006.01) |
| ***F41A 5/28*** | (2006.01) |
| ***F41A 11/04*** | (2006.01) |
| ***F41A 17/30*** | (2006.01) |

(52) U.S. Cl.

CPC ..... *F41A 19/10* (2013.01); *F41A 19/13* (2013.01); *F41A 19/42* (2013.01); *F41A 19/43* (2013.01); *F41A 19/46* (2013.01); *F41A 21/48* (2013.01); *F41A 21/484* (2013.01); *F41A 35/02* (2013.01); *F41C 23/04* (2013.01); *F41C 23/20* (2013.01)

(56) References Cited

U.S. PATENT DOCUMENTS

| | | | | |
|---|---|---|---|---|
| 1,202,707 | A | | 10/1916 | Greico |
| 1,227,439 | A | | 5/1917 | Hilgendorf |
| 1,363,262 | A | * | 12/1920 | North ..... F41A 21/484 42/75.02 |
| 1,402,459 | A | | 1/1922 | Swebilius |
| 1,413,409 | A | | 4/1922 | Lackman |
| 1,476,657 | A | | 12/1923 | Tawney |
| 1,500,580 | A | | 7/1924 | Matteo |
| 1,588,887 | A | | 6/1926 | Haubroe |
| 1,907,164 | A | | 5/1933 | White |
| 1,946,388 | A | | 2/1934 | Chevallier |
| 2,088,268 | A | | 7/1937 | Lauf |
| 2,096,028 | A | | 10/1937 | Burton et al. |
| 2,147,208 | A | | 2/1939 | Nolan |
| 2,217,848 | A | | 10/1940 | Schillstrom |
| 2,345,031 | A | | 3/1944 | Carithers |
| 2,365,306 | A | | 12/1944 | Swebilius |
| 2,365,392 | A | | 12/1944 | Cooley |
| 2,376,466 | A | | 5/1945 | Williams |
| 2,391,756 | A | | 12/1945 | Vesely |
| 2,462,119 | A | | 2/1949 | Moore |
| 2,482,880 | A | | 9/1949 | Sefried, II |
| 2,488,233 | A | | 11/1949 | Pero |
| 2,503,116 | A | | 4/1950 | Maillard |
| 2,756,640 | A | | 7/1956 | Maillard |
| 2,910,332 | A | * | 10/1959 | Madsen et al. ..... 277/446 |
| 2,981,154 | A | * | 4/1961 | Sweeney ..... 89/14.5 |
| 3,043,198 | A | | 7/1962 | Burns et al. |
| 3,090,148 | A | | 5/1963 | Smith |
| 3,090,149 | A | | 5/1963 | Marlas |
| 3,198,076 | A | * | 8/1965 | Stoner ..... 89/128 |
| 3,226,869 | A | | 1/1966 | Musgrave |
| 3,318,192 | A | * | 5/1967 | Sullivan et al. ..... 89/142 |
| 3,330,183 | A | | 7/1967 | Löffler |
| 3,333,510 | A | | 8/1967 | Muhlemann |
| 3,345,771 | A | | 10/1967 | Silsby |
| 3,346,982 | A | | 10/1967 | Loffler et al. |
| 3,366,011 | A | | 1/1968 | Stutervant |
| 3,440,751 | A | | 4/1969 | Fremont |
| 3,604,142 | A | | 9/1971 | Silsby |
| 3,641,691 | A | * | 2/1972 | Ellis ..... F41C 27/06 42/105 |
| 3,672,089 | A | | 6/1972 | Silsby |
| 3,688,641 | A | * | 9/1972 | Curtis et al. ..... 89/189 |
| 3,795,173 | A | | 3/1974 | Freymond |
| 3,977,114 | A | | 8/1976 | Poor |
| 3,990,348 | A | | 11/1976 | Vesamaa |
| 4,020,740 | A | | 5/1977 | Schirneker |
| 4,127,954 | A | | 12/1978 | Hausmann |
| 4,388,773 | A | * | 6/1983 | Beretta ..... F41A 21/484 42/75.02 |
| 4,416,186 | A | | 11/1983 | Sullivan |
| 4,428,137 | A | | 1/1984 | Johnson |
| 4,446,645 | A | | 5/1984 | Kelsey, Jr. |
| 4,505,182 | A | * | 3/1985 | Sullivan ..... 89/132 |
| 4,524,672 | A | | 6/1985 | Balsavage |
| 4,589,218 | A | | 5/1986 | Teppa |
| 4,765,224 | A | | 8/1988 | Morris |
| 4,769,938 | A | * | 9/1988 | Chesnut ..... F41A 21/484 42/124 |
| 4,833,970 | A | * | 5/1989 | Wilhelm ..... F41A 19/33 89/141 |
| 5,155,284 | A | * | 10/1992 | Flashkes ..... F41C 33/08 42/75.02 |
| 5,168,648 | A | | 12/1992 | Brandl |
| 5,448,940 | A | * | 9/1995 | Schuetz et al. ..... 89/185 |
| 5,495,687 | A | | 3/1996 | Waiser |
| 5,561,933 | A | | 10/1996 | Czekalski |
| 5,634,288 | A | | 6/1997 | Martel |
| 5,827,992 | A | | 10/1998 | Harris et al. |
| 5,900,577 | A | * | 5/1999 | Robinson ..... F41A 11/02 89/156 |
| 5,909,002 | A | | 6/1999 | Atchisson |
| 6,340,161 | B1 | * | 1/2002 | Zitting et al. ..... 277/459 |
| 6,484,430 | B1 | | 11/2002 | Robinson et al. |
| 6,606,812 | B1 | * | 8/2003 | Gwinn, Jr. ..... F41A 21/484 42/75.02 |
| 6,609,319 | B1 | | 8/2003 | Olson |
| 6,722,255 | B2 | * | 4/2004 | Herring ..... 89/193 |
| 6,829,974 | B1 | | 12/2004 | Gwinn, Jr. |
| 6,848,351 | B1 | * | 2/2005 | Davies ..... 89/191.01 |
| 6,898,888 | B2 | | 5/2005 | Greenhut |
| 6,931,978 | B1 | * | 8/2005 | Dionne ..... F41A 3/12 42/69.02 |
| 7,117,626 | B1 | | 10/2006 | Alzamora |
| 7,293,385 | B2 | * | 11/2007 | McCormick ..... 42/75.03 |
| 7,627,974 | B2 | * | 12/2009 | Olson ..... 42/46 |
| 7,823,314 | B1 | * | 11/2010 | Wheatley ..... 42/75.02 |
| 7,827,722 | B1 | | 11/2010 | Davies |
| 7,832,326 | B1 | * | 11/2010 | Barrett ..... 89/191.01 |
| 7,886,470 | B1 | * | 2/2011 | Doiron ..... 42/69.02 |
| 7,938,055 | B2 | * | 5/2011 | Hochstrate et al. ..... 89/193 |
| 8,061,071 | B2 | | 11/2011 | Fitzpatrick et al. |
| 8,087,194 | B1 | * | 1/2012 | Vuksanovich ..... 42/75.02 |
| 8,141,285 | B2 | * | 3/2012 | Brown ..... 42/71.01 |
| 8,205,373 | B1 | * | 6/2012 | Ubl et al. ..... 42/71.01 |
| 8,210,089 | B2 | * | 7/2012 | Brown ..... 89/191.02 |
| 8,261,653 | B2 | | 9/2012 | Crommett |
| 8,297,175 | B1 | | 10/2012 | Davies |
| 8,316,756 | B1 | | 11/2012 | Woodell et al. |
| 8,365,454 | B2 | | 2/2013 | Hogan, Jr. |
| 2003/0188567 | A1 | | 10/2003 | Garrett |
| 2004/0128898 | A1 | * | 7/2004 | Popikow ..... F41A 15/06 42/47 |
| 2005/0262752 | A1 | | 12/2005 | Robinson et al. |
| 2007/0199435 | A1 | | 8/2007 | Hochstrate et al. |
| 2008/0092733 | A1 | | 4/2008 | Leitner-Wise et al. |
| 2008/0134557 | A1 | * | 6/2008 | Wossner et al. ..... 42/75.02 |
| 2008/0168695 | A1 | * | 7/2008 | Nakayama ..... 42/75.02 |
| 2010/0095833 | A1 | | 4/2010 | Gavage et al. |
| 2010/0126053 | A1 | | 5/2010 | Fitzpatrick et al. |
| 2010/0163250 | A1 | * | 7/2010 | Schultz et al. ..... 166/381 |
| 2010/0269389 | A1 | | 10/2010 | Lopez Laparra |
| 2010/0300278 | A1 | | 12/2010 | Zedrosser |
| 2011/0005384 | A1 | | 1/2011 | Lewis et al. |

(56) References Cited

U.S. PATENT DOCUMENTS

| | | | | |
|---|---|---|---|---|
| 2011/0173857 | A1 | 7/2011 | Hogan, Jr. | |
| 2012/0131831 | A1 | 5/2012 | Sullivan et al. | |
| 2012/0152105 | A1 | 6/2012 | Gomez et al. | |
| 2013/0139424 | A1* | 6/2013 | Devine | 42/16 |

FOREIGN PATENT DOCUMENTS

| | | |
|---|---|---|
| CN | 1219231 | 6/1999 |
| CN | 101403587 | 4/2009 |
| DE | 569280 | 2/1933 |
| DE | 203574 | 8/1938 |
| DE | 664926 | 9/1938 |
| DE | 712084 | 10/1941 |
| DE | 858944 | 12/1952 |
| DE | 3707925 | 9/1988 |
| DE | 102006011278 | 9/2007 |
| DE | 102007011502 | 9/2008 |
| DE | 10 2007 034670 | 1/2009 |
| EP | 0055690 | 7/1982 |
| EP | 1479997 | 11/2004 |
| EP | 1596151 | 11/2005 |
| EP | 2045561 | 4/2009 |
| FR | 1362361 | 5/1964 |
| GB | 166579 | 7/1921 |
| GB | 525429 | 8/1940 |
| GB | 536728 | 12/1944 |
| GB | 604348 | 7/1948 |
| GB | 1227706 | 4/1971 |
| GB | 1338189 | 11/1973 |
| GB | 2231943 | 11/1990 |
| JP | 2003/287127 | 10/2003 |
| TW | 201024655 | 7/2010 |
| WO | WO 97/25581 | 7/1997 |

* cited by examiner

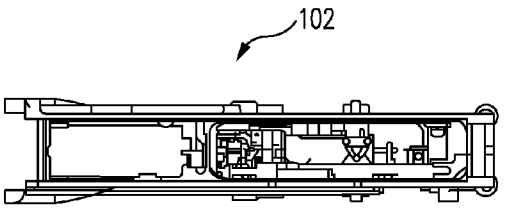
FIG. 5H
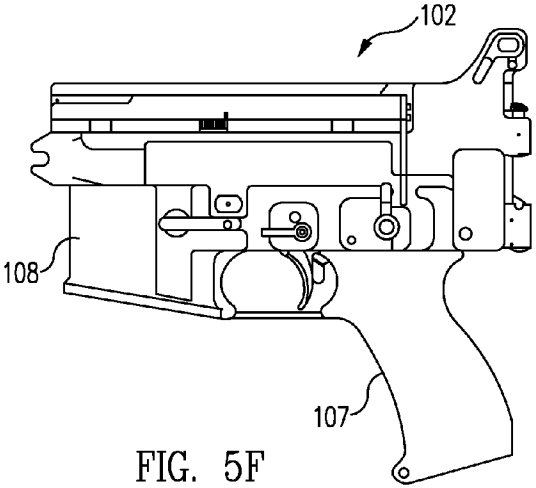
FIG. 5F
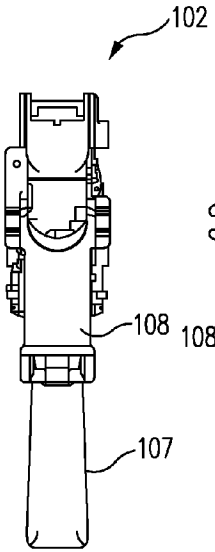
FIG. 5G
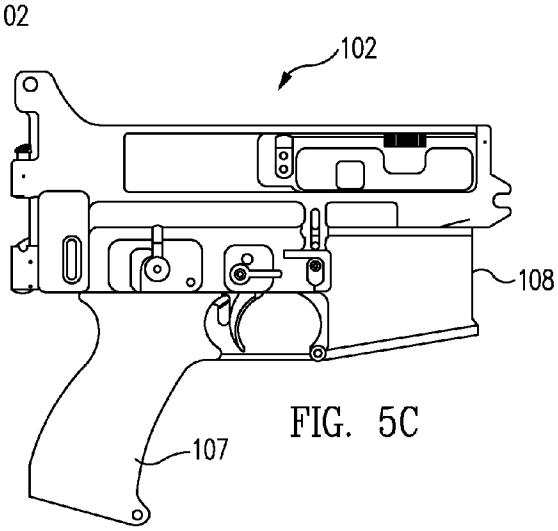
FIG. 5C
FIG. 5D
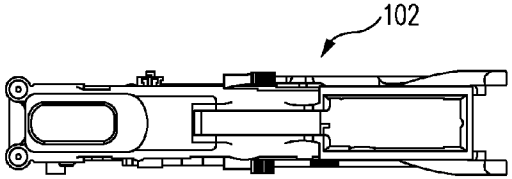
FIG. 5E

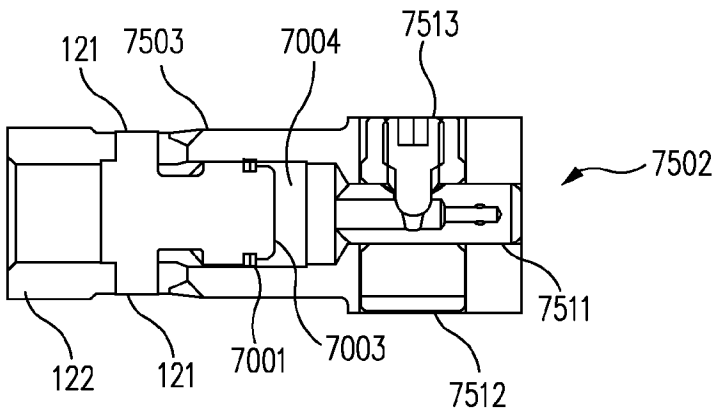
FIG. 73
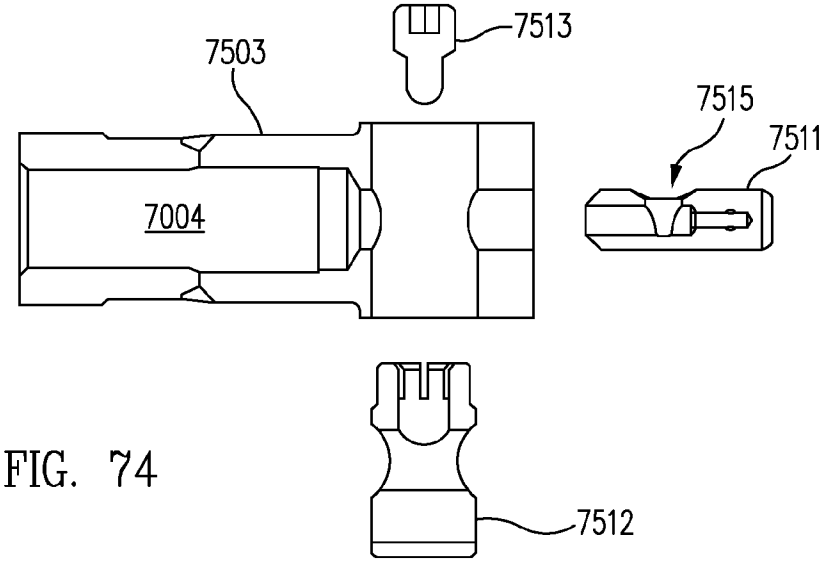
FIG. 74
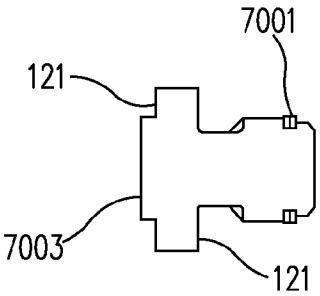

EXAMPLES OF FIREARMS CONFIGURATIONS

| | OPEN BOLT MACHINE GUN | OPEN BOLT AND CLOSED BOLT SEMI-AUTO RIFLE | OPEN BOLT CLOSED BOLT RIFLE/MACHINE GUN |
|---|---|---|---|
| OPEN BOLT FULL AUTO | X | | X |
| OPEN BOLT SEMI AUTO | X | X | X |
| CLOSED BOLT SEMI AUTO | | X | X |
| CHARGE HANDLE TRIGGER LOCK | X | X | X |
| MAGAZINE TAKE DOWN LOCK | X | X | X |
| AUTO SEAR TRIP | | X | X |
| SLAM FIRE | X | | |
| OPEN BOLT ARM DAMPER | X | X | X |
| HAMMER | | X | X |
| SAFETY (TRIGGER) | X | X | X |
| SAFETY (HAMMER) | | X | X |
| SAFETY (OPEN BOLT LEVER) | X | X | X |
| SELECTOR CAM OPEN BOLT SEMI AUTO | X | X | X |
| SELECTOR CAM OPEN BOLT FULL AUTO | X | | X |
| SELECTOR CAM CLOSED BOLT SEMI AUTO | | X | X |
| SELECTOR CAM OPEN BOLT/CLOSED BOLT BUTTON LOCK | | X | X |
| CLOSED BOLT SEAR | | X | X |
| CLOSED BOLT DISCONNECT | | X | X |
| AUTO SEAR (HAMMER) | | X | X |
| OPEN BOLT TRIGGER BAR | X | X | X |
| OPEN BOLT ARM RELEASE LEVER | X | X | X |
| OPEN BOLT ARM DISCONNECT | X | X | X |
| OPEN BOLT ARM | X | X | X |
| OPEN BOLT SEAR | X | X | X |
| TRIGGER (WITH BAR) | X | X | X |
| TRIGGER BLOCK SLAVE PIN | | X | X |

FIG. 83

QUICK BARREL CHANGE FIREARM

PRIORITY CLAIM

This application claims the benefit of U.S. Provisional Application No. 61/433,115, filed Jan. 14, 2011. This application claims the benefit of U.S. Provisional Application No. 61/524,138, filed Aug. 16, 2011. Both of these provisional patent applications are hereby incorporated by reference in their entirety.

TECHNICAL FIELD

One or more of the embodiments relate generally to firearms, and more particularly for example, to a firearm configured to facilitate a quick barrel change and having features which enhance the reliability thereof.

BACKGROUND

Semi-automatic and fully automatic firearms are well known. Semi-automatic firearms shoot one bullet each time that the trigger is pulled. Fully automatic firearms continue shooting as long as the trigger is pulled and they have not exhausted their ammunition. Fully automatic firearms are typically capable of relatively high rates of fire, i.e., cyclic rates. For example, the M16 and the M4 have a nominal cyclic rate of 700 to 950 rounds per minute.

Because fully automatic firearms are capable of such high cyclic rates, they are prone to a variety of problems. For example, sustained fully automatic fire can result in barrel overheating. Barrel overheating is particularly problematic when high capacity magazines, such as SureFire's 60 round and 100 round magazines, are being used. High capacity magazines allow longer periods of sustained fire since fewer magazine changes are required to fire a given number of rounds. Fewer magazine changes provide less time for the barrel to cool. Thus, the barrel, as well as other parts of the firearm, can be subjected to increased heat.

Often, the ability to keep firing is limited by barrel overheating. When the barrel of a firearm overheats, accuracy of the firearm is substantially reduced. Further overheating of the barrel can result in malfunction of the firearm. For example, cartridges chambered into an overheated barrel can detonate prematurely, i.e., cook off, particularly in closed bolt firearms. If the barrel is overheated sufficiently it can deform, thereby resulting in a catastrophic failure of the firearm.

Even after the barrel has returned to an acceptable operating temperature, the firearm may be unusable. The barrel and/or other components of the firearm may have been permanently damaged. Changing the barrel of a contemporary firearm such as the M16 or M4 takes a substantial amount of time and is not generally performed in the field. When the firearm is unusable due to overheating and while the barrel is being changed, a soldier or police officer cannot shoot the firearm and is thus undesirably vulnerable to attack.

The inability to shoot a firearm can have disastrous consequence in battlefield and police situations. The inability to shoot has resulted in loss of life in such instances. Therefore, it is desirable to provide systems and methods for facilitating the quick change of the barrel of a firearm and for otherwise enhancing the reliability and utility of the firearm, for example.

BRIEF SUMMARY

In accordance with embodiments further described herein, features are provided that may be advantageously used in one or more firearm designs. According to an embodiment, a firearm can have a backbone, a barrel, a swinging wedge, and a barrel latch. The barrel latch can be in mechanical communication with the swinging wedge such that moving the barrel latch will move the swinging wedge. The barrel latch can have a first position and a second position and the swinging wedge can be configured to maintain attachment of the barrel to the backbone when the barrel latch is in the first position and can be configured to release the barrel from the backbone when the barrel latch is in the second position.

According to an embodiment, a firearm can have a bolt carrier, a backbone configured to guide the bolt carrier, a lower receiver within which the bolt carrier is at least partially disposed wherein the barrel is attached to the backbone, a barrel latch attached to the backbone, a barrel configured to disengage from the backbone when the barrel latch is pushed, a trigger block assembly configured to drop into the lower receiver, a gas piston having a plurality of piston rings configured to only rotate substantially in unison with one another, an operating rod configured to move in response to movement of the gas piston and configured to move the bolt carrier when a cartridge is discharged, a metered gas port disposed out of the barrel for metering gas from the barrel to the gas piston, a spring guide having a main spring disposed thereon for biasing the bolt carrier in a forward position, an anti-bounce weight at least partially contained within the spring guide, a bolt carried by the bolt carrier, an extractor attached to the bolt, two springs disposed within the bolt for biasing the extractor toward a closed position of the extractor, a bar inhibiting separation of the lower receiver and the backbone when the main spring is compressed, a firing pin disposed within the bolt, a firing pin retaining pin configured to facilitate removal of the firing pin and configured to transfer forward movement of the bolt carrier to the firing pin to cause a cartridge to fire, a hammer assembly disposed within the lower receiver and having a hammer and a link with one end of the link attached to the hammer and another end of the link attached to the lower receiver such that the hammer has a rearward position that is below the bolt when the bolt is in a rearward position and the hammer has a forward position where the hammer strikes the firing pin when the bolt is in a forward position and wherein the link is configured such that the hammer has sufficient throw to travel over a last round stop as the hammer moves from the rearward position to the forward position, a takedown lever configured to inhibit separation of the backbone and the lower receiver, the takedown lever having a safety lock pin to inhibit inadvertent movement of the takedown lever, a charging handle configured to move rearward to move the bolt carrier from an uncocked position to a cocked position, a dust cover configured to open partially to allow the charging handle to move rearward, a gas port flash suppressor configured to guide the barrel during mating of the barrel to the backbone, and a stock having a horizontal groove formed therein. The groove can be configured to inhibit horizontal movement of a user's hand.

According to an embodiment, a firearm can have a bolt carrier, a backbone configured to guide the bolt carrier, a lower receiver within which the bolt carrier is at least partially disposed attached to the backbone, a barrel latch attached to the backbone, a barrel configured to disengage from the backbone when the barrel latch is pushed, a trigger block assembly configured to drop into the lower receiver, and a hammer assembly disposed within the lower receiver and having a hammer and a link with one end of the link attached to the hammer and another end of the link attached to the lower receiver such that the hammer has a rearward position that is below the bolt when the bolt is in a rearward position and the hammer has a forward position where the hammer strikes the firing pin when the bolt is in a forward position. The link can be configured such that the hammer has sufficient throw to travel over a last round stop as the hammer moves from the rearward position to the forward position.

According to an embodiment, a device can have a bolt carrier for a firearm and a backbone configured to at least partially guide the bolt carrier as the bolt carrier moves forward and backward during a firing cycle of the firearm. The bolt carrier can be not completely contained within the backbone.

According to an embodiment, a firearm can have a lower receiver, a backbone attached to the lower receiver, and a bolt carrier. Movement of the bolt carrier can be constrained by the backbone and not constrained by the lower receiver.

According to an embodiment, a method can include placing a portion of a bolt carrier within a backbone while leaving another portion of the bolt carrier out of the backbone. The backbone can be configured to at least partially guide the bolt carrier as the bolt carrier moves forward and backward during a firing cycle of a firearm.

According to an embodiment, a method can include at least partially guiding a bolt carrier with a backbone as the bolt carrier moves forward and backward during a firing cycle of a firearm. The bolt can be not completely contained within the backbone.

According to an embodiment, a device can comprise a bolt carrier for a firearm. The bolt carrier can having a generally tubular upper portion, a generally rectangular lower portion, and a waist interconnecting the upper portion and the lower portion. The upper portion can be substantially longer than the lower portion.

According to an embodiment, a method can include forming a bolt carrier for a firearm to have a generally tubular upper portion, a generally rectangular lower portion, and a waist interconnecting the upper portion and the lower portion. The upper portion can be substantially longer than the lower portion.

According to an embodiment, a method can include chambering a cartridge in a firearm using a bolt carrier having a generally tubular upper portion, a generally rectangular lower portion, and a waist interconnecting the upper portion and the lower portion. The upper portion can be substantially longer than the lower portion.

According to an embodiment, a firearm can have a backbone, a barrel removably attached to the backbone, a barrel latch attached to the backbone, a swinging wedge in mechanical communication with the barrel latch, and a pin attached to the barrel. The swinging wedge can be configured to facilitate attachment of the barrel to the backbone via the pin such that moving the barrel latch allows the barrel to detach from the backbone.

According to an embodiment, a method can include attaching a barrel latch to a backbone of a firearm. The barrel latch can have a swinging wedge attached thereto. A barrel can be attached to the backbone via a pin attached to the barrel that is captured by the swinging wedge. The swinging wedge can be configured to facilitate detachment of the barrel from the backbone by moving the barrel latch.

According to an embodiment, a method can include moving a swinging wedge of a firearm. Moving the swinging wedge can facilitate detachment of a barrel from a backbone of the firearm.

According to an embodiment, a device can have a trigger block assembly for a firearm. The trigger block assembly can be configured to drop into the firearm.

According to an embodiment, a method can include assembling a trigger block assembly for a firearm, providing a lower receiver for the firearm, and assembling the trigger block assembly to the lower receiver by dropping the trigger block assembly into the lower receiver.

According to an embodiment, a method can include firing a firearm by pulling a trigger of the firearm. The trigger can be part of a trigger block assembly. The trigger block assembly can be configured to drop into a lower receiver of the firearm during assembly of the firearm.

According to an embodiment, a device can have a piston for a gas operated firearm. Two protrusions can be formed upon the piston and configured to stop rearward movement of the piston when the firearm is discharged.

According to an embodiment, a method can include placing a piston into a cylinder of a gas operated firearm. The piston can have two protrusions formed thereon and the protrusions can be slidably disposed in two slots formed in the cylinder such that the protrusions limit movement of the piston.

According to an embodiment, a method can include firing a gas operated firearm to provide gas to a piston of the firearm. The piston can move in response to pressure provided by the gas. Movement of the piston can be limited by two protrusions formed upon the piston.

According to an embodiment, a device can have a recoil or drive spring configured to be compressed by rearward movement of a bolt carrier when a firearm is discharged, a spring guide for limiting movement of the drive spring, and an anti-bounce weight defined by at least a portion of the spring guide. The anti-bounce weight can be configured to inhibit bouncing of a bolt carrier of the firearm.

According to an embodiment, a method can include assembling a spring guide for a firearm and defining an anti-bounce weight using at least a portion of the spring guide. The anti-bounce weight can be configured to inhibit bouncing of a bolt carrier of the firearm.

According to an embodiment, a method can include firing a firearm, guiding a drive spring of the firearm with a spring guide, and inhibiting bouncing of a bolt carrier of the firearm with an anti-bounce weight. The anti-bounce weight can be defined by at least a portion of the spring guide.

According to an embodiment, a device can have a lower receiver for a firearm, a bolt having a forward position and a reward position, a firing pin disposed substantially within the bolt, and a hammer assembly disposed within the lower receiver. The hammer assembly can have a hammer and a link. One end of the link can be pivotally attached to the hammer and another end of the link can be pivotally attached to the lower receiver, such that the hammer has a rearward position that is below the bolt when the bolt is in the rearward position and the hammer has a forward position where the hammer strikes the firing pin when the bolt is in a forward position. The link can be configured such that the hammer has sufficient throw to travel over a last round stop as the hammer moves from the rearward position to the forward position.

According to an embodiment, a method can include installing a hammer assembly within a lower receiver of a firearm. The hammer assembly can have a hammer and a link. One end of the link can be pivotally attached to the hammer and another end of the link can be pivotally attached to a lower receiver such that the hammer has a rearward position that is below a bolt when the bolt is in a rearward position and the hammer has a forward position where the hammer strikes a firing pin when the bolt is in a forward position. The link can be configured such that the hammer has sufficient throw to travel over a last round stop as the hammer moves from the rearward position to the forward position.

According to an embodiment, a method can include pulling a trigger to discharge a firearm and striking a firing pin with a hammer in response to pulling the trigger. One end of a link can be pivotally attached to the hammer and another end of the link can be pivotally attached to a lower receiver such that the hammer has a rearward position that is below a bolt when the bolt is in the rearward position and the hammer has a forward position where the hammer strikes the firing pin when the bolt is in a forward position. The link can be configured such that the hammer has sufficient throw to travel over a last round stop as the hammer moves from the rearward position to the forward position.

According to an embodiment, a device can have a stock for a firearm, a butt formed on a distal end of the stock, and a generally horizontal groove from in the butt. The generally horizontal groove can be configured to inhibit vertical movement of a hand when grasping the butt.

According to an embodiment, a method can include forming a generally horizontal groove in a butt at the distal end of a stock for a firearm. The generally horizontal groove can be configured to inhibit vertical movement of a hand when grasping the butt.

According to an embodiment, a method can include discharging a firearm. A butt of a stock of the firearm can be grasped with a hand while the firearm is being discharged. A generally horizontal groove formed in the butt can substantially inhibit undesirable vertical movement of the hand, e.g. slipping of the hand, as the firearm is discharged.

According to an embodiment, a gas operated firearm can have a barrel, a gas port formed in the barrel, a gas system, and a metered gas port not disposed in the barrel. The metered gas port can be configured to meter gas from the barrel to the gas system. The metered gas port can tend to maintain a substantially uniform quantity of gas to the gas system as the gas port enlarges due to wear.

According to an embodiment, a method can include forming a gas port in a barrel of a firearm and attaching a metered gas port to the firearm at a location not in the barrel. The metered gas port can be configured to meter gas from the barrel to a gas system of the firearm. The metered gas port can tend to maintain a substantially uniform quantity of gas to the gas system as the gas port enlarges due to wear.

According to an embodiment, a method can include metering gas to the gas system of a firearm using a metered gas port. The metered gas port is not disposed in a barrel of the firearm can be disposed away from the barrel, such as in the gas block or front sight. The metered gas port tends to maintain a substantially uniform quantity of gas from the barrel to the gas system as the gas port enlarges due to wear.

According to an embodiment, a device can have an extractor for a firearm. The extractor can have a closed position and an open position. Two springs can bias the extractor toward the closed position. The extractor can be sufficiently wide to be biased by the two springs.

According to an embodiment, a method can include inserting two springs into a bolt for a firearm and attaching an extractor to the bolt. The two springs can bias the extractor toward a closed position of the extractor.

According to an embodiment, a method can include discharging a firearm, biasing an extractor of the firearm toward a closed position of the extractor with two springs, and extracting a spent casing from a chamber of the firearm with the extractor. The extractor can be sufficiently wide so as to accommodate contact with the two springs.

According to an embodiment, a device can have a drive spring for a firearm and a bolt carrier. The bolt carrier can have a forward position and a rearward position. The drive spring can bias the bolt carrier in the forward position. A bar can be configured to be pulled forward by the bolt carrier as the bolt carrier chambers a cartridge. The bar can be configured to inhibit takedown of the firearm when the bolt carrier is in the rearward position thereof and the drive spring is compressed.

According to an embodiment, a method can include installing a drive spring in a firearm, installing a bolt carrier in the firearm such that the drive spring biases the bolt carrier in a forward position of the bolt carrier, and installing a bar in the firearm. The bar can be configured to be pulled forward by the bolt carrier as the bolt carrier chambers a cartridge. The bar can be configured to inhibit takedown of the firearm when the bolt carrier is in a rearward position thereof and the drive spring is compressed.

According to an embodiment, a method can include biasing a bolt carrier in a forward position with a drive spring, discharging the firearm to move the bolt carrier to a rearward position and then back to a forward position, and pulling a bar forward by the bolt carrier as the bolt carrier chambers a cartridge. The bar can be configured to inhibit takedown of the firearm when the bolt carrier is in the rearward position thereof and the drive spring is compressed.

According to an embodiment, a device can have an backbone for a firearm, a lower receiver for the firearm, and a takedown lever. The takedown lever can have a first position and a second position. When the takedown lever is in the first position separation of the backbone from the lower receiver is facilitated. When the takedown lever is in the second position separation of the backbone from the lower receiver is inhibited. A safety lock pin can inhibit inadvertent movement of the takedown lever from the first position to the second position and can inhibit inadvertent movement of the takedown lever from the second position to the first position.

According to an embodiment, a method can include assembling a takedown lever to a firearm. The takedown lever can have a first position and a second position. When the takedown lever is in the first position separation of the backbone from the lower receiver is facilitated. When the takedown lever is in the second position separation of the backbone from the lower receiver is inhibited. The method can further include assembling a safety lock pin to the firearm. The safety lock pin can inhibit inadvertent movement of the takedown lever from the first position to the second position and can inhibit inadvertent movement of the takedown lever from the second position to the first position.

According to an embodiment, a method can include moving a safety lock pin of a firearm to facilitate movement of a takedown lever of the firearm and moving the takedown lever from a first position thereof to a second position thereof to facilitate disassembly of the firearm. The safety lock pin can inhibit inadvertent movement of the takedown lever from the first position to the second position and can inhibit inadvertent movement of the takedown lever from the second position to the first position.

According to an embodiment, a device can have a charging handle for a firearm and a dust cover. The dust cover can be configured to open approximately 7° to allow the charging handle to move rearwards as the firearm is cocked.

According to an embodiment, a method can include assembling a charging handle to a firearm and assembling a dust cover to the firearm. The dust cover can be configured to open approximately 7° to allow the charging handle to move rearwards as the firearm is cocked.

According to an embodiment, a method can include moving a charging handle of a firearm rearward to cock the firearm. The charging arm can open a dust cover approximately 7° to allow the charging handle to move rearwards as the firearm is cocked According to an embodiment, a device can have a firing pin and a firing pin retaining pin configured to retain the firing pin in a bolt of a firearm. The firing pin retaining pin can be configured to transfer forward movement of a bolt carrier to the firing pin to cause the firearm to discharge.

According to an embodiment, a method can include assembling a firing pin into a bolt of a firearm and retaining the firing pin within the bolt with a firing pin retaining pin. The firing pin retaining pin can be configured to transfer forward movement of a bolt carrier to the firing pin to cause the firearm to discharge.

According to an embodiment, a method can include pulling a trigger of a firearm, moving a bolt carrier forward in response to the trigger being pulled, and transferring forward movement of the bolt carrier to a firing pin via a firing pin retaining pin. The firing pin can be configured to retain the firing pin within a bolt.

According to an embodiment, a cylinder can be disposed in an backbone of a gas operated firearm. A gas exhaust port can be formed in the cylinder for exhausting gas from the cylinder. A gas exhaust port flash suppressor can be configured to guide a barrel to the backbone to facilitate attachment of the barrel to the backbone.

According to an embodiment, a method can include assembling a cylinder into an backbone of a gas operated firearm. The cylinder can have a gas exhaust port for exhausting gas from the cylinder. A gas exhaust port flash suppressor can be attached to the backbone. The gas exhaust port flash suppressor can be configured to guide a barrel to the backbone to facilitate attachment of the barrel to the backbone.

According to an embodiment, a method can include exhausting gas from a gas exhaust port of a cylinder of a gas operated firearm. Flash from the gas exhaust port can be suppressed with a flash suppressor configured to guide a barrel to the backbone to facilitate attachment of the barrel to the backbone.

According to an embodiment, a semi-automatic firearm can be configured for both closed bolt operation and open bolt operation. A selector mechanism can be configured to select between closed bolt operation and open bolt operation of the firearm.

According to an embodiment, a firearm can have a bolt and can be configured for both closed bolt operation and open bolt operation. The firearm can have a trigger mechanism configured such that during open bolt operation and when the bolt is rearward, pulling the trigger only allows the bolt to be manually moved forward when a button has been pressed. The firearm can have a trigger mechanism configured such that during closed bolt operation and when the bolt is rearward pulling the trigger allows the bolt to be manually moved forward.

According to an embodiment, a firearm can have a barrel, a lower receiver, a backbone and two V-blocks with a spring loaded 2-armed swinging wedge located halfway between them and attached to the backbone to hold the barrel pulled up tight and precisely centered in the V-blocks with the flange of the barrel extension in a fore and aft locking groove in the rear V-block.

The rear v-block bears on and centers the body diameter of the barrel extension while the top 120° of the flange of the barrel extension fits up into a locking groove in that V-block. The close fit of the flange and locking groove combined with the upward pull of the swinging wedge on the barrel cross pin holds the barrel centered in the V-blocks, locks the barrel to the backbone and securely blocks any fore and aft movement of the barrel breech in relation to the backbone structure.

For longitudinal heat expansion the barrel slides fore or aft in the front v-block and the swinging wedge follows that motion without releasing its wedging force.

For radial heat expansion the two upper arms of a "Y" shaped yoke fit around both sides of the barrel and have a cross pin fastened through them across the top of the barrel. The ends of the cross pin extend beyond the outer sides of the two arms so that the 2-armed swinging wedge pulls upward on the two ends of the cross pin. In the crotch of the yoke an adjustable set screw bears on the bottom of the barrel and is factory adjusted to push downward on a flanged threaded tube compressing high force spring washers holding the yoke and cross pin downward with an initial force of approximately 700 pounds. As the approximately 1" barrel diameter expands from the heat of firing, the angled walls of the v-block force the barrel diameter downward, the center of which moves downward about 0.0045 inches while the bottom compresses the spring washers about 0.009 inches increasing the force to approximately 1200 pounds as the barrel temperature reaches approximately 1500° F. The barrel remains centered with no longitudinal breach movement.

The bottom stem of the yoke is fastened through a fore grip.

To install a barrel it is lifted upward and pulled rearward by its fore grip. Guide surfaces bring the barrel extension into alignment with the locking groove and the cross pin into engagement with the swinging wedge which snaps onto the pin drawing the barrel tight upward into its V-blocks and locked into the groove.

To remove a barrel the barrel latch end of the swinging wedge is hit downward. The same guide surfaces that directed it into position guide it out and downward on a path that prevents it from hitting or damaging a magazine. That path is also not obstructed by the weapon's bipod.

According to an embodiment, a firearm can have a lower receiver and an backbone. The lower receiver can be attached to the firearm via a hook pivot. The lower receiver can pivot downward from the firearm while remaining pivotally attached to the firearm. The lower receiver can be detached from the backbone.

These and other features and advantages of the present invention will be more readily apparent from the detailed description of the embodiments set forth below taken in conjunction with the accompanying drawings. The scope of the disclosure is defined by the claims, which are incorporated into this section by reference. A more complete understanding of embodiments, as well as a realization of additional advantages thereof, will be afforded to those skilled in the art by a consideration of the following detailed description of one or more embodiments.

BRIEF DESCRIPTION OF THE DRAWINGS

FIGS. 5C-5H are various elevational views of lower receiver assembly of the machine gun of FIG. 1, according to an embodiment;

FIGS. 54A-54D show the backbone and the barrel with various cross-sections, according to an embodiment;

FIGS. 55A-55D show the backbone and the barrel with various cross-sections, according to an embodiment;

FIGS. 56A-56D are various views showing barrel release, according to an embodiment;

FIGS. 57A-57D are various views showing the gas system, according to an embodiment;

FIGS. 58-61 are various views an extractor, according to an embodiment;

FIG. 62 is a cross-sectional side views of an unassembled bolt, according to an embodiment;

FIG. 63 is a cross-sectional side views of an unassembled bolt, according to an embodiment;

FIG. 64 is an front view of the bolt, according to an embodiment;

FIG. 65 is a cross-sectional side view of the unassembled bolt, according to an embodiment;

FIG. 66 is a cross-sectional side views of the assembled bolt, according to an embodiment;

FIG. 67 is a perspective exploded view the bolt, according to an embodiment;

FIG. 68 is a perspective view the assembled bolt, according to an embodiment;

Figure 69:
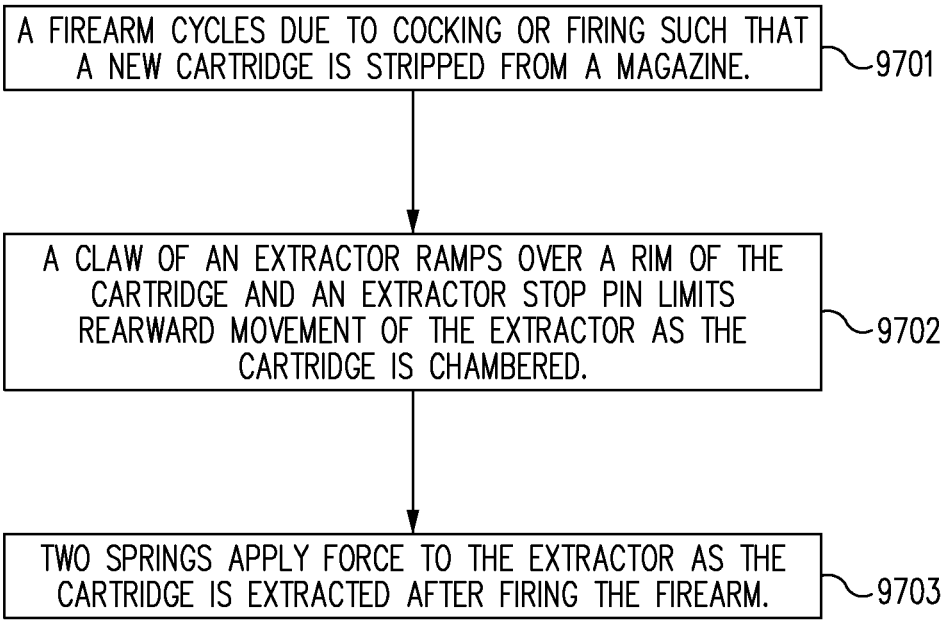
Figure 70:
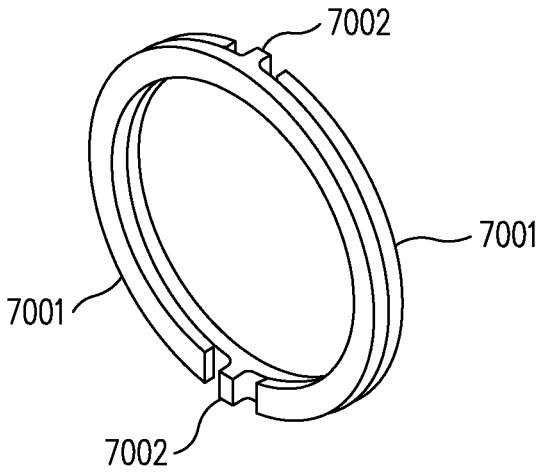
Figure 71:
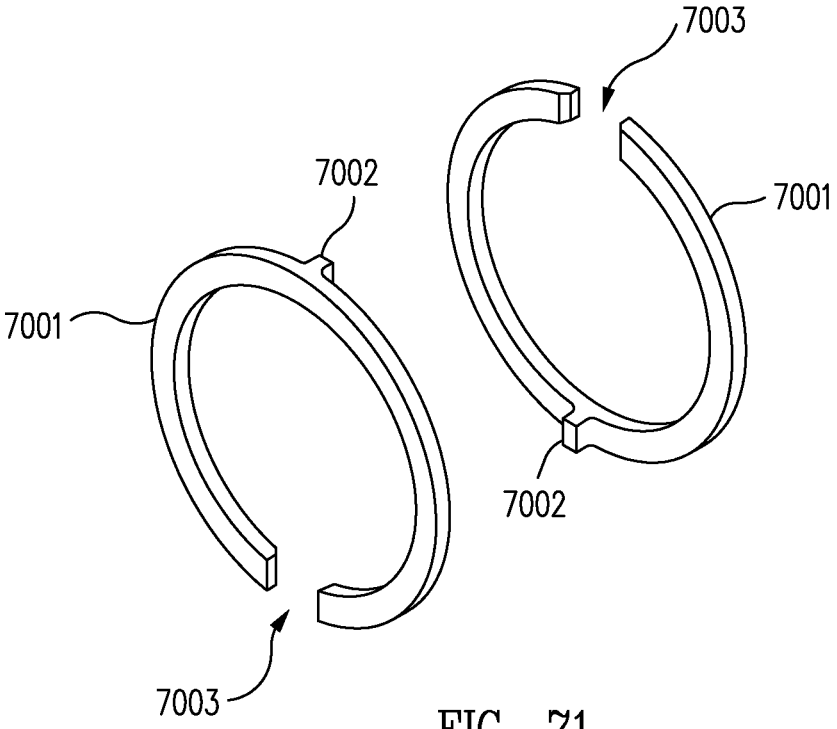
Figure 72:
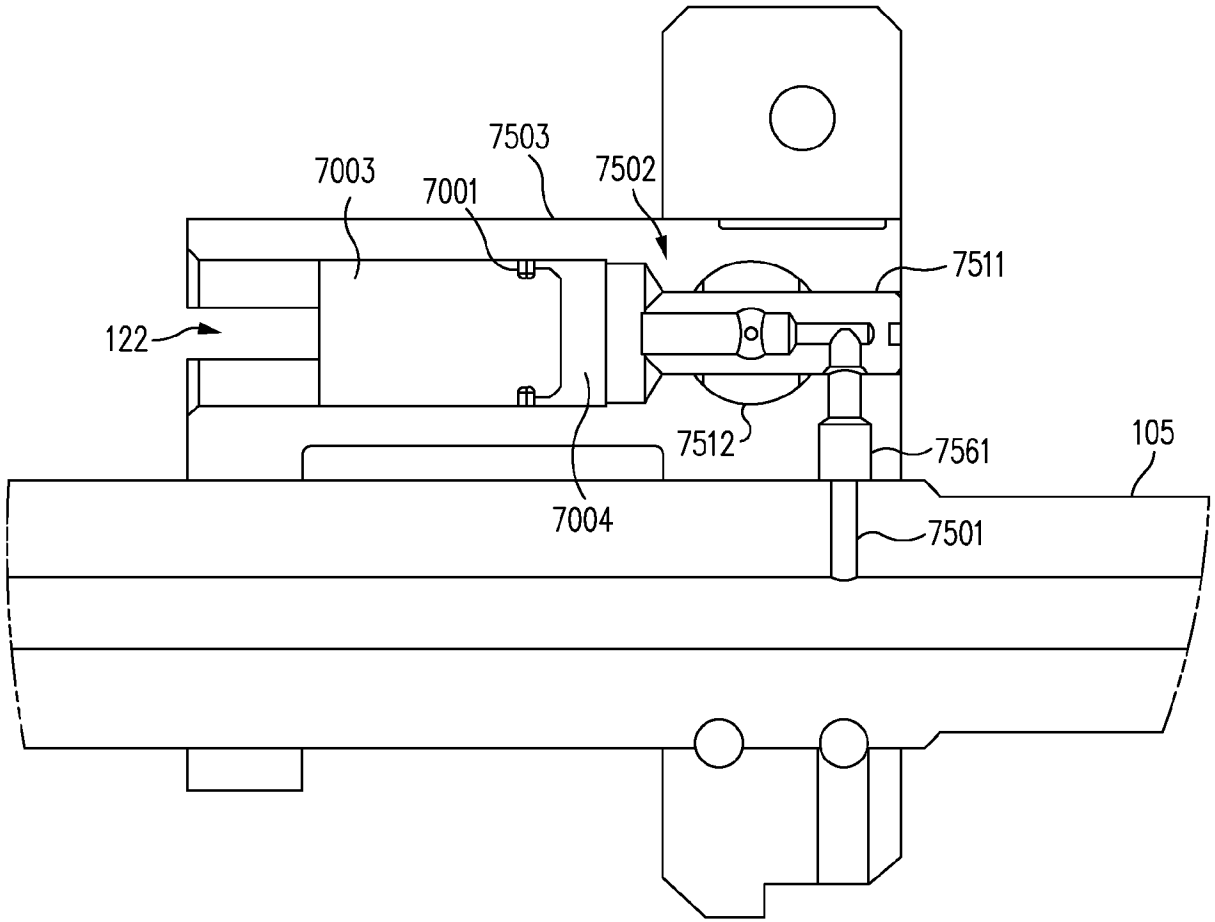
Figure 75:
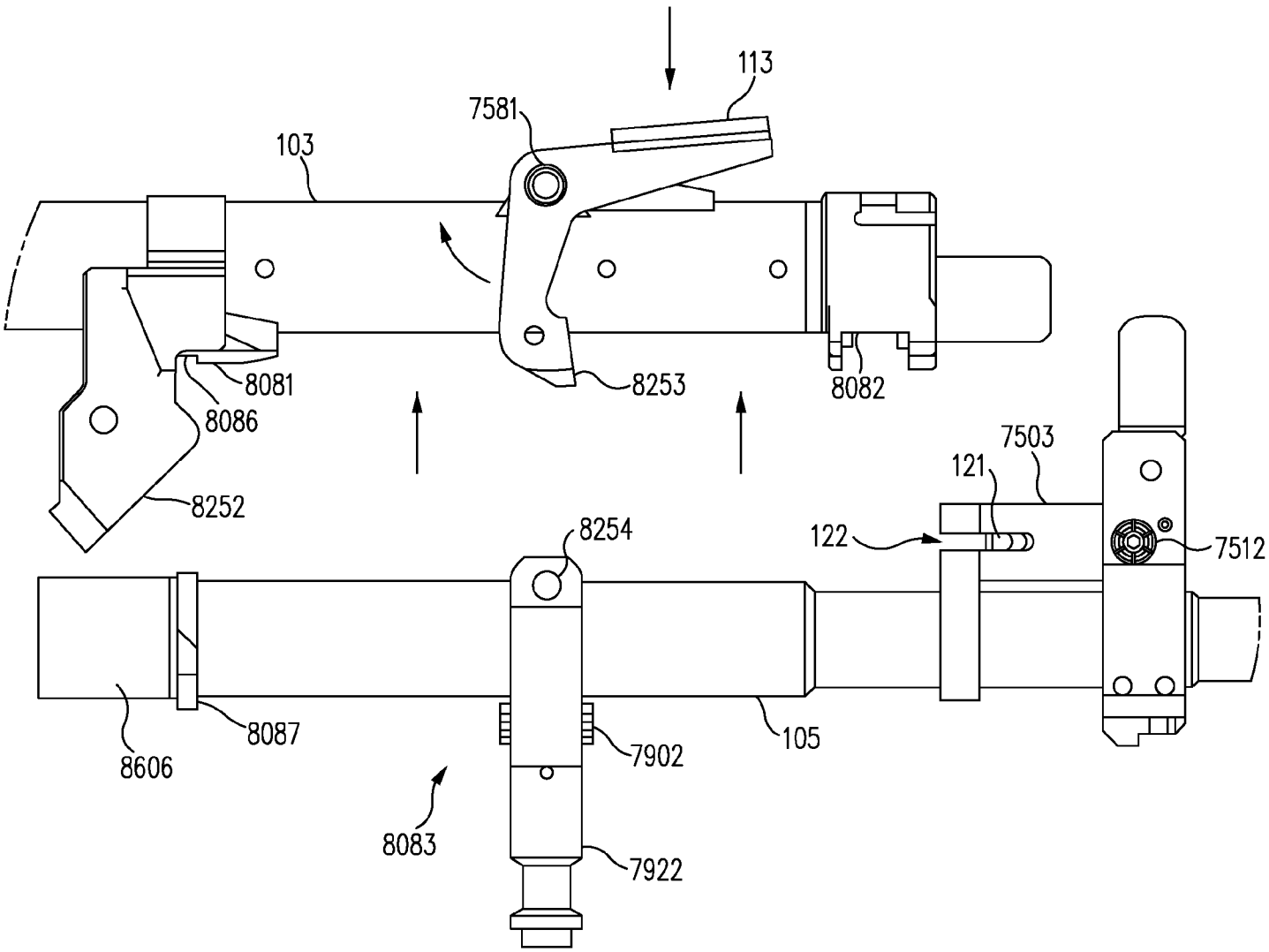
Figure 76:
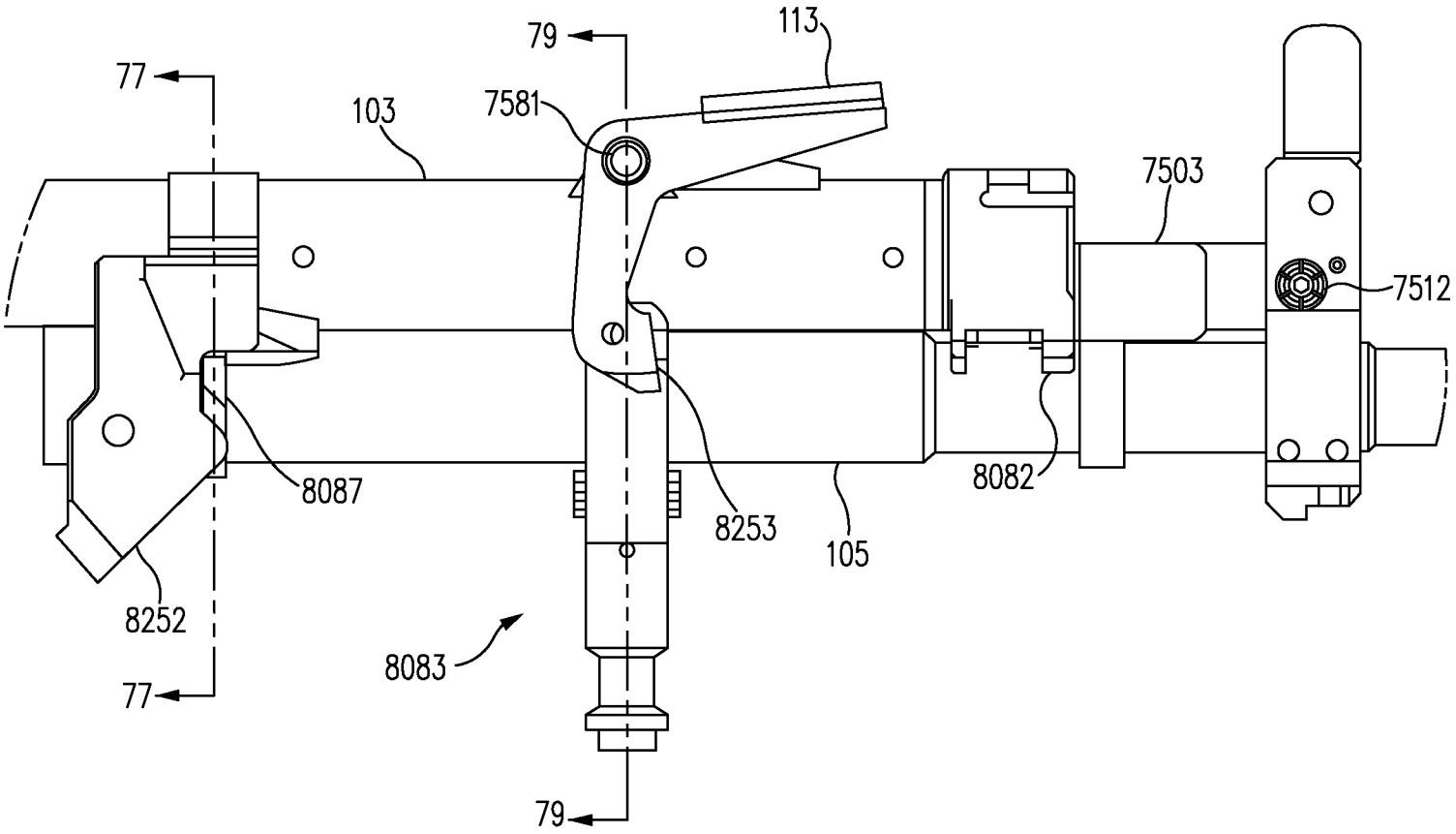
Figure 82:
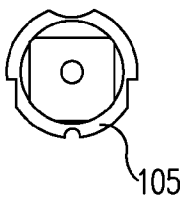
Figure 81:
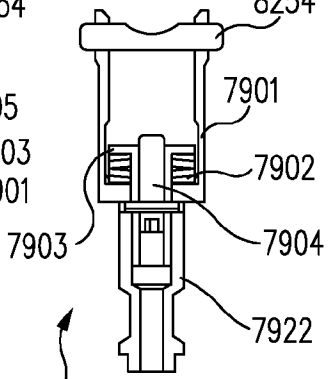
Figure 80:
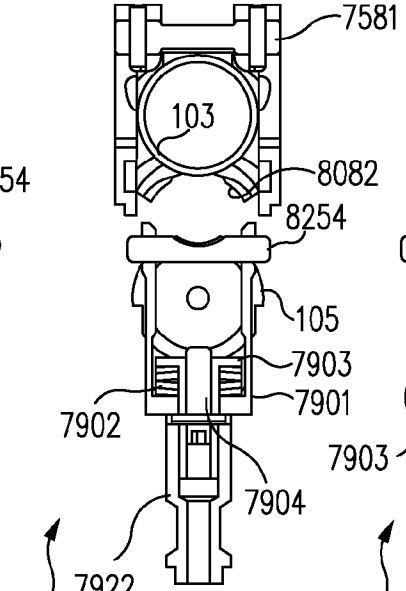
Figure 79:
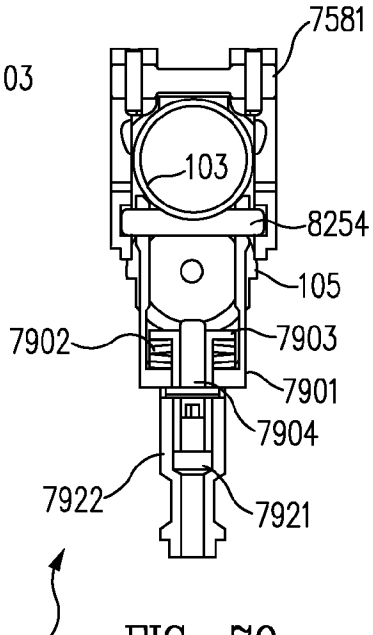
Figure 78:
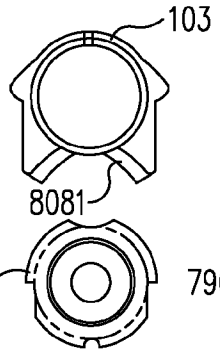
Figure 77:
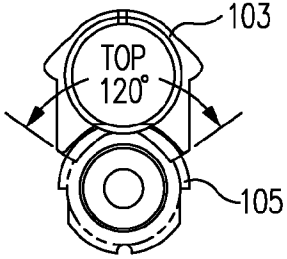

FIG. 69 is a flow chart showing operation of the firearm, according to an embodiment;

FIG. 70 is a perspective view showing two gas piston rings positioned together such that a key of one ring is disposed within a gap of the other ring, according to an embodiment;

FIG. 71 is a perspective view showing the two gas piston rings of FIG. 70 exploded apart from one another, according to an embodiment;

FIG. 72 is a cross-sectional side view showing the gas metering port, according to an embodiment;

FIG. 73 is a top view of the gas metering port of FIG. 72, according to an embodiment;

FIG. 74 is an exploded top view of the gas metering port of FIG. 72, according to an embodiment;

FIG. 75 is a side view of a barrel positioned for attachment to a backbone, according to an embodiment;

FIG. 76 is a side view of a barrel attached to a backbone, according to an embodiment;

FIG. 77 is a cross-sectional side view of the barrel and backbone taken along line 77 of FIG. 76, according to an embodiment;

FIG. 78 is a cross-sectional side view showing the barrel and backbone of FIG. 77 exploded apart from one another, according to an embodiment;

FIG. 79 is a cross-sectional side view of the barrel, backbone, swinging wedge, and tensioner taken along line 79 of FIG. 76, according to an embodiment;

FIG. 80 is a cross-sectional side view of the barrel, backbone, swinging wedge, and tensioner showing the barrel removed from the backbone, according to an embodiment;

FIG. 81 is a cross-sectional side view of the tensioner, according to an embodiment;

FIG. 82 is a cross-sectional side view of the barrel, according to an embodiment; and FIG. 83 is a chart showing which features are present on which firearm, according to embodiments.

Embodiments of the present invention and their advantages are best understood by referring to the detailed description that follows. It should be appreciated that like reference numerals are used to identify like elements illustrated in one or more of the figures.

DETAILED DESCRIPTION

An improved firearm, in accordance with one or more embodiments, has various different features that enhance the operation and use thereof. For example, the barrel of the firearm can be changed quickly in the field according to an embodiment. The ability to perform a quick barrel change enhances the firepower provided by the firearm and thus enhances the utility thereof. That is, the number of rounds that can be fired per minute, including time for barrel changes, is substantially increased.

According to an embodiment, the firearm can be compatible with large capacity magazines. For example, the firearm can be compatible with 60 and 100 round magazines. The firearm can be configured to withstand the heat associated with sustained fully automatic fire. The ability to quickly change the barrel is one aspect of how the firearm can withstand the heat associated with sustained fully automatic fire.

Three different types of firearms are discussed herein. These three types are a light machine gun, a semi-automatic (civilian) rifle, and a rifle/machine gun. The machine gun can fire either semi-automatic or fully automatic and fires only from an open bolt. The semi-automatic rifle is semi-automatic only and can fire from either an open bolt or closed bolt. The rifle/machine gun can fire either semi-automatic or fully automatic and can fire from either an open bolt or a closed bolt. The rifle/machine gun fires full auto only from an open bolt and fires semi-auto from either an either open bolt or a closed bolt.

Each type of firearm can be made in any desired caliber. For example, each type of firearm can be made in 5.56×45 mm NATO or 6.8×43 mm. Both 5.56×45 mm NATO and 6.8×43 mm can share components. For example, both 5.56×45 mm NATO and 6.8×43 mm can generally share all components except the barrel, bolt, and magazine for a given type of firearm.

The semi-automatic rifle and the rifle/machine gun can fire semi-auto from either an open bolt or a closed bolt. Generally, firing from a closed bolt provides better accuracy. However, it may be desirable to change to open bolt firing if many shots are fired in rapid succession, so as to reduce the likelihood of an undesirable cookoff. As discussed herein, changing from open bolt to closed bolt requires an extra step (such as depressing a button on the selector), so as to more likely cause the user to consider whether or not such a change is appropriate, since closed bolt operation can result in a cookoff, as discussed herein.

In the semi-automatic rifle and the rifle/machine gun, every shot is fired by a hammer. A long throw, long travel hammer is used advantageously, as discussed herein. As discussed herein, the machine gun is not fired by a hammer.

Figure 1:
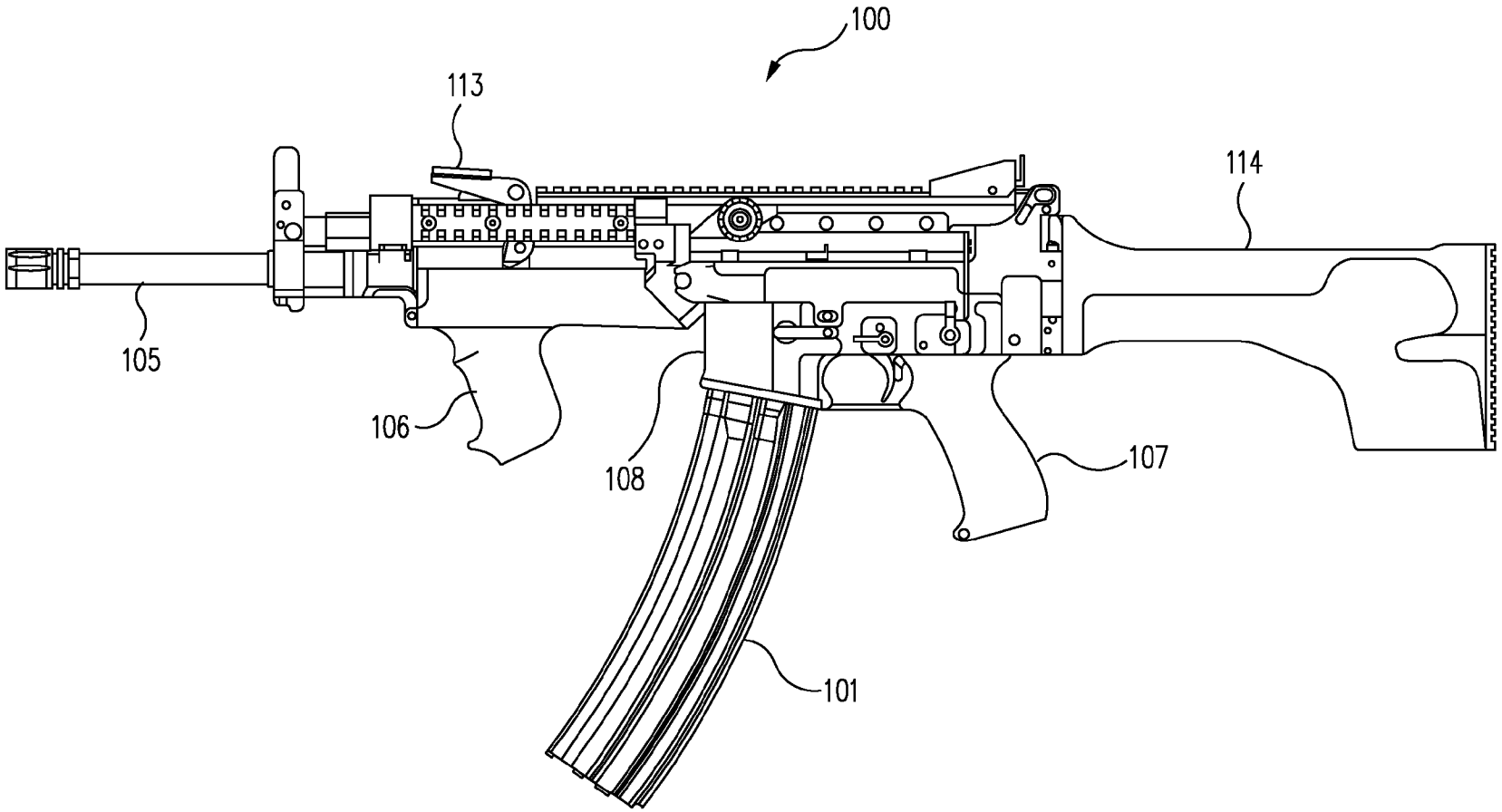
FIG. 1 is left side view of an open bolt, full auto, semi-auto machine gun having a magazine attached thereto, according to an embodiment.
Figure 2:
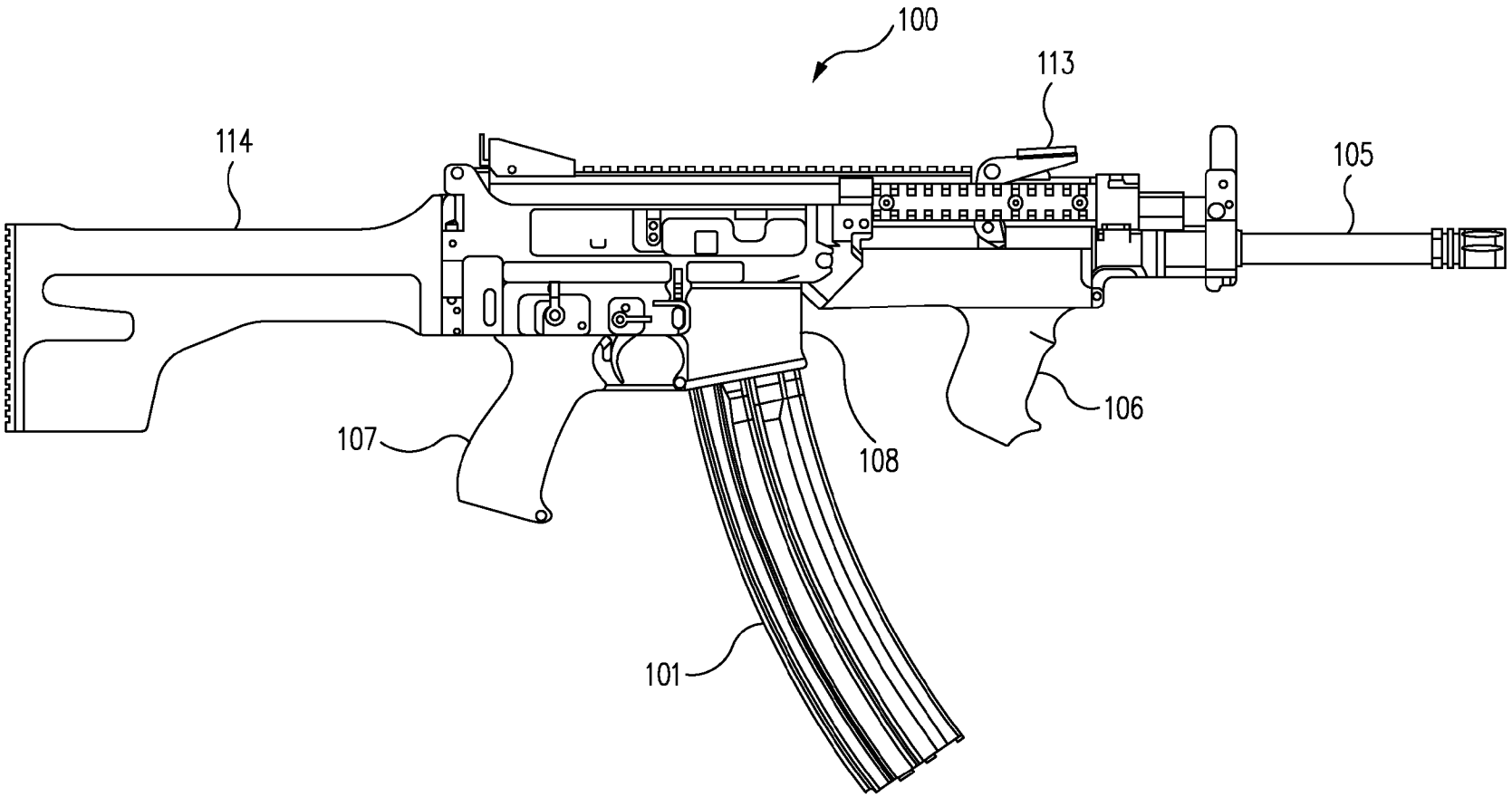
FIG. 2 is a right side view of the machine gun of FIG. 1, according to an embodiment.

FIGS. 1 and 2 show an open bolt machine gun 100, according to an embodiment. The machine gun 100 is capable of full auto and semi-auto fire, as selected by a user. The machine gun 100 fires from an open bolt. The machine gun 100 has a magazine 101 attached thereto. The magazine 101 can be, for example, a 60-round or 100-round magazine such as those sold by SureFire, LLC of Fountain Valley, Calif.

Figure 3A:
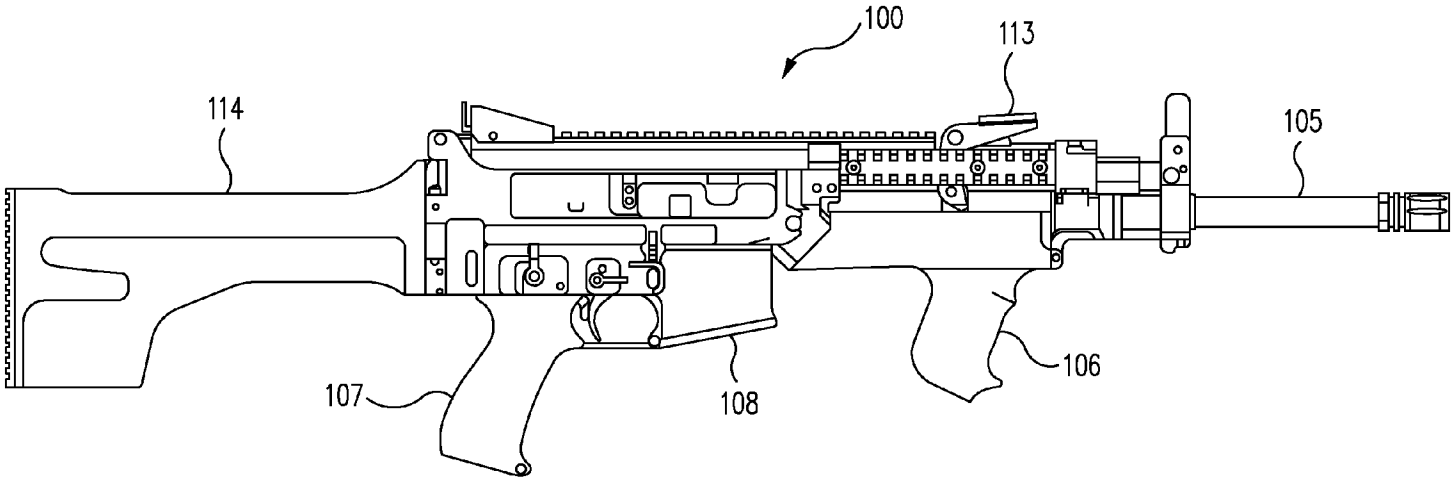
FIG. 3A is right side view of the machine gun of FIG. 1 having the magazine removed, according to an embodiment.
Figure 3B:
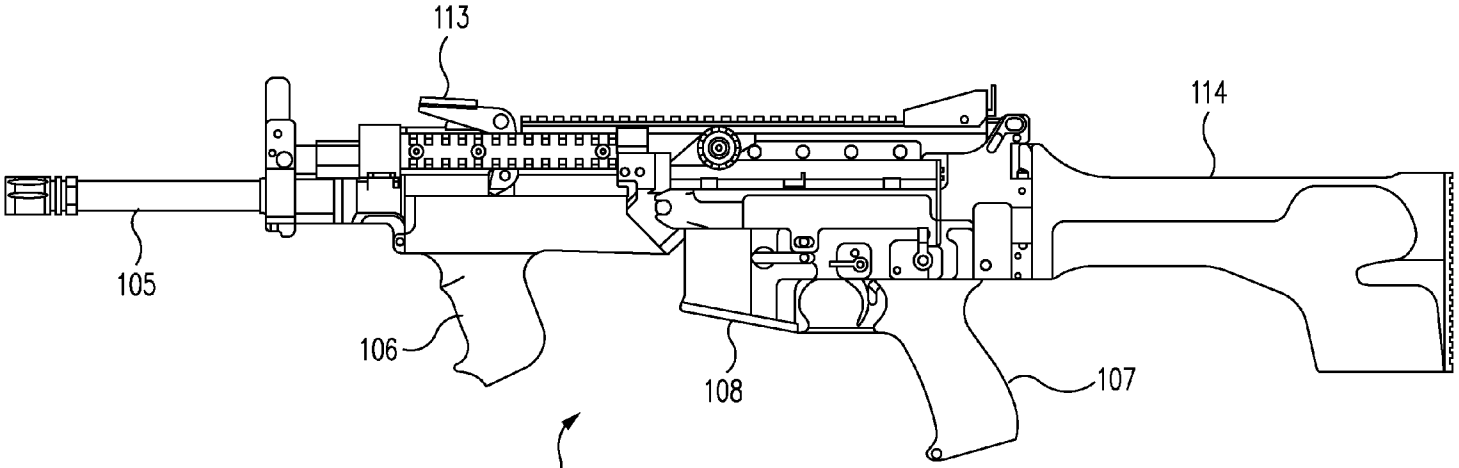
FIG. 3B is left side view of the machine gun of FIG. 1 having the magazine removed, according to an embodiment.
Figure 10A:
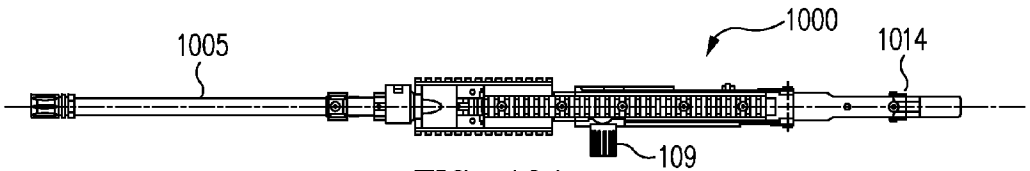
FIGS. 10A-10F are various elevational views of an open bolt, closed bolt, semi-auto rifle having a light-weight stock, according to an embodiment.
Figure 10B:
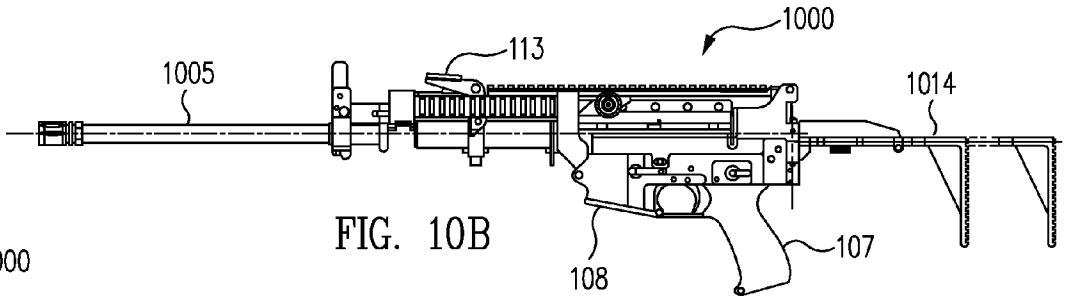
Figure 10C:
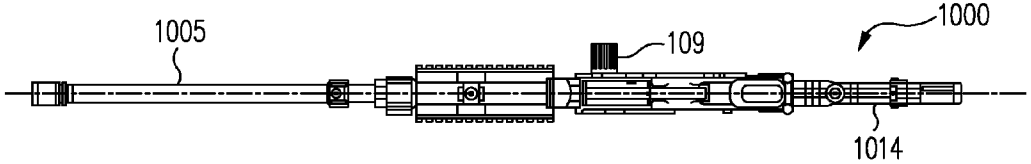
Figure 10D:
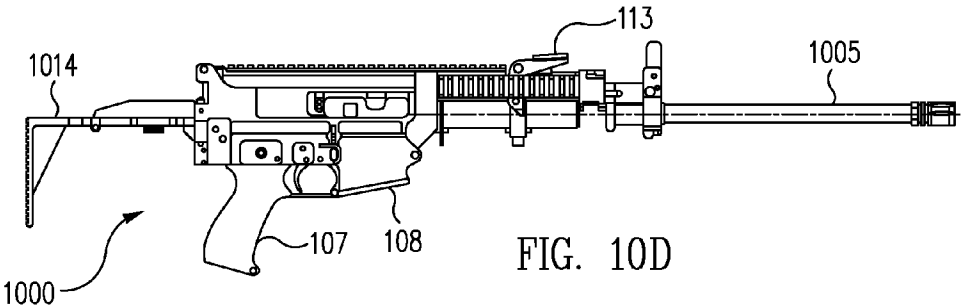
Figure 10F:
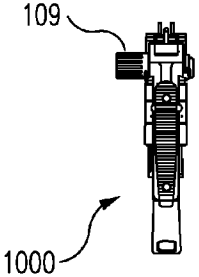
Figure 10E:
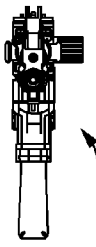

FIGS. 3A and 3B show the machine gun 100 with the magazine 101 removed, according to an embodiment. The machine gun 100, as well as the semi-automatic rifle 1000 (FIG. 10A) and the rifle/machine gun 8000 (FIG. 16A) can be made in any desired caliber. For example, the machine gun 100, as well as the semi-automatic rifle 1000 and the rifle/machine gun 8000 can be made in 5.56 mm or 6.8 mm.

FIGS. 4A-4F are additional views of the machine gun 100, according to an embodiment. The machine gun 100 has a lower receiver or receiver assembly 102. The receiver assembly 102 can include a grip 107 and a magazine well 108.

The backbone 103 constrains a bolt carrier 111, as described herein. A charging handle 109 can be slidably disposed between the backbone 103 and the receiver assembly 102 so as to facilitate cocking of the machine gun 100 by pulling a bolt carrier 111 rearward. A spring guide 112 can be at least partially disposed within the bolt carrier 111 and can define an anti-bounce system, as discussed herein.

A barrel assembly 104 can be removably detachable from the machine gun 100 (as well as from the semi-automatic rifle 1000 (FIGS. 10A-10F) and the rifle/machine gun 8000 (FIG. 16A) by pressing a barrel latch 113 on the backbone 103, as discussed herein. The barrel 105 can have a fore grip 106.

A stock 114 can be removably attachable to the receiver assembly 102. The stock 114 can be pivotally attached to the receiver assembly 102 such that the stock 114 can fold to either side of the receiver assembly 102. The stock 114 can be a heavy duty stock, as shown. Alternatively, the stock 114 can be a lightweight stock or any other type of stock.

Figure 4A:
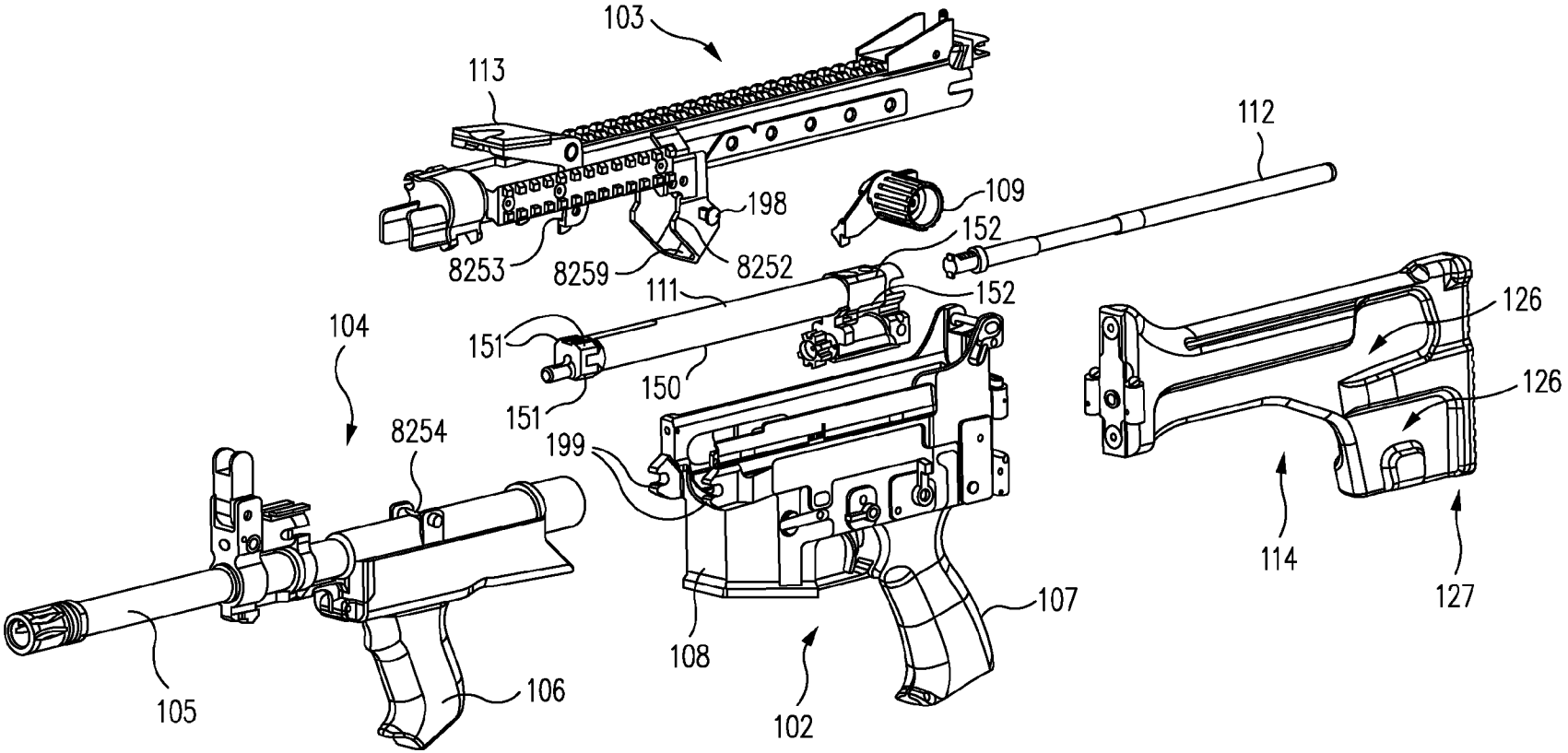
FIG. 4A is an exploded view of the machine gun of FIG. 1, according to an embodiment.
Figure 4F:
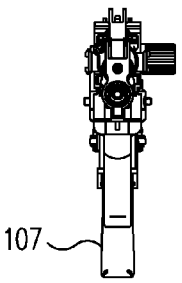
FIGS. 4B-4F are various elevational views of the machine gun of FIG. 1, according to an embodiment.
Figure 4B:
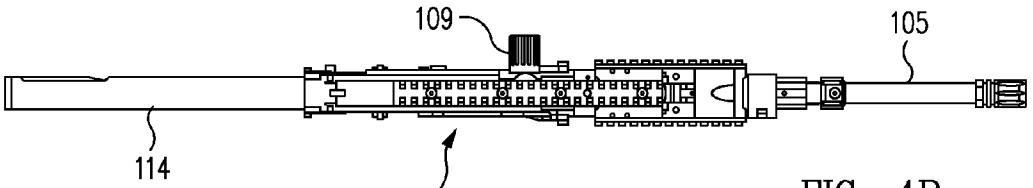
Figure 4C:
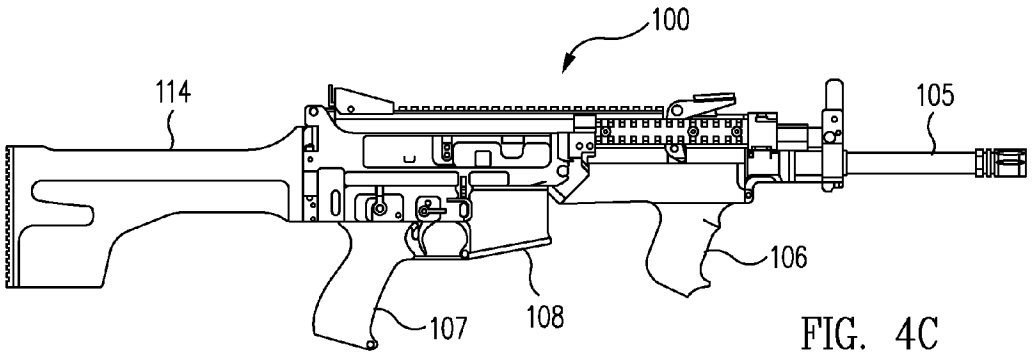
Figure 4D:
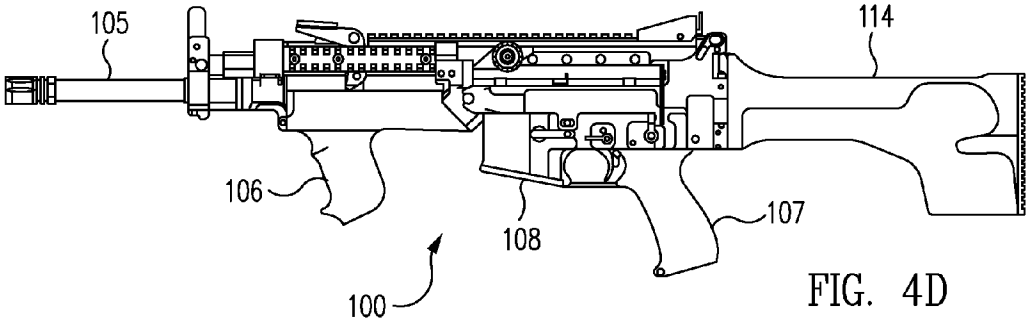
Figure 4E:
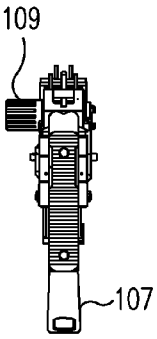

As shown in FIG. 4A, the stock 114 can have at least one generally horizontal groove 126 formed therein. The groove 126 can allow the user to better grasp the stock 114 when shooting to inhibit undesirable movement, e.g., upward movement, of the stock 114. For example, when the stock 114 is stowed or folded along side of the receiver assembly 102, a user can grasp the grip 107 with one hand and can grasp the butt 127 of the stock 114 with the other hand such that the user's thumb is in one of the grooves 126 to more securely hold the firearm.

Figure 4G:
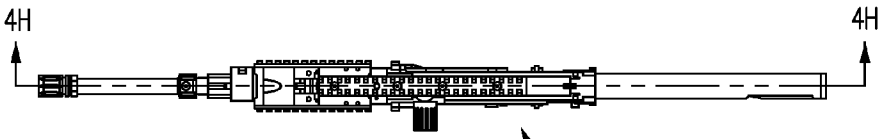
FIG. 4G is a top view of the machine gun of FIG. 1 having a section reference, according to an embodiment.
Figure 4H:
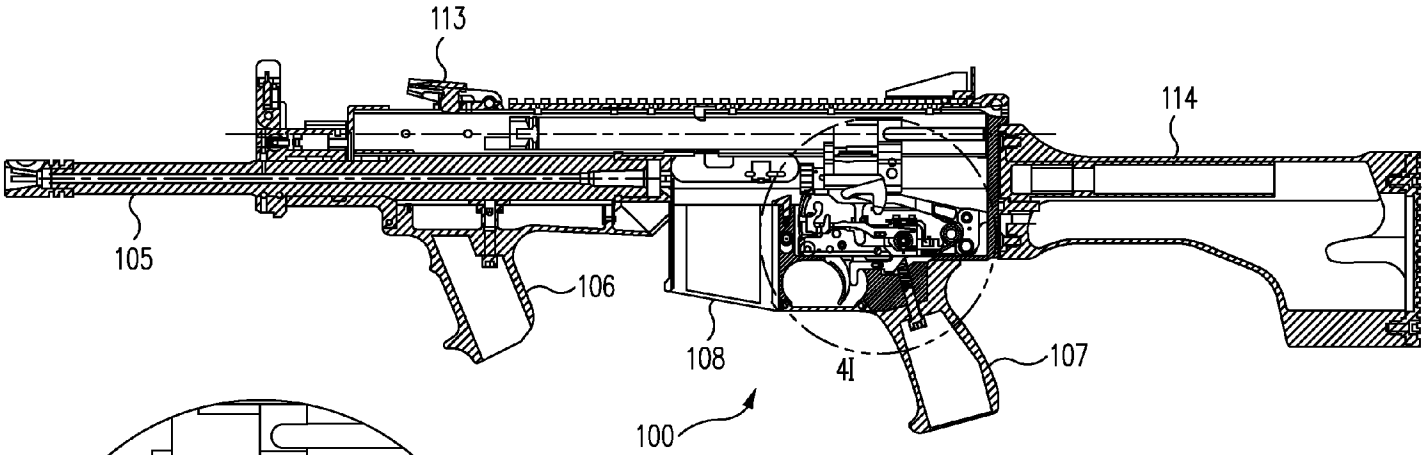
FIG. 4H is a cross-sectional side view taken along line 4H of FIG. 4G, according to an embodiment.
Figure 4I:
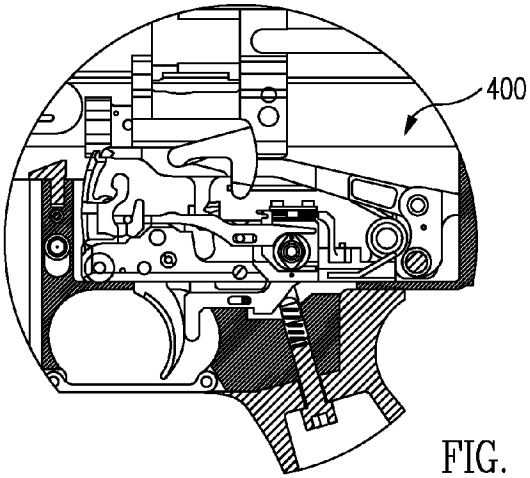
FIG. 4I is an enlarged view taken within the section circle 41 of FIG. 4H, according to an embodiment.

FIGS. 4G-4I show a drop-in trigger assembly 400, according to an embodiment. The trigger block assembly 400 can be assembled outside of the machine gun 100. Once assembled, the trigger block assembly 400 can be dropped into place in the receiver assembly 102, as discussed herein.

Figure 5A:
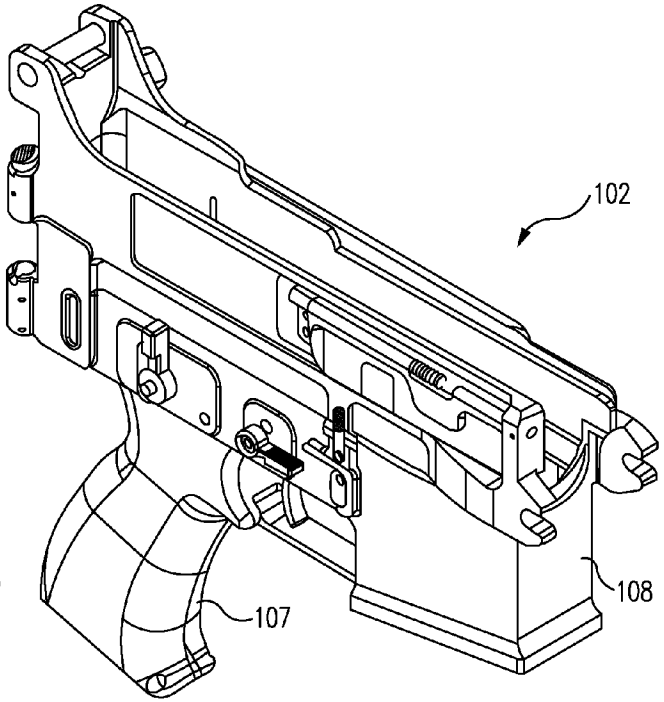
FIG. 5A is a perspective view of the lower receiver assembly of the machine gun of FIG. 1, according to an embodiment.
Figure 5B:
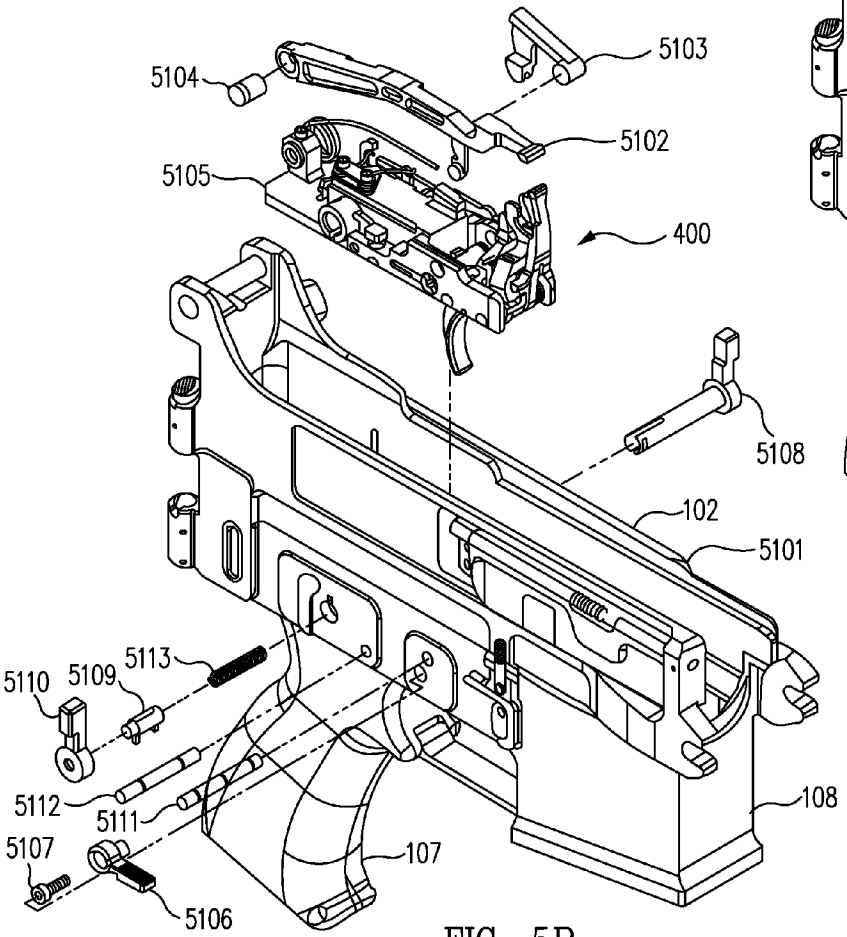
FIG. 5B is an exploded view of the lower receiver assembly of the machine gun of FIG. 1, according to an embodiment.
Figure 5I:
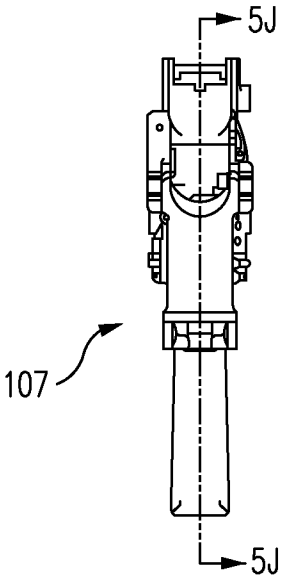
FIG. 5I is a front end view of the machine gun of FIG. 1 having a section reference, according to an embodiment.
Figure 5J:
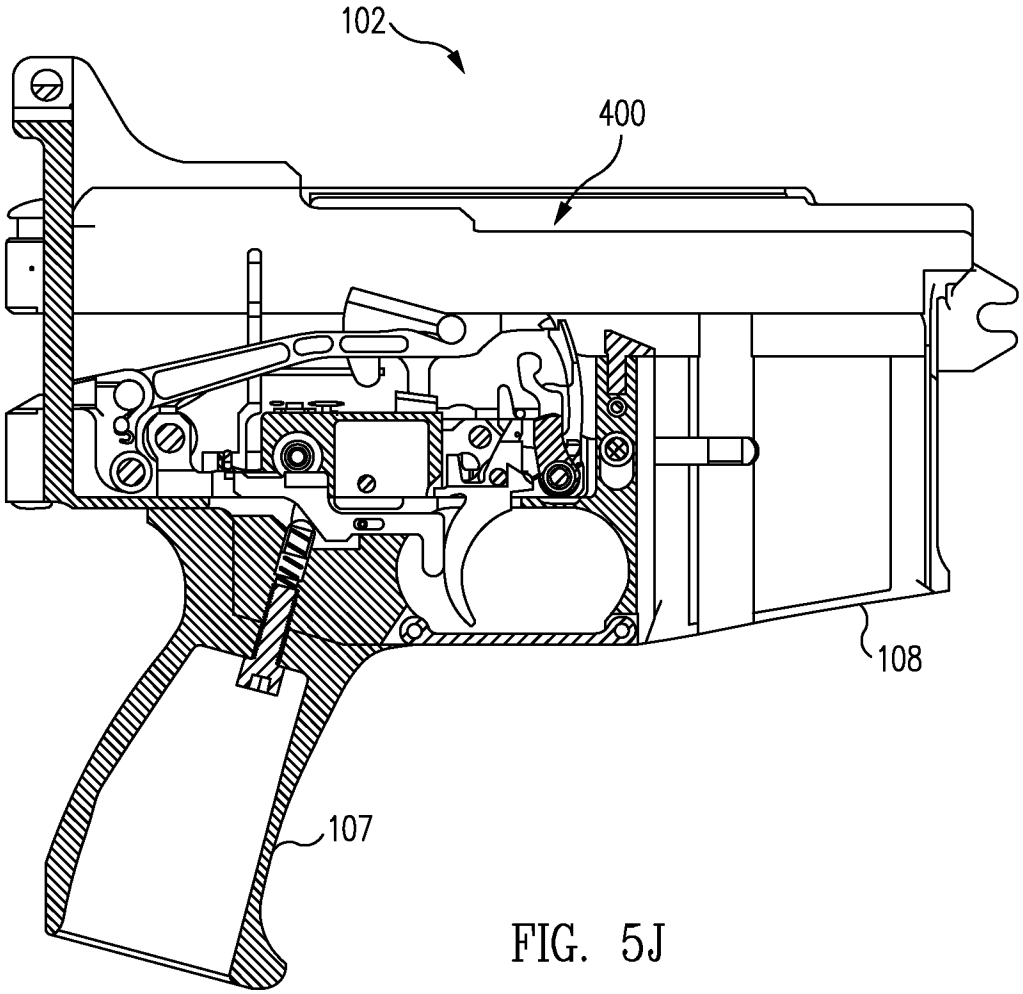
FIG. 5J is a cross-sectional side view taken along line 5J of FIG. 5I, according to an embodiment.
Figure 5L:
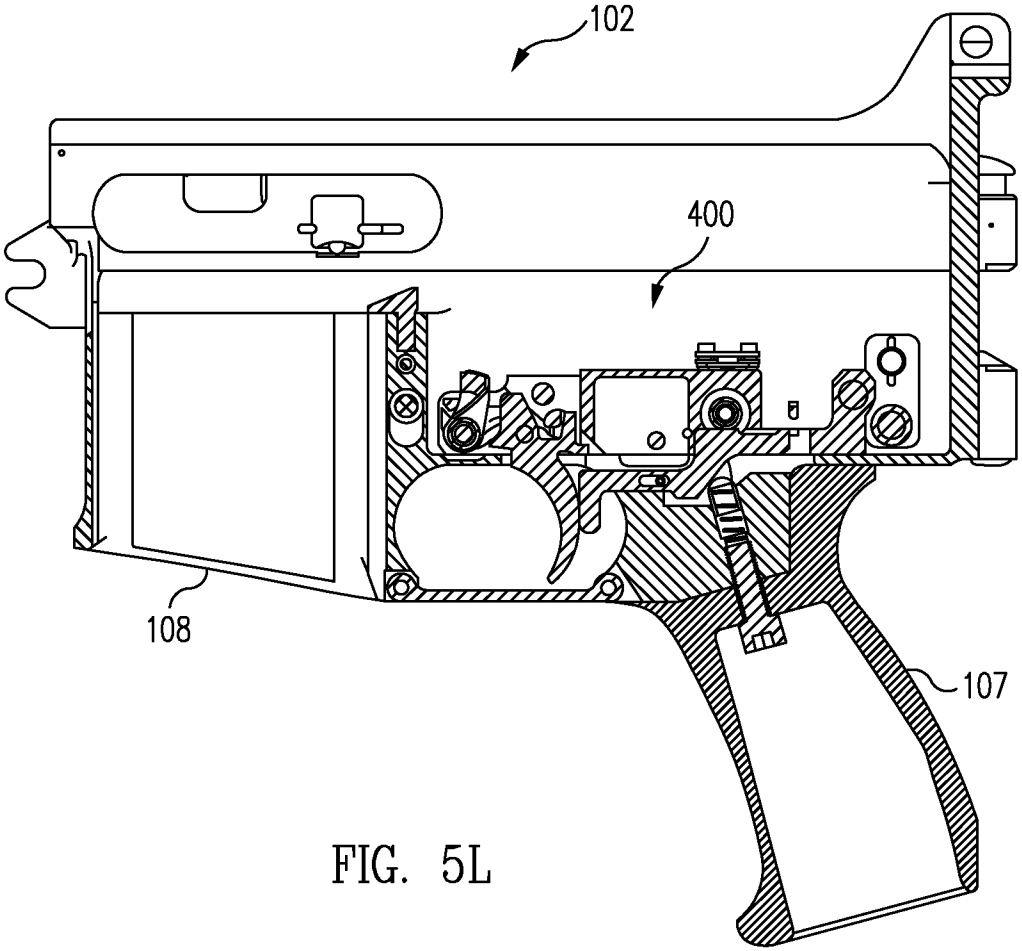
FIG. 5L is a cross-sectional side view taken along line 5L of FIG. 5K, according to an embodiment.
Figure 5K:
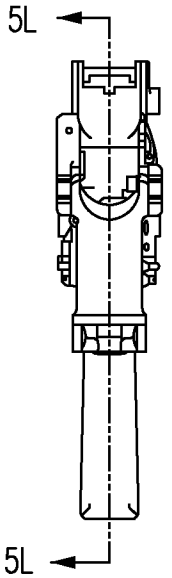
FIG. 5K is a front end view of the machine gun of FIG. 1 having a section reference, according to an embodiment.

FIGS. 5A and 5B show the receiver assembly 102 with FIG. 5B showing the trigger block assembly 400 exploded from the receiver assembly 102, according to an embodiment. The receiver assembly 102 has a receiver sub-assembly 5101, an open bolt arm 5102, an open bolt arm sear 5103, an open bolt arm pin 5104, an open bolt full auto/semi auto trigger block assembly 5105, a barrel latch safety 5106, a handgrip bolt 5107, a selector barrel latch 5108, a closed bolt safety button assembly 5109, a take down lever 5110, rammer link crosspin 5111, a sear crosspin 5112, and a selector cam assembly compression spring 5113. The sear crosspin 5112 and the hammer link crosspin 5111 can secure the drop-in trigger block assembly 400 within the receiver assembly 102.

FIGS. 5C-5H are various elevational views of receiver assembly 102 of the machine gun 100 of FIG. 1, according to an embodiment. FIG. 5C shows the right side of the receiver assembly 102. FIG. 5D shows the rear of the receiver assembly 102. FIG. 5E shows the bottom of the receiver assembly 102. FIG. 5F shows the left side of the receiver assembly 102. FIG. 5G shows the front of the receiver assembly 102. FIG. 5H shows the top of the receiver assembly 102.

FIGS. 5I-5L show the receiver assembly 102, according to an embodiment. The trigger block assembly 400 is shown installed (dropped into) the receiver assembly 102.

Figure 6A:
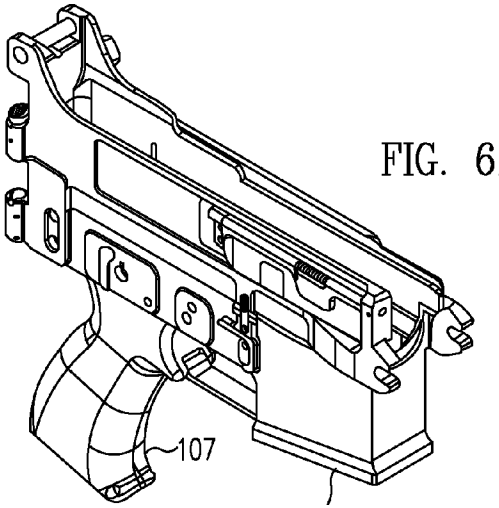
FIG. 6A is a perspective view of the lower receiver assembly of the machine gun of FIG. 1, according to an embodiment.
Figure 6B:
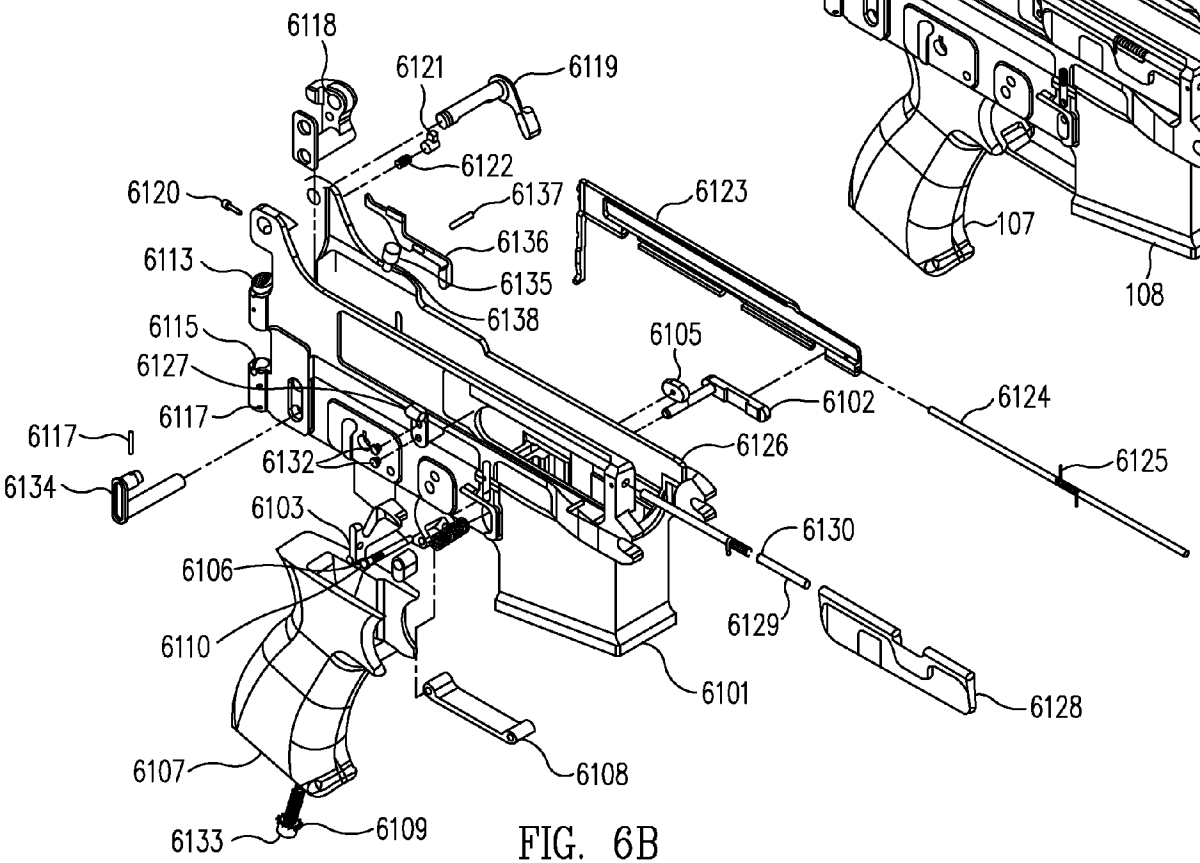
FIG. 6B is an exploded view of the lower receiver assembly of the machine gun of FIG. 1, according to an embodiment.

FIGS. 6A and 6B are perspective views of the receiver assembly 102 of the machine gun 100, according to an embodiment. The receiver assembly 102 has an open bolt lower receiver 6101, a magazine catch 6102, a bolt catch 6103, a magazine catch button 6104, a bolt catch release button 6105, a bolt catch release plunger 6106, a hand grip 6107, a trigger guard 6108, a lock washer 6109, a compression spring 6110, a wire spring 6111, a wire spring 6112, an upper retension pin 6113, an upper retension pin stock 6114, a lower retension pin 61, a retension pin cap 6115, a retension pin cap 6116, a roll pin 6117, an open bolt arm torsion damper assembly 6118, a receiver latch pin 6119, a receiver latch retension pin 6120, a receiver latch pin detent 6121, a receive latch compression spring 6122, a dust cover assembly 6123, a dust cover hinge pin 6124, a dust cover spring 6125, a slotted roll pin 6126, an ejector port cover lug 6127, an ejector port cover assembly 6128, an ejector port cover hinge pin 6129, an ejection port cover torsion spring 6130, a slotted roll pin 6131, a low height rivet 6132, a handgrip bolt 6133, a torsion damper retainer 6134, a trigger lock bar plunger 6135, a trigger lock bar 6136, a roll pin 6137, a trigger lock compression spring 6138, and a magazine catch spring 6139.

Figure 6H:
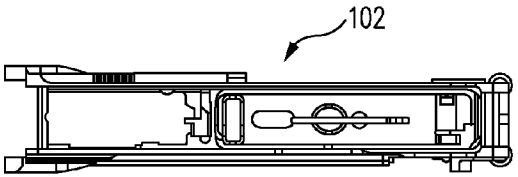
FIGS. 6C-6H are various elevational views of lower receiver assembly of the machine gun of FIG. 1, according to an embodiment.
Figure 6F:
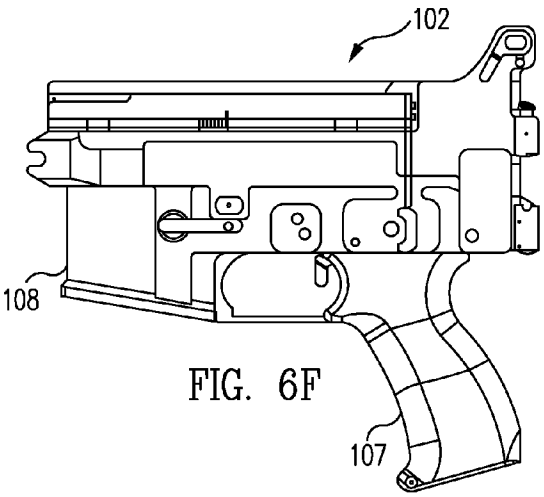
Figure 6G:
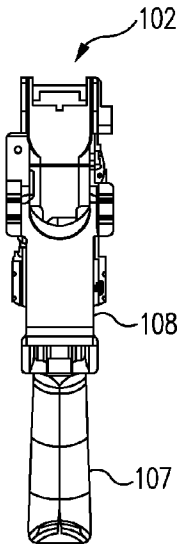
Figure 6C:
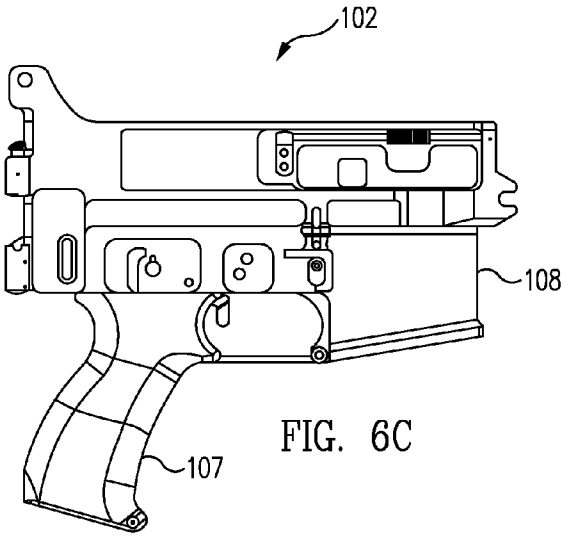

FIGS. 6C-6H are various elevational views of receiver assembly 102 of the machine gun 100, according to an embodiment. FIG. 6C shows the right side of the receiver assembly 102.

Figure 6E:
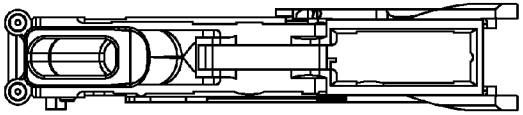
Figure 6D:
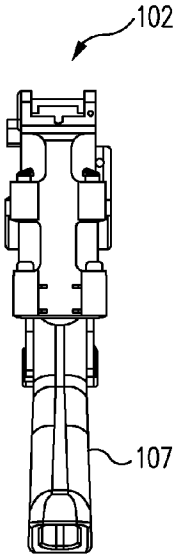
Figure 6I:
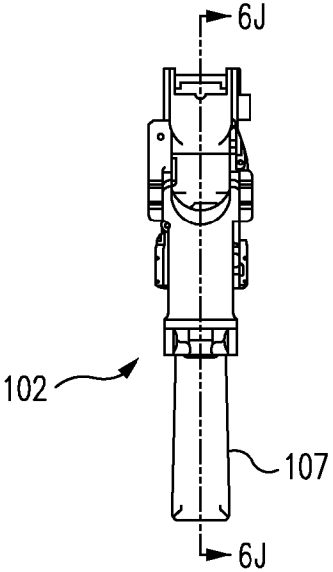
FIG. 6I is a front end view of the machine gun of FIG. 1 having a section reference, according to an embodiment.
Figure 6J:
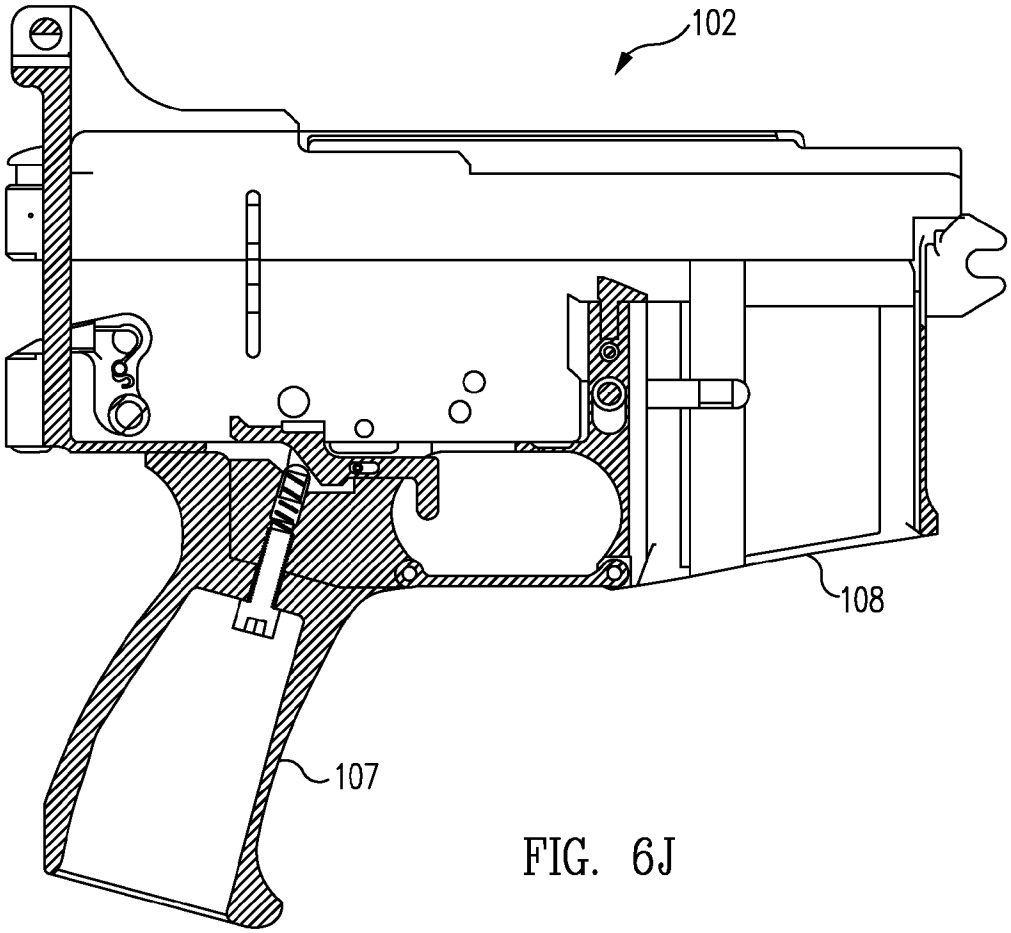
FIG. 6J is a cross-sectional side view taken along line 6J of FIG. 5I, according to an embodiment.
Figure 6L:
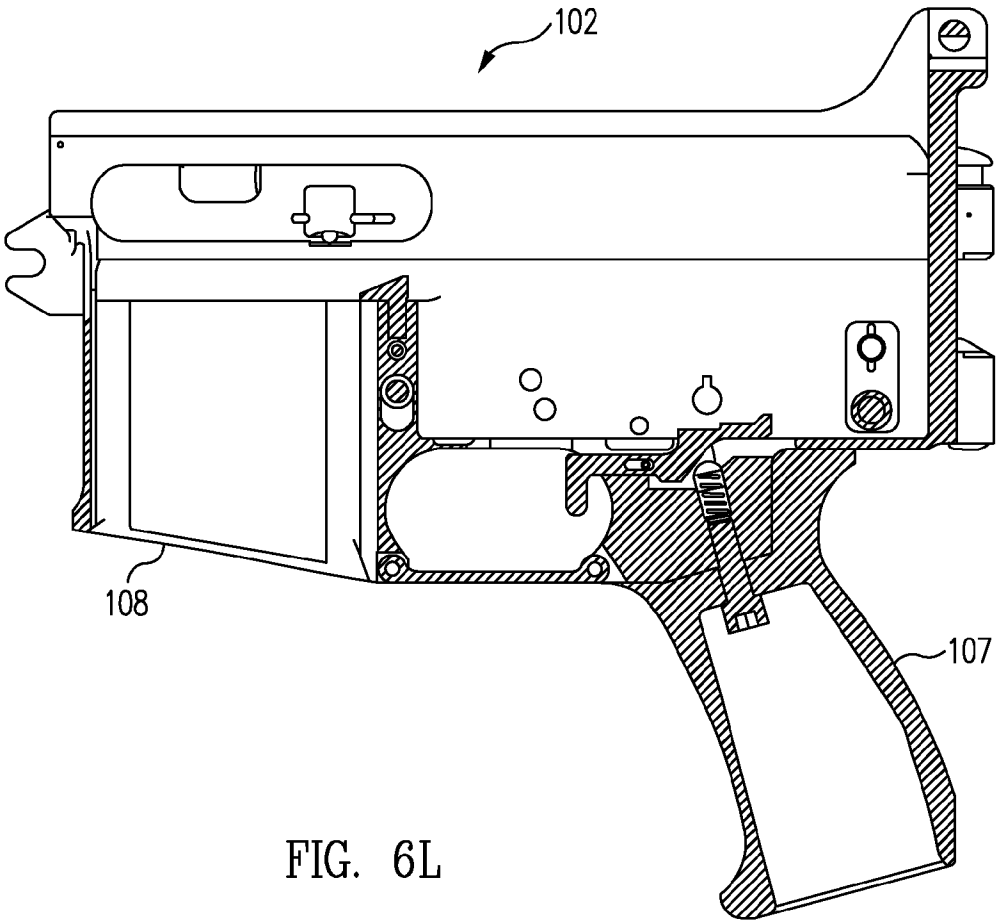
FIG. 6L is a cross-sectional side view taken along line 6L of FIG. 5K, according to an embodiment.
Figure 6K:
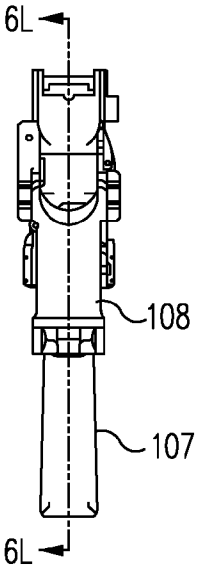
FIG. 6K is a front end view of the machine gun of FIG. 1 having a section reference, according to an embodiment.
Figure 7A:
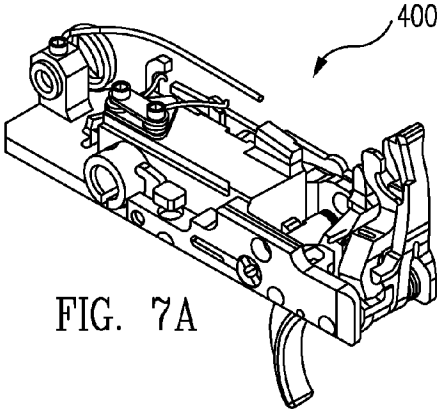
FIG. 7A a perspective view of a trigger block assembly of the machine gun of FIG. 1, according to an embodiment.
Figure 7B:
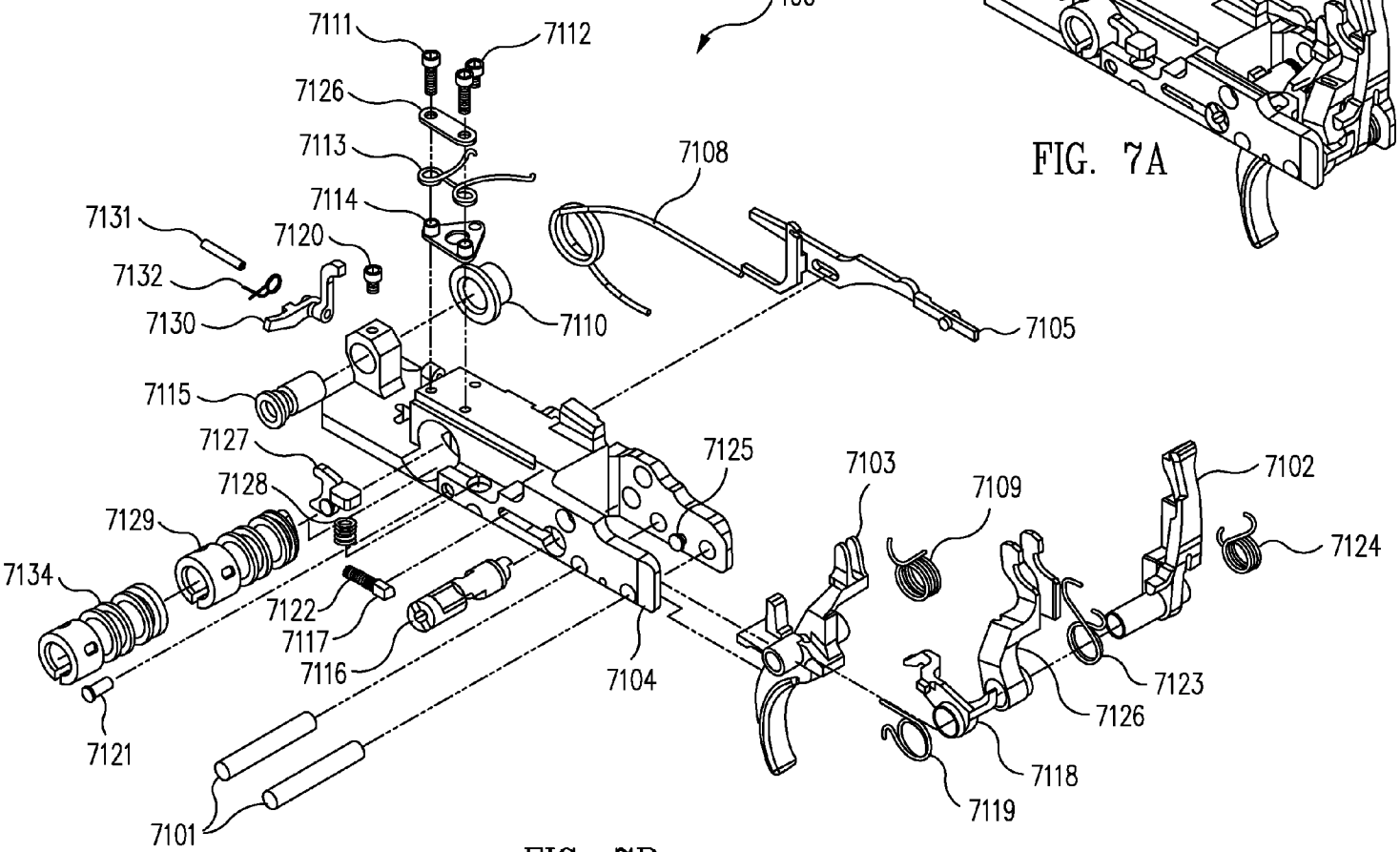
FIG. 7B a perspective exploded view of the trigger block assembly of FIG. 7A, according to an embodiment.
Figure 7F:
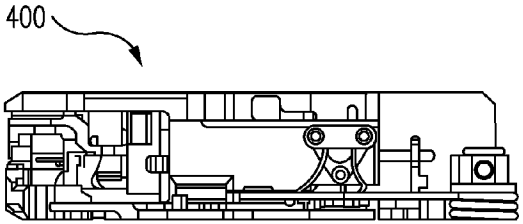
FIGS. 7C-7G are various elevational views of the trigger block assembly of FIG. 7A, according to an embodiment.
Figure 7G:
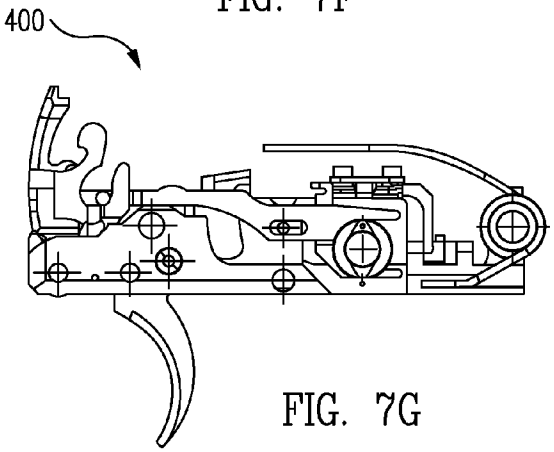
Figure 7E:
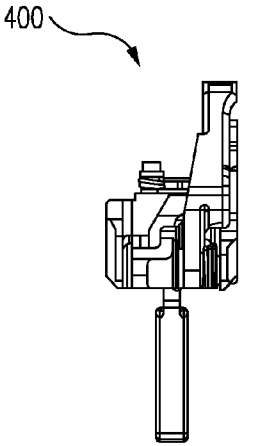
Figure 7C:
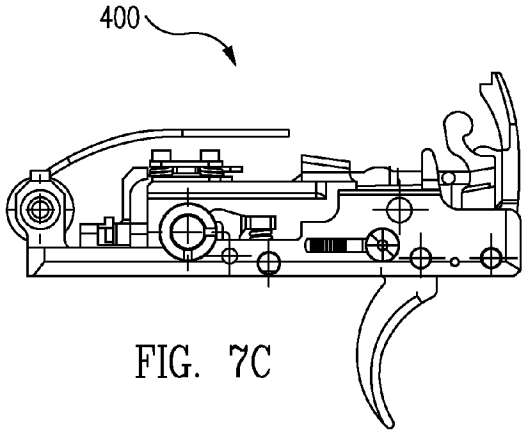
Figure 7D:
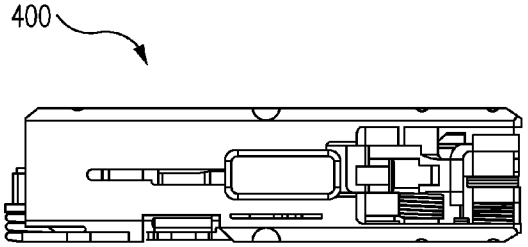

FIG. 6D shows the rear of the receiver assembly 102. FIG. 6E shows the bottom of the receiver assembly 102. FIG. 6F shows the left side of the receiver assembly 102. FIG. 6G shows the front of the receiver assembly 102. FIG. 6H shows the top of the receiver assembly 102.

FIGS. 6I-6L show the receiver assembly 102, according to an embodiment. The trigger block assembly 400 is removed from the receiver 102.

FIGS. 7A-7G show the trigger block assembly 400 of the machine gun 100, according to an embodiment. The trigger block assembly 400 has an open bolt lever trigger pin 7101, an open bolt/closed bolt-full auto/semi auto open bolt-full auto/semi auto open bolt arm release lever 7102, a trigger 7103, a trigger block 7104, a trigger bar 7105, a disconnect 7106, a closed bolt catch trigger bar pin 7107, an open bolt arm spring 7108, a trigger spring 7109, an open bolt arm spring bushing 7110, a socket head cap screw 7111, a socket head cap screw 7112, a closed bolt catch trigger spring bar 7113, a trigger bar spring plate 7114, an open bolt arm spring pin 7115, a safety cylinder 7116, a safety cylinder detent 7117, an open bolt arm safety lever 7118, an open bolt lever safety spring 7119, a socket head cap screw 7120, a selector detent pin 7121, a safety cylinder detent spring 7122, an open bolt arm disconnector spring 7123, an open bolt release lever spring 7124, a torsion damper spring retainer 7125, a spring plate cap 7126, a selection detent 7127, a selection detent spring 7128, an open bolt full auto semi-auto selector cam 7129, a trigger block gate 7130, a roll pin 7131, a trigger lock out spring 7132, a trigger bock pin retension spring 7133, and an open bolt full auto selector cam 7134.

Figure 8:
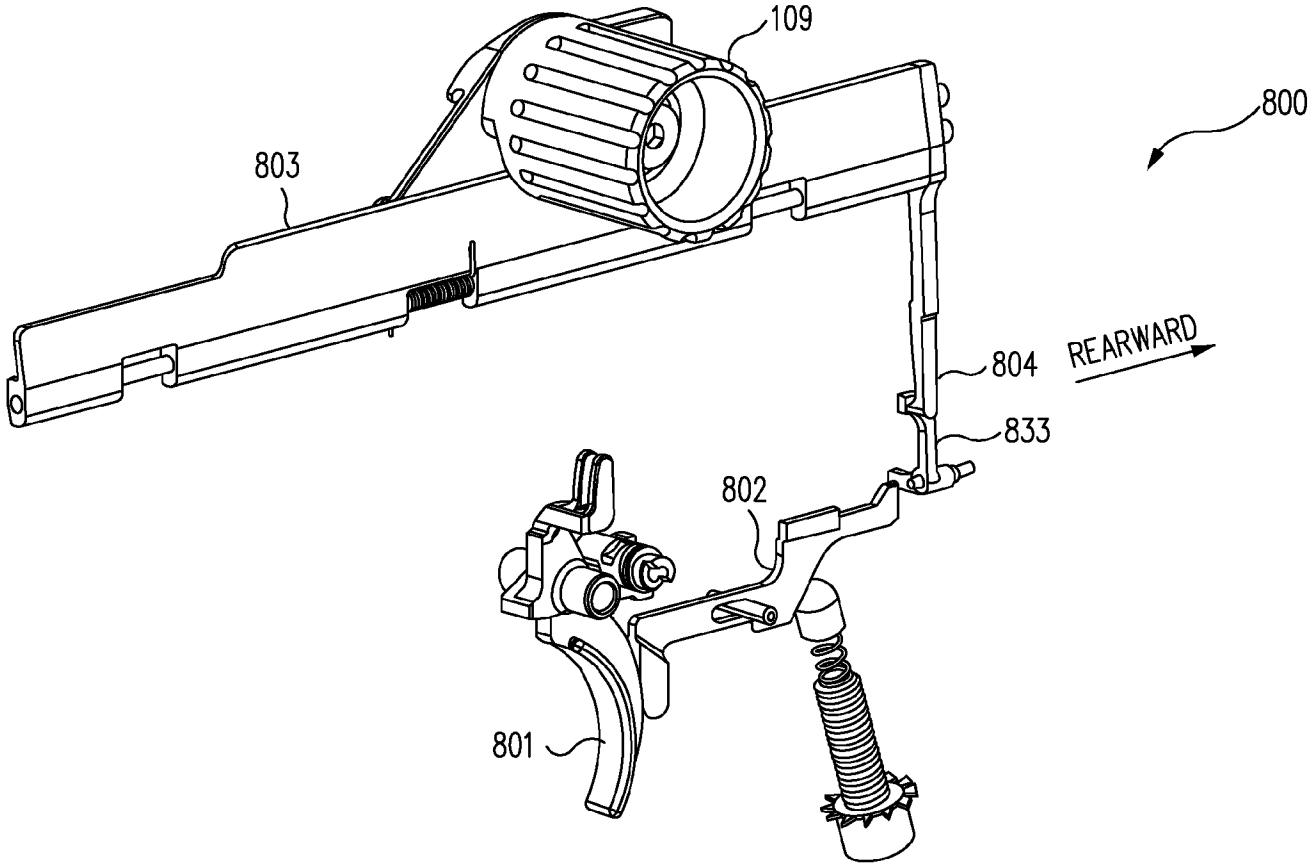
FIG. 8 is a perspective view of a trigger lock-out mechanism of the machine gun of FIG. 1 showing the trigger locked out, according to an embodiment.

FIG. 8 is a perspective view of a trigger lock-out mechanism 800 of the machine gun 100, according to an embodiment. The trigger lock-out mechanism 800 is shown with a trigger 801 locked out or blocked by a trigger lock bar 802. When a dust cover 803 is open because the charging handle 109 is being pulled back, then an arm 804 formed on the dust cover 803 partly rotates trigger lock lever 833 which prevents rearward movement of the trigger lock bar 802, which in turn prevent rearward movement of the trigger 801. Thus, the trigger 801 cannot be pulled and the machine gun 100 cannot be fired when the charging handle 109 is being pulled rearward, e.g., when the machine gun 100 is being cocked. The dust cover 803 can open approximately 7° to allow the charging handle 109 to be pulled rearward to cock the machine gun 100, for example.

Figure 9:
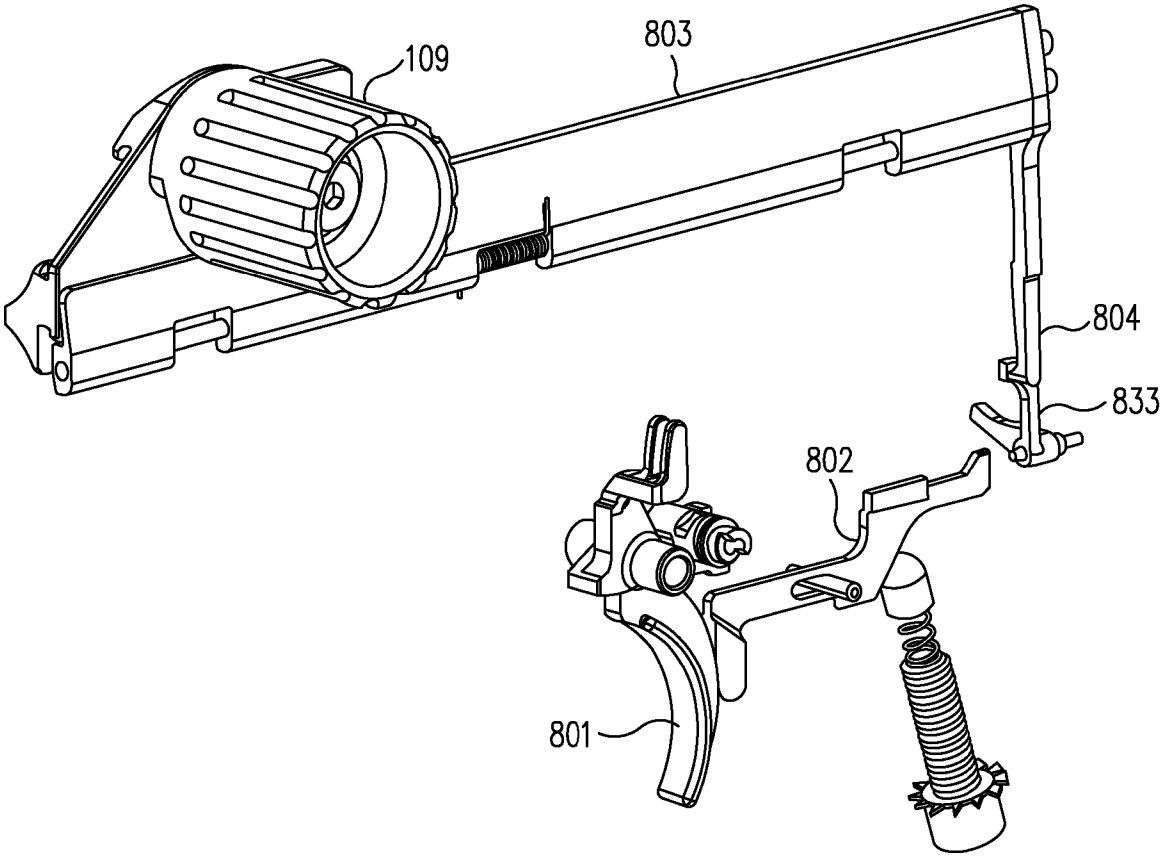
FIG. 9 is a perspective view of a trigger lock-out mechanism of the machine gun of FIG. 1 showing the trigger not locked out, according to an embodiment.

FIG. 9 is a perspective view of a trigger lock-out mechanism of the machine gun 100 showing the trigger 801 not locked out, according to an embodiment. When the dust cover 803 is closed because the charging handle 109 is not being pulled back and is in a forward position thereof, then the arm 804 formed on the dust cover 803 does not rotate trigger lever 833 to prevent rearward movement of the trigger lock bar 802 and therefore the trigger lock bar 802 does not prevent rearward movement of the trigger 801. Thus, the trigger 801 can be pulled and the machine gun 100 can be fired.

FIGS. 10A-10F are various elevational views of a semi-auto rifle 1000, according to an embodiment. The semi-auto rifle 1000 is not capable of full auto fire. The semi-auto rifle 1000 can be fired from either an open bolt or a closed bolt, as selected by a user. Many of the features of the semi-auto rifle 1000 are substantially the same as those of the machine gun 100 discussed above. For example, the barrel 105 can be released from the semi-auto rifle 1000 in the same manner as for the machine gun 100. Other features of the semi-auto rifle 1000 are different with respect to those of the machine gun 100. For example, the machine gun 100 slam fires, can have a shorter barrel 105, and can have a heavy duty stock 114, while the semi-auto rifle 1000 uses a hammer 8203 (FIG. 21B) to fire, can have a longer barrel 1005, and can have a light weight collapsible stock 1014. Some of these different features are interchangeable between the semi-auto rifle 1000 and the machine gun 100. For example, either stock 114, 1001 and either barrel 105, 1005 can be used on the semi-auto rifle 1000 and the machine gun 100.

Figure 10G:
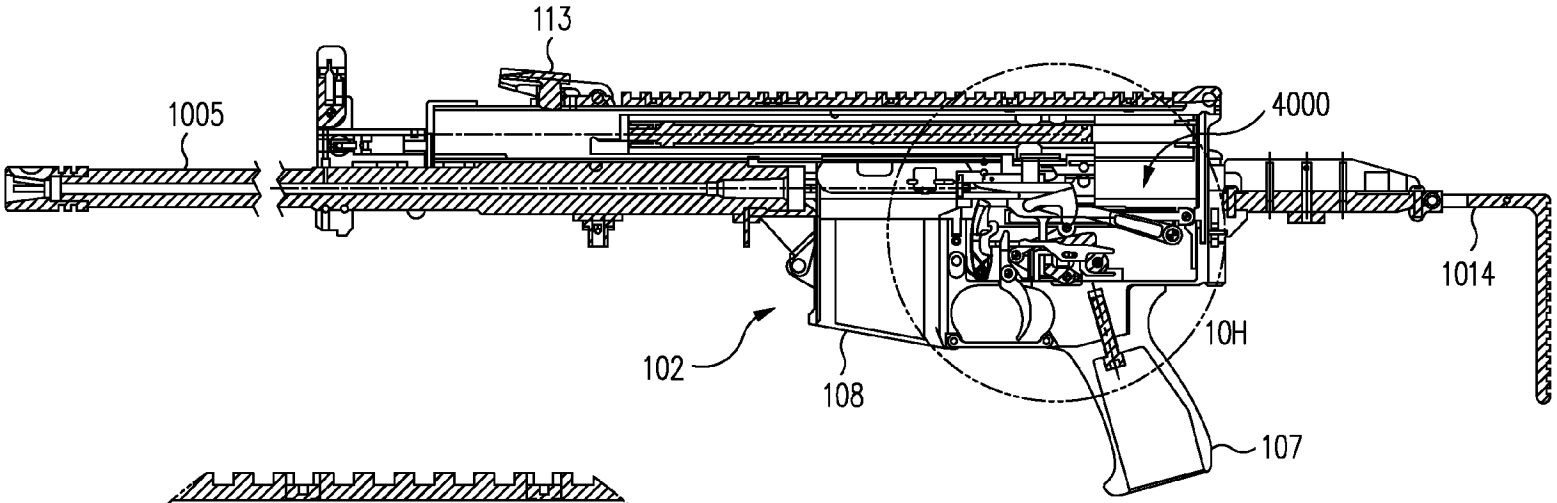
FIG. 10G is a cross-sectional side view of the rifle of FIG. 10A, according to an embodiment.
Figure 10H:
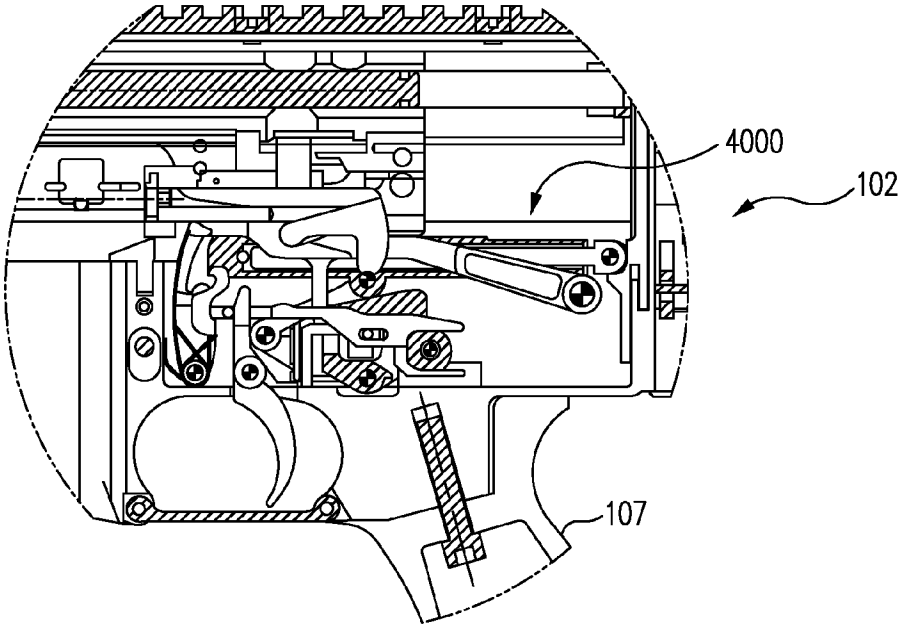
FIG. 10H is an enlarged view taken within the section circle 10H of FIG. 10G, according to an embodiment.
Figure 10I:
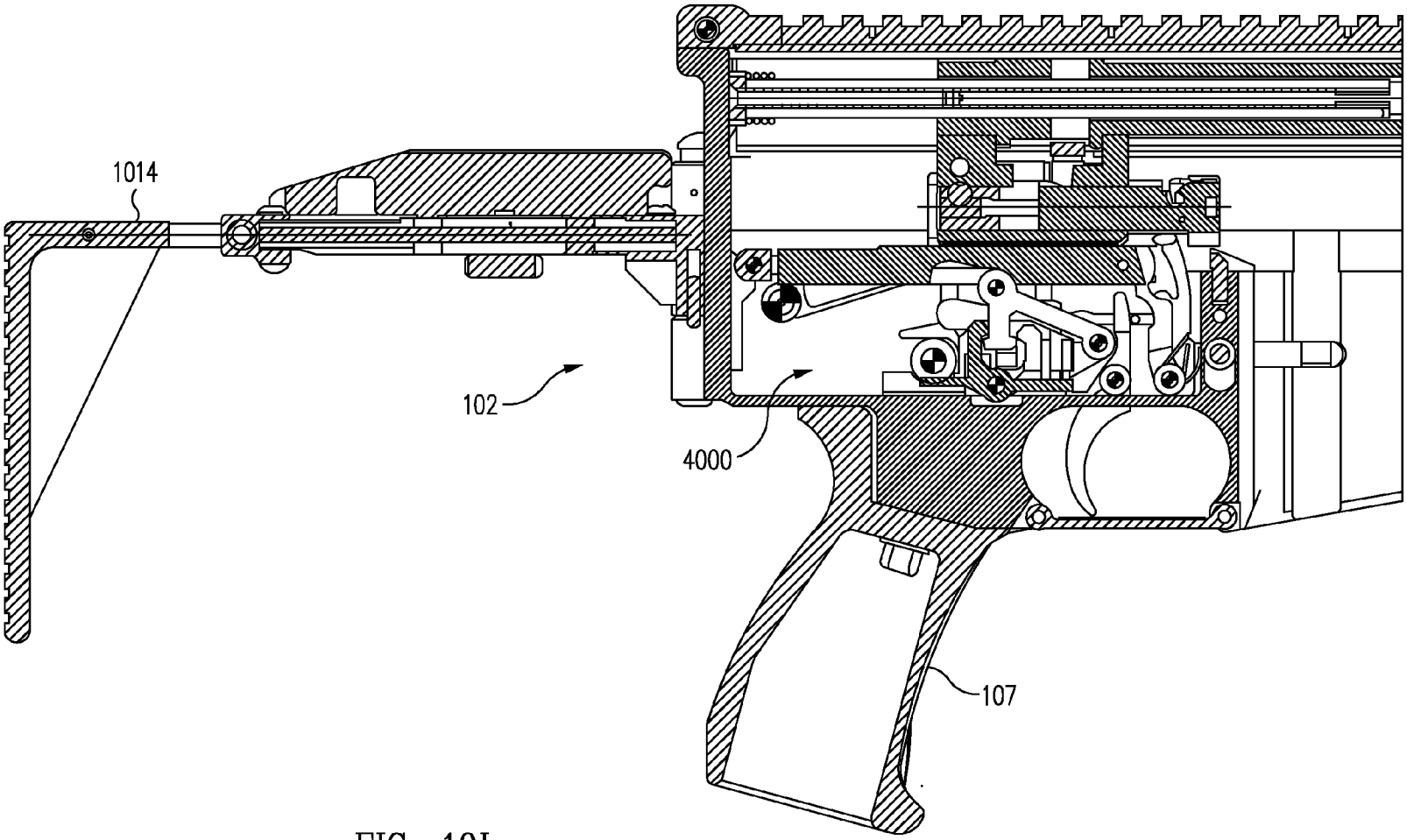
FIG. 10I is an cross-sectional view of the semi-auto rifle of FIG. 10A, according to an embodiment.
Figure 11A:
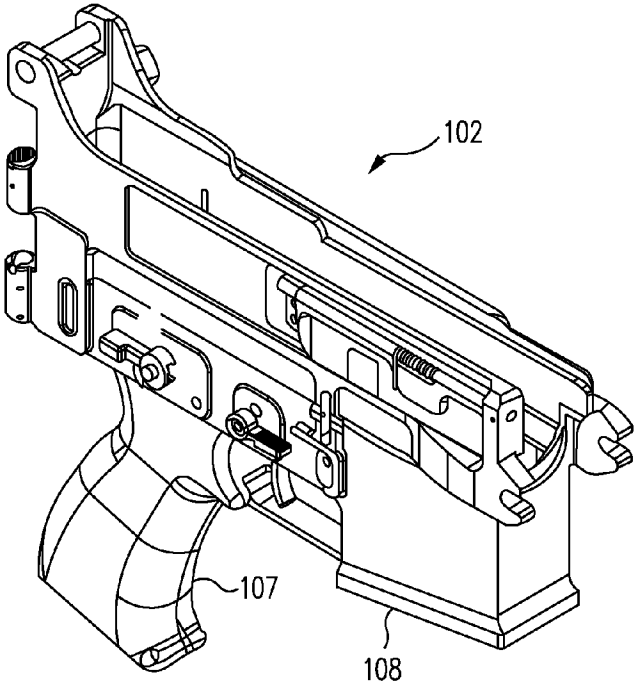
FIG. 11A is a perspective view of the lower receiver assembly of the semi-auto rifle of FIG. 10A, according to an embodiment.
Figure 11B:
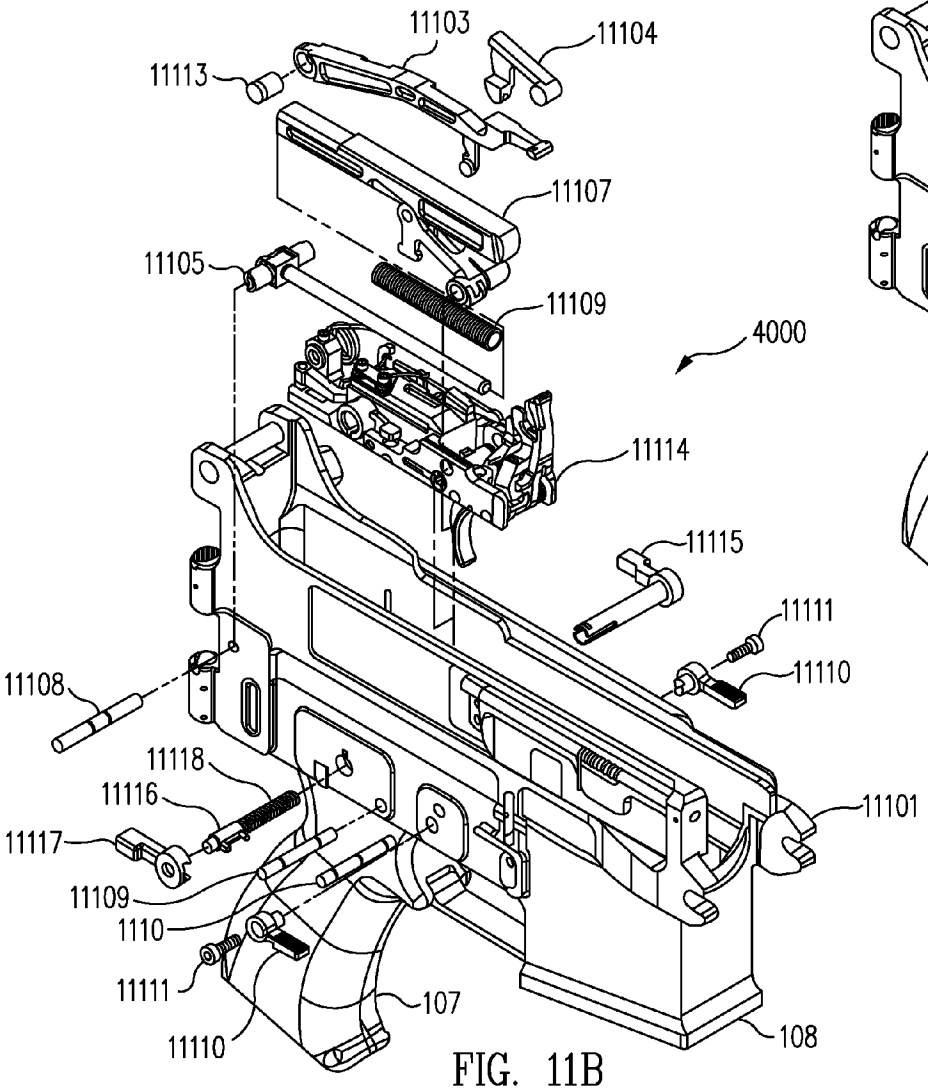
FIG. 11B is an exploded view of the lower receiver assembly of the semi-auto rifle of FIG. 10A, according to an embodiment.
Figure 11H:
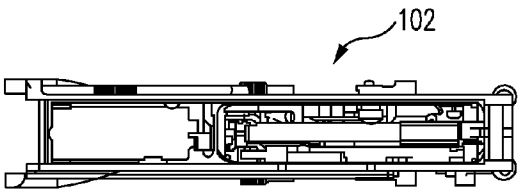
FIGS. 11C-11H are various elevational views of the lower receiver assembly of the semi-auto rifle of FIG. 10A, according to an embodiment.
Figure 11F:
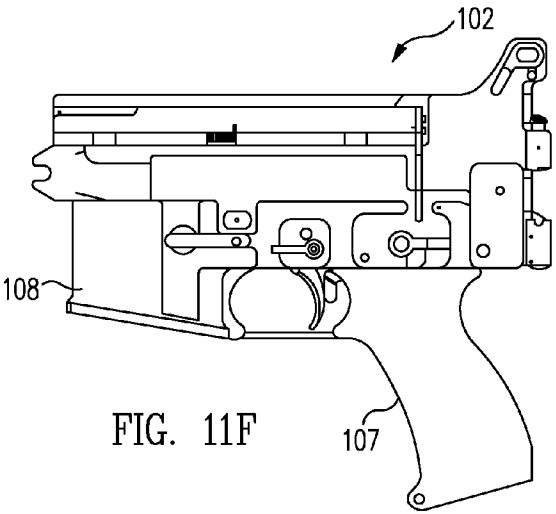
Figure 11G:
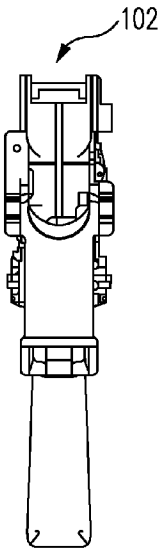

FIGS. 10G-10I show a drop-in trigger assembly 4000, according to an embodiment. The drop-in trigger assembly 4000 can be assembly outside of the semi-auto rifle 1000. Once assembled, the drop-in trigger assembly 4000 can be dropped into place in the receiver assembly 102, as discussed herein. FIGS. 11A and 11B show the drop-in trigger block assembly 4000 exploded from the receiver assembly 102, according to an embodiment. The receiver assembly 102 has an open bolt/closed bolt semi auto lower receiver sub assembly 11101, a hammer link crosspin 11102, an open bolt/closed bolt semi auto lower receiver sub assembly 11101, a hammer link crosspin 11102, an open bolt arm 11103, an open bolt arm sear 11104, a hammer shaft assembly 11105, a hammer link assembly 11106, a hammer assembly 11107, a hammer shaft crosspin 11108, a sear crosspin 11109, a safety lever 11110, an SHCS 11111, an autosear trip lever 11112, an open bolt arm pin 11113, an open bolt/closed bolt semi auto trigger block assembly 11114, a selector lever 11115, a closed bolt safety button assembly 11116, a take down lever 11117, a selector cam assembly compression spring 11118, and a hammer mainspring 11119.

Figure 11C:
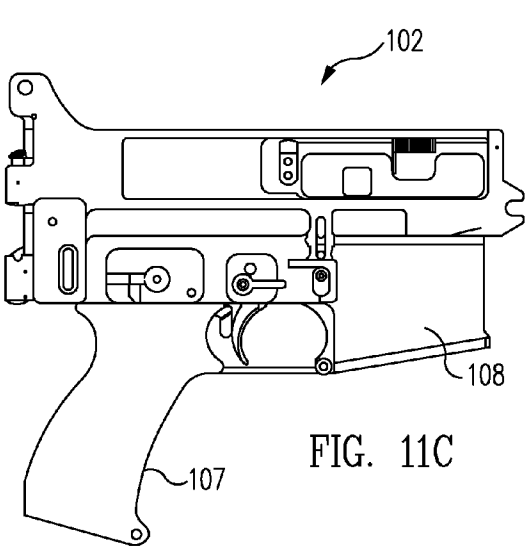
Figure 11E:
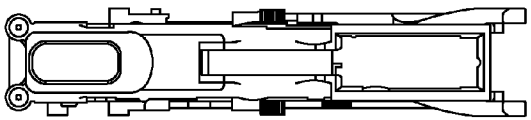
Figure 11D:
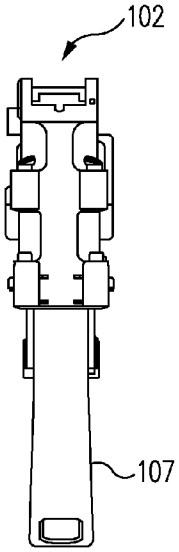

FIGS. 11C-11H are various elevational views of receiver assembly 102 of the semi-auto rifle 1000, according to an embodiment. FIG. 11C shows the right side of the receiver assembly 102. FIG. 5D shows the rear of the receiver assembly 102. FIG. 5E shows the bottom of the receiver assembly 102. FIG. 5F shows the left side of the receiver assembly 102. FIG. 5G shows the front of the receiver assembly 102. FIG. 5H shows the top of the receiver assembly 102.

Figure 11I:
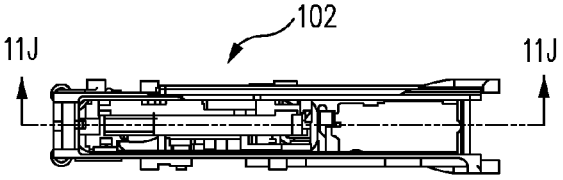
FIG. 11I is a top view of the lower receiver of the semi-auto rifle of FIG. 10A having a section reference, according to an embodiment.
Figure 11J:
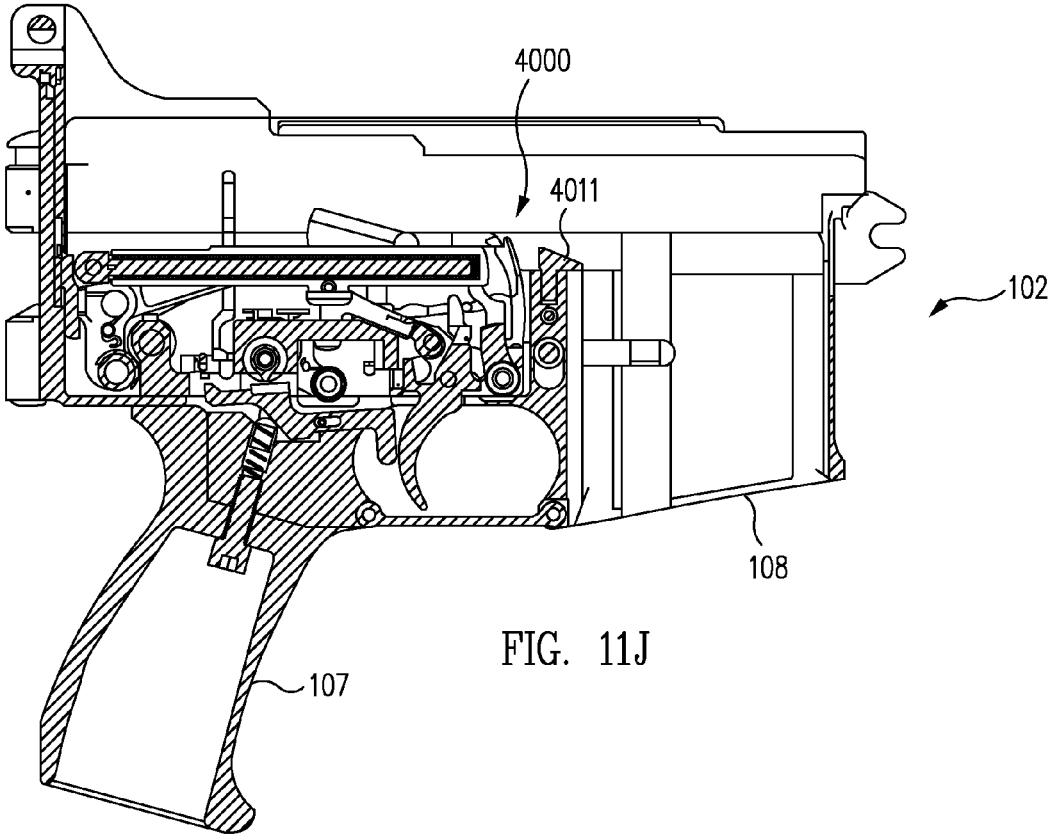
FIG. 11J is a cross-sectional side view taken along line 11J of FIG. 11I, according to an embodiment.

FIGS. 11I-11J show the receiver assembly 102, according to an embodiment. The trigger block assembly 400 is shown installed (dropped into) the receiver assembly 102.

Figure 12A:
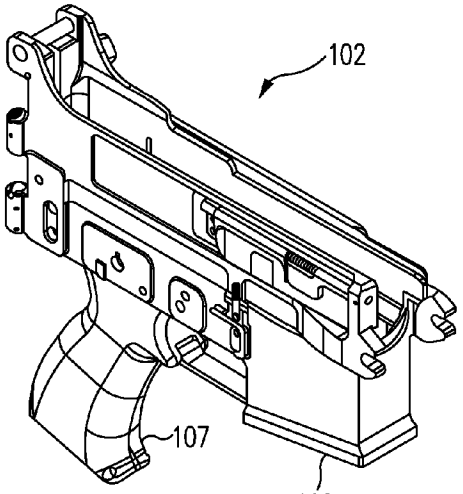
FIG. 12A is a perspective view of the lower receiver assembly of the semi-auto rifle of FIG. 10A, according to an embodiment.
Figure 12B:
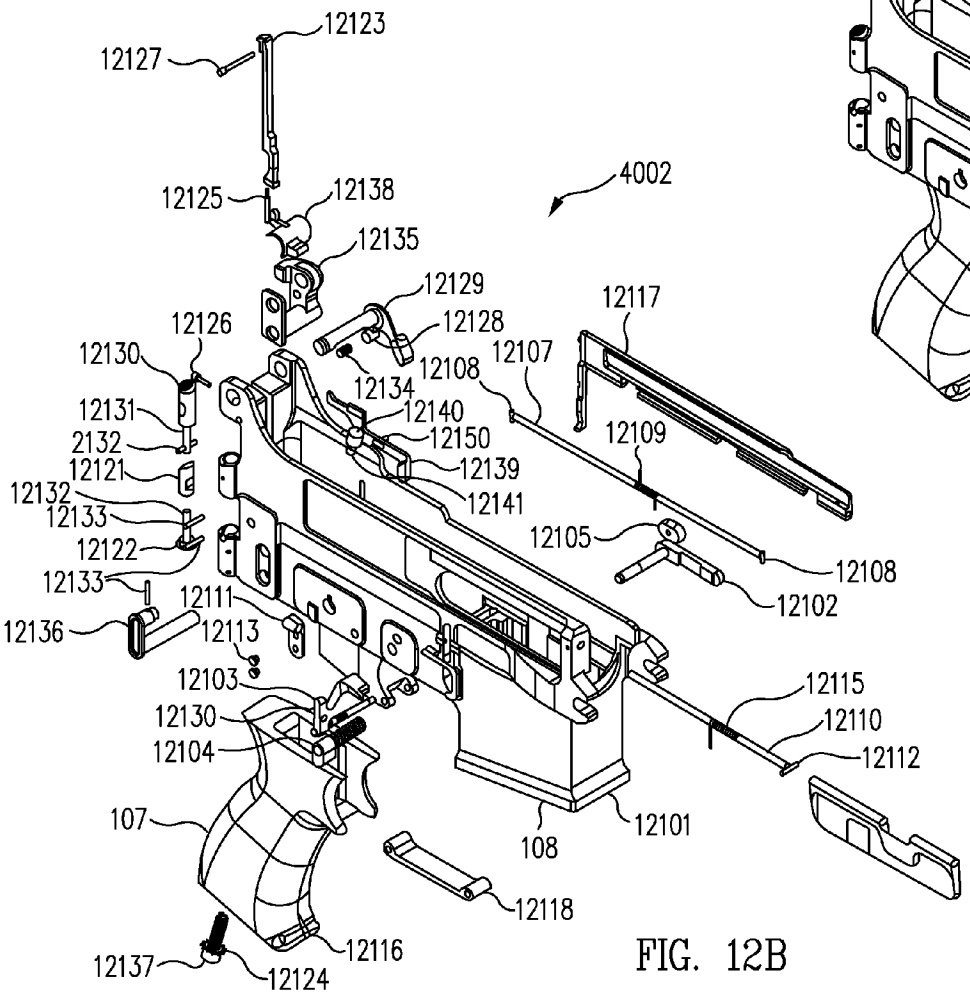
FIG. 12B is an exploded view of the lower receiver assembly of the semi-auto rifle of FIG. 10A, according to an embodiment.

FIGS. 12A and 12B are perspective views of the receiver assembly 102 of the machine gun 100, according to an embodiment. The receiver assembly 102 has an open bolt/closed bolt semi auto lower receiver 12101, a magazine catch 12102, a bolt catch 12103, a magazine catch button 12104, a bolt catch release button 12105, a bolt catch release plunger 12106, a dust cover hinge pin 12107, a slotted roll pin 12108, a spring dust cover 12109, an eject port cover hinge pin 12110, an eject port cover 12111, a slotted roll pin 12112, a low height rivet 12113, an eject port cover assembly 12114, an ejection port cover torsion spring 12115, a hand grip 12116, a dust cover assembly 12117, a trigger guard 12118, an backbone stock retension pin LH 12119, an backbone stock retension pin RH 12120, a lower receiver stock retension pin 12121, a retention pin cap 12122, an autosear trip plunger 12123, a lock washer 12124, an autosear trip plunger guide spring 12125, a latch receiver retension pin 12126, an autosear trip plunger retainer screw 12127, a receiver latch pin detent 12128, a receiver latch pin 12129, a roll pin 12130, a spring 12131, a spring 13132, a roll pin 12133, a receiver latch compression spring 12134, an open bolt arm torsion damper assembly 12135, a torsion damper retainer 12136, an SHCS 12137, an autosear trip lever 12138, a trigger lock bar 12139, a trigger lock bar plunger 12140, a trigger lock compression spring 12141, and a magazine catch spring 12142.

Figure 12H:
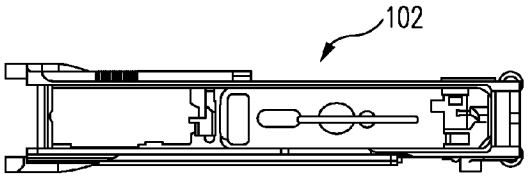
FIGS. 12C-12H are various elevational views of the lower receiver assembly of the semi-auto rifle of FIG. 10A, according to an embodiment.
Figure 12F:
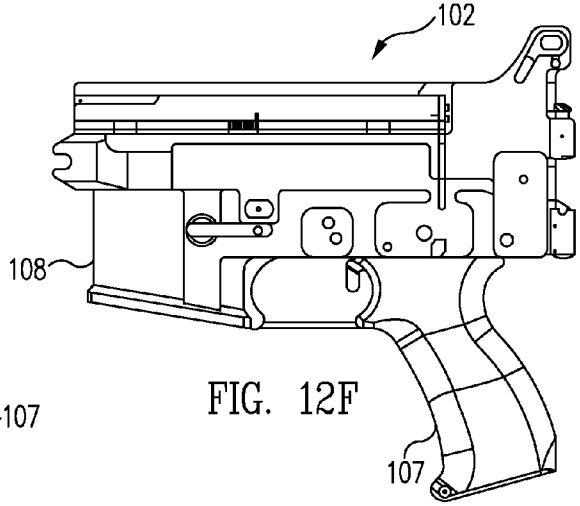
Figure 12G:
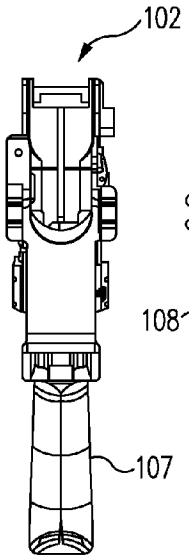
Figure 12C:
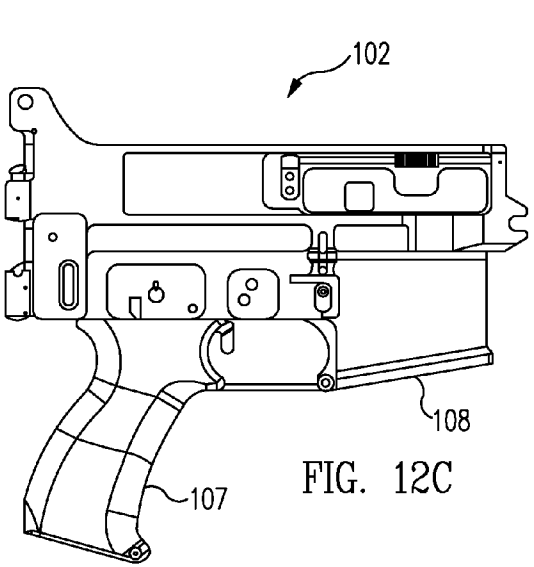
Figure 12D:
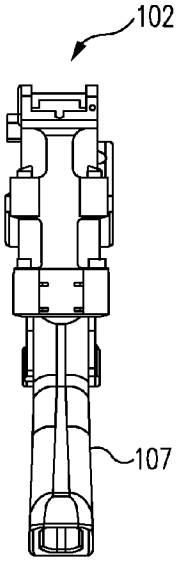
Figure 12E:
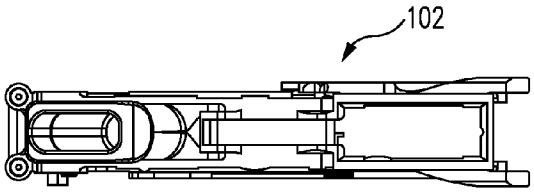
Figure 12I:
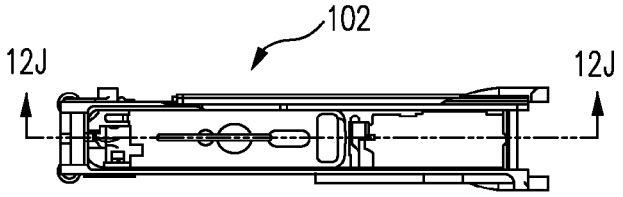
FIG. 12I is a top view of the lower receiver of the semi-auto rifle of FIG. 10A having a section reference, according to an embodiment.
Figure 12J:
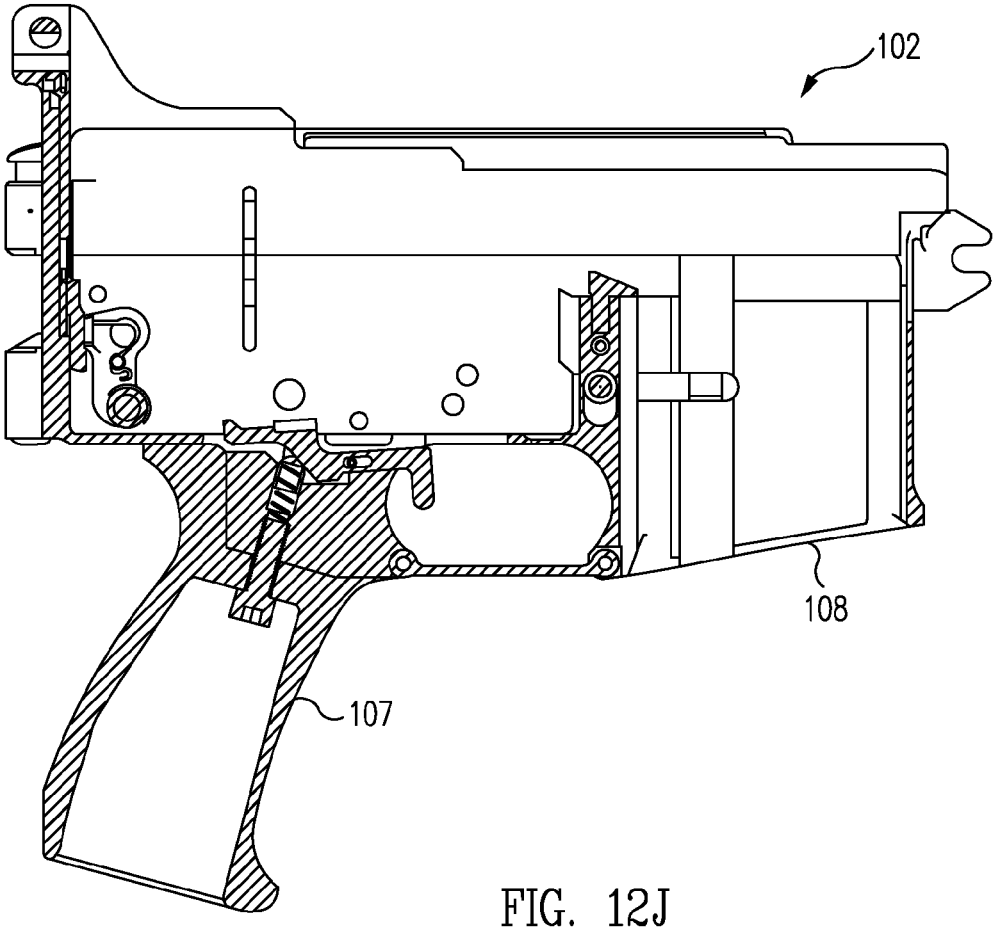
FIG. 12J is a cross-sectional side view taken along line 12J of FIG. 12I, according to an embodiment.
Figure 12K:
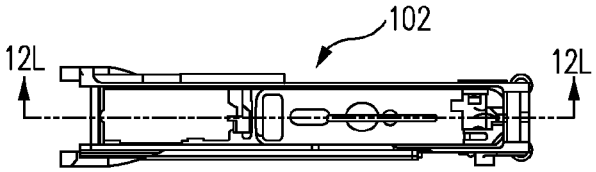
FIG. 12K is a top view of the lower receiver of the lower receiver of the semi-auto rifle of FIG. 12A having a section reference, according to an embodiment.
Figure 12L:
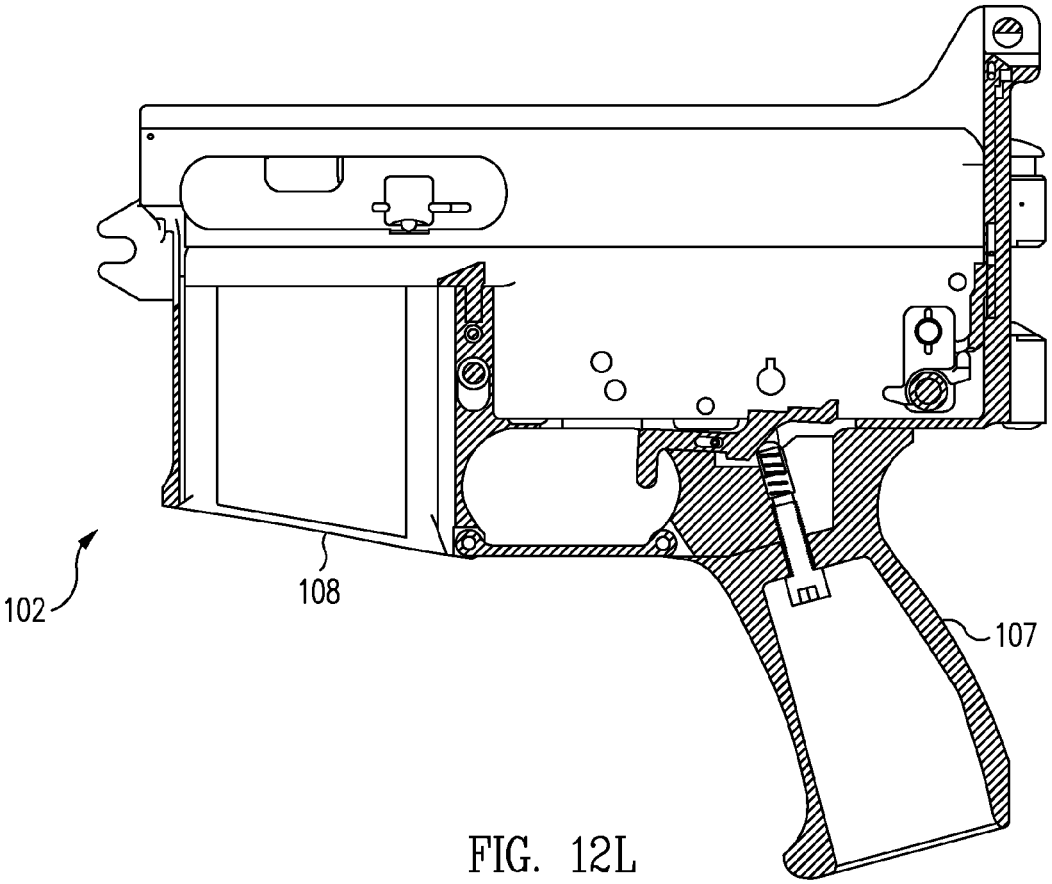
FIG. 12L is a cross-sectional side view taken along line 12L of FIG. 12K, according to an embodiment.
Figure 13A:
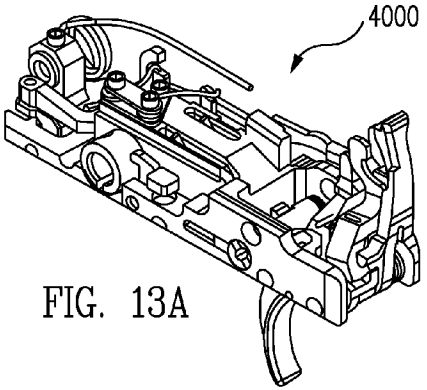
FIG. 13A is a perspective view of a trigger block assembly of the semi-auto rifle of FIG. 10A, according to an embodiment.
Figure 13B:
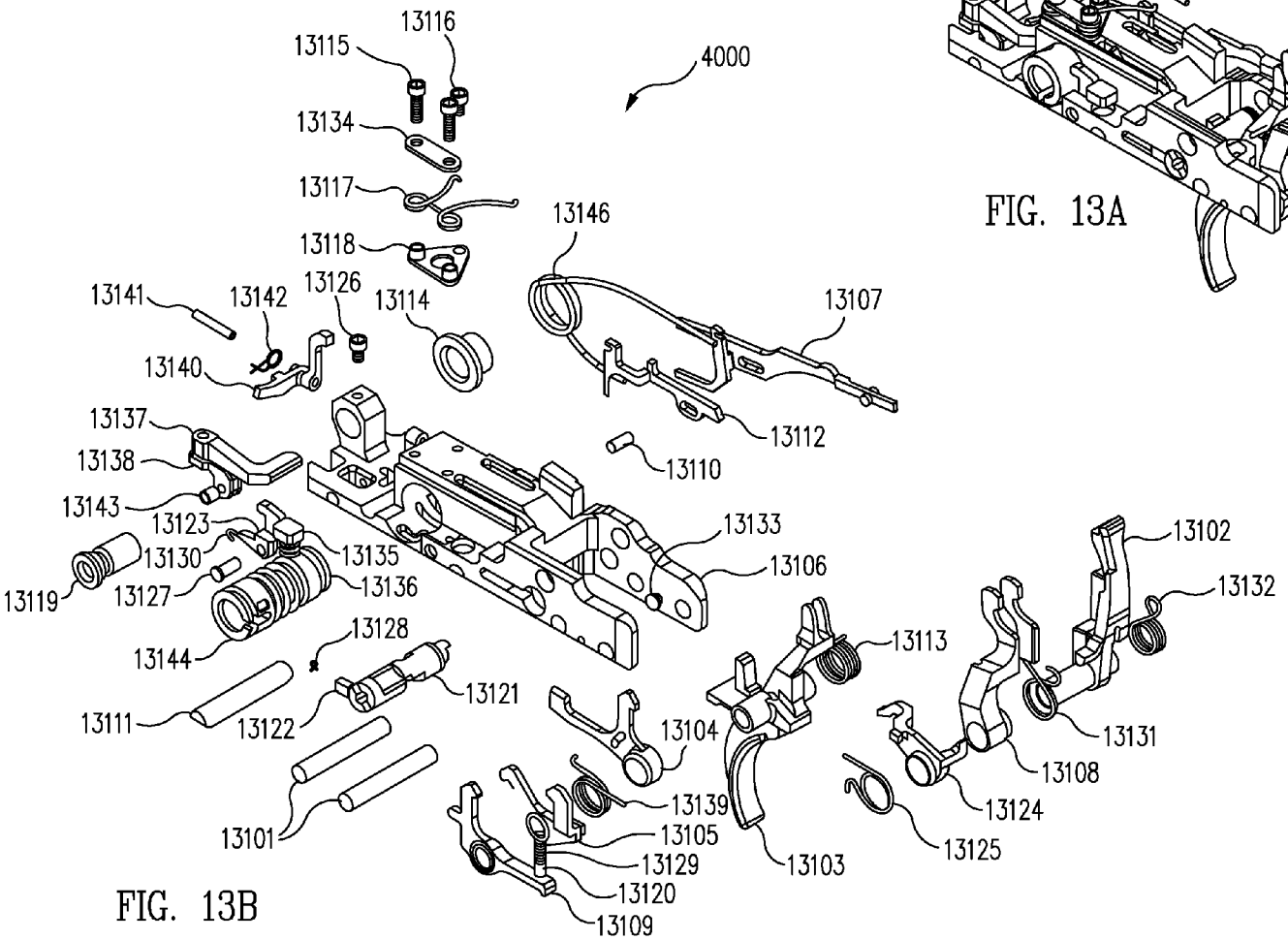
FIG. 13B is a perspective exploded view of the trigger block assembly of FIG. 13A, according to an embodiment.
Figure 13G:
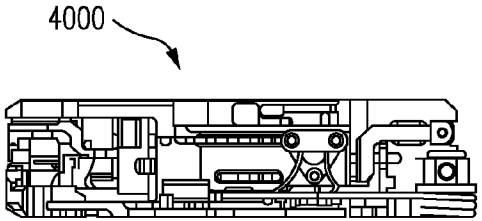
FIGS. 13C-13H are various elevational views of the trigger block assembly of FIG. 13A, according to an embodiment.
Figure 13H:
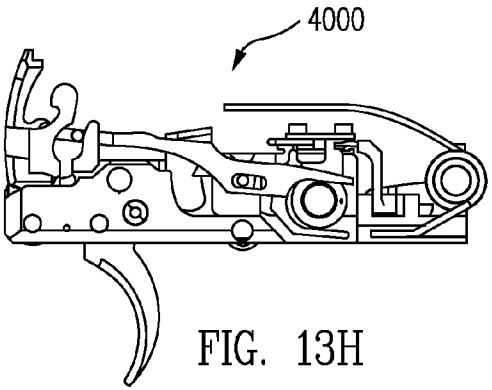
Figure 13F:
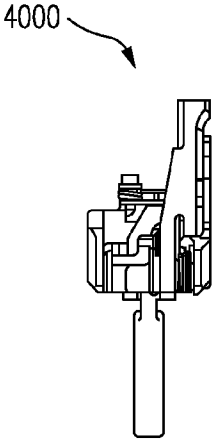
Figure 13D:
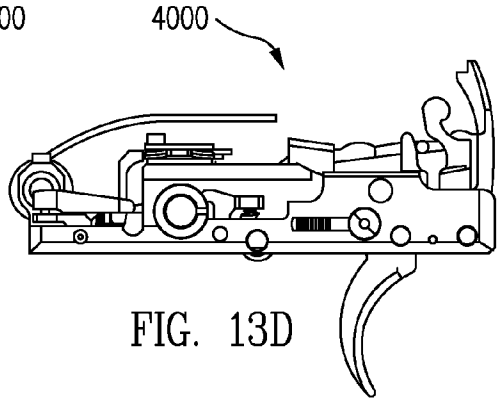
Figure 13E:
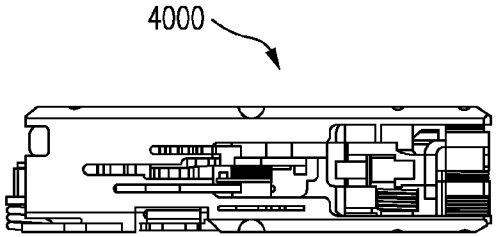
Figure 13C:
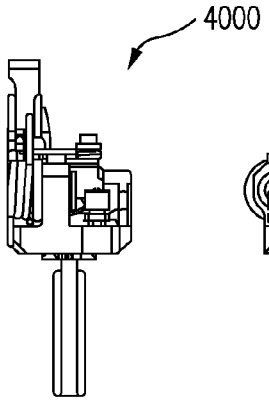
Figure 14A:
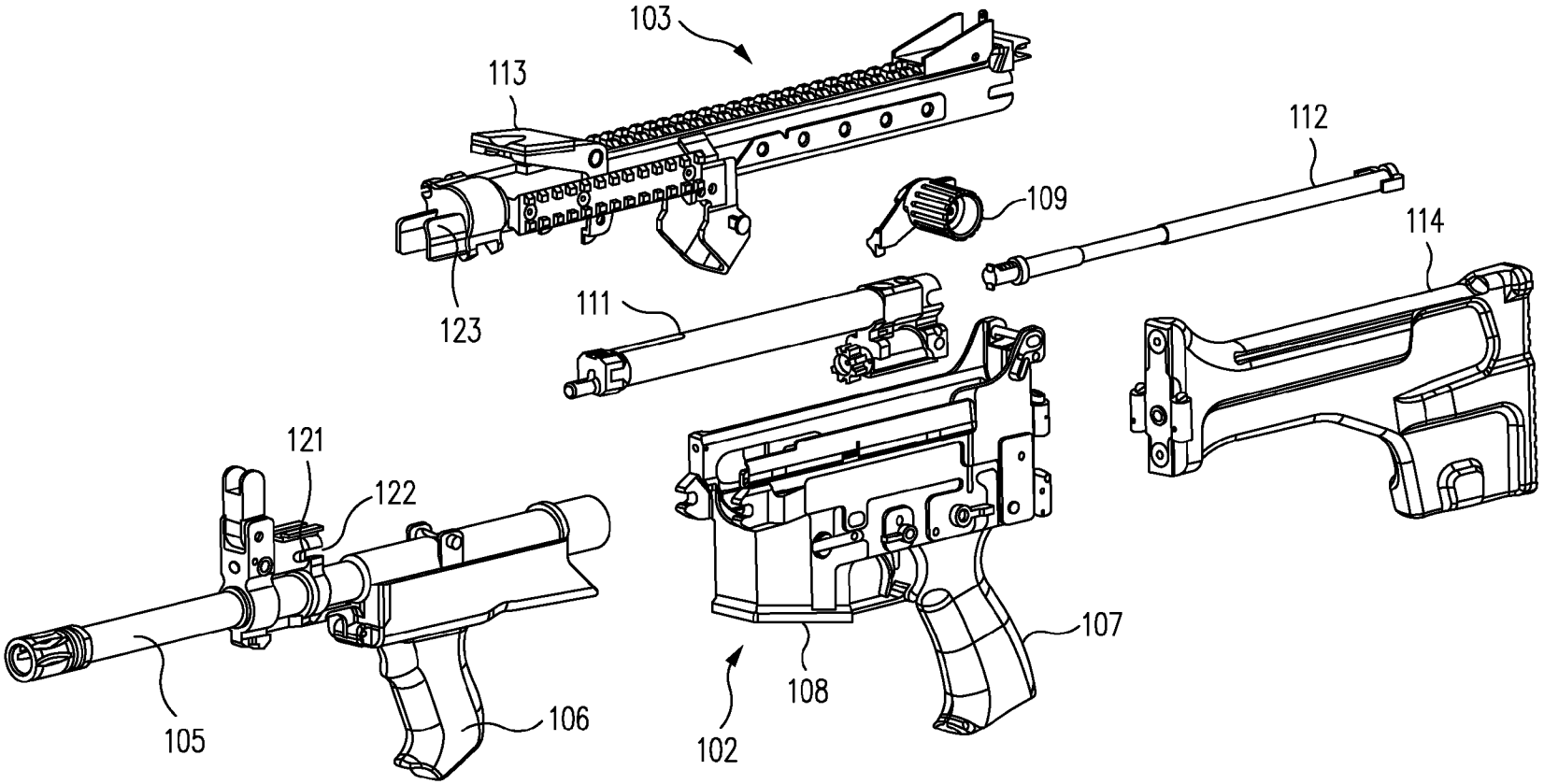
FIG. 14A is an exploded view of an open bolt, closed bolt semi-auto rifle having a heavy duty stock, according to an embodiment.
Figure 14B:
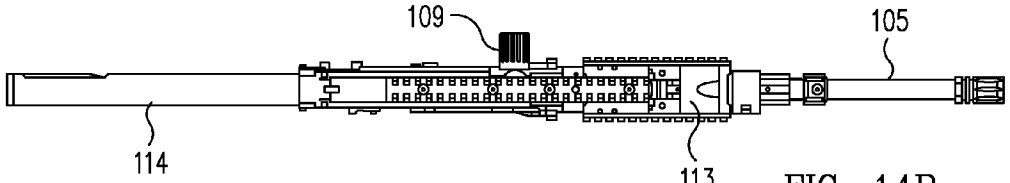
FIGS. 14B-14F are various elevational views of the semi-auto rifle of FIG. 14A, according to an embodiment.
Figure 14C:
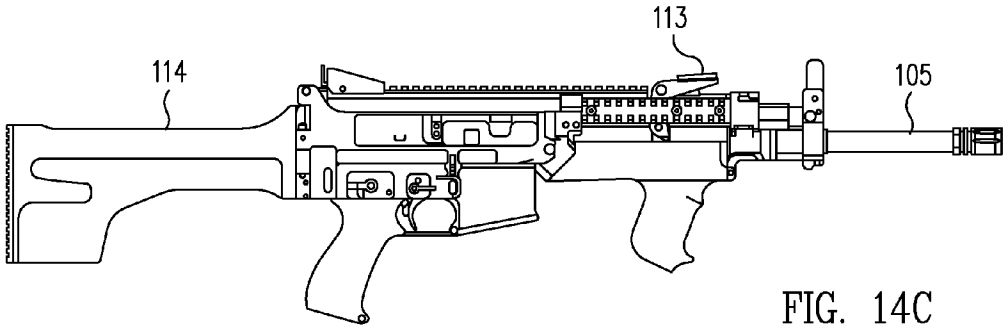
Figure 14D:
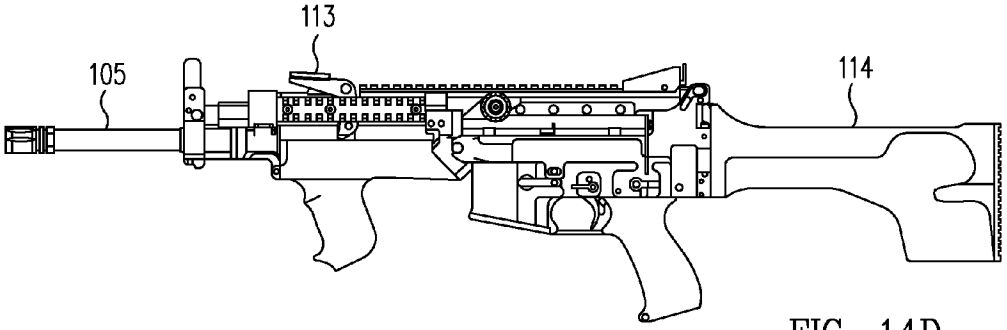
Figure 14E:
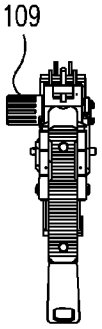
Figure 14F:
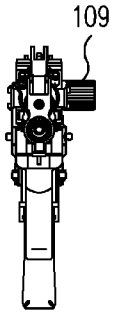
Figure 14G:
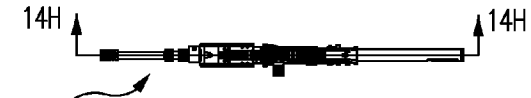
FIG. 14G is a top view of the semi-auto rifle of FIG. 14A having a section reference, according to an embodiment.
Figure 14H:
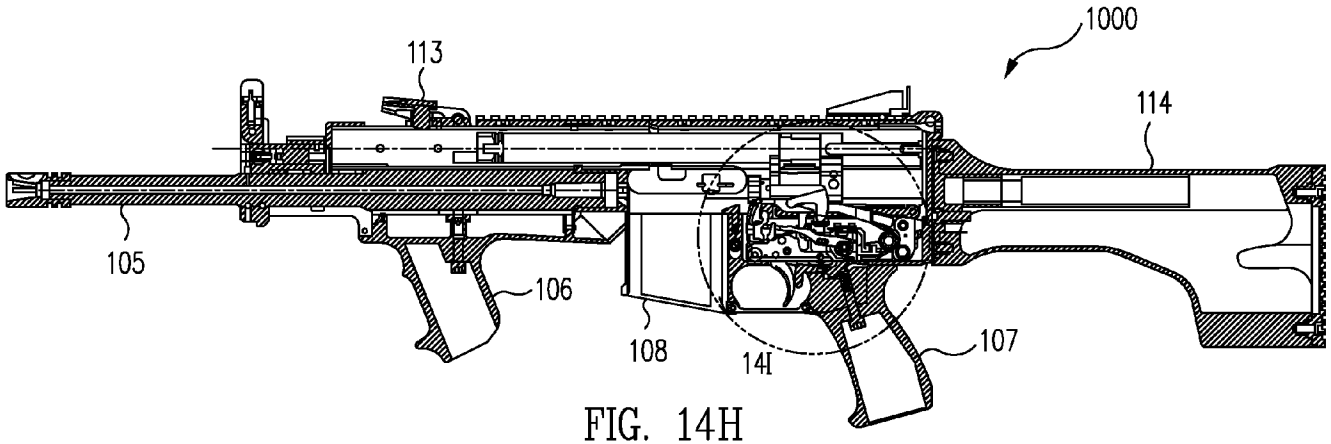
FIG. 14H is a cross-sectional side view taken along line 14H of FIG. 14G, according to an embodiment.
Figure 14I:
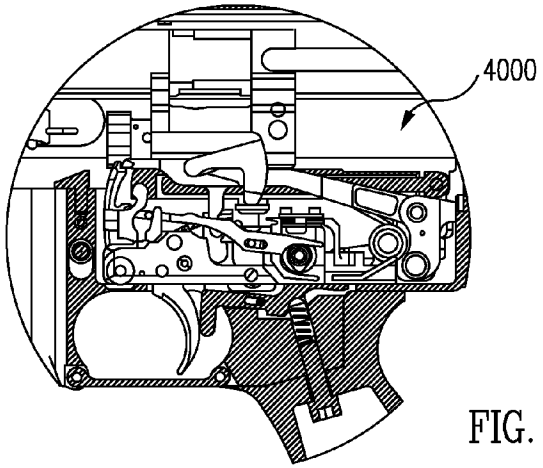
FIG. 14I is an enlarged view taken within the section circle 14I of FIG. 14H, according to an embodiment.
Figure 14J:
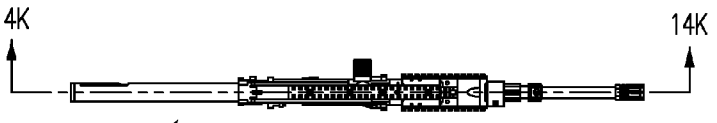
FIG. 14J is a top view of the semi-auto rifle of FIG. 14A having a section reference, according to an embodiment.
Figure 14K:
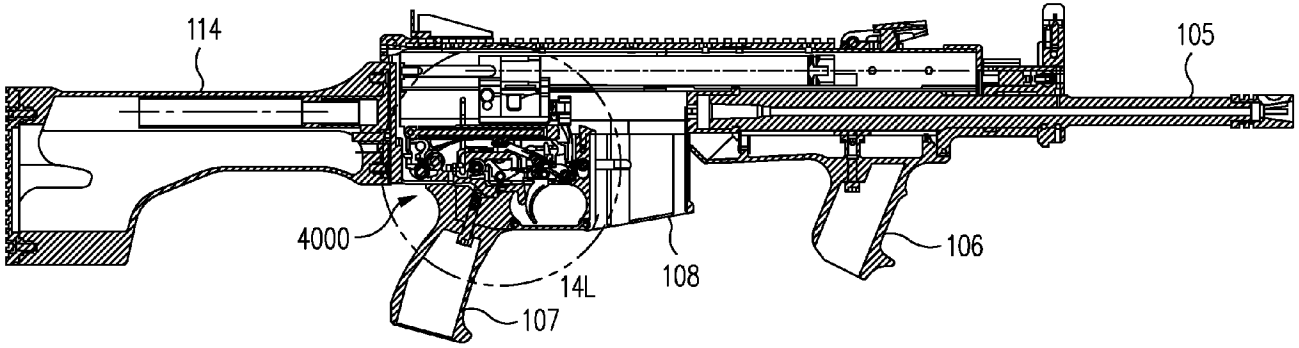
FIG. 14K is a cross-sectional side view taken along line 14K of FIG. 14J, according to an embodiment.
Figure 14L:
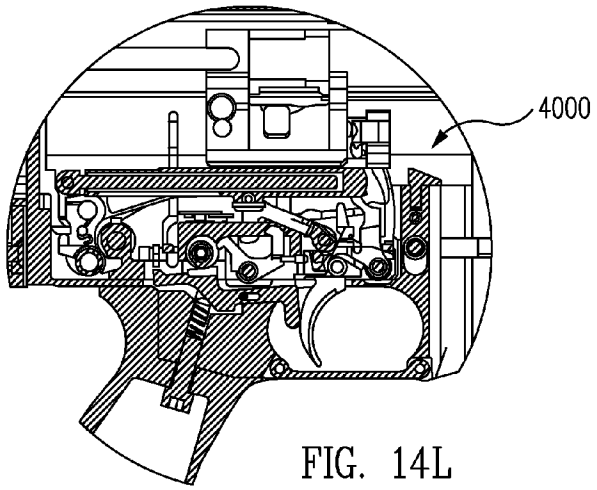
FIG. 14L is an enlarged view taken within the section circle 14L of FIG. 14K, according to an embodiment.
Figures 15A, 15B, 15C:
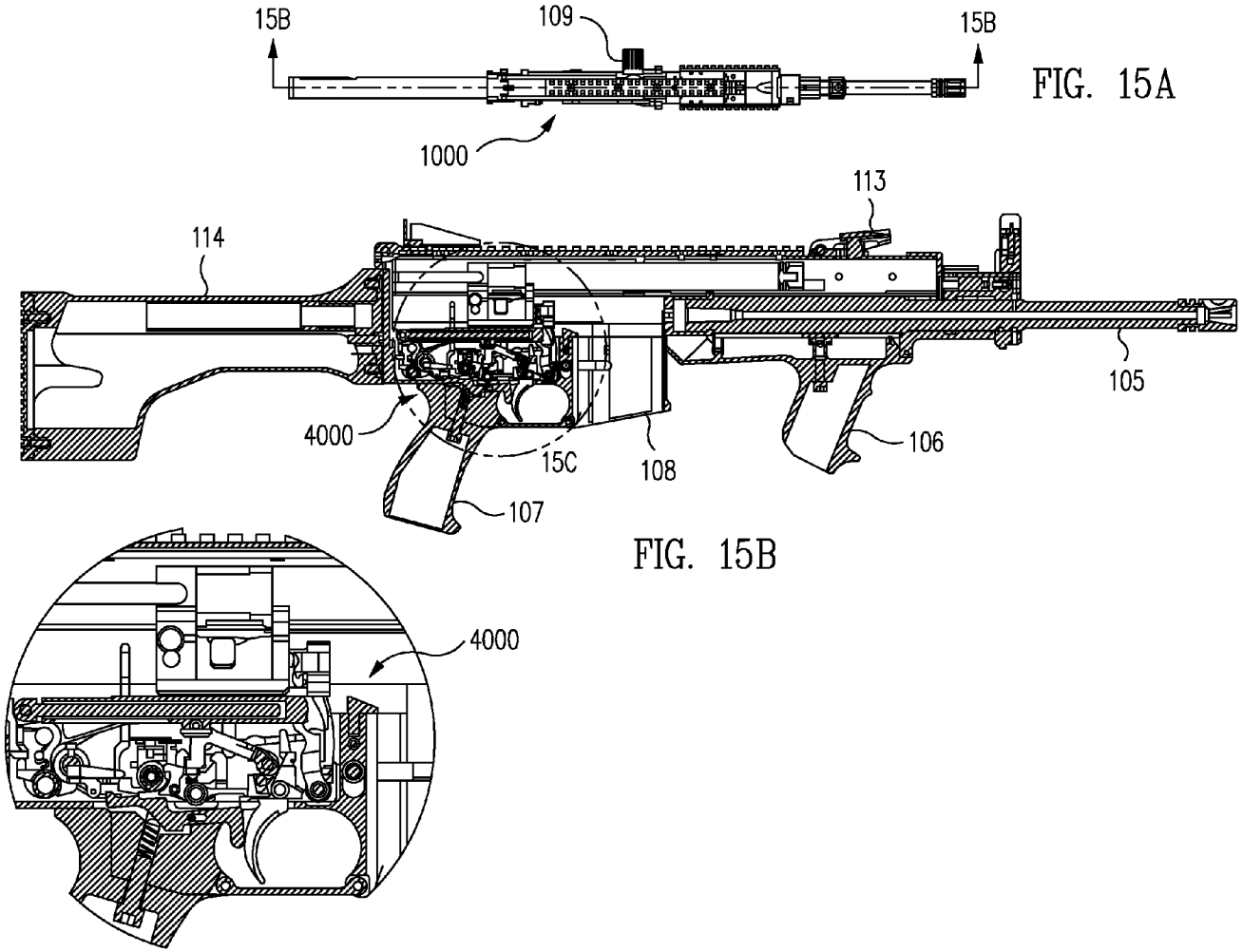
FIG. 15A is a top view of the semi-auto rifle of FIG. 14A having a section reference, according to an embodiment.
FIG. 15B is a cross-sectional side view taken along line 15B of FIG. 15A, according to an embodiment.
FIG. 15C is an enlarged view taken within the section circle 15C of FIG. 15B, according to an embodiment.

FIGS. 12C-6H are various elevational views of receiver assembly 102 of the semi-auto rifle 1000, according to an embodiment. FIG. 12C shows the right side of the receiver assembly 102. FIG. 12D shows the rear of the receiver assembly 102. FIG. 12E shows the bottom of the receiver assembly 102. FIG. 12F shows the left side of the receiver assembly 102. FIG. 12G shows the front of the receiver assembly 102. FIG. 12H shows the top of the receiver assembly 102.

FIGS. 12I-12L show the receiver assembly 102, according to an embodiment. The trigger block assembly 4002 is removed from the receiver 102.

FIGS. 13A-13H show the trigger block assembly 400 of the semi-auto rifle 1000, according to an embodiment. The trigger block assembly 400 has an open bolt lever trigger pin 13101, an open bolt arm open bolt/closed bolt semi auto release lever 13102, open bolt full auto/semi auto open bolt/closed bolt semi auto trigger 10103, auto sear 13104, a closed bolt disconnector 13105, an open bolt/closed bolt trigger semi auto trigger block 13106, an open bolt trigger bar 13107, an open bolt arm open bolt/closed bolt full auto/semi auto open bolt full auto semi auto open bolt closed bolt semi auto disconnect 13108, a closed bolt sear 13109, an open bolt catch trigger pin 13110, an open bolt and auto sear bushing 13111, an open bolt closed bolt catch 13112, a trigger spring 13113, an open bolt arm spring bushing 13114, an SHCS 13115, an SHCS 13116, a closed bolt catch trigger bar spring 13117, a trigger bar plate spring 13118, an open bolt arm spring pin 13119, a closed bolt sear spring plunger 13120, a safety cylinder 13121, a safety cylinder detent 13122, a closed bolt selector safety pawl 13123, an open bolt arm safety lever 13124, a closed bolt lever safety spring 13125, a SHCS 13126, a selector detent pin 13127, a safety cylinder detent spring 13128, a closed bolt sear spring 13129, a closed bolt selector safety pawl spring 13130, a closed bolt arm disconnector spring 13131, an open bolt release lever spring 13132, a torsion damper spring retainer 13133, a spring plate cap 13134, a selector detent 13135, a selector detent spring 13136, an autosear trip lever assembly 13137, an autosear trip lever support 13138, a closed bolt disconnector autosear spring 13139, a trigger block gate 13140, a roll pin 13141, a trigger lock out spring 13142, a receiver latch retension pin 13143, an open bolt/closed bolt semi auto selector cam 13144, a trigger block retension spring pin 13145, and an open bolt arm spring 13146.

FIGS. 14A-14F are additional views of the semi-auto rifle 1000, according to an embodiment. The semi-auto rifle 1000 can have the lower receiver or receiver assembly 102. The receiver assembly 102 can include a grip 107 and a magazine well 108.

The backbone 103 constrains a bolt carrier 111, as described herein. A charging handle 109 can be slidably disposed between the backbone 103 and the receiver assembly 102 so as to facilitate cocking of the machine gun 100 by pulling a bolt carrier 111 rearward. A spring guide 112 can be at least partially disposed within the bolt carrier 111 and can define an anti-bounce system, as discussed herein.

A barrel assembly 104 can be removably detachable from the semi-auto rifle 1000 by pressing a barrel latch 113 on the backbone 103, as discussed herein. The barrel 105 can have a fore grip 106. The barrel 105 can be shorter that that shown in FIGS. 10A-10F for the semi-auto rifle 1000.

A stock 114 can be removably attachable to the receiver assembly 102. The stock 114 can be pivotally attached to the receiver assembly 102 such that the stock 114 can fold to either side of the receiver assembly 102. The stock 114 can be a heavy duty stock, as shown. Alternatively, the stock 114 can be a lightweight stock such as that shown in FIGS. 10-10F or can be any other type of stock.

FIGS. 14G-15C show a drop-in trigger assembly 4000, according to an embodiment. The drop-in trigger assembly 4000 can be assembly outside of the semi-auto rifle 1000. Once assembled outside of the receiver assembly 102, the drop-in trigger assembly 4000 can be dropped into place in the receiver assembly 102, as discussed herein.

Figure 16A:
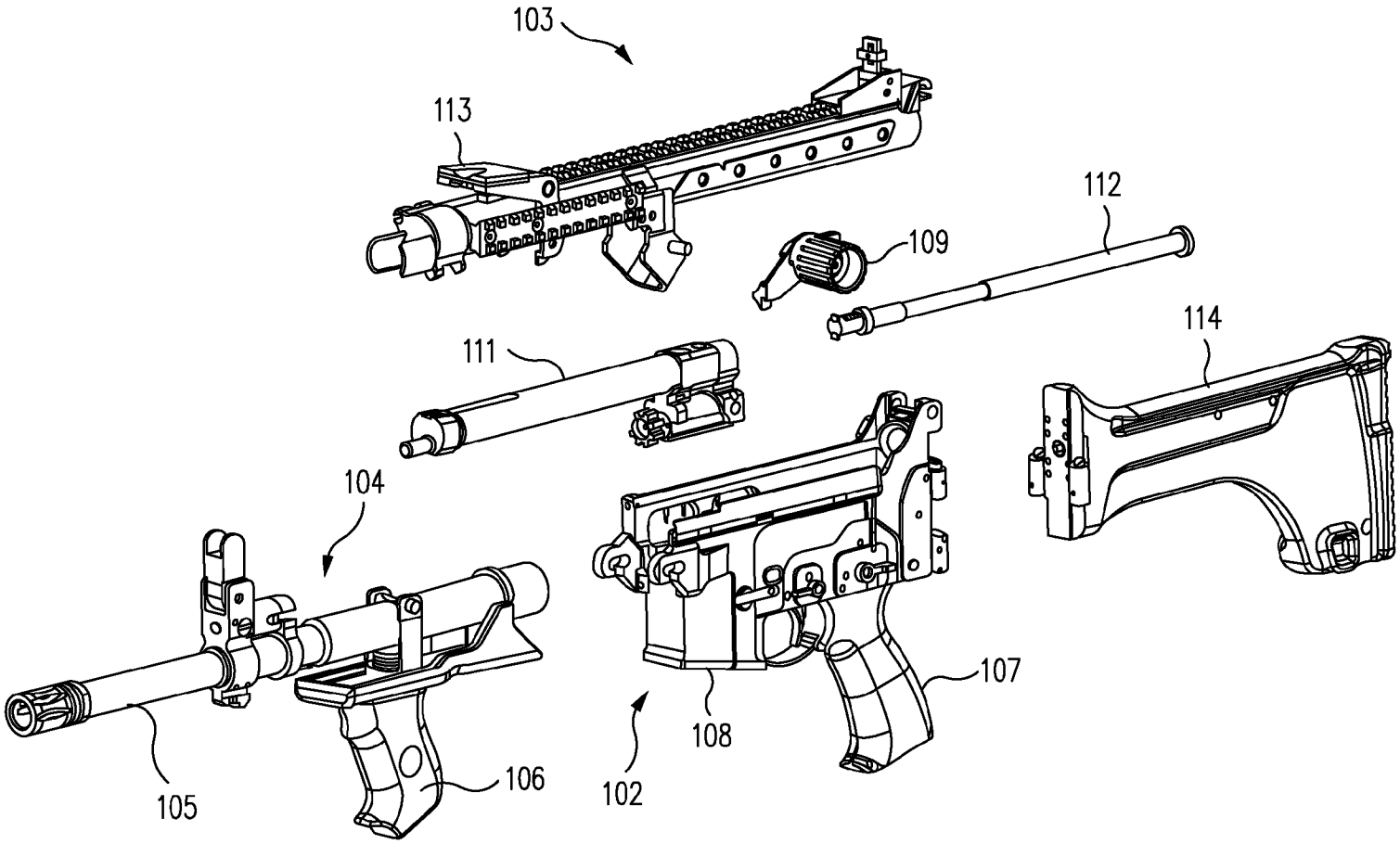
FIG. 16A is an exploded view of an open bolt, closed bolt full auto, semi-auto rifle/machine gun having a heavy duty stock, according to an embodiment.
Figure 16B:
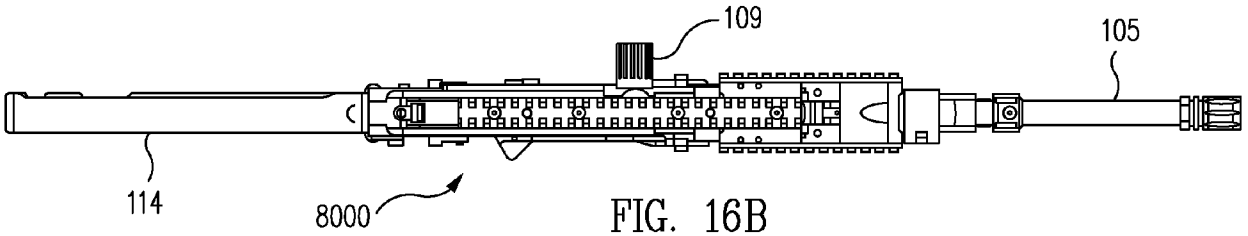
FIGS. 16B-16F are various elevational views of the rifle/machine gun of FIG. 16A, according to an embodiment.
Figure 16C:
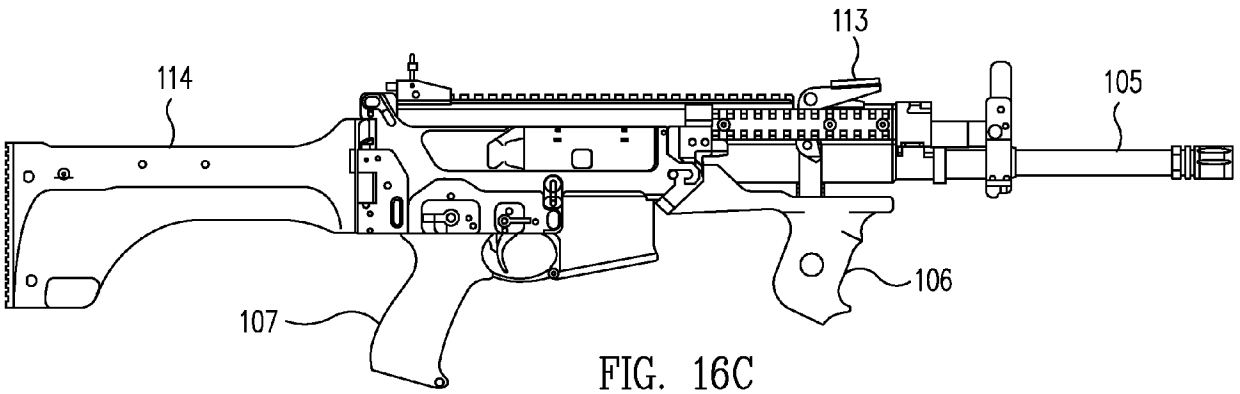
Figure 16D:
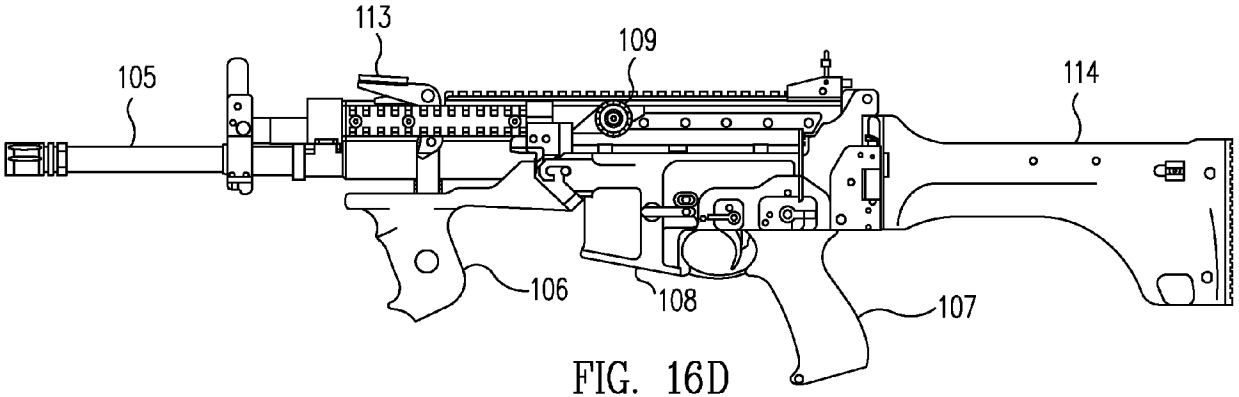
Figure 16F:
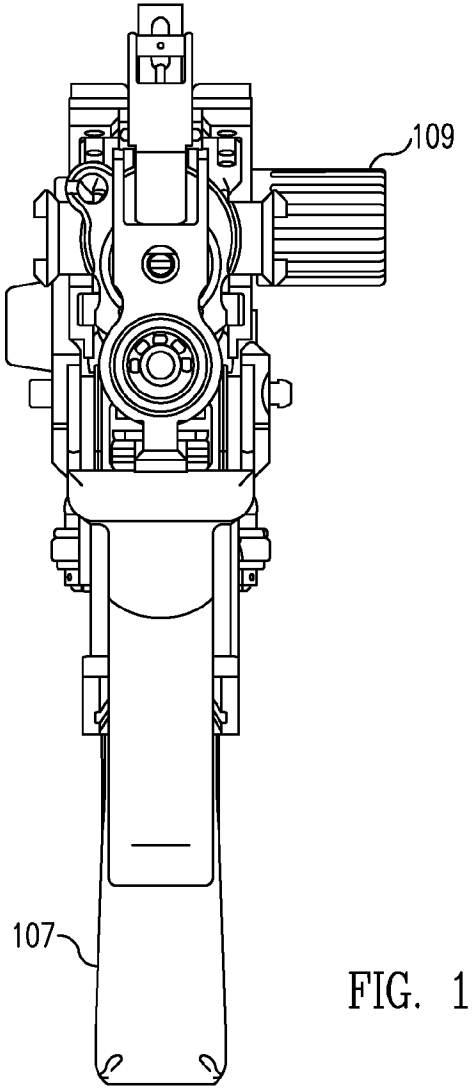
Figure 16E:
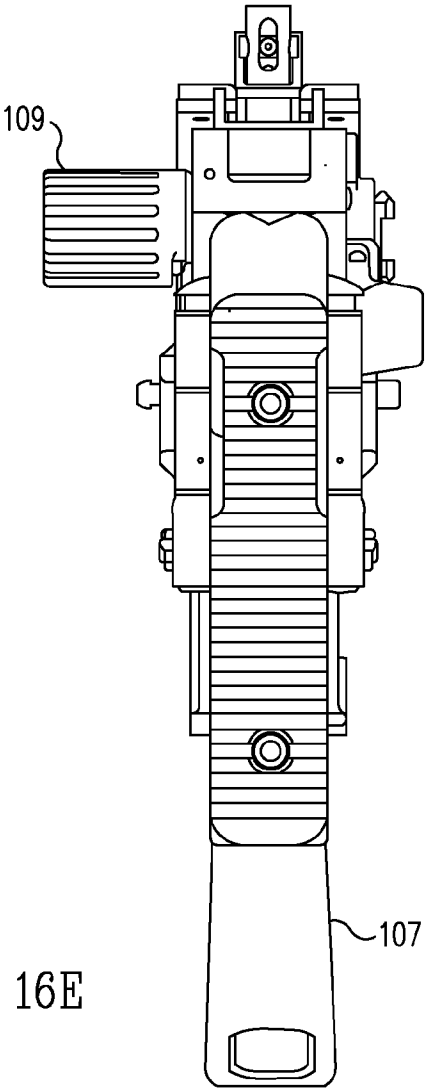

FIG. 16A shows of rifle/machine gun 8000, according to an embodiment. The rifle/machine gun 8000 is capable of semi-auto and full auto fire, as selected by the user. The rifle/machine gun 8000 can be fired from either an open bolt or a closed bolt, as selected by a user. Many of the features of the semi-auto rifle 1000 are substantially the same as those of the machine gun 100 discussed above.

FIGS. 16B-16F are additional views of the rifle/machine gun 8000, according to an embodiment. The rifle/machine gun 8000 has a lower receiver or receiver assembly 102. The receiver assembly 102 can include a grip 107 and a magazine well 108.

The backbone 103 constrains a bolt carrier 111, as described herein. A charging handle 109 can be slidably disposed between the backbone 103 and the receiver assembly 102 so as to facilitate cocking of the rifle/machine gun 8000 by pulling a bolt carrier 111 rearward. A spring guide 112 can be at least partially disposed within the bolt carrier 111 and can define an anti-bounce system, as discussed herein.

A barrel assembly 104 can be removably detachable from the rifle/machine gun 8000 by pressing a barrel latch 113 on the backbone 103, as discussed herein. The barrel assembly 104 can have a fore grip 106.

A stock 114 can be removably attachable to the receiver assembly 102. The stock 114 can be pivotally attached to the receiver assembly 102 such that the stock 114 can fold to either side of the receiver assembly 102. The stock 114 can be a heavy duty stock, as shown. Alternatively, the stock 114 can be a lightweight stock or any other type of stock.

Figure 16G:
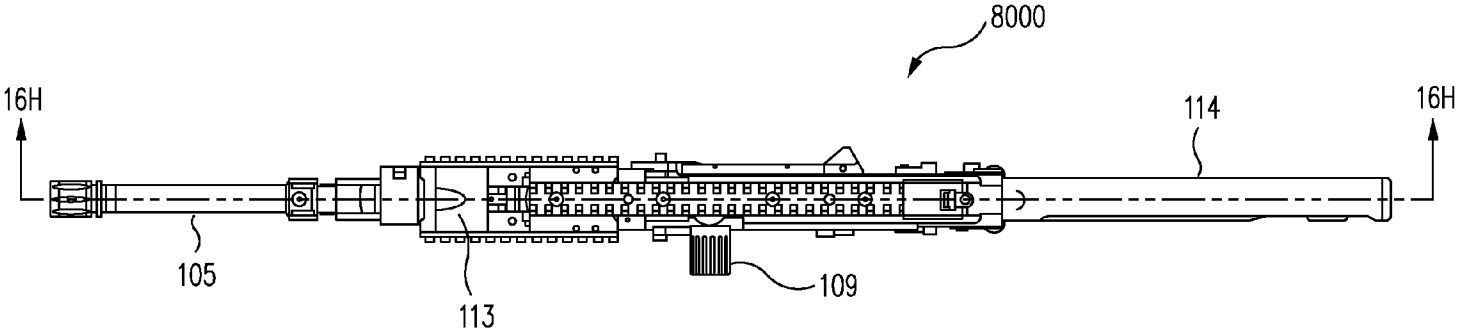
FIG. 16G is a top view of the rifle/machine gun of FIG. 16A having a section reference, according to an embodiment.
Figure 16H:
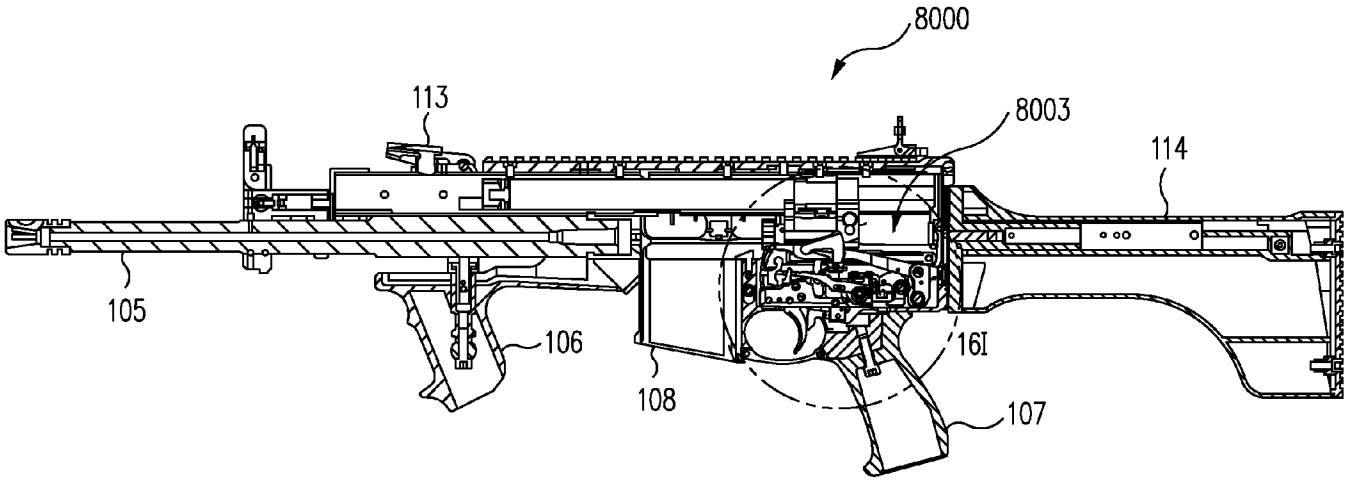
FIG. 16H is a cross-sectional side view taken along line 16H of FIG. 16G, according to an embodiment.
Figure 16I:
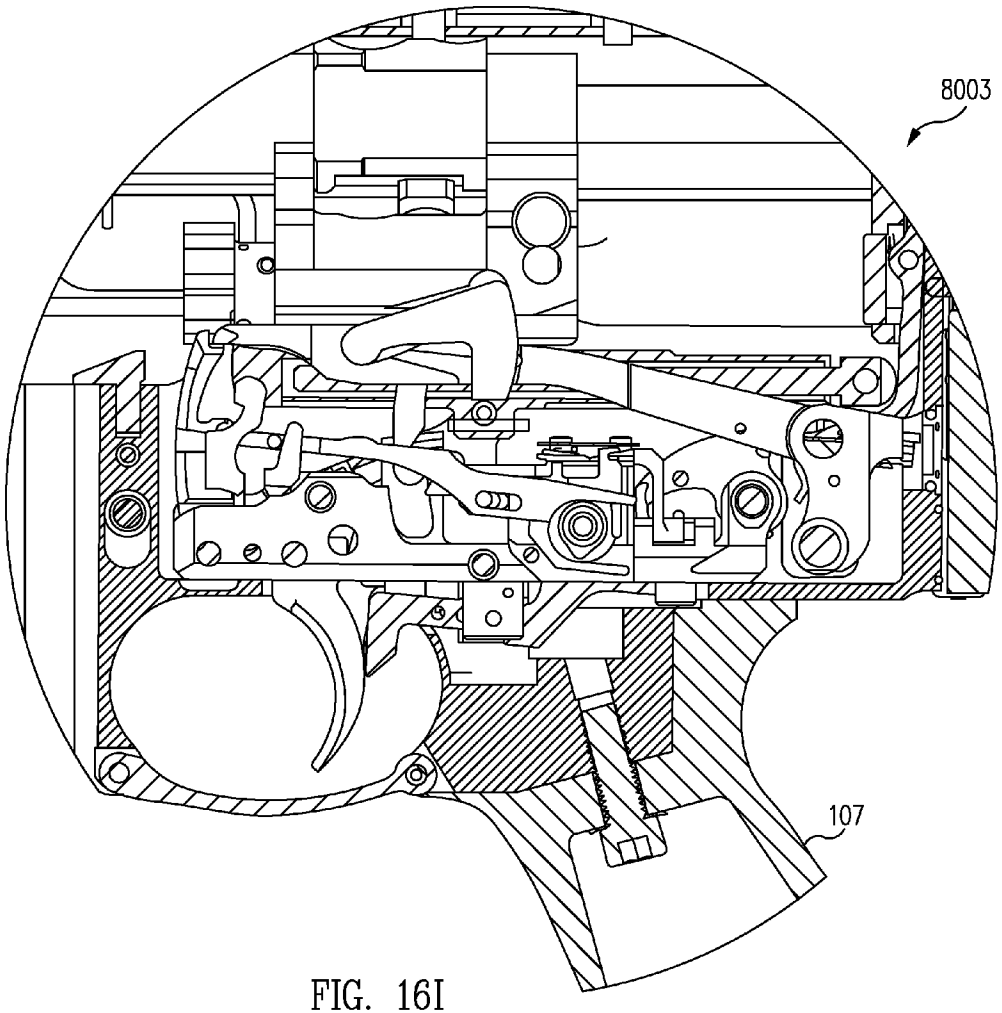
FIG. 16I is an enlarged view taken within the section circle 16I of FIG. 16H, according to an embodiment.

FIGS. 16G-16I show a drop-in trigger block assembly 8003, according to an embodiment. The trigger block assembly 8003 can be assembled outside of the rifle/machine gun 8000. Once assembled, the trigger block assembly 400 can be dropped into place in the receiver assembly 102, as discussed herein.

Figure 17A:
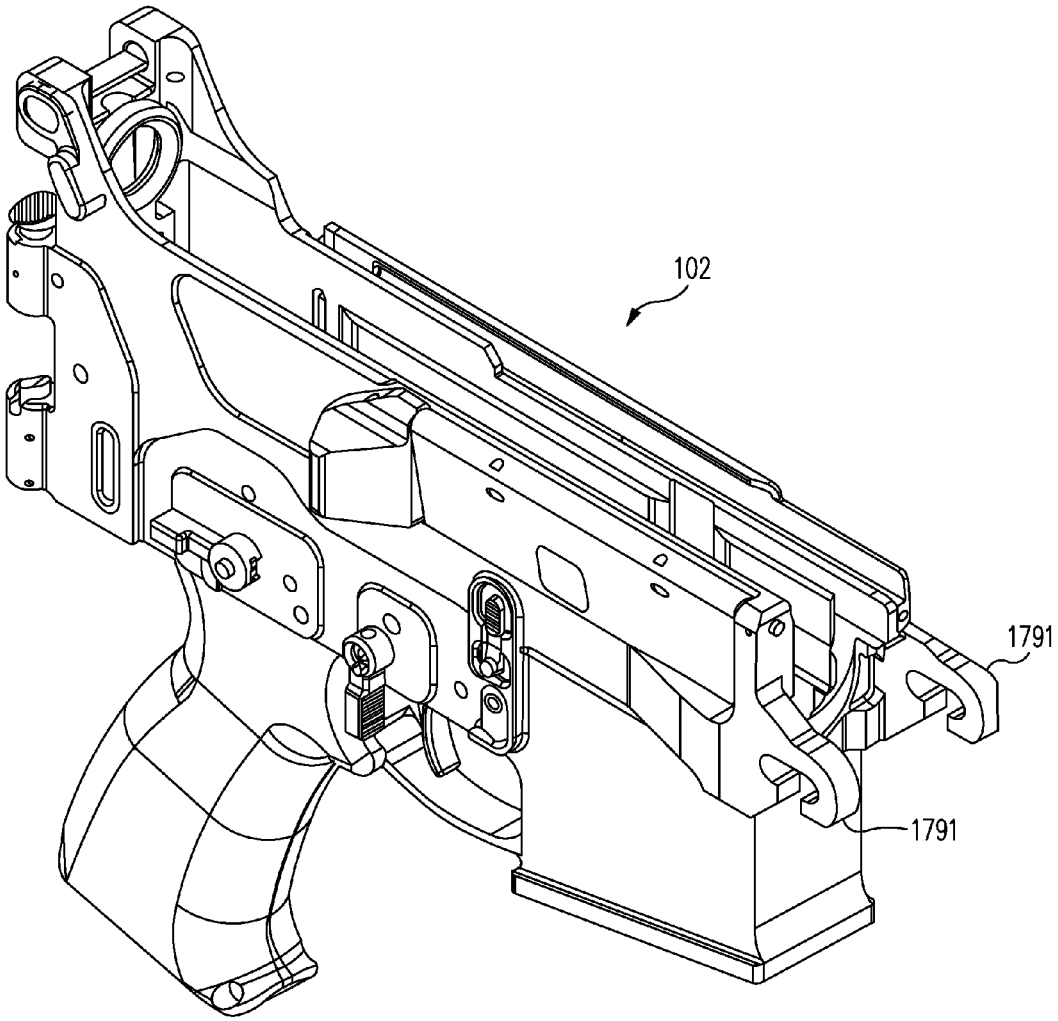
FIG. 17A is a perspective view of the lower receiver assembly of the rifle/machine gun of FIG. 16A, according to an embodiment.
Figure 17B:
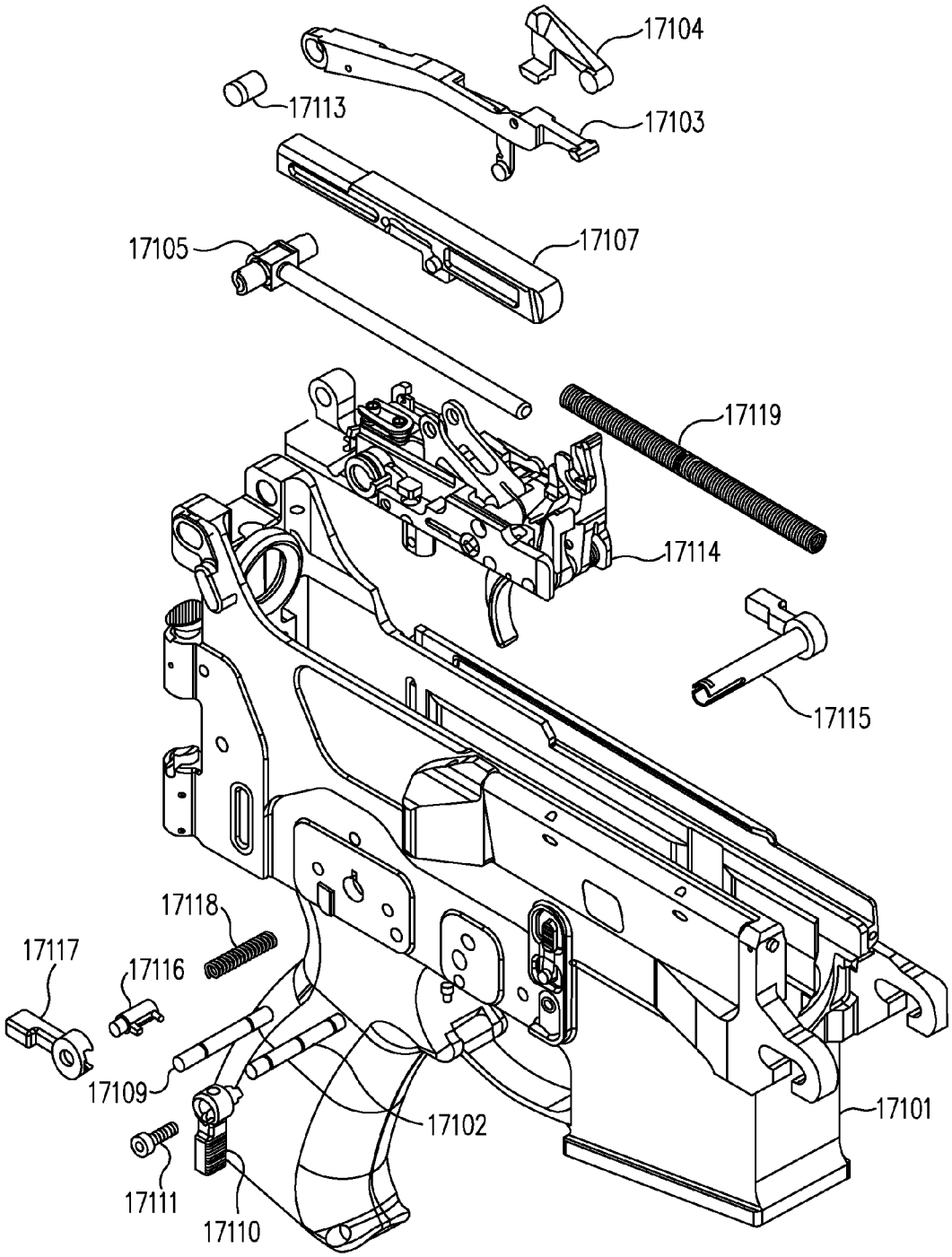
FIG. 17B is an exploded view of the lower receiver assembly of the rifle/machine gun of FIG. 16A, according to an embodiment.

FIGS. 17A and 17B show the trigger block assembly 8003 exploded from the receiver assembly 102, according to an embodiment. The sear crosspin 1709 and the hammer link crosspin 1702 can secure the drop-in trigger block assembly 400 within the receiver assembly 102. Two hook pivots 1791 can be formed on the front of the receiver assembly 102 to facilitate partial separation of the receiver assembly 102 from the backbone 103. The hook pivots 1791 can hook around and pivot about backbone studs 198 (FIG. 4A). The lower receiver or receiver assembly 102 can pivot downwardly approximately 40° from two backbone studs 198 while remaining pivotally attached to the backbone 103. The receiver assembly 102 can be detached from the backbone or backbone 103 when the receiver assembly 102 is pivoted down approximately 20° or halfway where a gap in the hook pivot 1791 allows the receiver assembly 102 to be lifted up and off the backbone studs 198. Alternatively, the receiver assembly 102 can use straight slots 119 (FIG. 4A).

The receiver assembly 102 can have an open bolt/closed bolt full auto/semi auto lower receiver sub-assembly 17101, a hammer link crosspin 17102, an open bolt arm 17103, an open bolt arm sear 17104, a hammer shaft assembly 17105, a hammer link assembly 17106, a hammer assembly 17107, a hammer shaft crosspin 17108, a sear crosspin 17109, a safety lever 17110, an SHCS 17111, an autosear trip lever 17112, an open bolt arm pin 17113, an open bolt/closed bolt-full auto/semi auto trigger block assembly 17114, a selector lever 17115, a closed bolt safety button assembly 17116, a take-down lever 17117, a selector cam assembly compression spring 17118, a selector cam assembly compression spring 17118, and a hammer mainspring 17119.

Figure 17C:
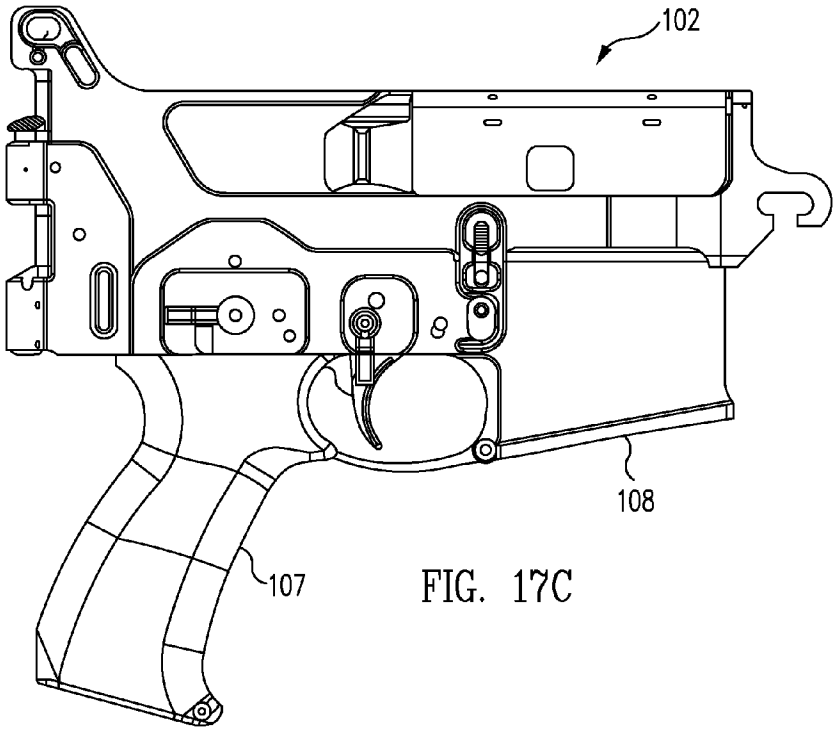
FIGS. 17C-17H are various elevational views of lower receiver assembly of the rifle/machine gun of FIG. 17A, according to an embodiment.
Figure 17E:
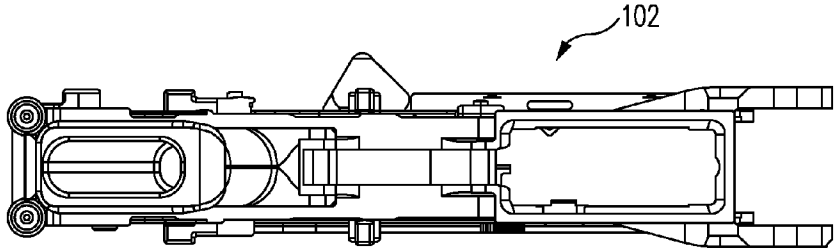
Figure 17D:
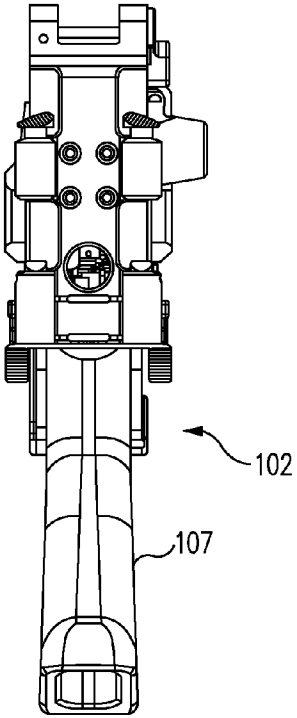
Figure 17H:
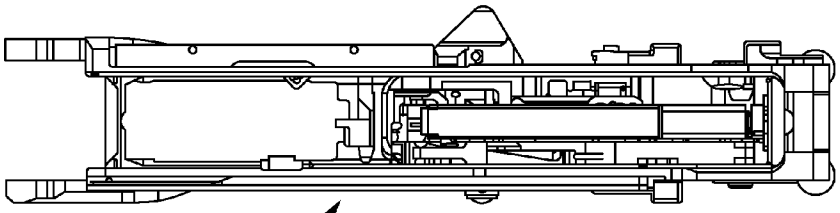
Figure 17F:
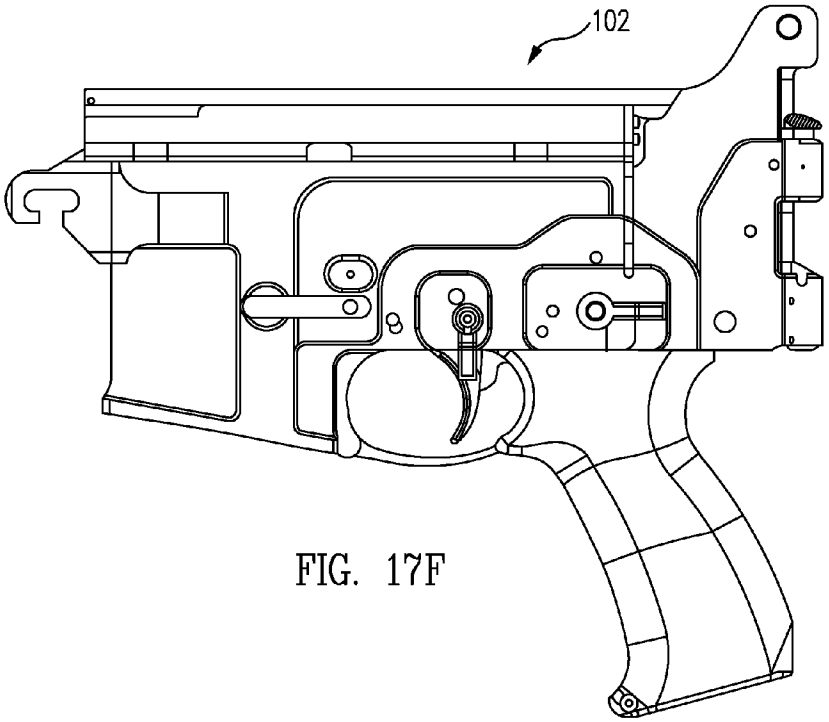
Figure 17G:
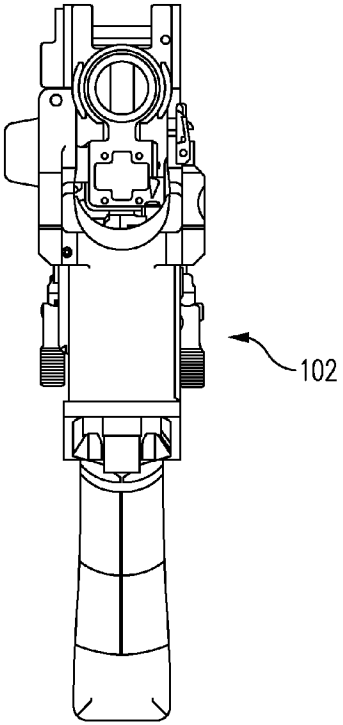
Figure 17I:
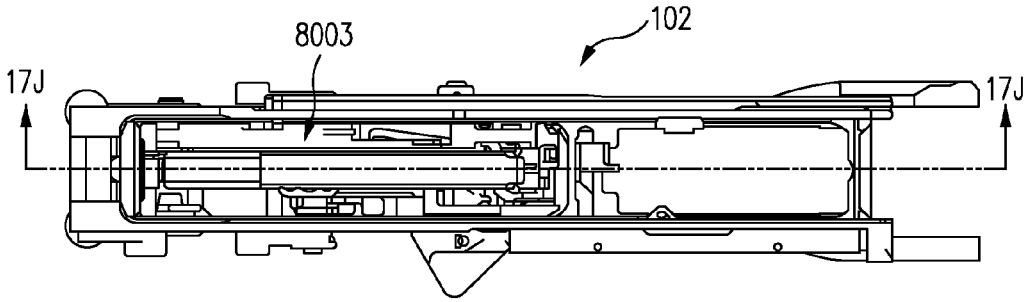
FIG. 17I is a top view of the rifle/machine gun of FIG. 17A having a section reference, according to an embodiment.
Figure 17J:
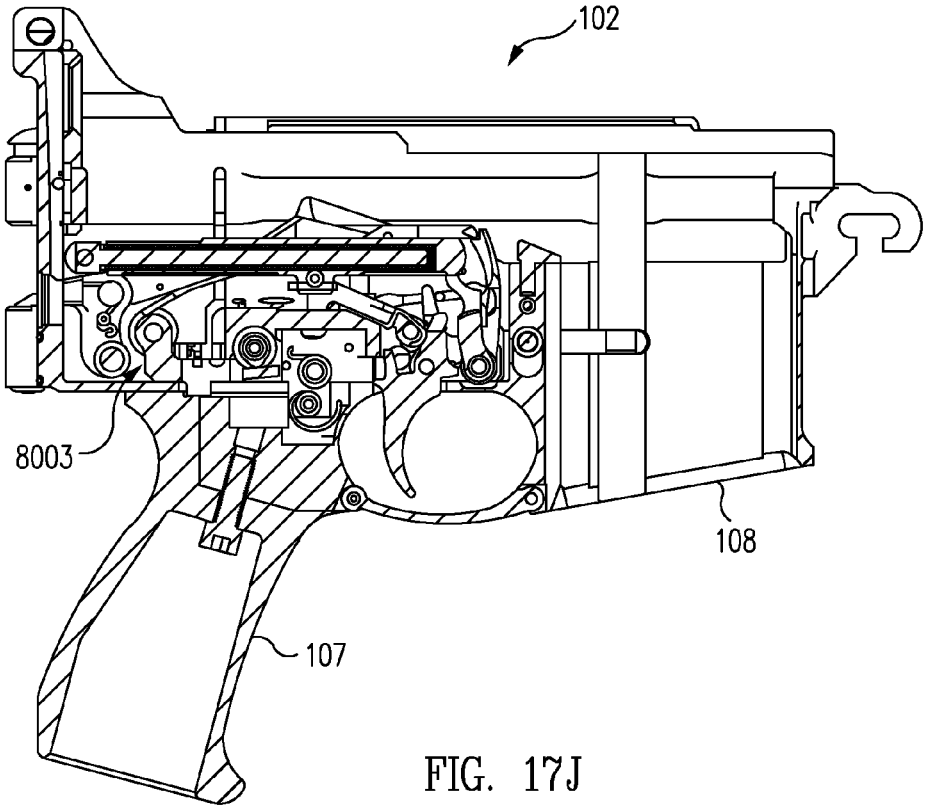
FIG. 17J is a cross-sectional side view taken along line 17J of FIG. 17I, according to an embodiment.
Figure 17K:
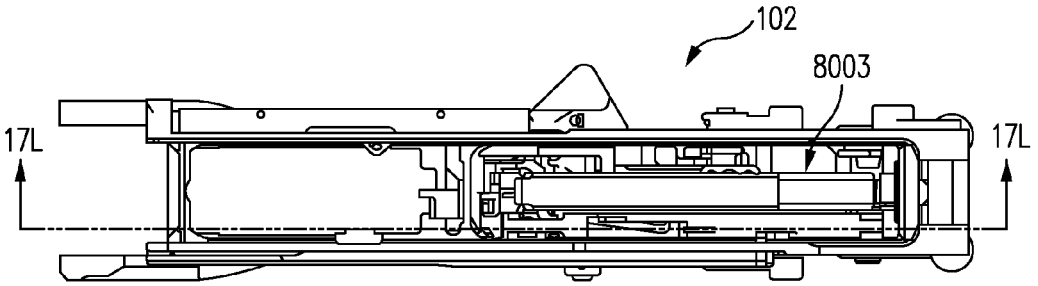
FIG. 17K is a top view of the rifle/machine gun of FIG. 17A having a section reference, according to an embodiment.
Figure 17L:
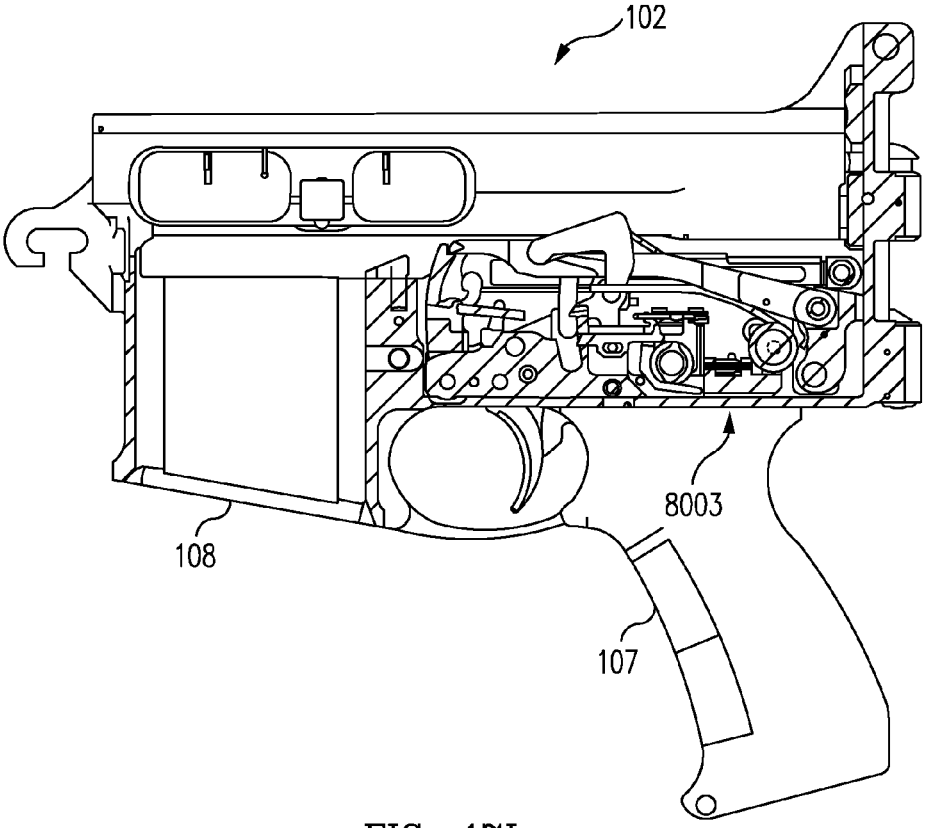
FIG. 17L is a cross-sectional side view taken along line 17L of FIG. 17K, according to an embodiment.

FIGS. 17C-17H are various elevational views of receiver assembly 102 of the rifle/machine gun 8000, according to an embodiment. FIG. 17C shows the right side of the receiver assembly 102. FIG. 17D shows the rear of the receiver assembly 102. FIG. 17E shows the bottom of the receiver assembly 102. FIG. 17F shows the left side of the receiver assembly 102. FIG. 17G shows the front of the receiver assembly 102. FIG. 17H shows the top of the receiver assembly 102.

FIGS. 17I-17L show the receiver assembly 102, according to an embodiment. The trigger block assembly 8003 is shown installed (dropped into) the receiver assembly 102.

Figure 18A:
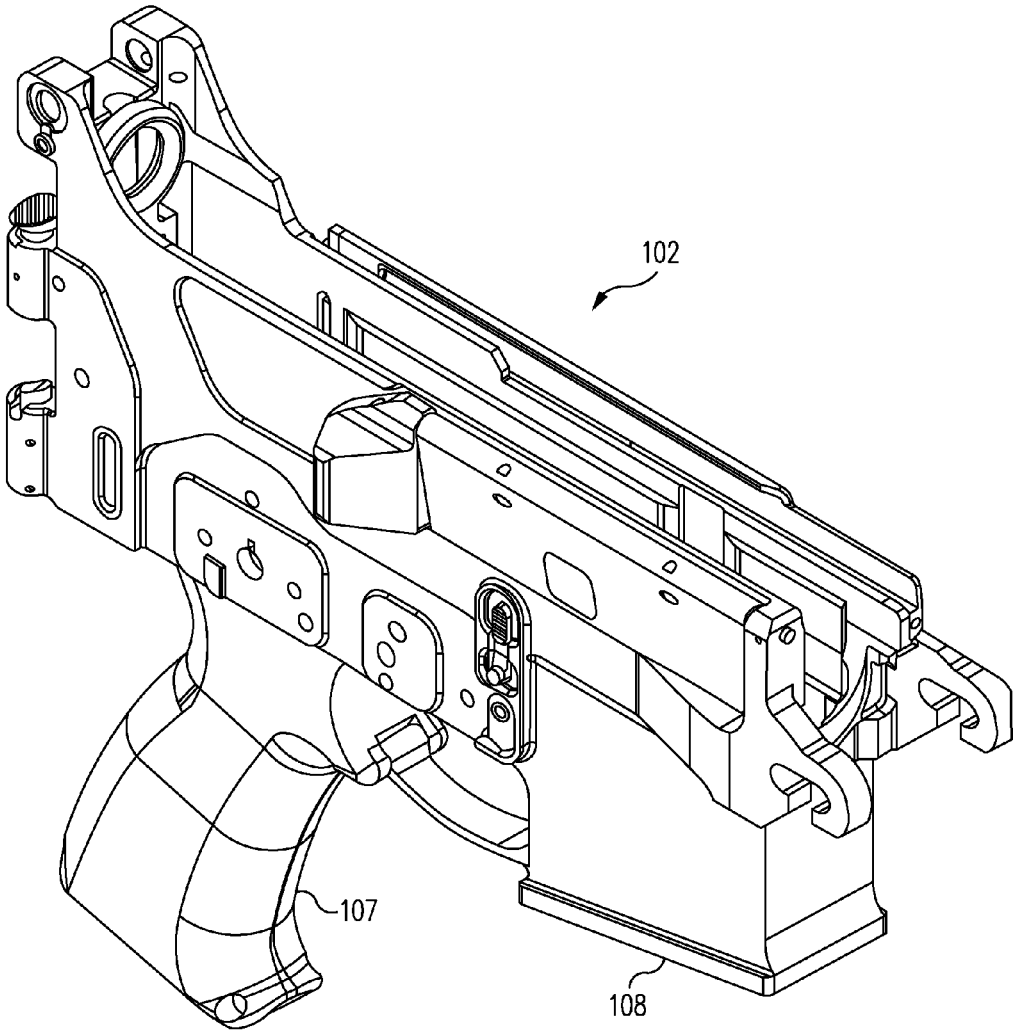
FIG. 18A is a perspective view of the lower receiver assembly of the rifle/machine gun of FIG. 16A, according to an embodiment.
Figure 18B:
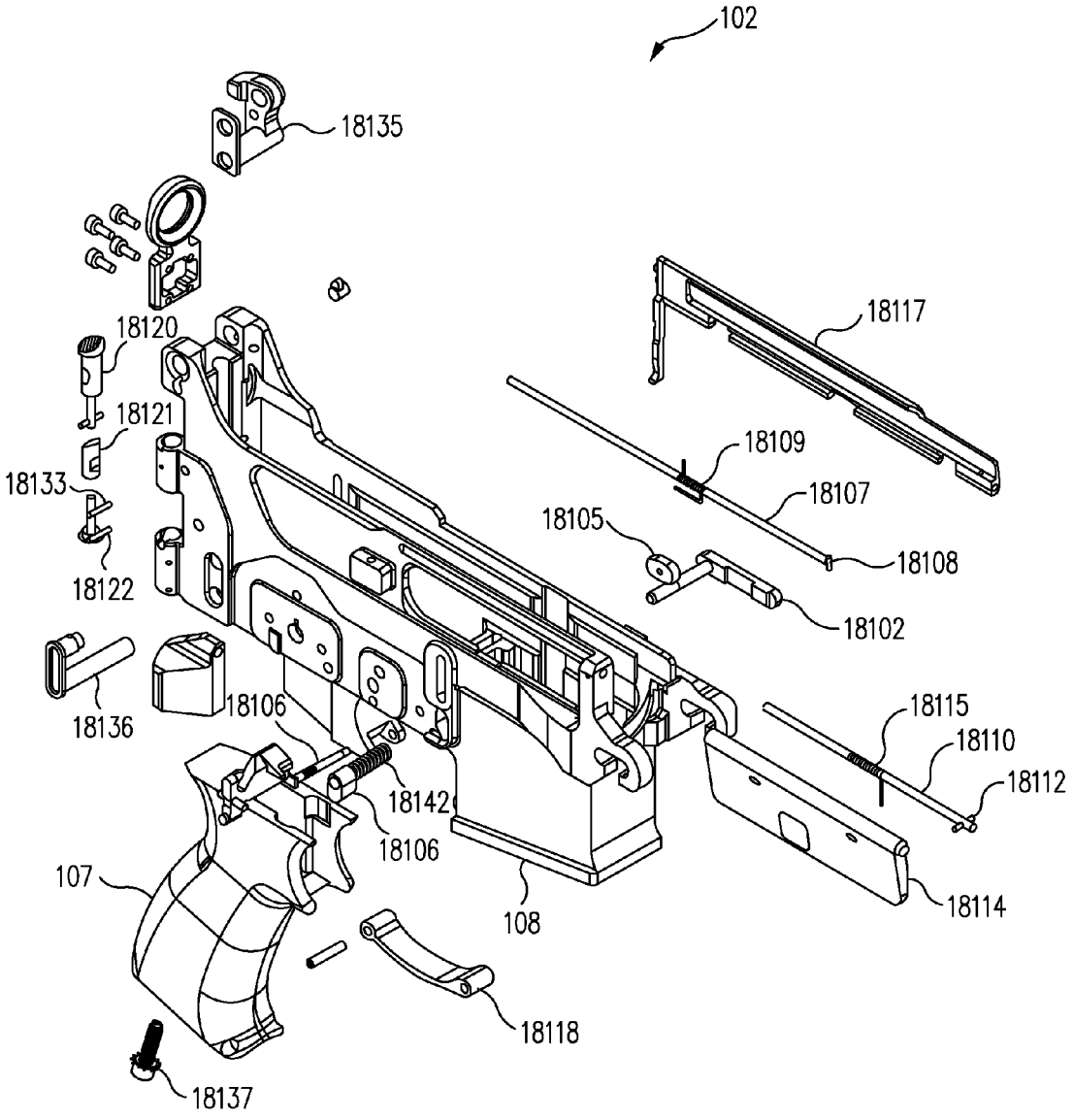
FIG. 18B is an exploded view of the lower receiver assembly of the rifle/machine gun of FIG. 16A, according to an embodiment.

FIGS. 18A and 18B are perspective views of the receiver assembly 102 of the rifle/machine gun 8000, according to an embodiment. The receiver assembly 102 has an open bolt/closed bolt full auto/semi auto lower receiver 18101, a magazine catch 18102, a bolt catch 18103, a magazine catch button 18104, a bolt catch release button 18105, a bolt catch release plunger 18106, a dust cover hinge pin 18107, a slotted roll pin 18108, a dust cover spring pin 18109, an eject port cover hinge pin 18110, an eject port cover lug 18111, a slotted roll pin 18112, a low height rivet 18113, an eject port cover assembly 18114, an ejection port cover torsion spring 18115, a hand grip 18116, a dust cover assembly 18117, a trigger guard 18118, an LH backbone retension stock pin 18119, an RH backbone retension stock pin 18120, a lower receiver retension stock pin 18121, a retension pin cap 18122, an autosear trip plunger 18123, a lock washer 18124, an autosear trip plunger guide spring 18125, a receiver latch retention pin 18126, an autosear trip plunger retainer screw 18127, a receiver latchpin detent 18128, a receiver latchpin 18129, a roll pin 18130, a spring 18131, a spring 18132, a roll pin 18133, a receiver latch compression spring 18134, an open bolt arm torsion damper assembly 18135, a torsion damper retainer 18136, an SHCS 18137, an autosear trip lever 18138, a trigger lock bar 18139, a trigger lock bar plunger 18140, a trigger lock compression spring 18141, and a magazine catch spring 18142.

Figure 18H:
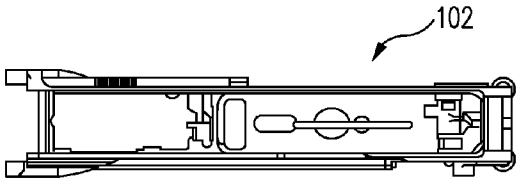
FIGS. 18C-18H are various elevational views of lower receiver assembly of the rifle/machine gun of FIG. 18A, according to an embodiment.
Figure 18F:
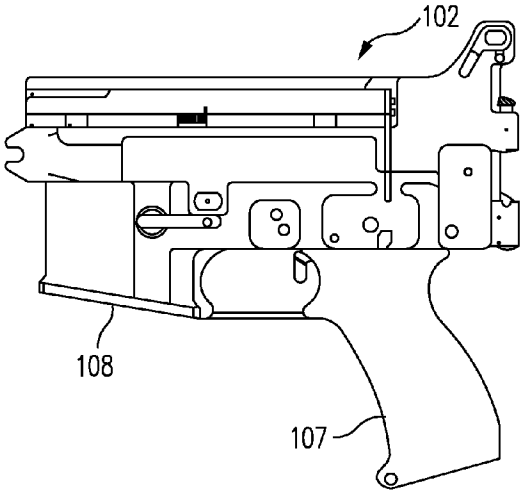
Figure 18G:
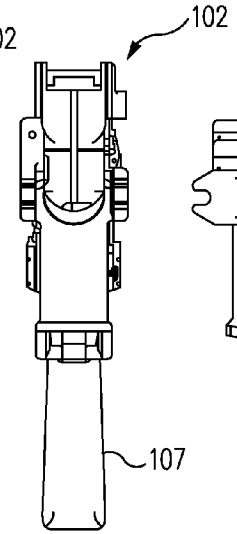
Figure 18C:
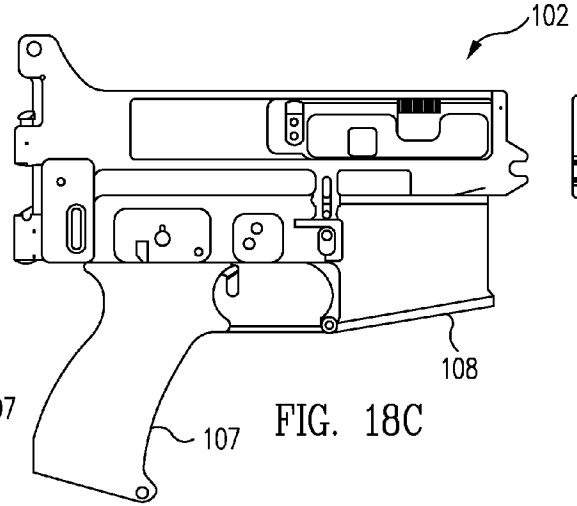
Figure 18D:
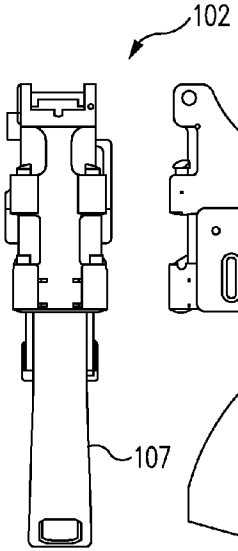
Figure 18E:
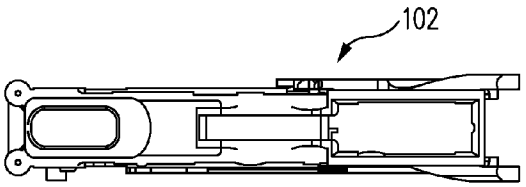
Figure 18I:
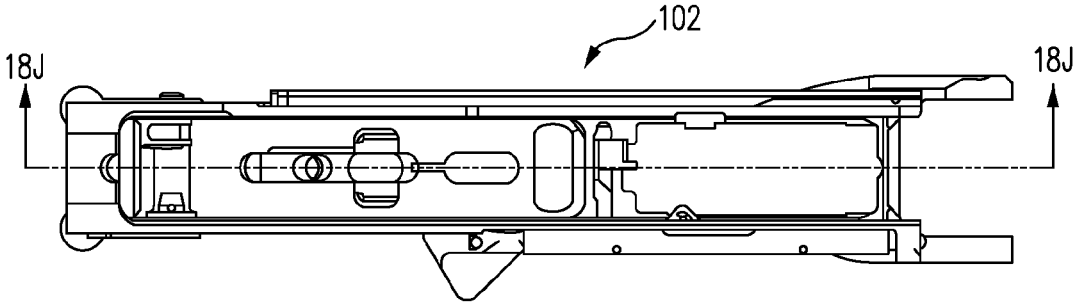
FIG. 18I is a top view of the rifle/machine gun of FIG. 18A having a section reference, according to an embodiment.
Figure 18J:
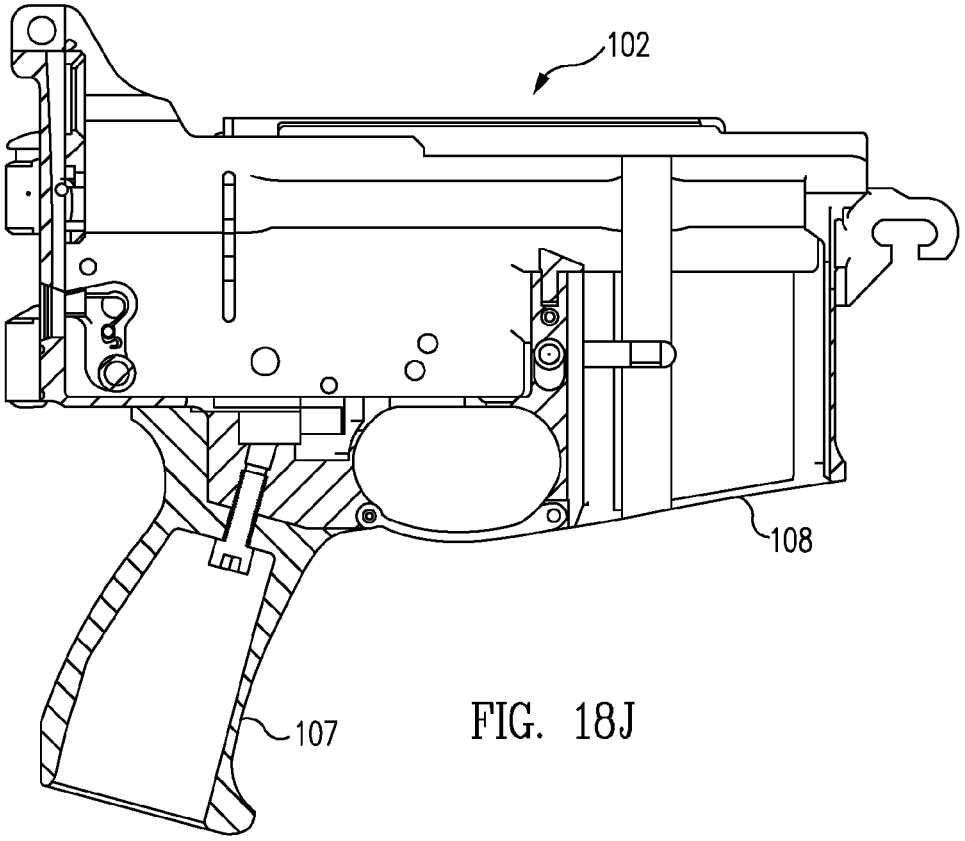
FIG. 18J is a cross-sectional side view taken along line 18J of FIG. 18I, according to an embodiment.
Figure 18K:
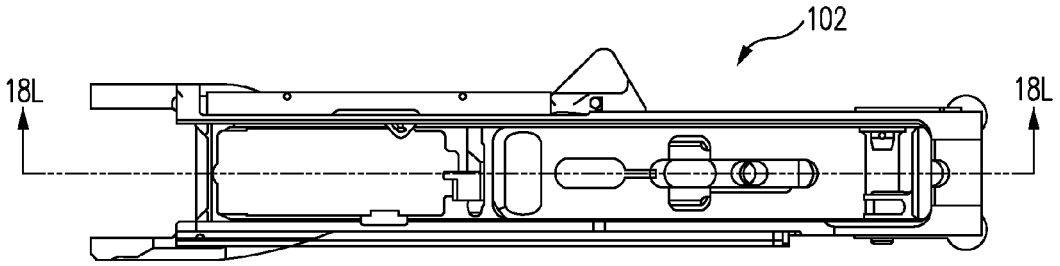
FIG. 18K is a top view of the rifle/machine gun of FIG. 18A having a section reference, according to an embodiment.
Figure 18L:
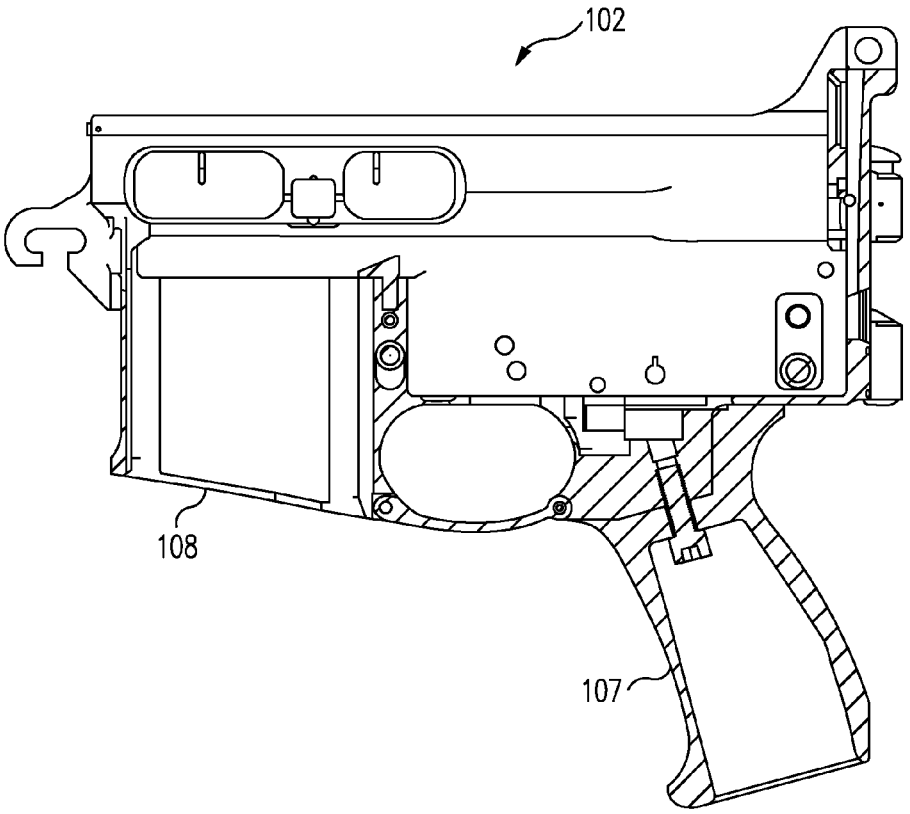
FIG. 18L is a cross-sectional side view taken along line 18L of FIG. 18K, according to an embodiment.
Figure 18M:
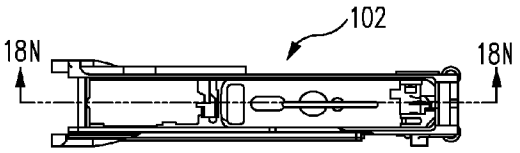
FIG. 18M is a top view of the rifle/machine gun of FIG. 18C having a section reference, according to an embodiment.
Figure 18N:
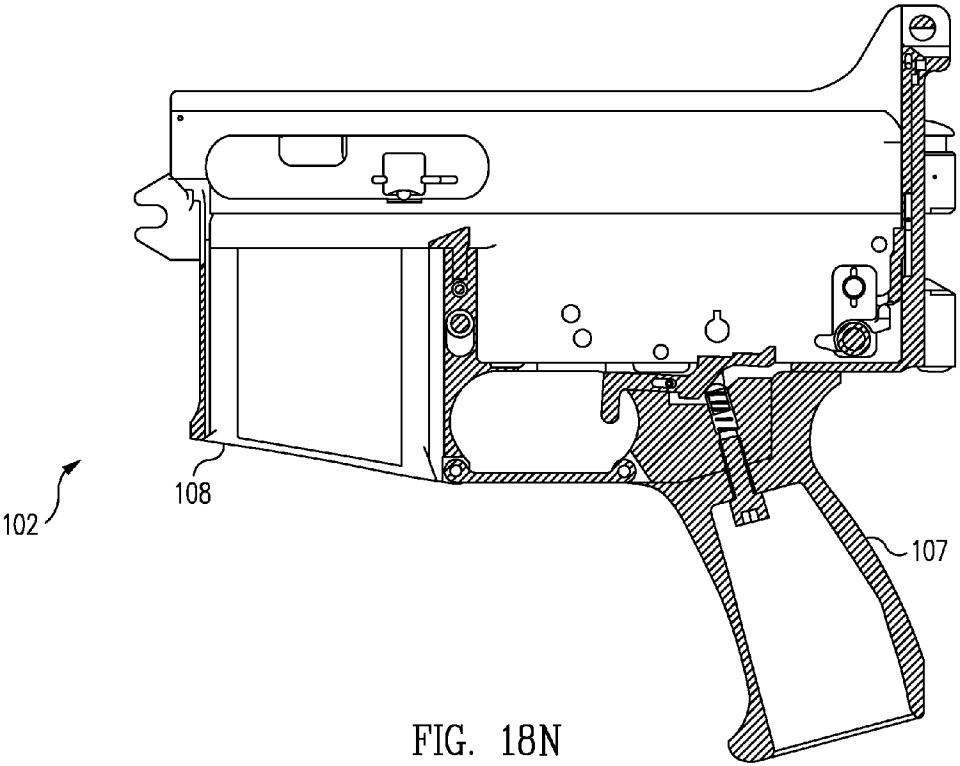
FIG. 18N is a cross-sectional side view taken along line 18N of FIG. 18M, according to an embodiment.
Figure 19A:
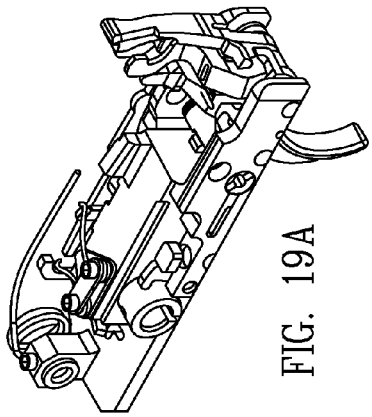
FIG. 19A is a perspective view of a trigger block assembly of the rifle/machine gun of FIG. 16A, according to an embodiment.
Figure 19B:
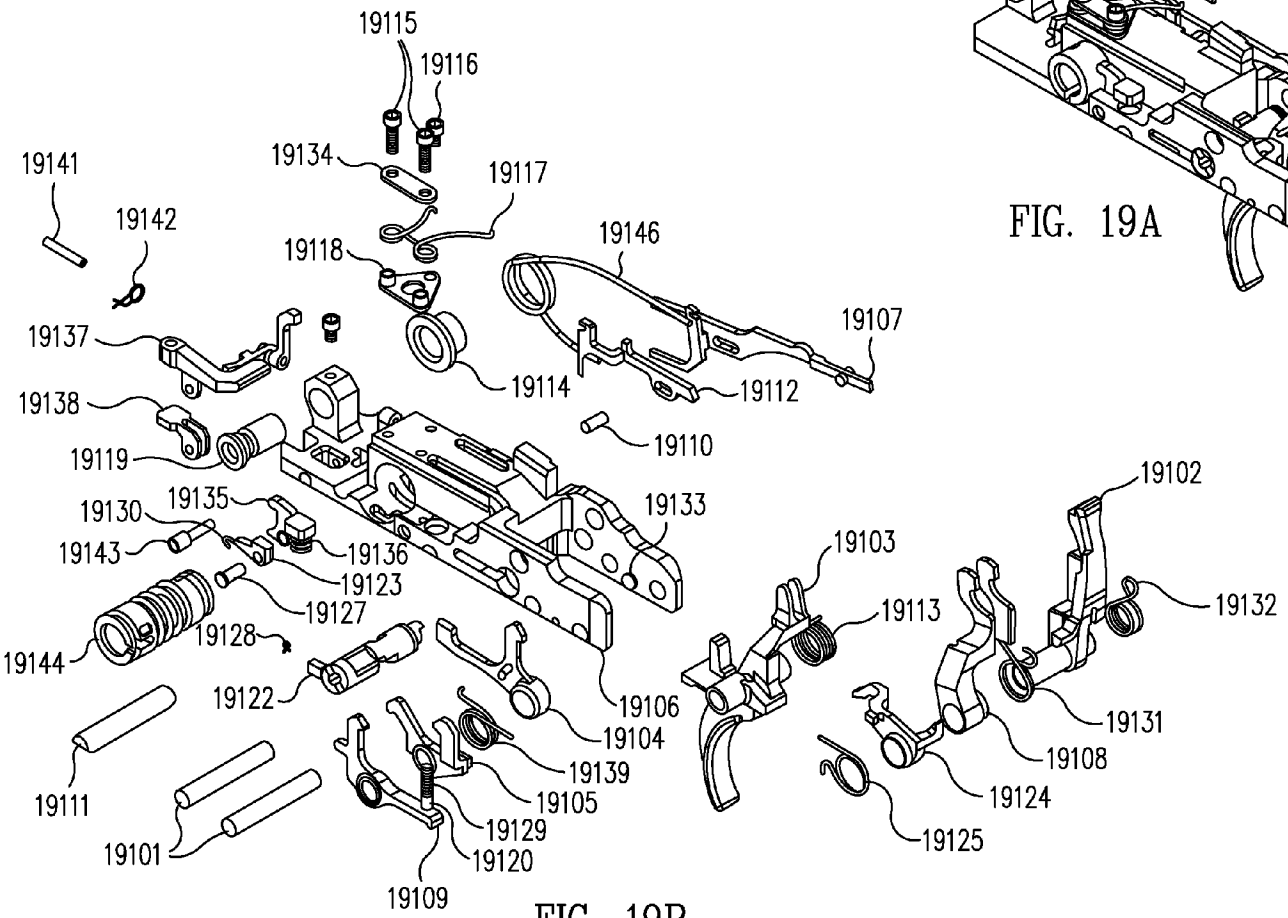
FIG. 19B is a perspective exploded view of the trigger block assembly of FIG. 19A, according to an embodiment.
Figure 19G:
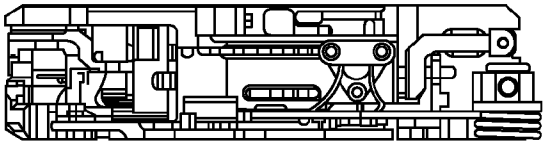
FIGS. 19C-19H are various elevational views of the trigger block assembly of FIG. 19A, according to an embodiment.
Figure 19H:
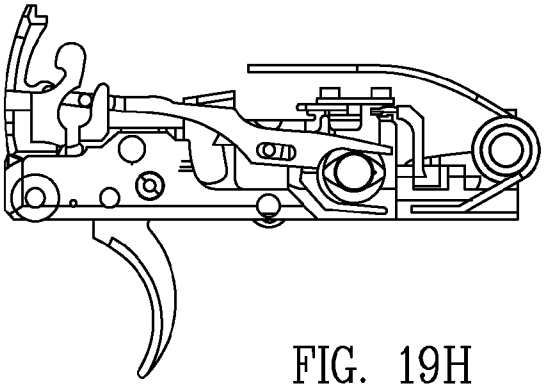
Figure 19F:
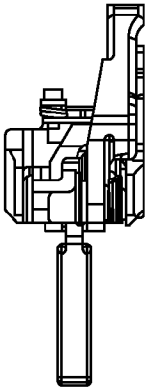
Figure 19D:
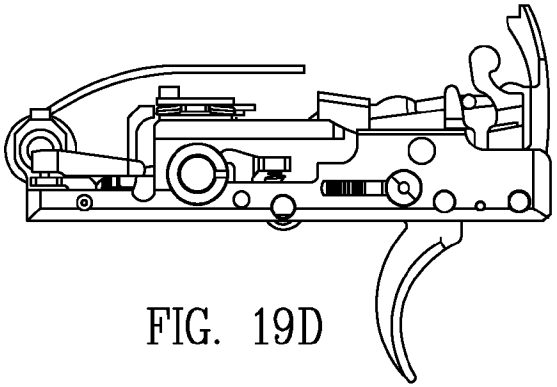
Figure 19E:
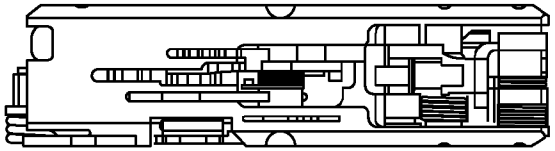
Figure 19C:
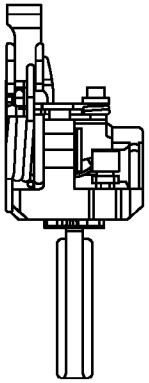
Figure 19I:
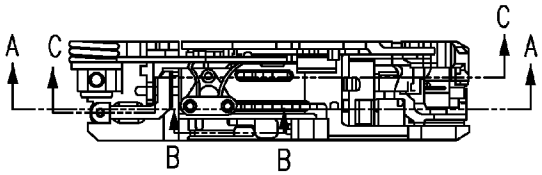
FIGS. 19I-19L are various elevational views of the trigger block assembly of FIG. 19A, according to an embodiment.
Figure 19J:
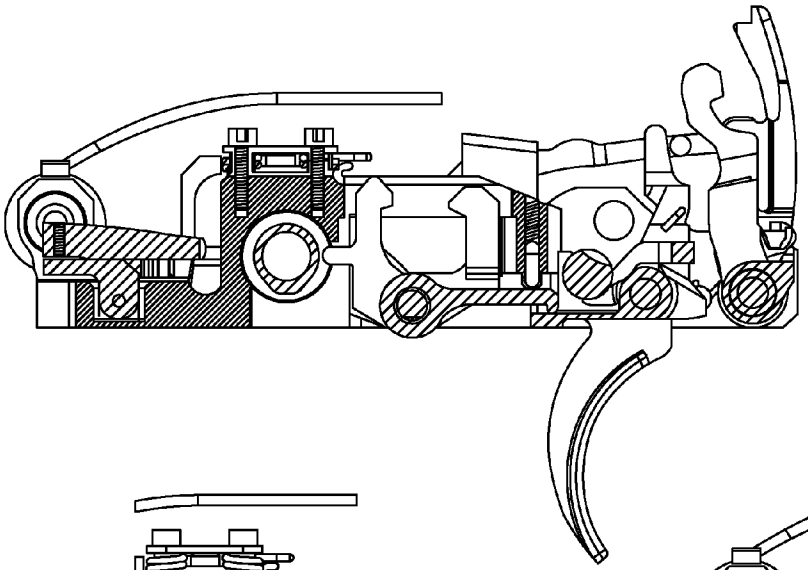
Figure 19L:
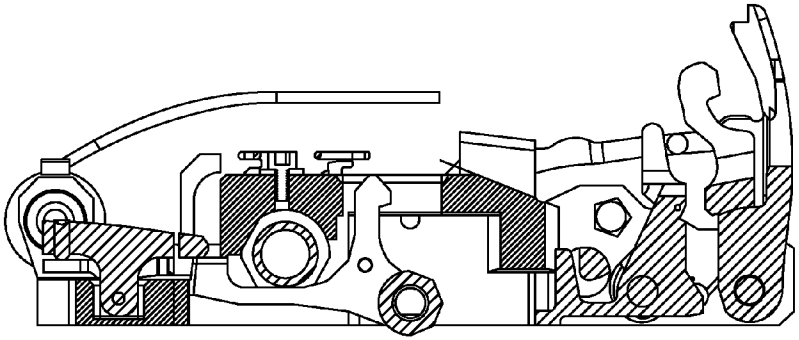
Figure 19K:
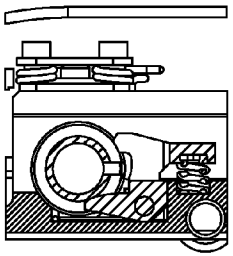

FIGS. 18C-18H are various elevational views of receiver assembly 102 of the rifle/machine gun 8000, according to an embodiment. FIG. 18C shows the right side of the receiver assembly 102. FIG. 18D shows the rear of the receiver assembly 102. FIG. 18E shows the bottom of the receiver assembly 102. FIG. 18F shows the left side of the receiver assembly 102. FIG. 18G shows the front of the receiver assembly 102. FIG. 18H shows the top of the receiver assembly 102.

FIGS. 18I-18N show the receiver assembly 102, according to an embodiment. The trigger block assembly 8003 is removed from the receiver 102.

FIGS. 19A-19I show the trigger block assembly 8003 of the rifle/machine gun 8000, according to an embodiment. The trigger block assembly 400 has 19A—an open bolt lever trigger pin 19101, an open bolt arm open bolt/closed bolt-full auto/semi auto, open bolt-full auto/semi auto release lever 19102, an open bolt full auto/semi auto open bolt/closed bolt full auto semi auto open bolt/closed bolt semi auto trigger 19103, an auto sear 19104, a closed bolt disconnector 19105, an open bolt/closed bolt full auto/semi auto trigger block 19106, an open bolt trigger bar 19107, an open bolt arm open bolt/closed bolt full auto auto/semi auto open bolt closed full auto semi auto open bolt/closed bolt semi auto disconnect 19108, a closed bolt sear 19109, a closed bolt catch trigger bar pin 19110, a closed bolt and auto sear bushing 19111, an open bolt arm open bolt catch 19112, a trigger spring 19113, an open bolt arm spring bushing 19114, an SHCS 19115, an SHCS 19116, a closed bolt catch trigger bar spring 19117, a trigger bar spring plate 19118, an open bolt arm spring pin 19119, a closed bolt sear spring plunger 19120, a safety cylinder 19121, a safety cylinder detent 19122, a closed bolt selector safety pawl 19123, an open bolt arm lever safety 19124, an open bolt lever safety spring 19125, an SHCS 19128, a selector detent pin 19129, a safety cylinder detent spring 19128, a closed bolt sear spring 19129, a closed bolt selector safety pawl spring 19130, a closed bolt arm disconnector spring 19131, an open bolt release lever spring 19132, a torsion damper retainer spring 19133, a spring plate cap 19134, a selector detent 19135, a selector detent spring 19136, an autosear trip lever assembly 19137, an autosear trip lever support 19138, a closed bolt disconnector autosear spring 19139, a trigger block gate 19140, a roll pin 19141, a trigger lock out spring 19142, an open bolt/closed bolt full auto semi auto selector cam 19144, a trigger block retension spring pin 19145, and an open bolt arm spring 19146.

Figure 20:
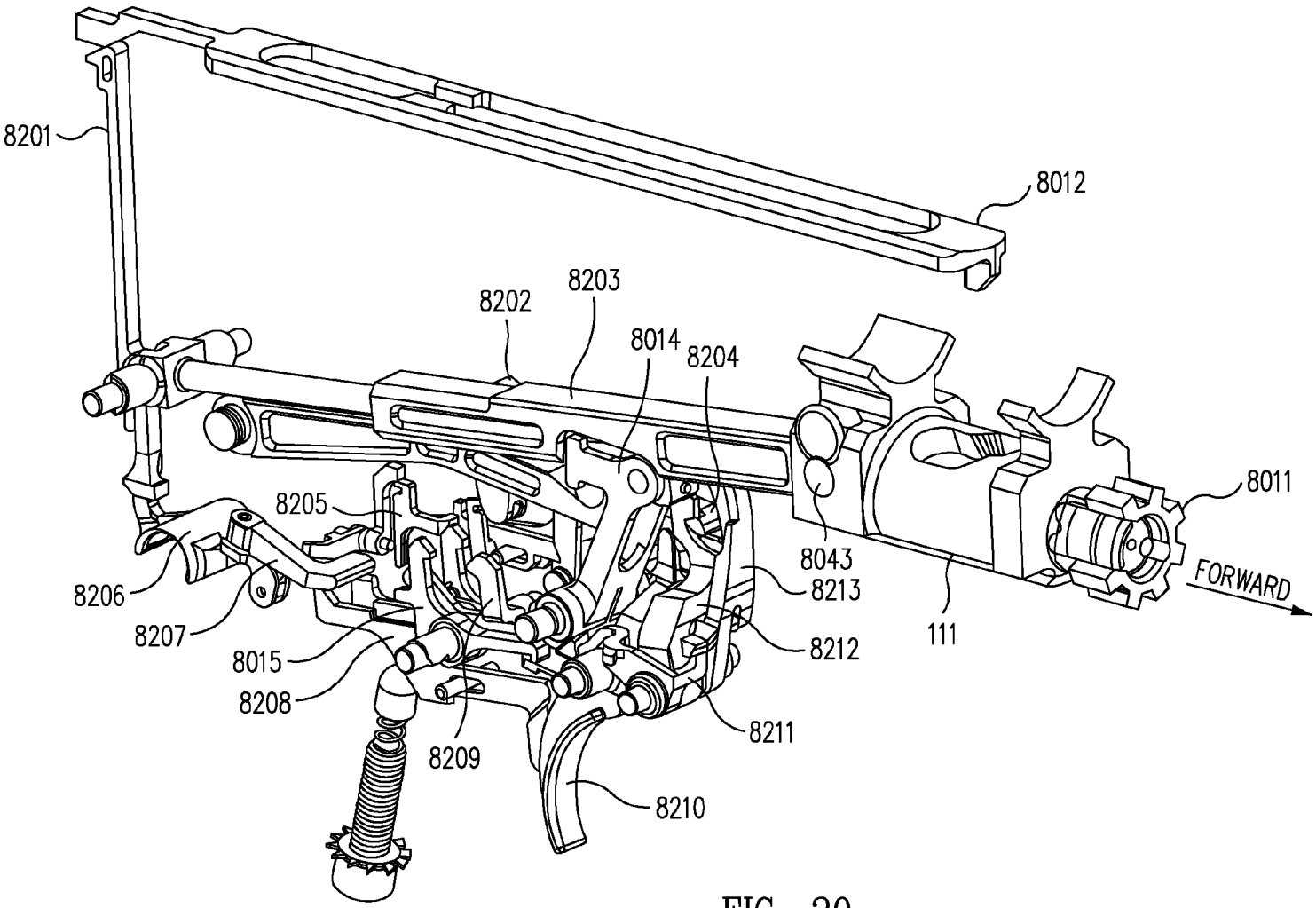
FIG. 20 is a perspective view showing components of the rifle/machine gun of FIG. 16A in a closed bolt firing configuration, according to an embodiment.
Figure 21B:
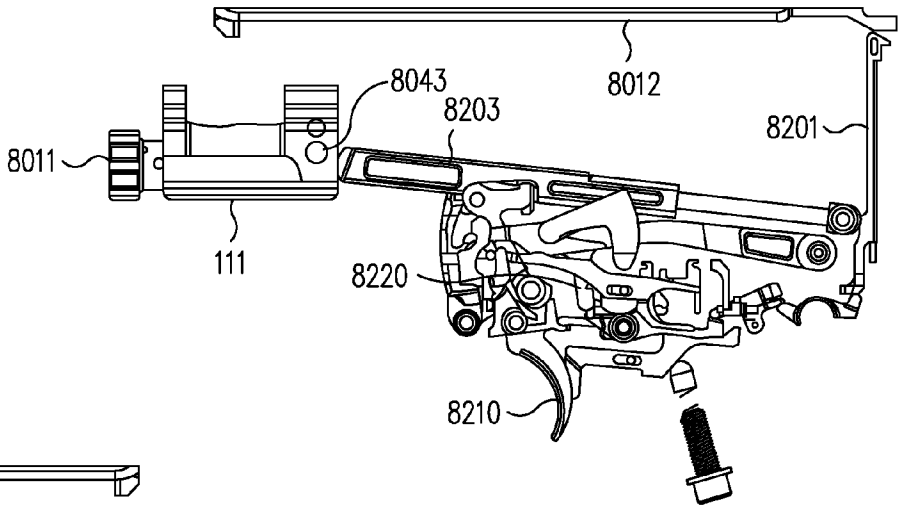
FIG. 21B is a perspective view showing components of the rifle/machine gun of FIG. 16A wherein a tip of a closed bolt, open bolt arm catch captures an open bolt arm notch, according to an embodiment.

FIGS. 20-21B show components of the rifle/machine gun 8000 in a closed bolt firing configuration, according to an embodiment. The rifle/machine gun 8000 has an autosear trip bar 8012, an autosear trip plunger 8201, an open bolt sear 8202, a hammer 8203, an open bolt arm 8204, a closed bolt open bolt arm catch 8205, an autosear reversing lever 8206, an autosear trip lever 8207, a closed bolt sear 8015, a hammer link 8014, a trigger lock bar 8208, a closed bolt disconnector 8209, a trigger 8210, an open bolt are release lever safety lock 8211, an open bolt disconnector 8212, an open bolt release lever 8213, and a bolt carrier 111.

The bolt 8011 is closed and locked. The autosear trip bar 8012 is pulled forward by the bolt carrier 111 and an autosear 8013 (see FIG. 26) has been tripped. A hammer link 8014 is release by a closed bolt sear 8015. The trigger charge handle lock-out mechanism 800 (see FIG. 8) is disengaged. The open bolt arm catch 8205 is deployed and the open bolt arm 8204 is caught in a downward location. The trigger 8210 is pulled and the hammer 8203 is release so that the rifle/machine gun 8000 fires.

Figure 21A:
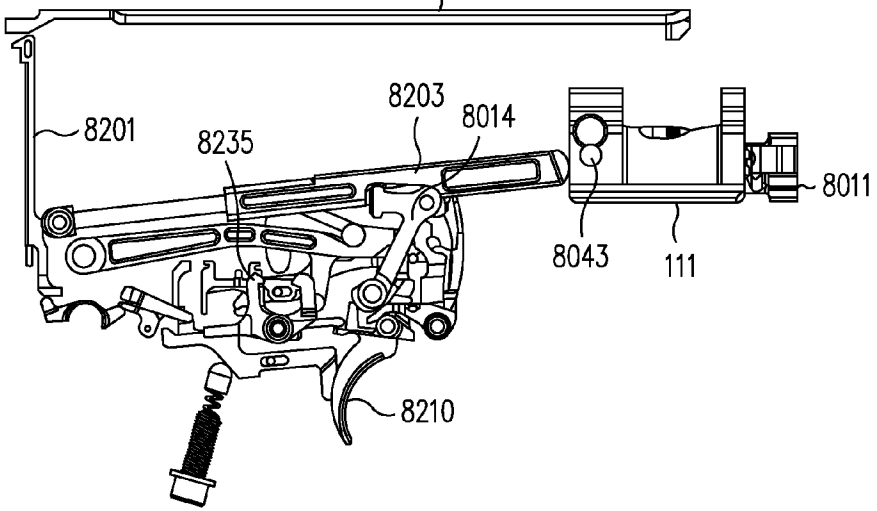
FIG. 21A is a perspective view showing components of the rifle/machine gun of FIG. 16A wherein a hammer link has released a closed bolt sear hook to allow the lamer link to move, according to an embodiment.

With particular reference to FIG. 21A, the hammer link 8014 has been released by the close bolt sear hook 8235 allowing the hammer link 8014 to move. With particular reference to FIG. 21B, a tip of the close bolt open bolt arm catch 8205 captures the open bolt arm notch 8220.

A firing pin retaining pin 8043 maintains the firing pin 8044 within the bolt 8011 and the bolt carrier 111. The firing pin retaining pin 8043 can also transfer forward movement of the bolt carrier to firing pin 8044 to fire the machine gun 8000 such as during slam firing thereof.

Figure 22:
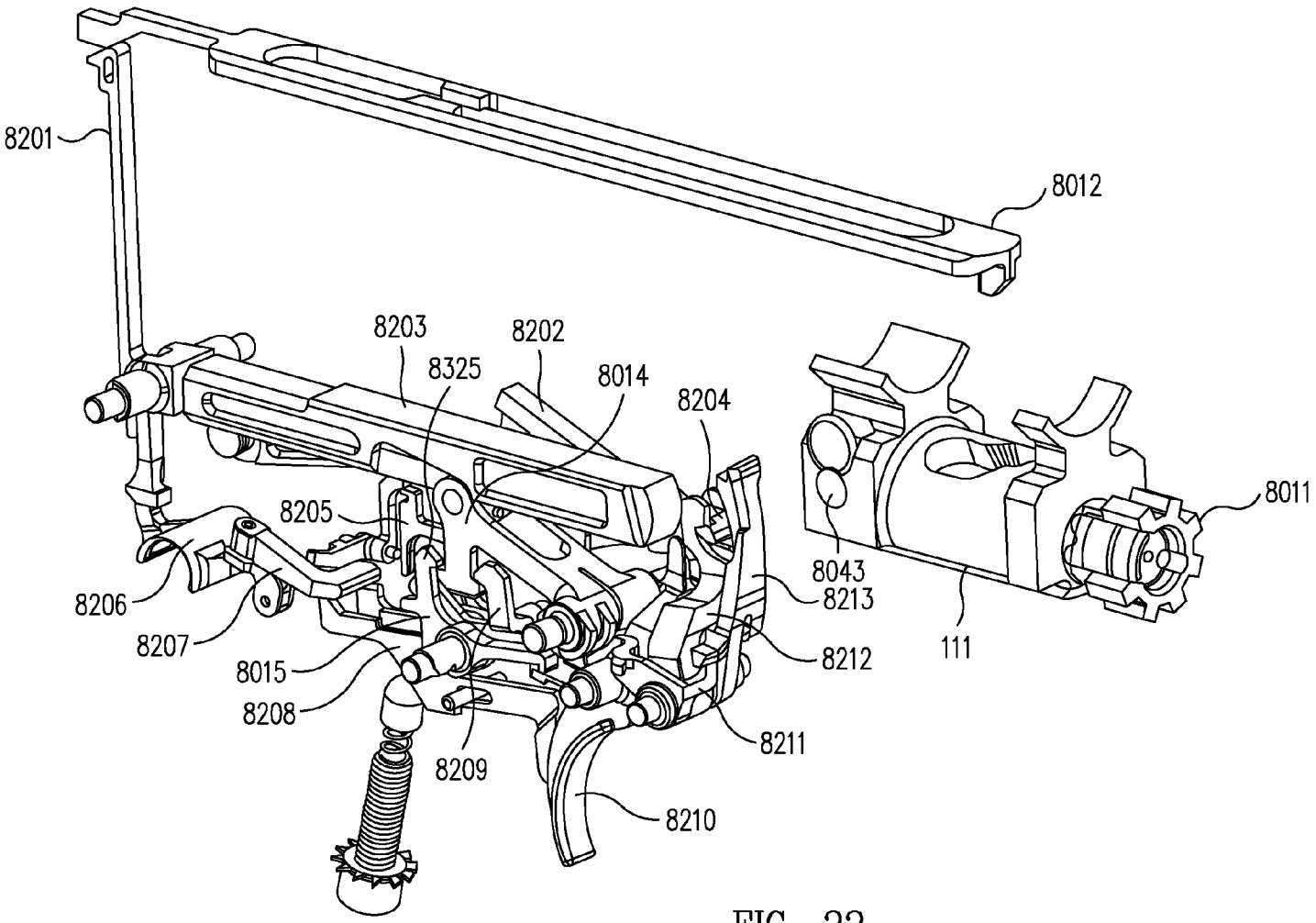
FIG. 22 is a perspective view showing components of the rifle/machine gun of FIG. 16A in a closed bolt firing configuration, according to an embodiment.
Figure 23B:
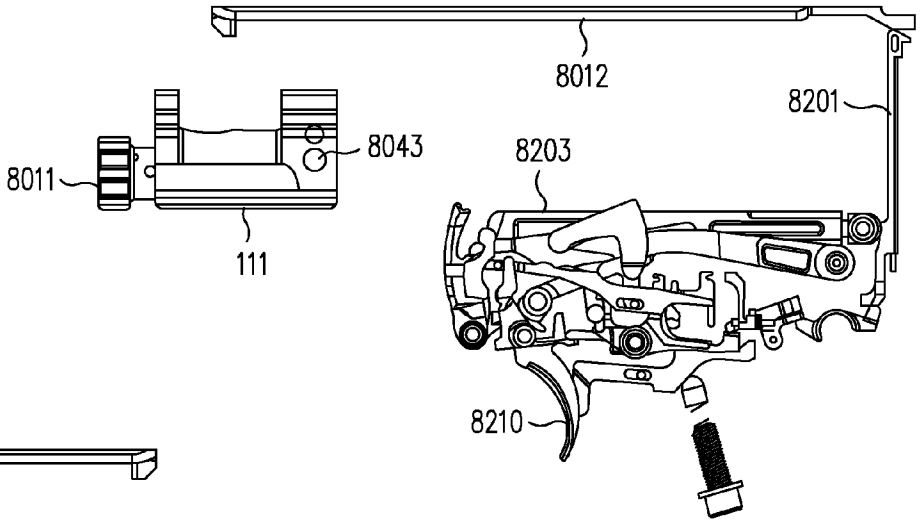
FIG. 23B is a perspective view showing components of the rifle/machine gun wherein a tip of a closed bolt, open bolt arm catch captures an open bolt arm notch, according to an embodiment.

FIGS. 22-23B shows components of the rifle/machine gun 8000 in a closed bolt firing configuration, according to an embodiment. The bolt 8011 is closed and locked. The autosear trip bar 8012 is pulled forward by the bolt carrier 111. The autosear 8013 is tripped. The hammer link 8014 has been released by the closed bolt sear 8015. The trigger charge handle lock-out mechanism 800 (see FIG. 8) is disengaged. The open bolt arm catch 8205 is deployed and the open bolt arm 8204 is caught in a downward location. The trigger 8210 is pulled.

Figure 23A:
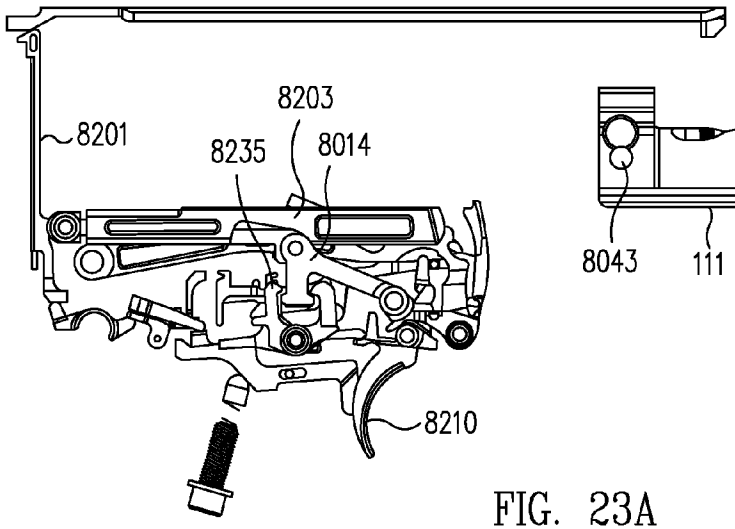
FIG. 23A is a perspective view showing components of the rifle/machine gun of FIG. 16A wherein a hammer link has released a closed bolt sear hook to allow the hammer link to move, according to an embodiment.

With particular reference to FIG. 23A, the hammer link 8014 has released the close bolt sear hook 8235 allowing the hammer link 8014 to move. With particular reference to FIG. 21B, a tip of the close bolt open bolt arm catch 8205 captures the open bolt arm notch 8220.

Figure 24:
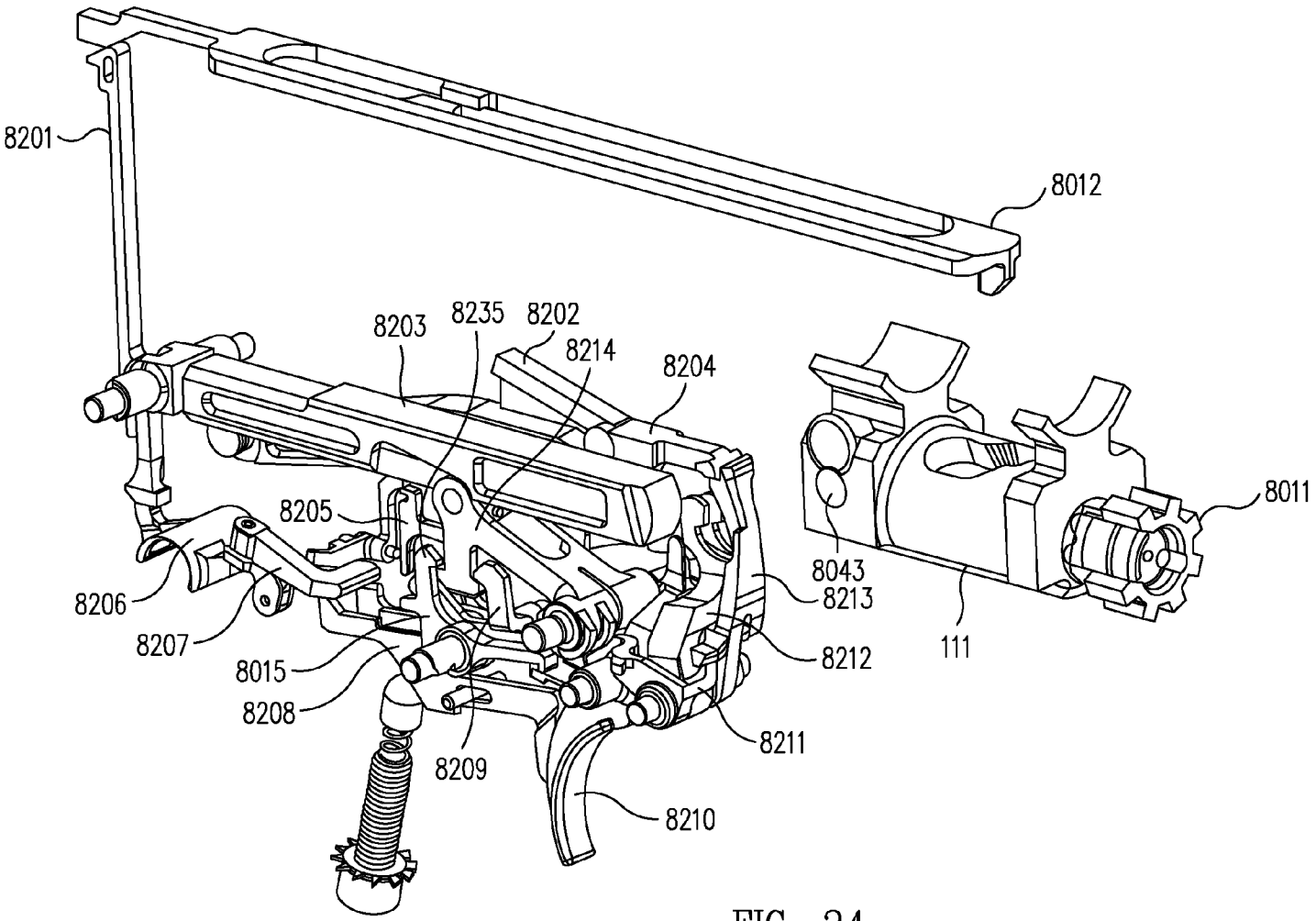
FIG. 24 is a perspective view showing components of the rifle/machine gun of FIG. 16A in a closed bolt firing configuration, according to an embodiment.
Figure 25B:
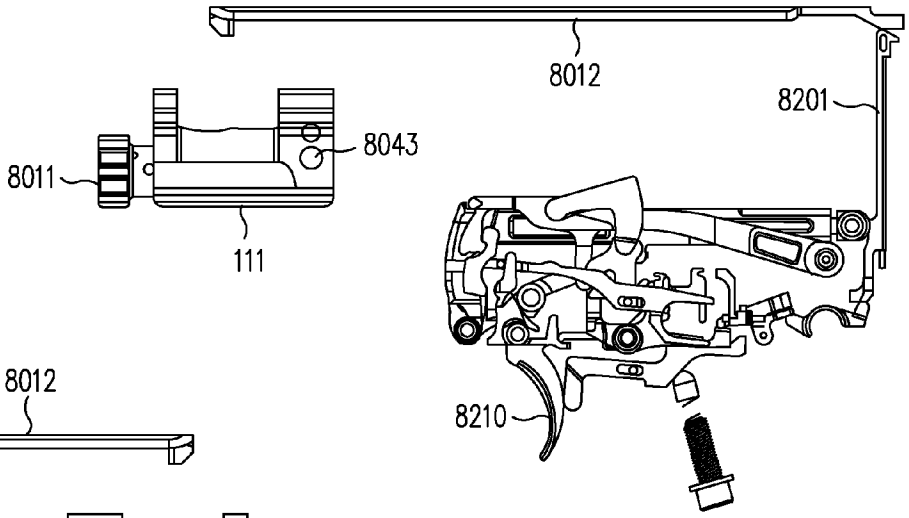
FIGS. 25A and 25B are perspective views showing components of the rifle/machine gun of FIG. 16A wherein a hammer link is held closed by a closed bolt sear hook, according to an embodiment.

FIGS. 24-25B shows components of the rifle/machine gun 8000 in a closed bolt firing configuration, according to an embodiment. The bolt 8011 is closed and locked. The autosear trip bar 8012 is pulled forward by the bolt carrier 111. The autosear 8013 is tripped. The hammer link 8014 is held by the closed bolt sear 8015. The trigger charge handle lock-out mechanism 800 (see FIG. 8) is disengaged. The open bolt arm catch 8205 is deployed and the trigger 8210 is not pulled.

Figure 25A:
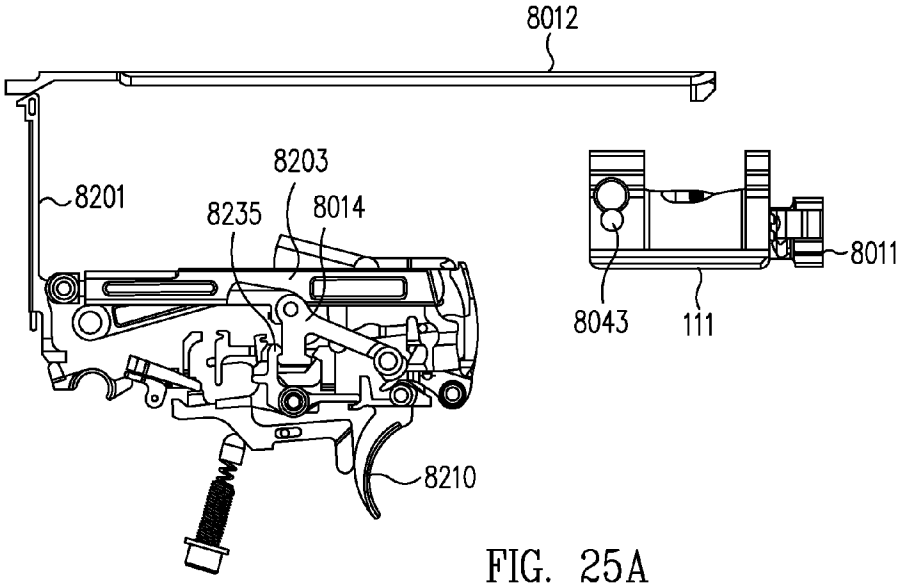

With particular reference to FIG. 25A, the hammer link 8014 is held by the closed bolt sear hook 8235.

Figure 26:
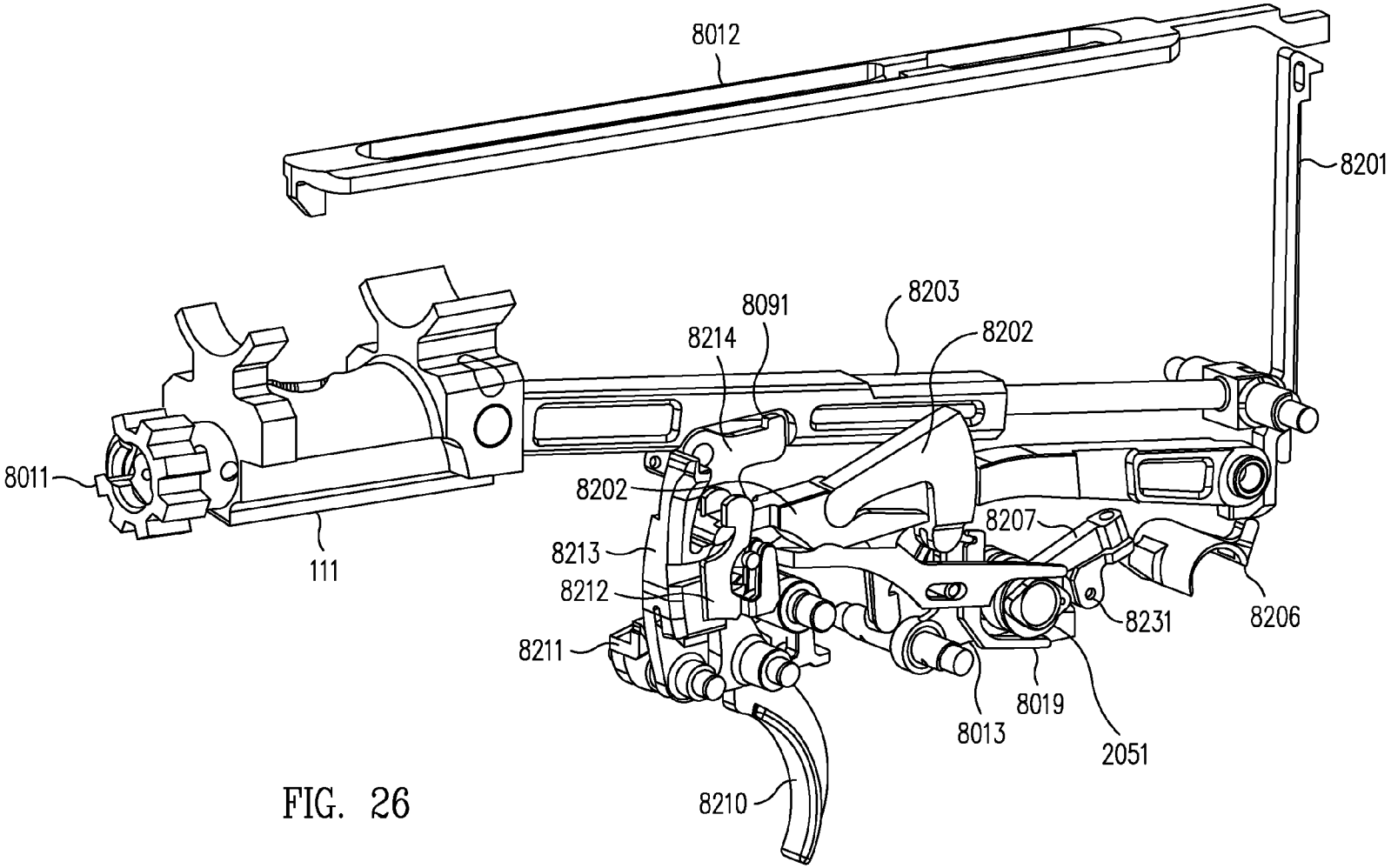
FIG. 26 is a perspective view showing an open bolt firing mechanism of the rifle/machine gun of FIG. 16A in a fired condition with the bolt locked and the autosear tripped, according to an embodiment.
Figure 27B:
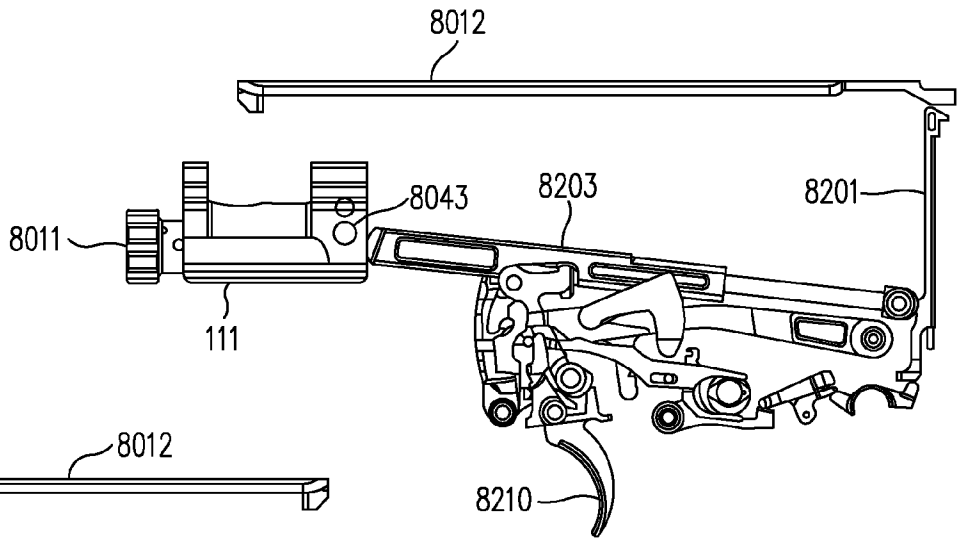
FIGS. 27A and 27B are side views showing the open bolt firing mechanism of FIG. 26, according to an embodiment.
Figure 27A:
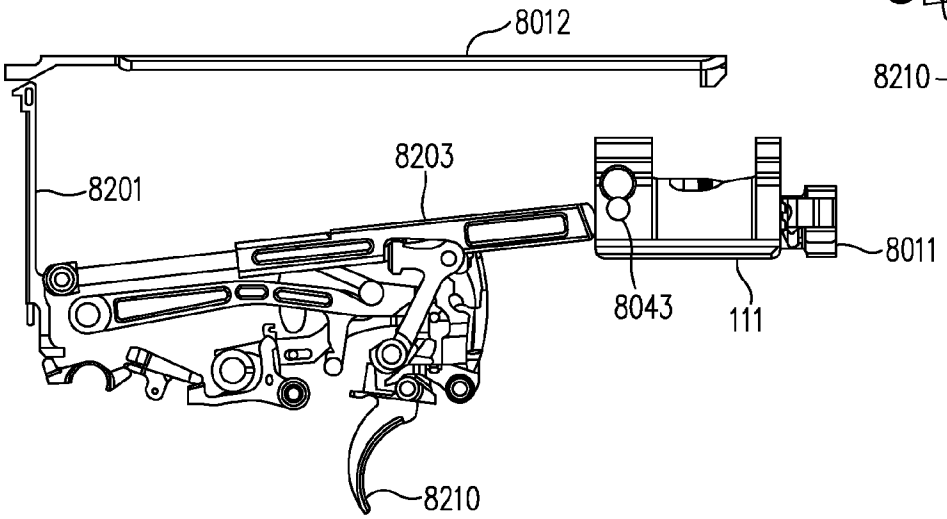

FIGS. 26-27B show the open bolt firing mechanism of the rifle/machine gun 8000 in a fired condition with the bolt 8011 locked and the autosear 8013 tripped, according to an embodiment. The autosear trip bar 8012 is pulled forward by the bolt carrier 111. The open bolt arm 8202 is moved down by spring pressure from the bolt carrier 111 and is held down until the trigger 8210 is released. The hammer 8203 is allowed to move forward by the hammer link 8014. The autosear trip plunger 8201 is rammed downward by the autosear trip bar 8012. The autosear trip lever 8207 and support 8213 are rotated by the reversing lever 8206. The autosear 8013 is tripped by the trip lever 8207 releasing the hammer link hook 8091. The open bolt release lever 8213 is pushed forward by the trigger bar 8019 to release the open bolt arm 8202.

Figure 28:
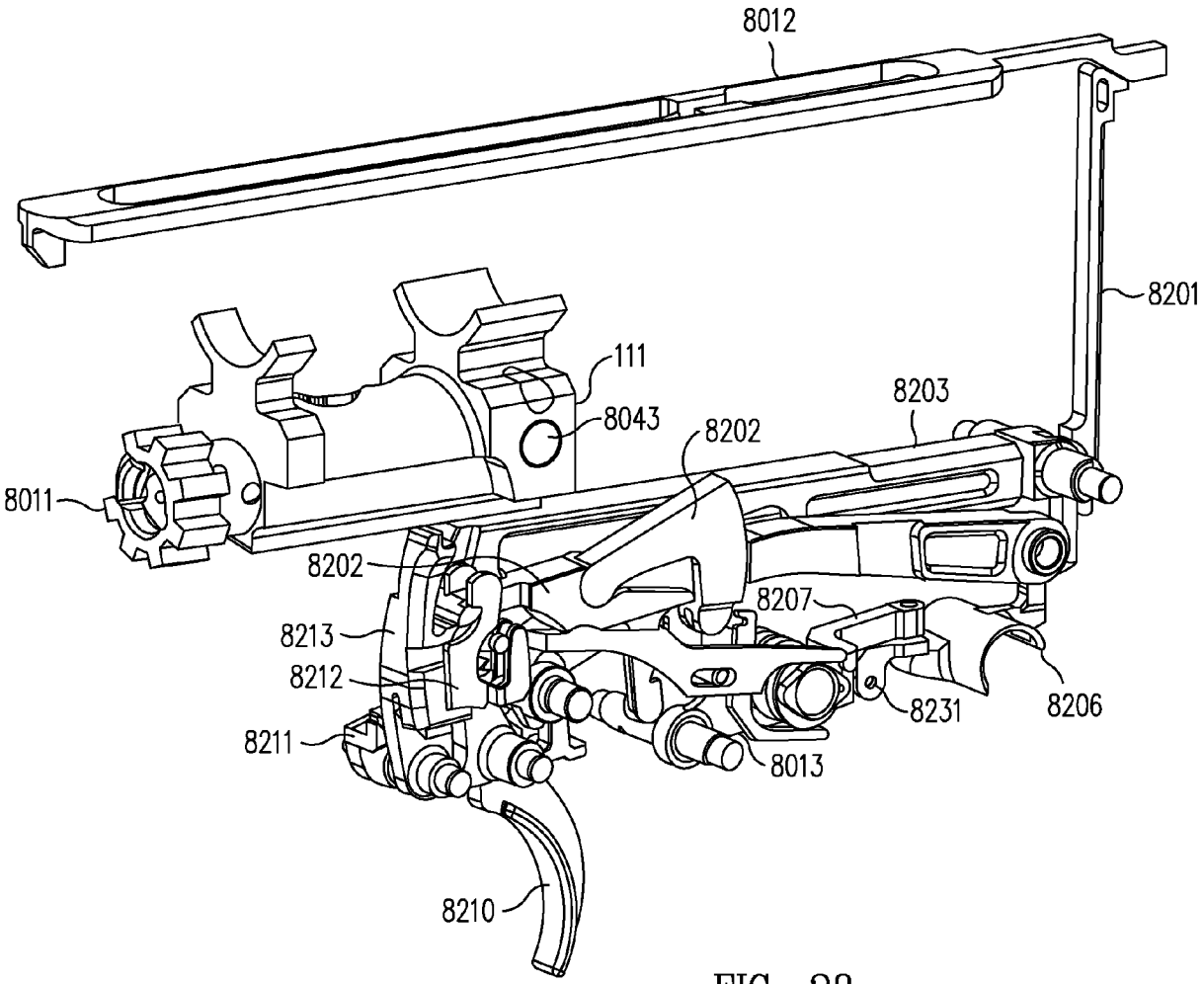
FIG. 28 is a perspective view showing an open bolt firing mechanism of the rifle/machine gun of FIG. 16A in a firing condition with the bolt unlocked, according to an embodiment.
Figure 29B:
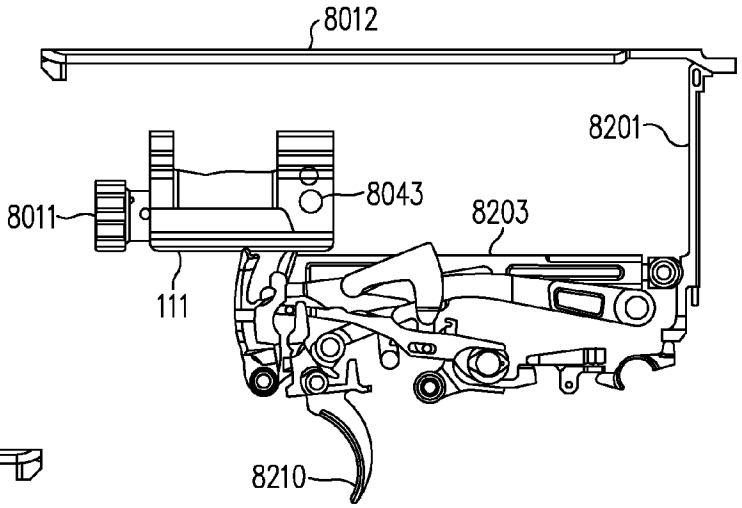
FIGS. 29A and 29B are side views showing the open bolt firing mechanism of FIG. 28, according to an embodiment.
Figure 29A:
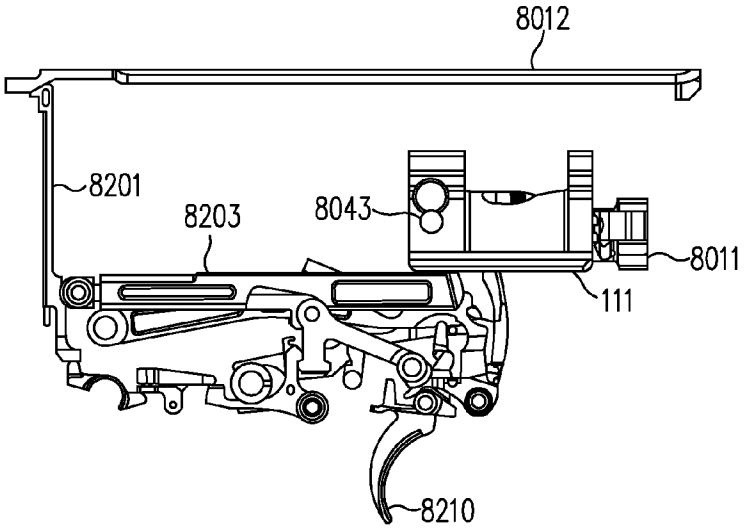

FIGS. 28-29B show an open bolt firing mechanism of the rifle/machine gun 8000 in a firing condition with the bolt 8011 unlocked, according to an embodiment. The open bolt arm 8202 is moved down by spring pressure from the bolt carrier 111 and is held down until the trigger 8210 is released. The open bolt release lever 8213 is pushed forward by the trigger bar 8019 to release the open bolt arm 8202.

Figure 30:
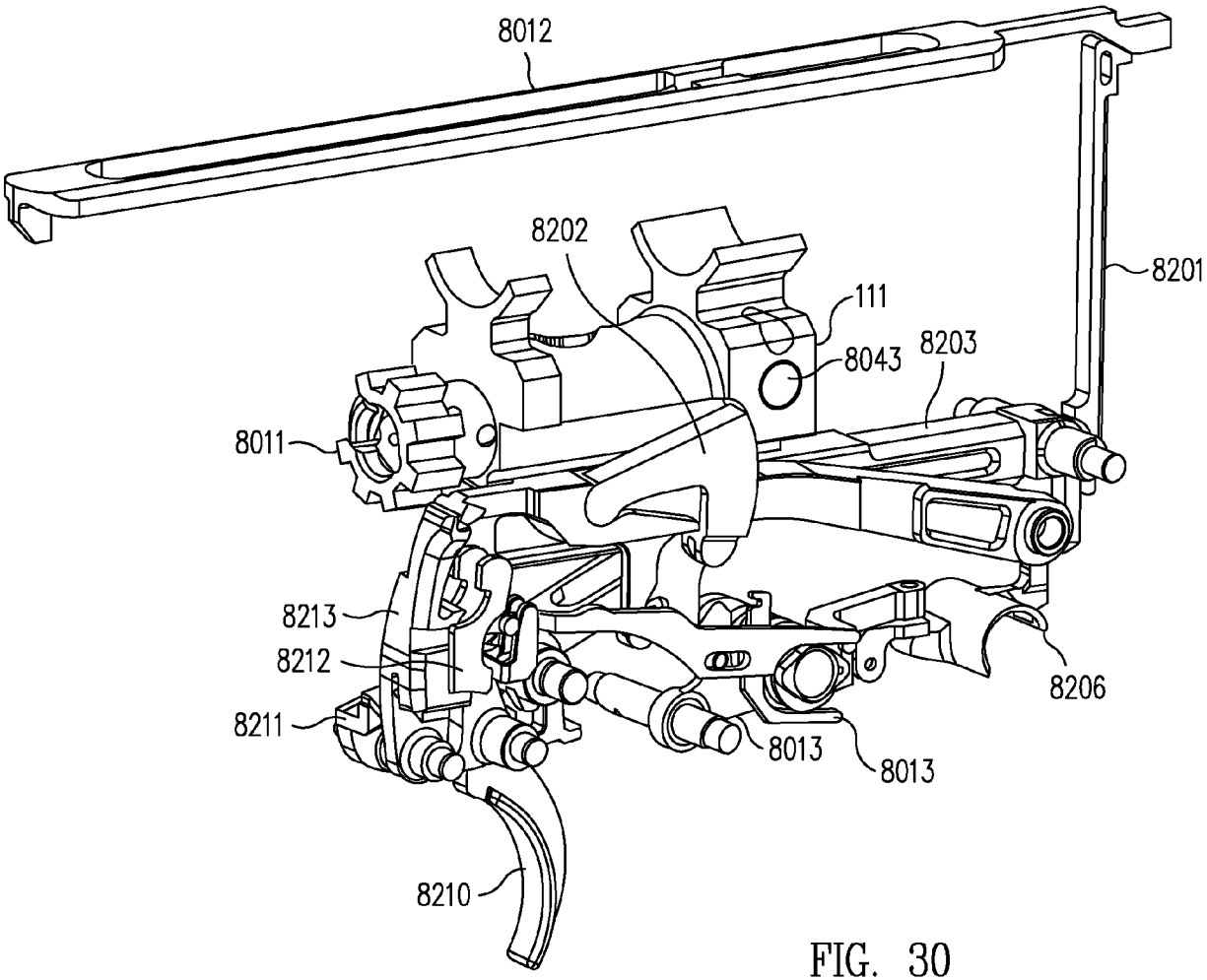
FIG. 30 is a perspective view showing an open bolt firing mechanism of the rifle/machine gun of FIG. 16A in a seared condition, according to an embodiment.
Figure 31B:
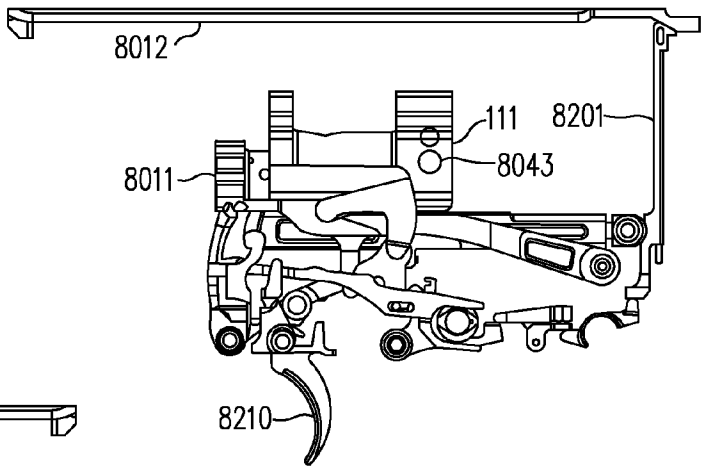
FIGS. 31A and 31B are side views showing the open bolt firing mechanism of FIG. 30, according to an embodiment.
Figure 31A:
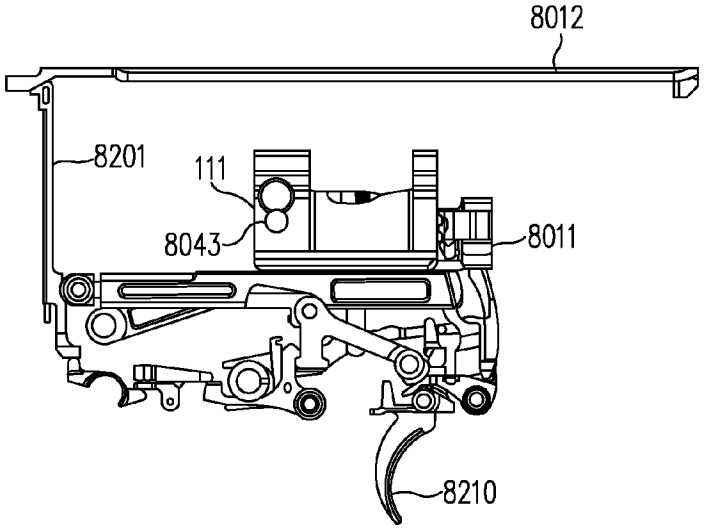

FIGS. 30-31B show an open bolt firing mechanism of the rifle/machine gun 8000 in a seared condition, according to an embodiment. In the seared condition, the bolt carrier 111 is held rearward under spring tension by the open bolt sear 8202.

Figure 32:
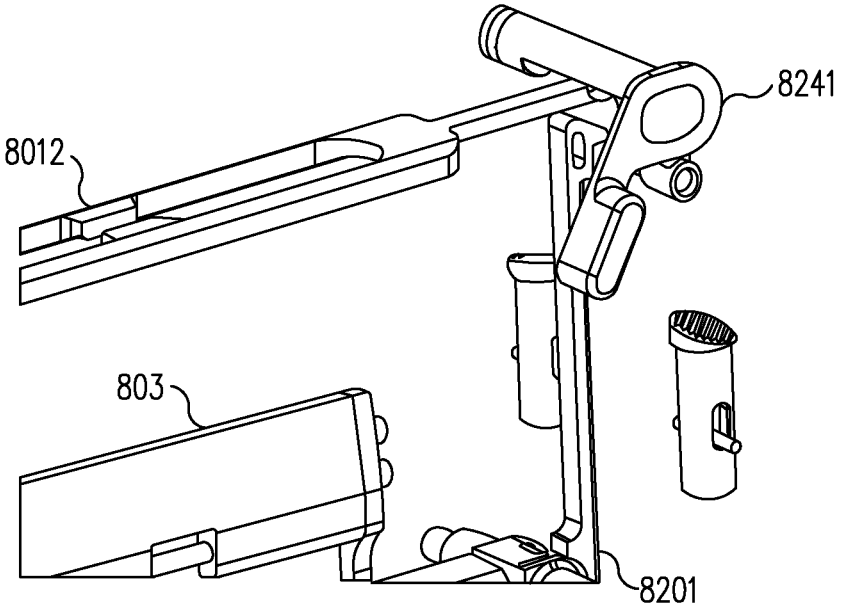
FIG. 32 is perspective view showing the autosear trip bar of the rifle/machine gun, according to an embodiment.
Figure 38A:
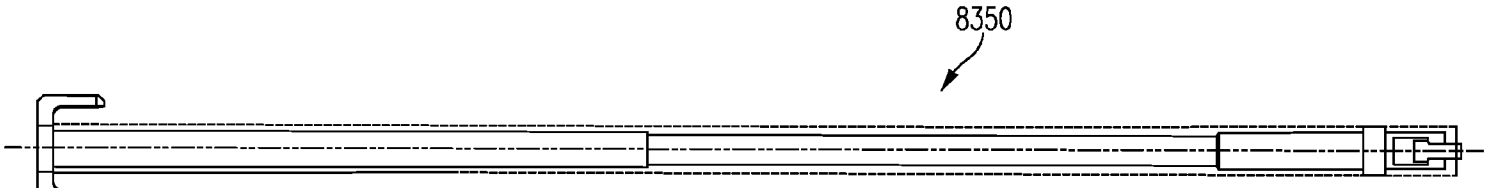
FIGS. 38A-38C are various views showing a spring assembly, according to an embodiment.
Figure 38B:
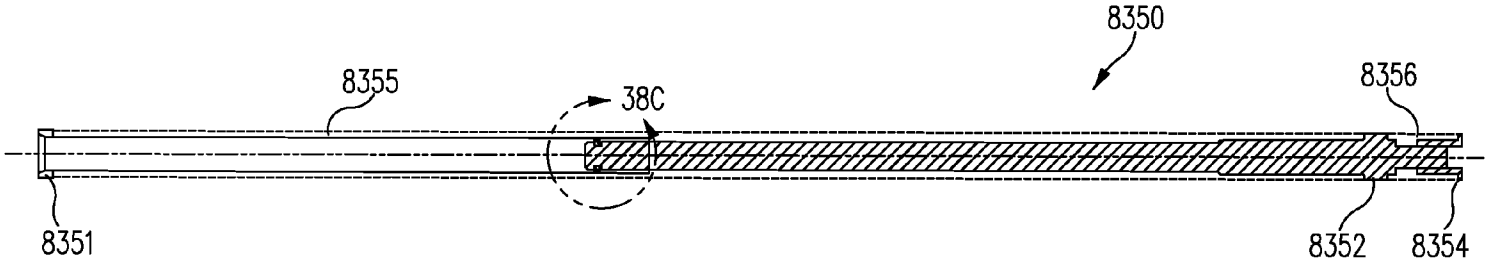
Figure 38C:
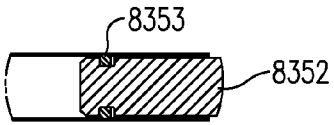
Figure 39A:
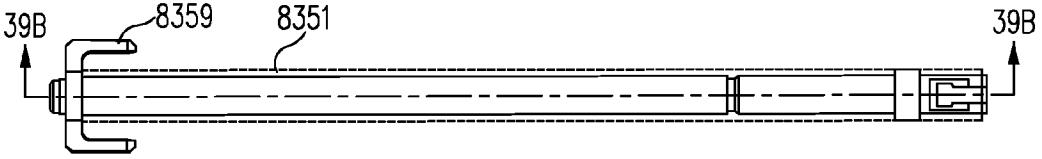
FIGS. 39A-39C are various views showing a spring assembly, according to an embodiment.
Figure 39B:
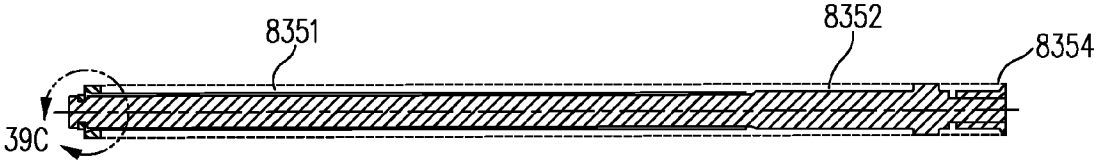
Figure 39C:
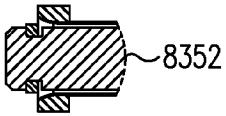
Figure 40:
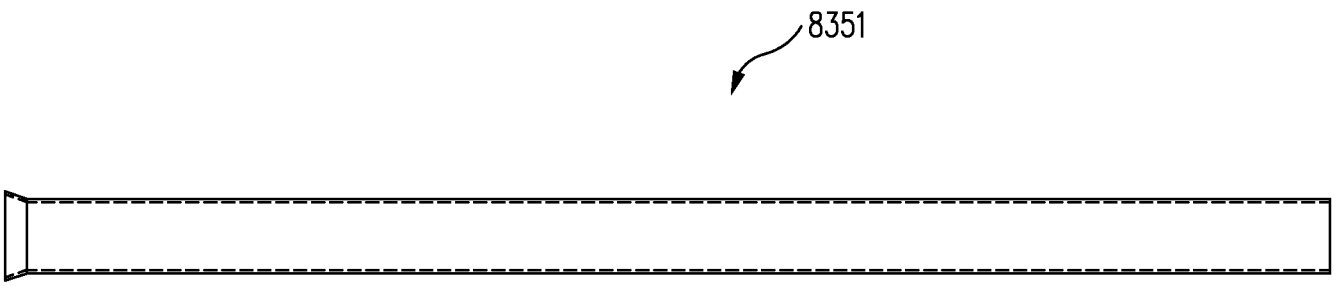
FIG. 40 is a side view of a spring guide tube, according to an embodiment.
Figure 41:
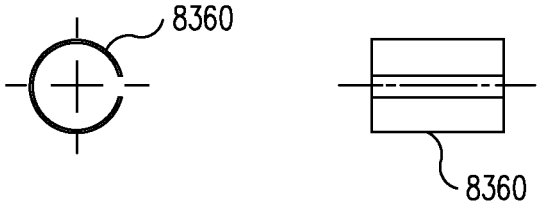
FIG. 41 is an end view of a spring guide insert, according to an embodiment.
Figure 42A:
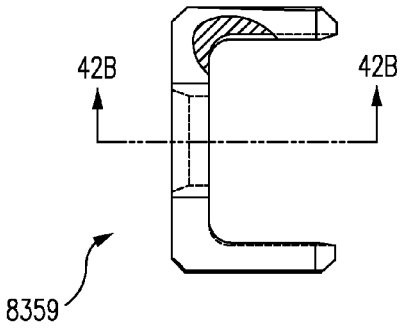
FIGS. 42A-42D are various views showing a spring guide cap, according to an embodiment.
Figure 42C:
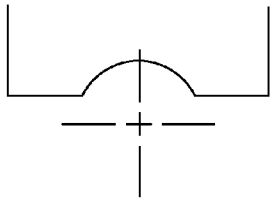
Figure 42B:
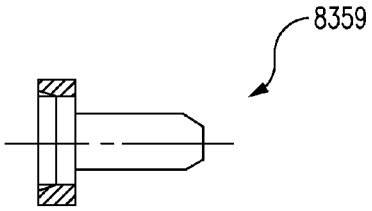
Figure 42D:
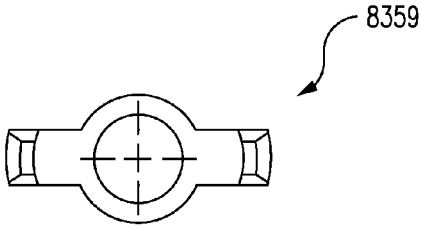
Figure 43A:
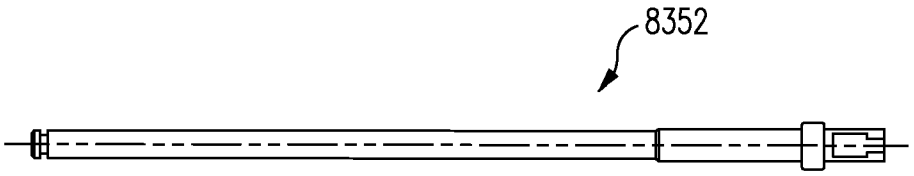
FIGS. 43A-43D are various views showing a spring guide, according to an embodiment.
Figure 43B:
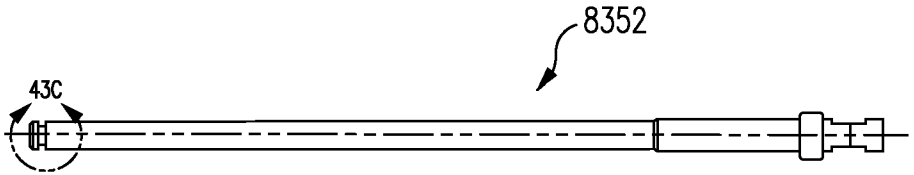
Figure 43C:
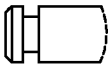
Figure 43D:
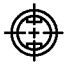

FIG. 32 shows the autosear trip bar 8012 of the rifle/machine gun 8000, according to an embodiment. When the bolt 8011 is in a rearward position, then the autosear trip bar 8012 is also to the rear. In this instance, the receiver latch pin 8241, when rotated to open the rifle/machine gun 8000, will bear against the autosear trip bar to prevent further rotation of the receiver latch pin 8241. In this manner, the rifle/machine gun 8000 is prevented from be opened until the bolt carrier 111 is positioned forward so as to release compression of the drive spring 8355 (FIG. 38B). Thus, the rifle/machine gun 8000 cannot be opened when the drive spring 8355 is compressed, which would be unsafe.

Figure 33C:
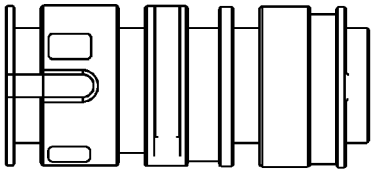
FIGS. 33A-33L are various views showing a selector cam layout according to an embodiment.
Figure 33B:
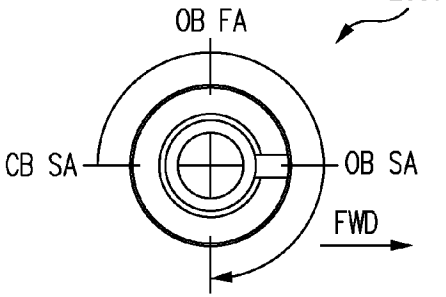
Figure 33A:
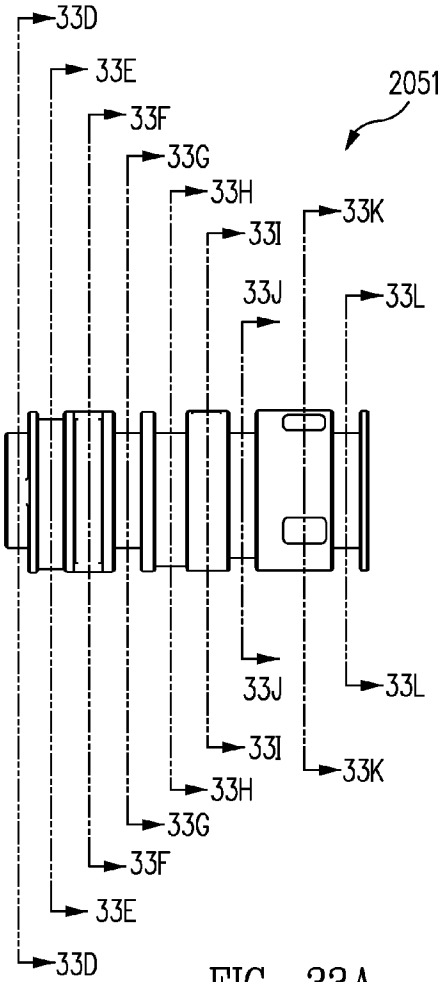
Figure 33D:
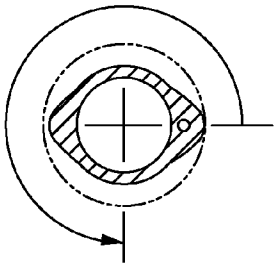
Figure 33E:
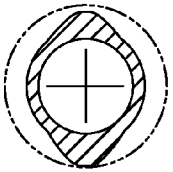
Figure 33F:
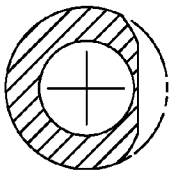
Figure 33G:
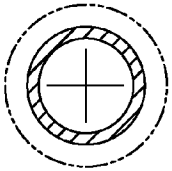
Figure 33H:
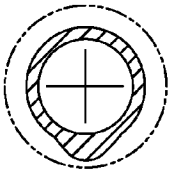
Figure 33I:
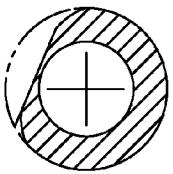
Figure 33J:
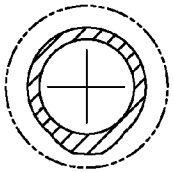
Figure 33K:
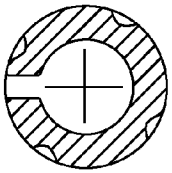
Figure 33L:
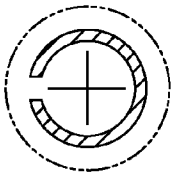

FIGS. 33A-33L are various views showing a selector cam layout according to an embodiment. FIG. 33A shows the selector 2051 as viewed looking forward at the selector 2051. FIG. 22*b* shows the selector 2051 in a closed bolt, semi auto position. FIG. 33C shows the selector 2051 as viewed looking rearward at the selector 2051. FIGS. 33D-33L show the cross-sections of the selector 2051 taken through lines 33D-33L of FIG. 33A.

Figures 34A, 34B, 34C, 34D, 34E, 34F, 34G:
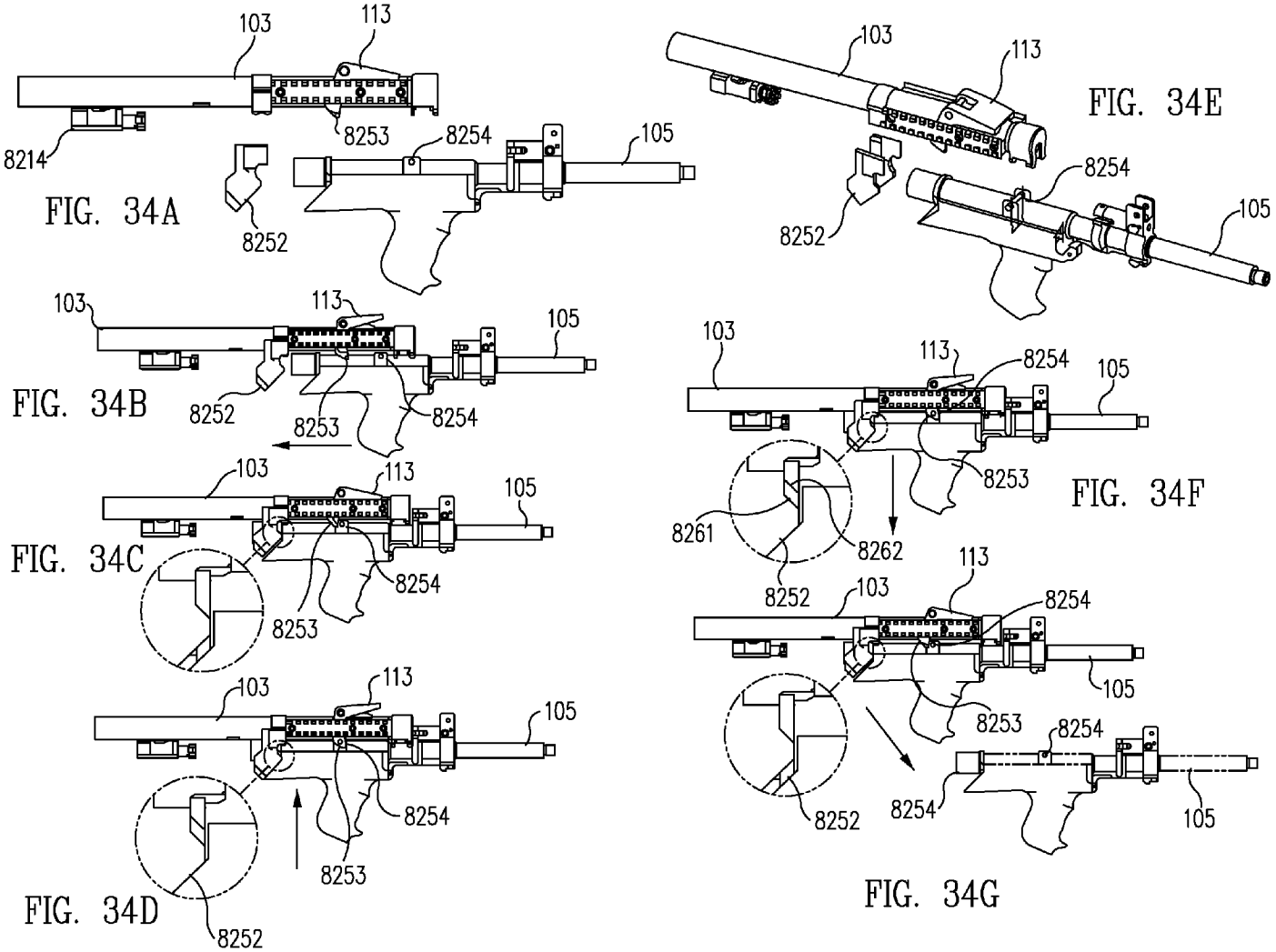
FIGS. 34A-34G are various views showing barrel installation, according to an embodiment.

FIGS. 34A-34D are various views showing installation of the barrel 105, according to an embodiment. FIG. 34A shows the barrel 105, ramp 8252, and backbone 103 in an exploded view. FIG. 34B shows the ramp 8252 attached to the backbone 103. The barrel 105 is positioned such that the barrel 105 can be pushed rearward to facilitate attachment to the backbone 103. FIG. 34C shows the barrel 105 pushed rearward such that the pin 8254 contacts the swinging wedge 8253 attached to the barrel latch 113. FIG. 34D shows the pin 8254 captured by the swinging wedge 8253. The swinging wedge 8253 holds the pin 8254, can consequently the barrel 105, to the backbone 103.

FIGS. 34E-34G are various views showing removal of the barrel 105, according to an embodiment. FIG. 34E shows the barrel 105, ramp 8252, and backbone 103 in an exploded view. FIG. 34F shows the barrel 105 attached to the backbone 103. When the barrel latch 113 is pushed downwardly, then the swinging wedge 8253 will swing to the left to release the pin 8254, thus allowing the barrel 105 to drop downwardly, as shown by the arrow. FIG. 34G shows that as the barrel 105 drops downwardly, the proximal end 8254 of the barrel 105 is ramped forward by the cam 8252 by a distance approximately equal to one wall thickness of the barrel 105. More particularly, a ramp cam 8262 of the ramp 8252 can cam a corresponding barrel cam 8262 to effect such ramping forward of the barrel 105. A second cam 8259 (FIG. 4A) can cam the barrel 105 forward further such that the barrel 105 does not contact the magazine 101 as the barrel 105 drop clear of the firearm.

Figure 35A:
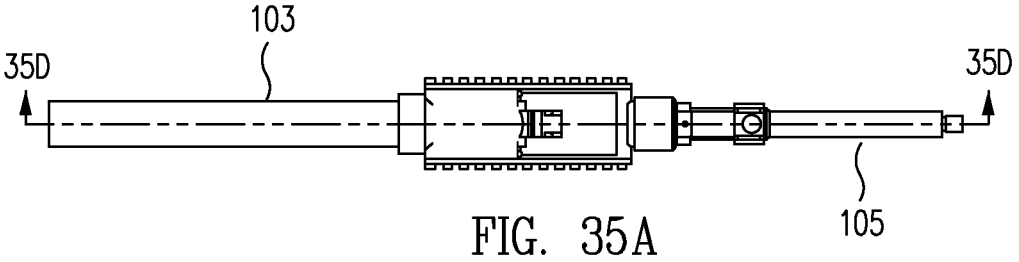
FIGS. 35A-35D are various views showing the barrel 105 and the backbone 103, according to an embodiment.
Figure 35B:
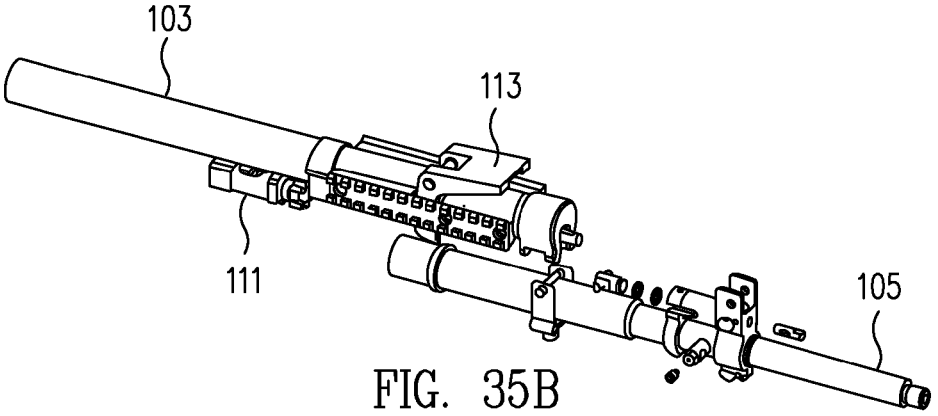
Figure 35C:
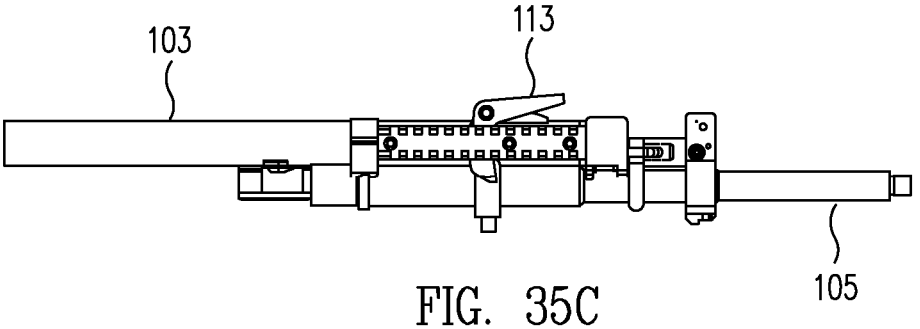
Figure 35D:
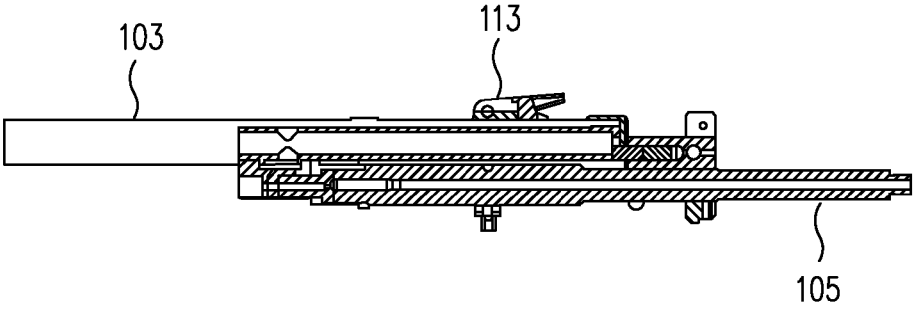
Figures 36A, 36B, 36C, 36D, 36E, 36F, 36G:
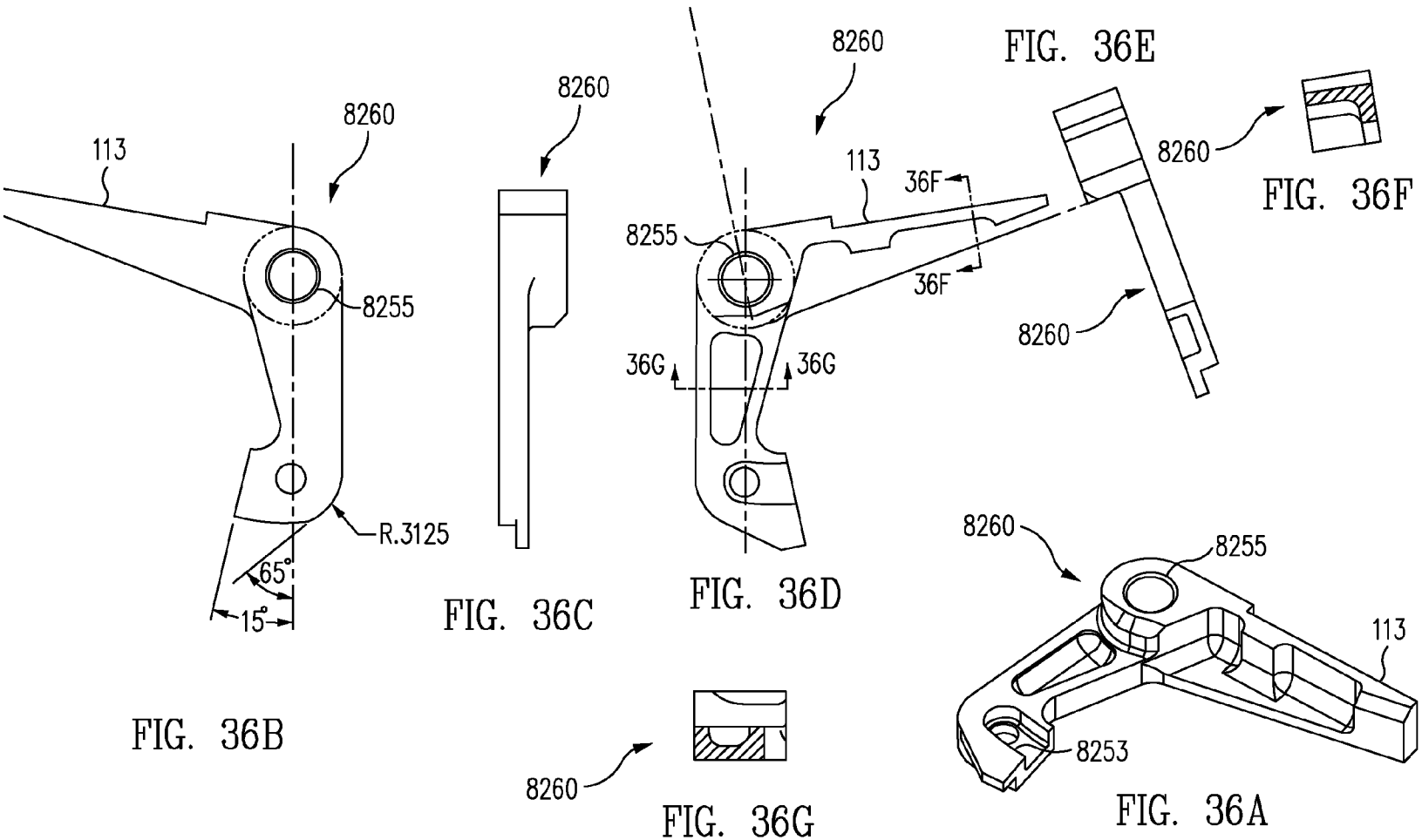
FIGS. 36A-36G are various views showing a barrel latch, according to an embodiment.

FIGS. 35A-35D are various views showing a barrel 105 attached to a backbone 103, according to an embodiment. FIG. 35A is a top view of the barrel 105 and the backbone 103. FIG. 35B is a perspective view showing the barrel 105 exploded away from the backbone 103. FIG. 35C is a side view showing the barrel 105 attached to the backbone 103. FIG. 35D is a cross-sectional side view showing the barrel 105 attached to the backbone 103.

FIGS. 36A-36G are various views showing a barrel latch 113, according to an embodiment. The barrel latch 113 attaches the barrel 105 to the backbone 103 and facilitates removal of the barrel 105 from the backbone 103. The barrel latch 113 includes a pivot hole 8255 and the swinging wedge 8253. Thus, the barrel latch 113 and the swinging wedged 8253 can be formed as a single, monolithic unit. Alternatively, the barrel latch 113 and the swinging wedge 8253 can be formed as two or more separate pieces.

Figure 37:
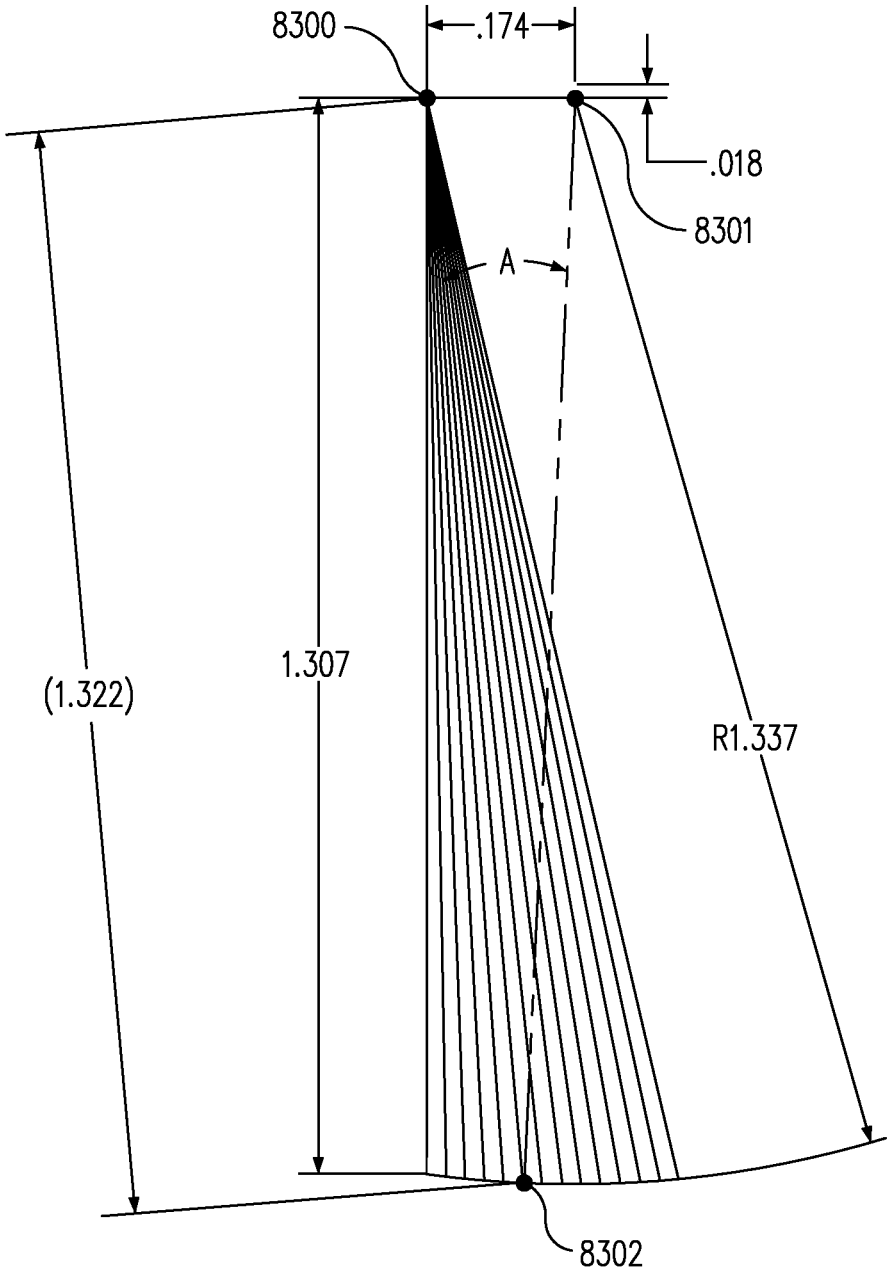
FIG. 37 is a drawing that shows how the curve is defined for the swinging wedge, according to an embodiment.

FIG. 37 is a drawing that shows how the curve is defined for the swinging wedge 8253, according to an embodiment. The swinging wedge 8253 engages and captures the pin 8254 attached to the barrel 105 to attach the barrel 105 to the backbone 103. A pivot 8300 of the swinging wedge 8253 is offset with respect to a radius of the swinging wedge 8253. Thus, the pivot 8300 and the center 8301 of the radius are not concentric with respect to one another. A line from the pivot 8300 to a given point on the curve can form an angle of approximately 8° with respect to a radius of the curve.

FIGS. 38A-48 are various views showing a spring assembly 8350, according to an embodiment. The spring assembly 8350 can function both as a spring guide for the drive spring and as an anti-bounce system, as discussed herein. The spring assembly 8350 has a tube assembly 8351, a spring guide 8352, a spring keeper 8353, an anti-bounce spring keeper 8354, a recoil or drive spring 8355, and an anti-bounce spring 8356. The spring guide 8352 moves within the tube assembly 8351 to define a weight that mitigates bouncing of the bolt carrier 111.

With particular reference to FIG. 4I, a spring guide insert 8360 blocks the anti-bounce weight from being pushed out of the spring guide 8352 during normal disassembly of the firearm.

Figure 44A:
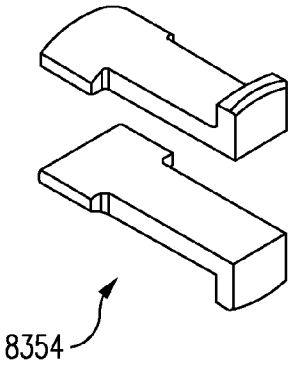
FIGS. 44A-44D are various views showing an anti-bounce spring keeper, according to an embodiment.
Figure 44B:
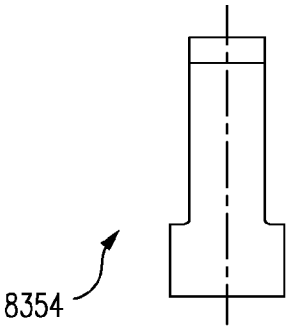
Figure 44C:
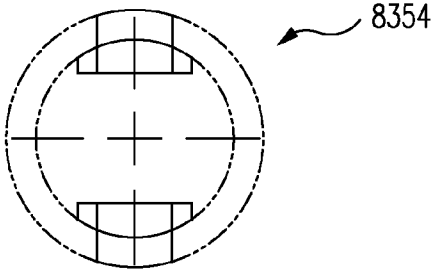
Figure 44D:
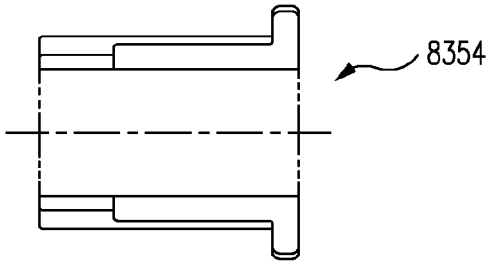

With particular reference to FIGS. 42A-42D, a spring guide cap 8359 keeps the drive spring 8355 on the spring guide 8352. With particular reference to FIG. 44A, the anti-bounce spring keeper 8353 keeps the anti-bounce spring 8356 on the spring guide 8352.

Figure 45A:
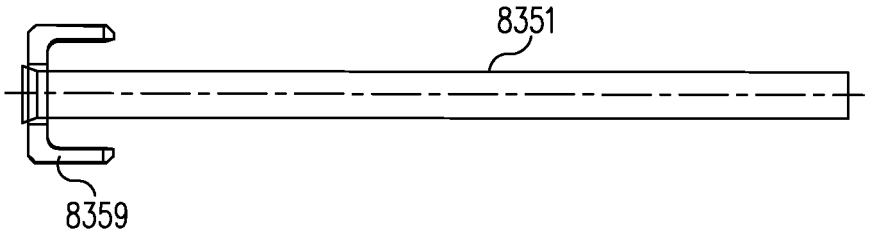
FIGS. 45A-45C are various views showing a spring guide tube assembly, according to an embodiment.
Figure 45B:
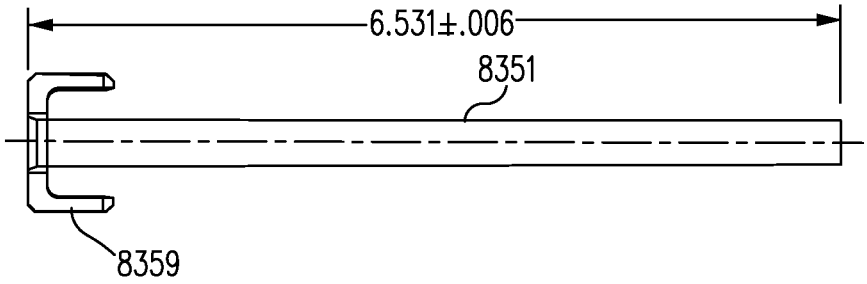
Figure 45C:
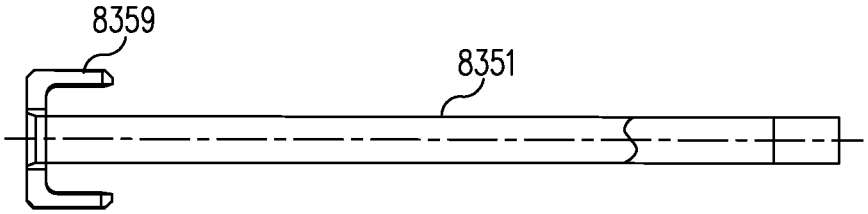

With particular reference to FIGS. 45A-C, the spring guide cap 8359 is shown in various views with the spring guide tube assembly 8351.

Figure 46:
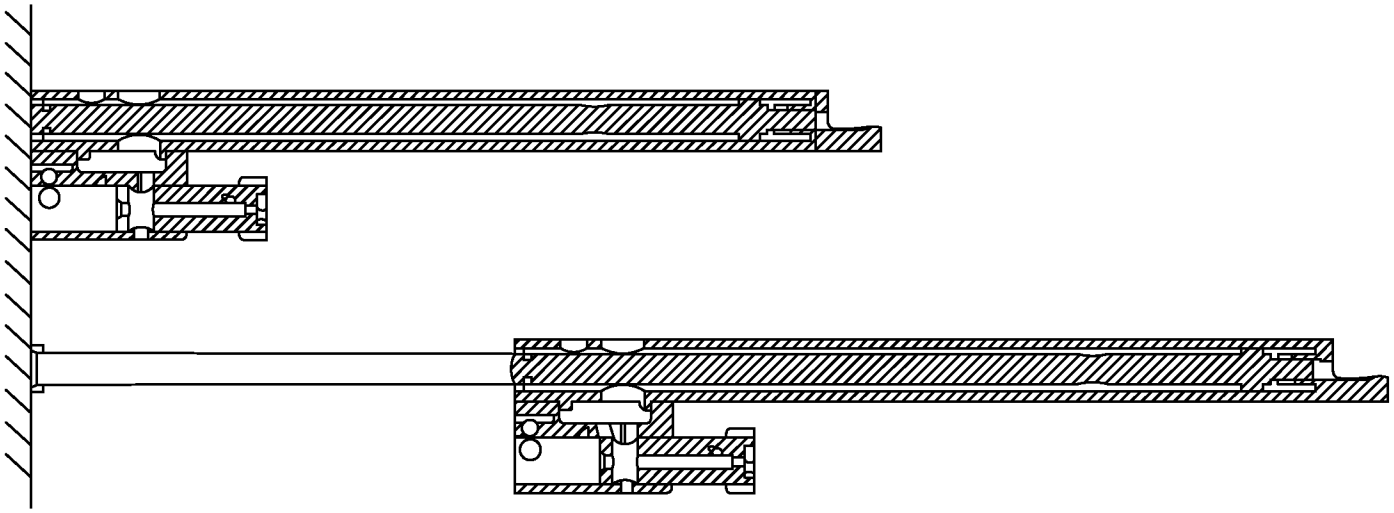
FIG. 46 is a cross-section view showing the anti-bounce spring with the drive spring compressed (top) and with the drive spring extended (bottom), according to an embodiment.
Figure 47:
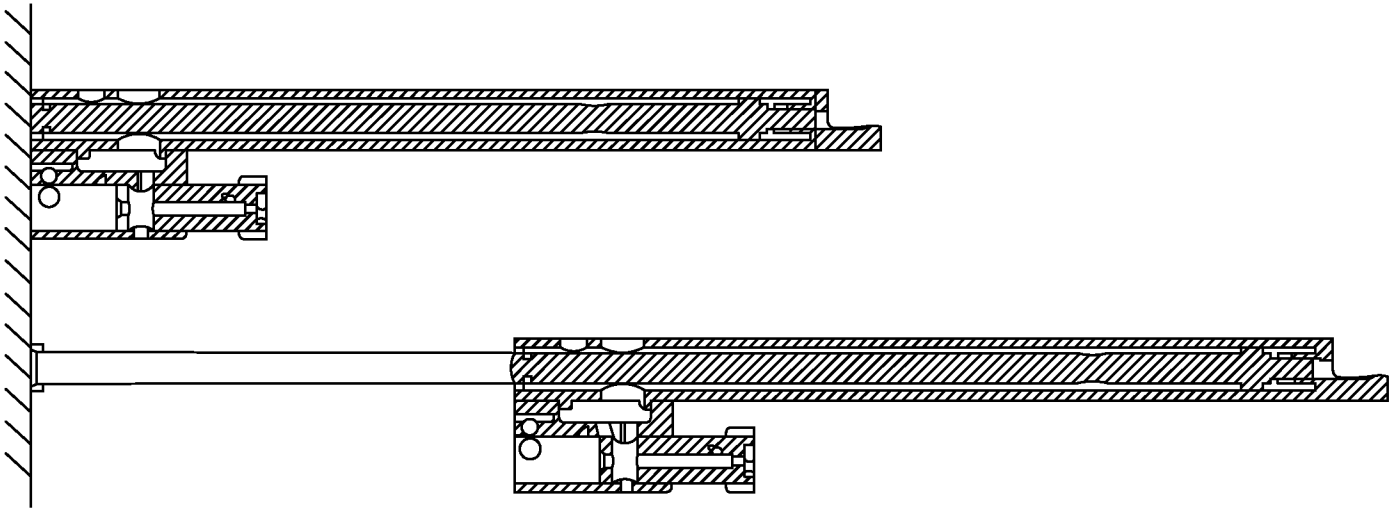
FIG. 47 is a cross-section view showing the spring drive with the drive spring compressed (top) and with the drive spring extended (bottom), according to an embodiment.
Figure 48:
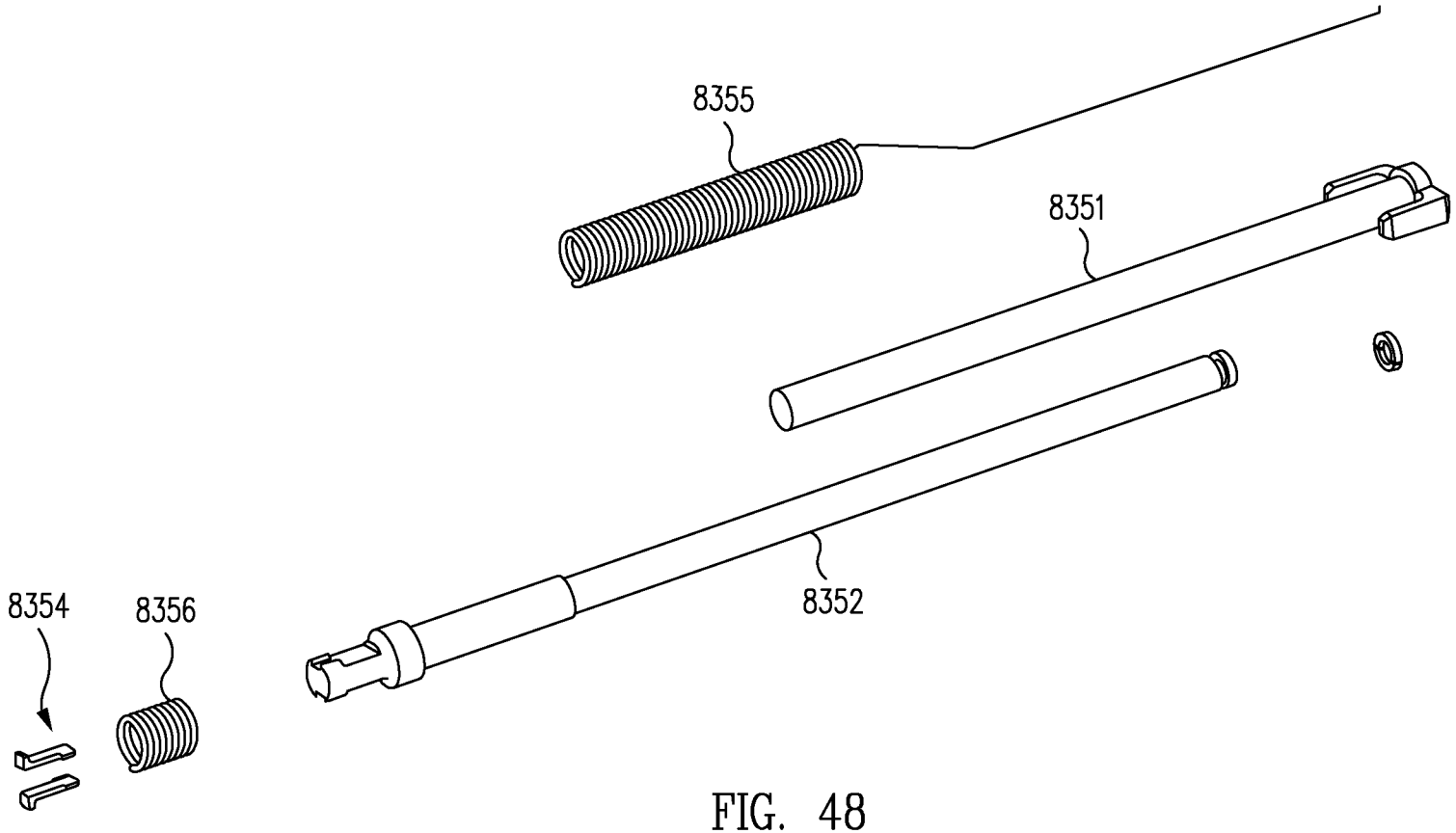
FIG. 48 is an exploded perspective view of a spring assembly, according to an embodiment.

FIG. 46 shows the anti-bounce system with the drive spring 8355 compressed (top) and with the drive spring extended (bottom), according to an embodiment. FIG. 47 showing the anti-bounce system with the 8455 spring compressed (top) and with the drive spring extended (bottom), according to an embodiment. FIG. 48 is an exploded perspective view of anti-bounce system, according to an embodiment. Timing for the anti-bounce weight can be at least partially determined by a distance between the front end of the anti-bounce weight and the inside of the front cap of the bolt carrier 8011.

Figure 49:
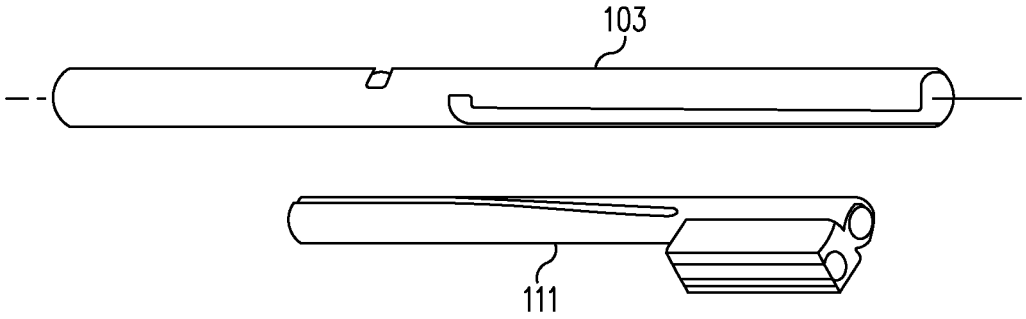
FIG. 49 is perspective view showing a backbone and bolt carrier, according to an embodiment.
Figure 50A:
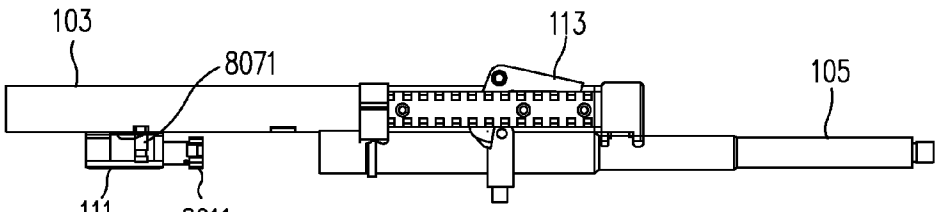
FIGS. 50A-50G are various views showing a bolt aligned with a barrel with the backbone not locked to the barrel via the swinging wedge, according to an embodiment.
Figure 50B:
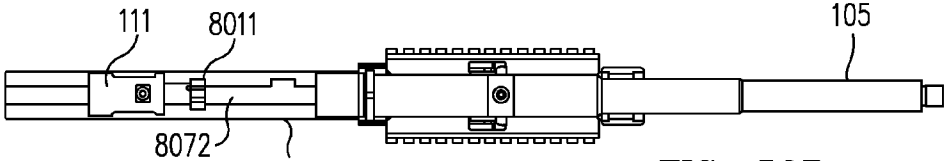
Figure 50C:
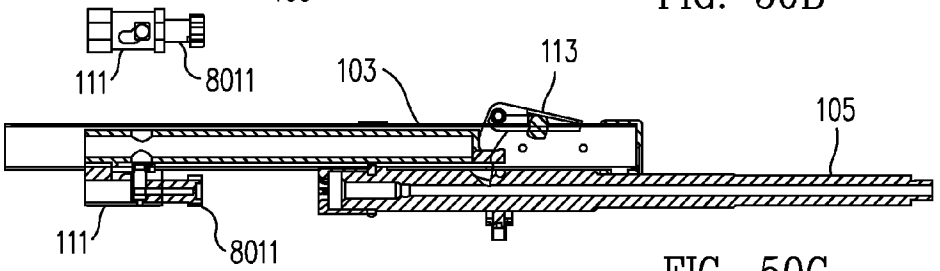
Figure 50D:
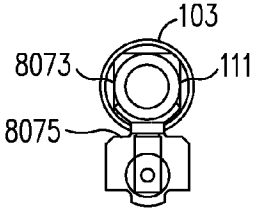
Figure 50E:
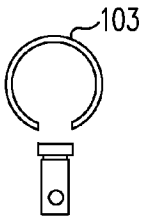
Figure 50F:
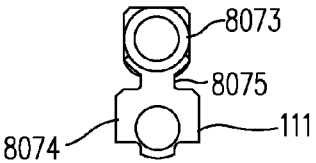
Figure 50G:
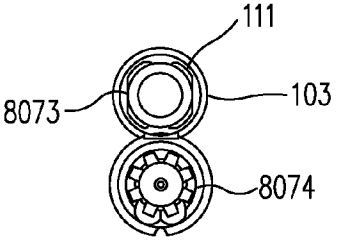
Figure 51A:
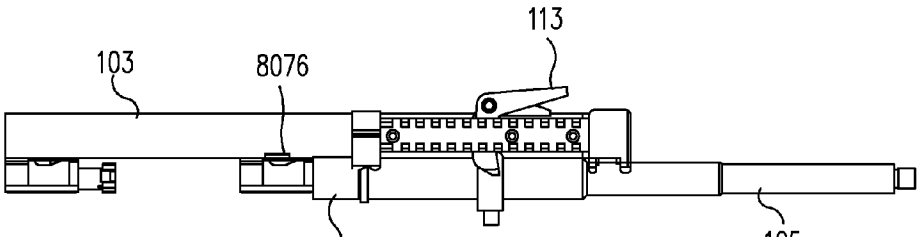
FIGS. 51A-51F are various views showing a bolt aligned with a barrel with the backbone locked to the barrel via the swinging wedge, according to an embodiment.
Figure 51B:
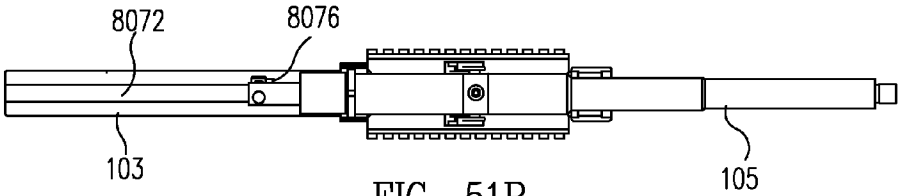
Figure 51C:
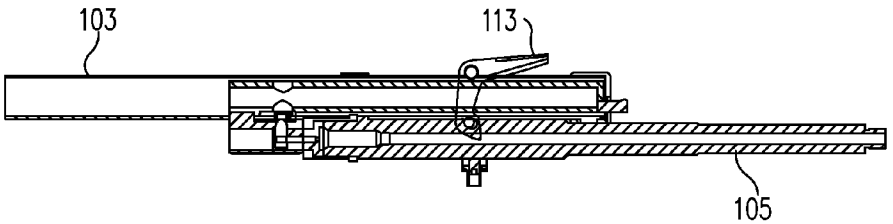
Figure 51D:
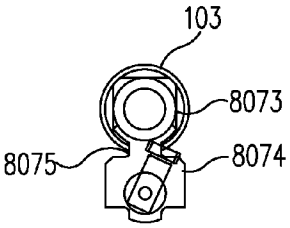
Figure 51E:
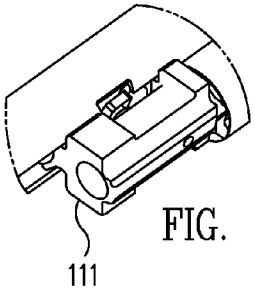
Figure 51F:
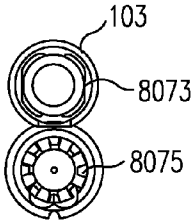

FIG. 49 is perspective view showing a backbone 103 and bolt carrier 111, according to an embodiment.

FIGS. 50A-50G are various views showing a bolt 8011 aligned with a barrel 105 with the backbone 103 not locked to the barrel 105 via the swinging wedge 8253, according to an embodiment. A cam pin 8071 extends from the bolt 8011 into a slot 8072 formed in the backbone 103. The slot 8072 cooperates with the cam pin 8071 to prevent the bolt 8011 from rotating when the cam pin 8071 is in the slot 8072.

The bolt carrier has an upper portion 8073, a lower portion 8074, and a waist interconnecting the upper portion 8073 and the lower portion 8074. The waist 8075 is slidably disposed within the slot 8072.

FIGS. 51A-51F are various views showing a bolt 8011 aligned with a barrel 105 with the backbone 103 locked to the barrel 105 via the swinging wedge 8253, according to an embodiment. The slot 8072 can have a cutout 8076 formed therein. The cam pin 8071 can enter the cutout 8076 from the slot 8072 to allow rotation of the bolt 8011 and thereby allow the bolt 8011 to lock to the barrel extension 8606.

Figure 52A:
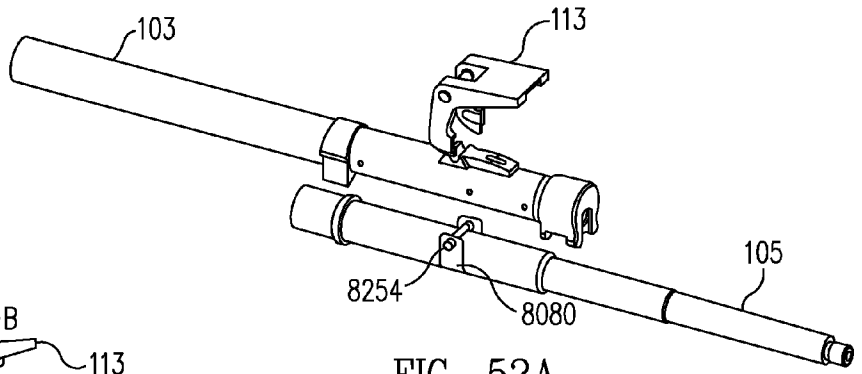
FIGS. 52A-52C show the backbone and the barrel with various cross-sections, according to an embodiment.
Figure 52B:
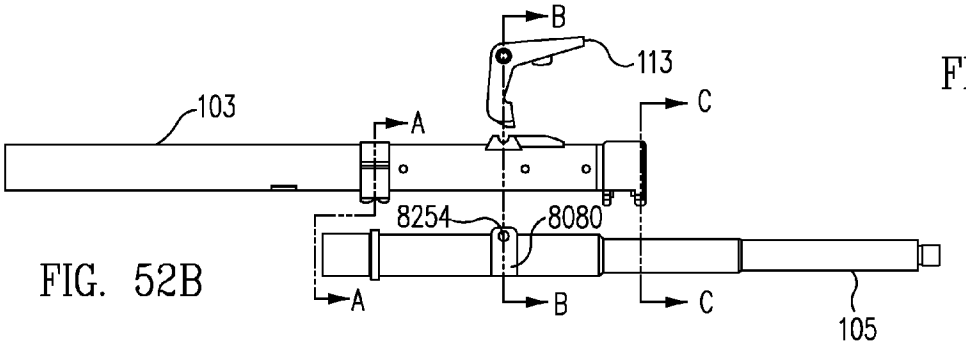
Figure 52C:
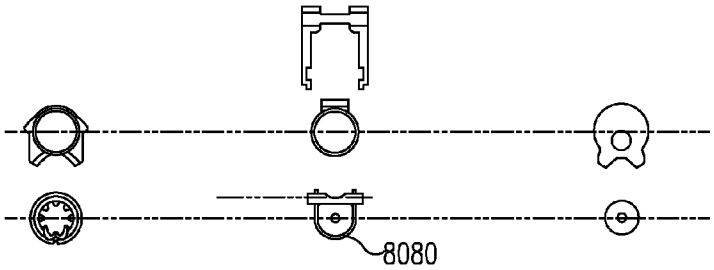

FIGS. 52A-52C show the backbone 103 and the barrel 105 with various cross-sections, according to an embodiment. The pin 8254 can be attached to the barrel 105 via a strap.

Figure 53A:
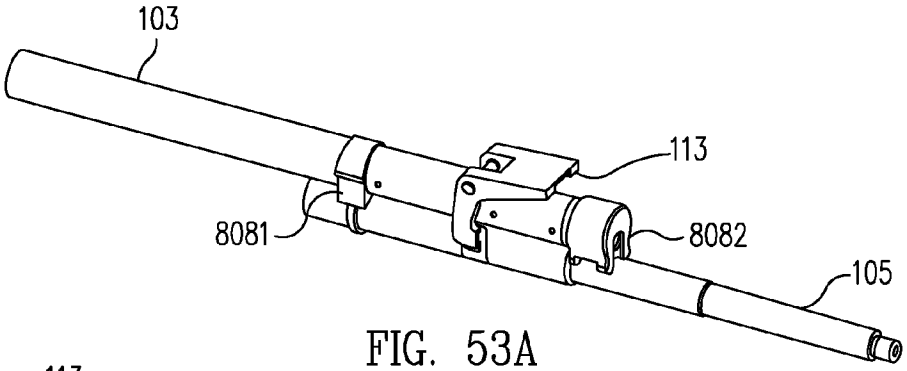
FIGS. 53A-53C show the backbone and the barrel with various cross-sections, according to an embodiment.
Figure 53B:
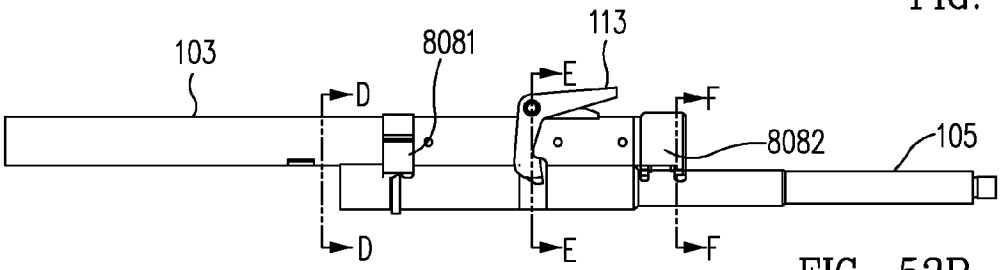
Figure 53C:
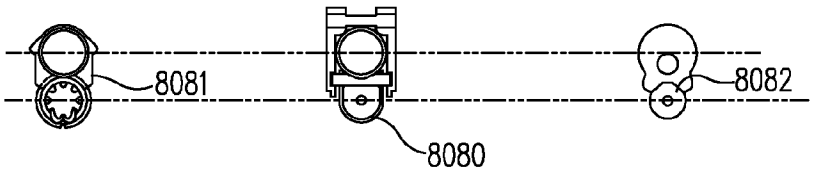
Figure 54A:
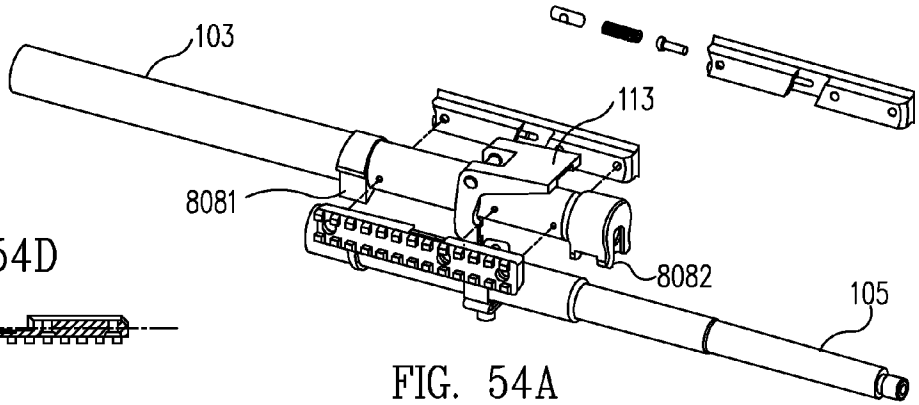
Figure 54B:
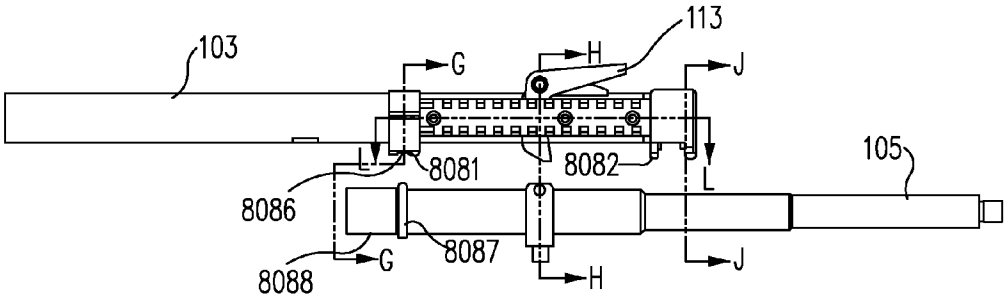
Figure 54C:
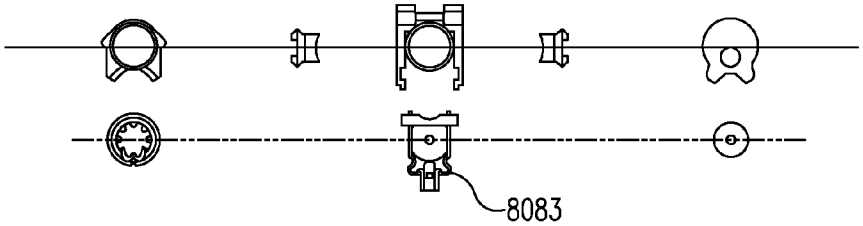
Figure 54D:
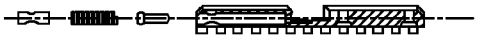
Figure 55A:
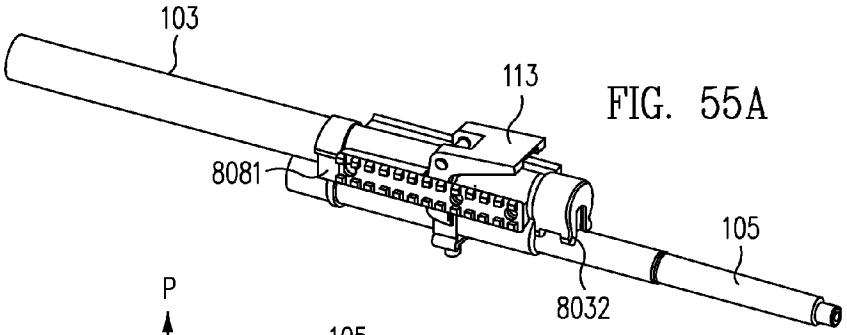
Figure 55B:
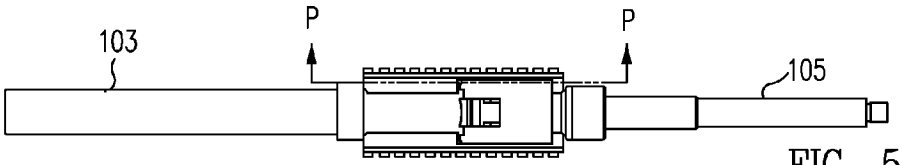
Figure 55C:
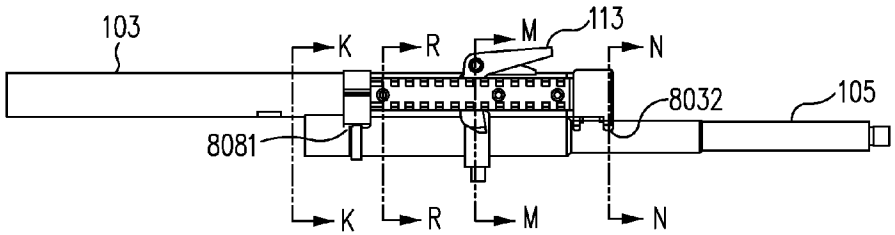
Figure 55D:
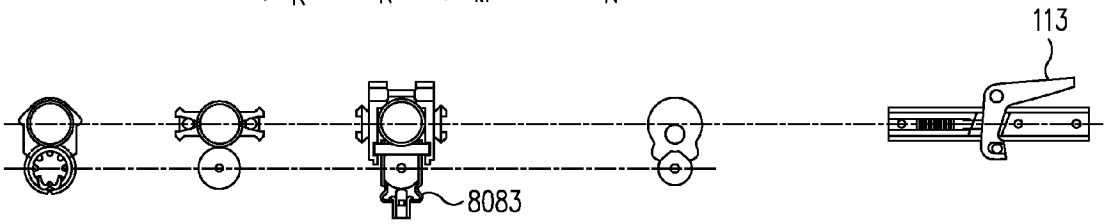
Figure 56C:
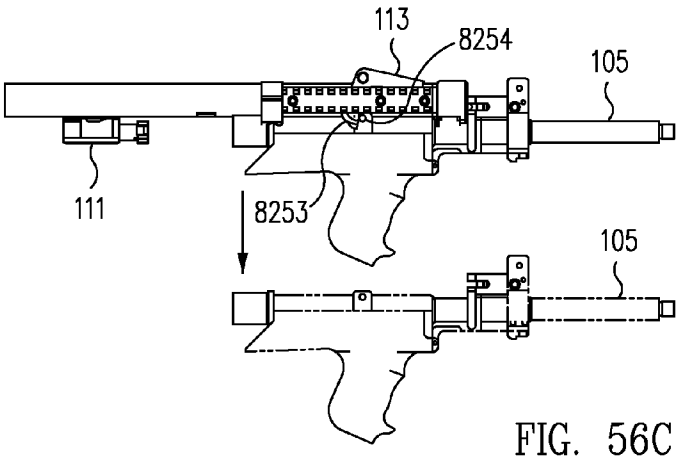
Figure 56D:
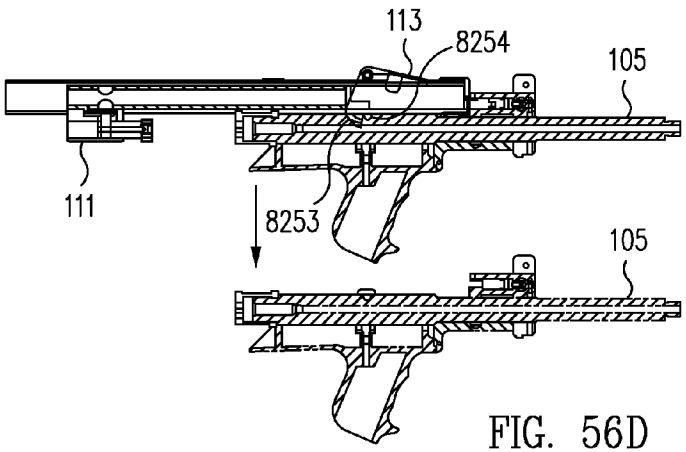
Figure 56A:
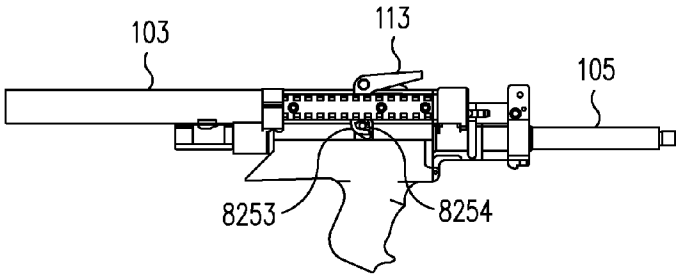
Figure 56B:
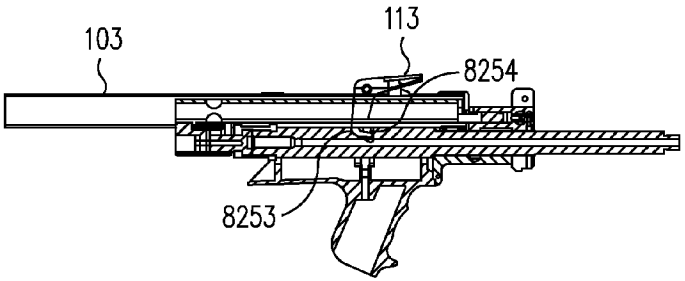
Figure 57A:
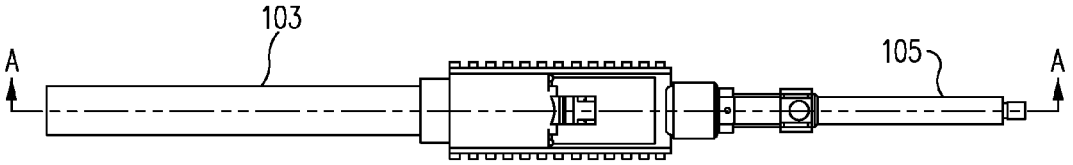
Figure 57B:
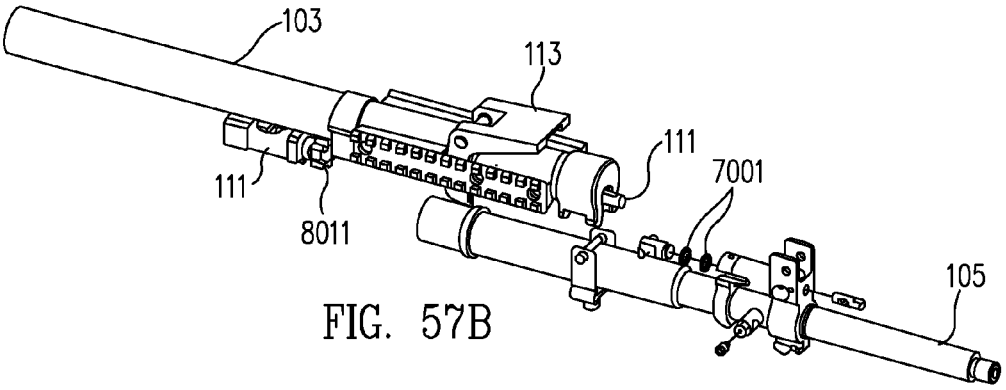
Figure 57C:
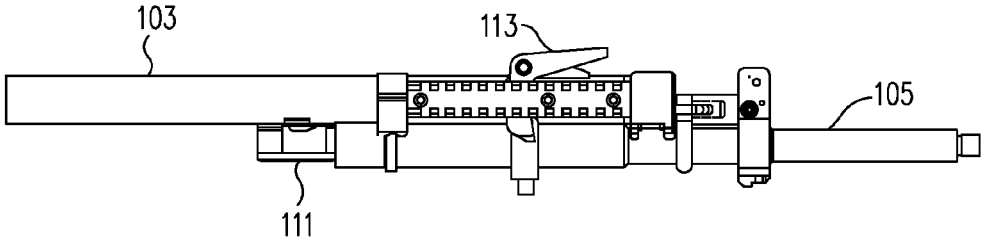
Figure 57D:
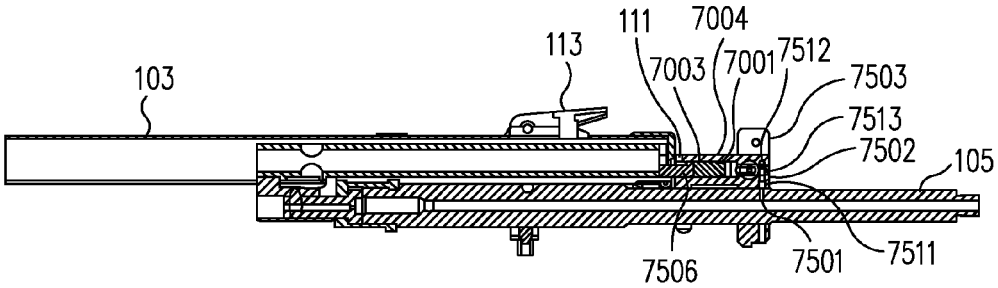
Figure 58:
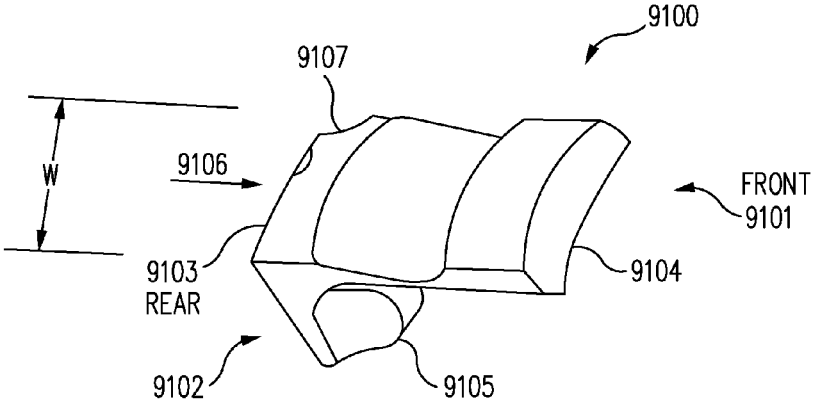
Figure 59:
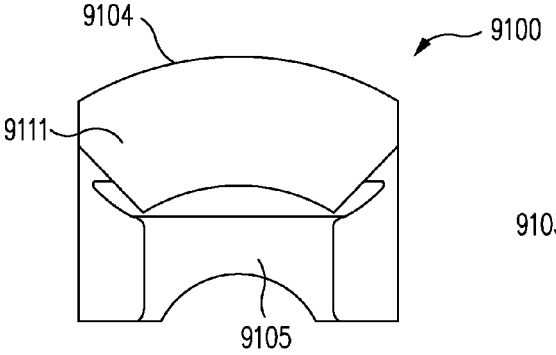
Figure 60:
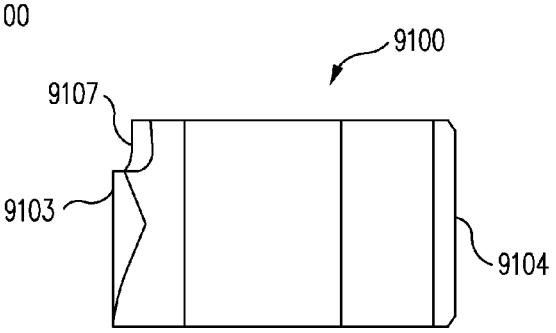
Figure 61:
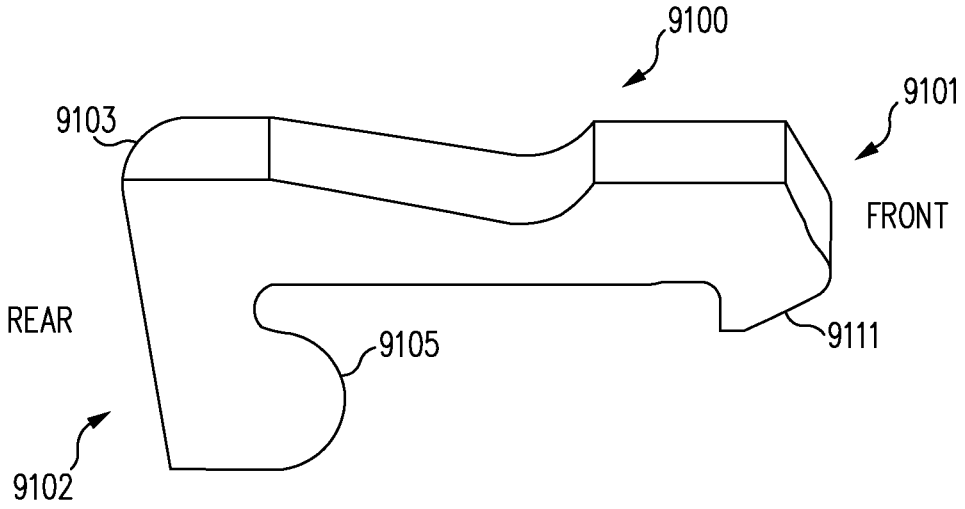

FIGS. 53A-53C show the backbone 103 and the barrel 105 with various cross-sections, according to an embodiment. The swinging wedge 8253 can pull the barrel 105 up into two V-bocks 8081 and 8082. The use of V-blocks 8081 and 8082 assures proper alignment of the barrel 105 with respect to the backbone 103. A groove 8086 can be formed in the rear v-block to receive a flange 8087 of the barrel extension 8088.

FIGS. 54A-54D show the backbone 103 and the barrel 105 with various cross-sections, according to an embodiment. The barrel 105 is shown detached from the backbone 103. The strap 8080 can be replaced or configured, e.g., bent or shaped, so as to define a tensioner 8083. The tensioner 8083 can provide a desired preload. For example, the tensioner 8083 can provide a preload of approximately 700 lbs. when the barrel 105 is attached to the backbone 103 via the swinging wedge 8253.

FIGS. 55A-55D show the backbone and the barrel with various cross-sections, according to an embodiment. The barrel 105 is shown attached to the backbone 103. The tensioner 8083 is applying the preload to the barrel 105 to properly seat the barrel 105 within the V-blocks 8081 and 8082.

FIGS. 56A-56D are various views showing release of the barrel 105, according to an embodiment. When the barrel latch 113 is pushed downwardly, the swinging wedge 8253 disengages or releases the pin 8254 to allow the barrel 105 to fall free of the firearm, as discussed herein.

FIGS. 57A-57D are various views showing the gas system, according to an embodiment. Gas from a fired cartridge enters the gas system via barrel gas port 7501. The gas flows from the barrel gas port 7501 to a gas metering port 7502 with the gas block 7503. The gas metering port 7502 determines, at least in part, the amount and pressure of gas provided to the gas system. The gas port is discussed in further detail with reference to FIGS. 72-74 below.

Gas piston rings 7001 can provide an enhanced seal, as discussed herein. The gas piston rings 7001 can be disposed upon a piston 7003, which can be disposed within a cylinder 7004. The gas piston 7003 can drive the bolt carrier 111 to operate the firearm. More particularly, the gas piston 7003 can abut a protrusion 7506 formed upon a forward end of the bolt carrier 111 to push the bolt carrier 111 rearward when the firearm discharges. Protrusions 121 can be formed upon the piston 7003 and can slide within guide slots 122 (FIG. 14A) to define the motion of the piston 7003. A flash guard 123 (FIG. 14A) can obscure, hide, or diffuse flash exhausting from the guide slots 122 when the firearm is discharged.

Overheating of the barrel of a firearm can be mitigated by more readily facilitating barrel changes. Changing the barrel of a contemporary firearm, such as the M16 or M4, during a firefight is generally not practical. According to an embodiment, the barrel of a firearm can be changed quickly, even under adverse conditions, such as during a firefight. Thus, a soldier can have several, e.g., four or five, barrels on hand and can change barrels each time that a barrel get too hot, such as after a predetermined number of shots are fired or a predetermined number of magazines are used. The barrels can be reused after they have cooled. Thus, a soldier can generally continue to shoot until the ammunition supply is exhausted.

According to an embodiment, the ability to quickly change the barrel is facilitated by the use of a backbone and bolt carrier structure, as discussed herein. According to an embodiment, the ability to quickly change the barrel is further facilitated by the use of a swinging wedge, tensioner, and other features, as discussed herein. The use of a backbone allows the bolt carrier to be moved out of the receiver, at least to some degree.

According to an embodiment, a backbone replaces the backbone of a contemporary firearm. The backbone can comprise a tube having a generally round cross-section. The backbone can comprise a tube having a generally rectangular, e.g. square, cross-section. The backbone can comprise a tube having any desired cross-section or combination of cross-sections.

The backbone can guide the bolt carrier. A portion of the bolt carrier can move within the backbone. That portion of the bolt carrier that moves within the backbone can be attached to another portion of the bolt carrier that contains the bolt. A portion of the bolt carrier can move outside of the backbone. That portion of the bolt carrier that moves outside of the backbone can contain the bolt.

For example, the bolt carrier can comprise an elongated generally tubular portion 150 (FIG. 4A) that slides within the backbone. A portion of the bolt carrier can be formed from tube stock. For example, that portion of the bolt carrier that moves within the backbone can be formed from tube stock.

Surfaces of the generally tubular portion of the bolt carrier can bear against or contact the inner wall of the backbone to control the motion of the bolt carrier. For example, the bolt carrier can have surfaces of contact with backbone that are forward and aft on bolt carrier. These contact surfaces of the bolt carrier can slide within the backbone and can facilitate guiding of the bolt carrier, at least to some degree.

The bolt carrier can have four surfaces 151 (FIG. 4A) that contact backbone that are forward on the bolt carrier and can have four surfaces 152 (FIG. 4A) that contact the backbone that are aft on bolt carrier. The bolt carrier can have three surfaces of contact with backbone that are forward on the bolt carrier and can have three surfaces of contact with the backbone that are aft on bolt carrier. The bolt carrier can any desired number surfaces of contact with backbone that are forward and any desired number surfaces that are aft on bolt carrier. The number of forward surfaces of contact do not have to equal the number of aft surfaces of contact.

By providing surfaces of contact that are forward and aft on the bolt carrier, the configuration and dimensions of the bolt carrier at other portions thereof can be less critical. For example, the diameter of the bolt carrier can vary substantially between the forward and aft contact surfaces without adversely affecting the operation of the firearm. By providing surfaces of contact that are forward and aft on the bolt carrier, the stability of the bolt carrier with respect to the backbone is enhanced.

According to an embodiment, part of the bolt carrier can be within backbone and part out the bolt carrier can be outside of the backbone. The part of the bolt carrier that is outside of the backbone can be below the backbone. Thus, the bolt carrier can comprise an upper portion (inside the backbone) and a lower portion (below the backbone). The upper portion can be substantially longer that the lower portion. The upper portion can extend substantially forward of the chamber when the bolt is locked, such that a telescoping bolt carrier is defined. The lower portion can include the bolt.

The backbone can have a slot form therein to facilitate connection of the upper portion of the backbone to the lower portion of the backbone. The upper portion of the backbone can be connected to the lower portion of the backbone at a waist of the bolt carrier. The waist can be a portion of reduced cross-sectional width of the bolt carrier. The waist of the bolt carrier can slide within the slot of the backbone. The width of the slot is such that excessive lateral movement of the lower portion of the bolt carrier is inhibited. Thus, the slot of the backbone can guide the bolt carrier in the fore and aft movement of the bolt carrier as the firearm cycles.

Movement of the bolt carrier is not motion constrained by a receiver, as is common in contemporary firearms. Rather, movement of the bolt carrier can be motion constrained by the backbone.

A lug lock can have a twist tab or cam pin that travels within the slot and that exits the slot (such as to one side thereof) as the lugs of the bolt reach their forwardmost position so as to effect rotation of the bolt to engage the lugs and lock the bolt in a firing position. A release notch formed in slot (as an extension of the slot to one side thereof) can cause the cam pin to rotate when the cam pin is cammed by bolt carrier lower portion to rotate lugs and lock bolt. The release notch can be formed and positioned so as to allow the cam pin to rotate after cam pin moves out of dwell.

The use of such a backbone can facilitate the construction of a firearm having a quick barrel change feature wherein the barrel drops downwardly, under the force of gravity, when the barrel is released from the firearm, e.g., from the backbone of the firearm. A new barrel can be rapidly snapped into place. Thus, the barrel can be quickly changed in battlefield conditions.

According to an embodiment, a swinging wedge can be pivotally attached to the backbone. The swinging wedge can engage a pin attached to the barrel to hold the barrel to the firearm. For example, the swinging wedge can have two wedged paws and each wedged paw can engage one end of the pin. A single pin can be engaged by the two wedged paws or two separate pins can be engaged by the paws.

A barrel latch can be formed with the swinging wedge such that actuating, e.g., depressing, the barrel latch causes the swinging wedge to rotate and release the barrel from the firearm. When the swinging wedge rotates, it can slide against the tension caused by contact with the pin. The swinging wedge can be spring biased toward a position thereof that holds the barrel to the firearm. Thus, the barrel latch can be moved against spring tension to release the barrel.

The swinging wedge and the pin can be configured such that approximately the same force, e.g., tension, is applied by the swinging wedge to the pin anywhere along the swinging wedge. The swinging wedge can provide approximately the same force regardless of where along the swinging wedge the pin contacts the swinging wedge.

The swinging wedge can be a curved swinging wedge. The pivot point and the curve of the swinging wedge can be non-concentric. The pivot point and the curve of the swinging wedge can be defined such that the swinging wedge provides approximately the same force regardless of where along the swinging wedge the pin contacts the swinging wedge.

For example, the pivot point and the curve of the swinging wedge can be configured such that at points of contact between the pin and the swinging wedge, a tangent to any point on the curve of the swinging wedge is at an angle of approximately 8 degrees with respect to a perpendicular to a line through that point and the pivot point of the swinging wedge. This angle allows the swinging wedge to readily slide during installation and removal of the barrel and also inhibits undesirable movement of the swinging wedge due to tension applied by the tensioner via the pin.

That is, the radius that defines the surface of the swinging wedge can be taken from a point that is offset with respect to the pivot point of the swinging wedge. As such, the surface of the swinging wedge can have a different radius as compared to the radius taken from the pivot point of the swinging wedge, as shown in FIG. 37.

More particularly, the approximately 8 degree angle can be present along the swinging wedge at each point on the swinging wedge where the pin can contact the swinging wedge. That is, wherever the pin contacts the swinging wedge, the wedge is effectively at an 8 degree angle with respect to the force applied by the pin. Since this angle does not vary substantially along the swinging wedge, it does not matter substantially where along the swinging wedge the pin is positioned to attach the barrel to the firearm.

Regardless of where the pin is positioned along the swinging wedge, the force applied by the pin to the swinging wedge is substantially the same and the force required to push the barrel latch down to release the barrel does not vary substantially. Because of the 8 degree angle, expansion of the barrel does not cause the position of the pin upon the swinging wedge to change substantially. Expansion of the barrel does not cause the pin to slide along the wedge.

The swinging wedge can be defined by channels formed within the paws that receive the ends of the pin. The channels can be curved to define the swinging wedge so as to pull the pin (and consequently the barrel) closer to the backbone as the wedge slides into tighter contact with the pin.

According to an embodiment, a tensioner can apply a predetermined amount of tension to the pin when the pin engages the swinging wedge. The tension can hold the barrel to the firearm. For example, the tension can hold the barrel against one or more v-blocks that are formed to the backbone. The v-blocks can assure proper alignment of the barrel with respect to the backbone. The v-blocks are spaced sufficiently apart with respect to one another so as to adequately stabilize the barrel with respect to the firearm.

The tensioner can be defined by a spring that at least partially surrounds the barrel. The tensioner can be disposed proximate where the swinging wedge is positioned on the firearm. The tensioner can be attached to the pin, such that pulling the pin away from the barrel stretches the tensioner and thus applies tension to the pin. Thus, as the swinging wedge pulls the pin away from the barrel, the tensioner applies tension to the pin that tends to pull the pin toward the barrel. Further, as the barrel expands due to heating of the barrel during firing and thus moves radially away from the backbone, additional tension is accommodated by the tensioner.

The v-blocks cooperate with the tensioner, pin, and swinging wedge to accommodate thermal expansion of barrel while maintaining alignment. Thus, as the barrel expands due to the heat during firing, desired alignment of the barrel with respect to the backbone is maintained.

According to an embodiment, as barrel expands longitudinally, it simply slides in v-blocks. As the barrel expands radially, the barrel does not push the swinging wedge backwards (towards the barrel release position of the swinging wedge) against spring tension. The swinging wedge is not pushed backwards because of the approximately 8 degree angle thereof. That is, the angle is not sufficient (steep enough) to allow the pin to move the swinging wedge. Rather, the angle is such that the swinging wedge can move the pin, but not visa versa. As barrel expands radially, the tensioner accommodates this radial expansion.

The tensioner can have a preload of approximately 700 lbs., for example. This preload can accommodate the heat expansion of the barrel that causes the barrel to move away from the backbone. This preload is sufficient to hold the barrel tightly in place on the firearm, while also readily facilitating movement of the barrel latch to release the barrel, when desired. As those skilled in the art will appreciate, other configurations of the swinging wedge and tensioner (such as the preload provided thereby), can be likewise suitable.

Thus, the swinging wedge wedges against the pin with approximately just amount that is necessary to hold barrel to the firearm. In this manner, only a minimal amount of force applied downwardly to the barrel latch tends to be required in order to release the barrel. That is, excessive force need not be applied to the barrel latch so as to overcome excessive force applied by the swinging wedge to the pin.

The barrel can have an 8 degree angle formed in an annular boss that extends radially therefrom and that is received within the rear v-block. This 8 degree angle can assure a desired fit of the boss within the v-block while inhibiting forward and reverse movement of the barrel within the v-block. Thus, the 8 degree angle readily facilitates installation and removal of the barrel into the v-block while substantially inhibiting longitudinal movement of barrel with respect to the v-block. The forward v-block can lack such an angle. The forward v-block can be configured to facilitate some amount of longitudinal movement of the barrel, so as to accommodate thermal expansion of the barrel.

According to an embodiment, the ability to quickly change the barrel while maintaining accuracy of fire without requiring re-zeroing of the sights is provided. The accuracy is maintained, at least in part, by the use of the v-blocks and the tensioner. The v-blocks and the tensioner cooperate to provide a rigid mount that brings a new barrel substantially into the same alignment as the old barrel.

According to an embodiment, as the barrel is released it undergoes a two stage camming process. During the first stage of the camming process, the barrel is moved forward slightly (about one wall thickness of the barrel). During the second stage of the camming process, the barrel is moved forward substantially more. Two camming surfaces are provided on the firearm, proximate the rear end of the barrel. These two camming surfaces serially contact the rear end of the barrel as the barrel falls from the firearm in a manner that pushes or cams the barrel forward as the barrel falls.

More particularly, a first camming surface can be formed on the lower receiver to move the barrel slightly forward during barrel release and a second, larger camming surface can be formed on the backbone to move the barrel more forward as the barrel drops further. The two stages of the camming process assure that the barrel moves forward sufficiently so as to drop cleanly away from the firearm. In particular, the barrel moves forward sufficiently so as to drop away from the firearm without contacting the magazine as the barrel falls. This both assures that the barrel properly detaches from the firearm and assures that the barrel falls in a predictable manner so as to avoid harm to personnel or equipment from the hot barrel.

To release the barrel, the barrel latch is pushed downwardly. Pushing the barrel latch downwardly moves the swinging wedge so as to release the pin captured by the swinging wedge. Once the pin is released, the barrel is free to drop under the force of gravity. The barrel immediately falls slightly, is pushed forward by the camming process, and drops away from the firearm.

A safety mechanism, including a safety selector switch, can be configured to cam the trigger forward in a manner that prevents actuation of the trigger. The safety mechanism can be configured to prevent the bolt carrier from being released during open bolt operation of the firearm. This can, for example, inhibit unintended firing of the firearm when the firearm is dropped. The safety mechanism can also lock the hammer to prevent actuation thereof.

According to an embodiment, many of the internal working components of the firearm can be part of a common assembly. For example, the trigger group, the selector switch, the safety switch, the trigger lock out (keeps trigger from being pulled when the charge handle is pulled back), etc., can be part of a trigger block assembly.

Thus, at least some of the internal workings of the firearm can be attached to, contained within, and/or mounted upon a common structure or framework to define the trigger block assembly. The use of the trigger block assembly facilitates the assembling of these components outside of the firearm. Once assembled, the components can be dropped into the firearm, e.g., the lower receiver, and then secured in place, such as with one or more pins, screws, or other fasteners.

As those skilled in the art will appreciate, the assembly of such small, intricate components within the lower receiver can be difficult, time consuming, and require a substantial amount of skill. Thus, such assembly can be comparatively expensive. By way of contrast, assembly of the same parts outside of the lower receiver can be substantially less difficult, substantially less time consuming, and require substantially less skill. As such, assembling the trigger block assembly outside of the lower receiver and then dropping the trigger block assembly into the lower receiver to facilitate assembly of these components can be advantageous.

According to an embodiment, two gas piston rings are configured to be received at least partially within a groove of the piston. A key can be formed upon each of the rings and a gap that is generally complimentary to the key can be formed in each of the rings. Thus, the gap of one ring can be configured to receive at least a portion of the key of another ring. In this manner, the rings can be interlocked such that they cannot rotate to a position where gaps in the rings line up in a manner that allows hot gasses to flow through the gaps.

As those skilled in the art will appreciate, when the hot gases flow through the gaps, the force provided by the gases to extract the spent case and to chamber a new cartridge is undesirably reduced. Further, when the hot gases flow through the gaps, the hot gases can burn the ends of the rings and thereby undesirably enlarge the gaps.

According to an embodiment, wings or protrusions 121 can be formed upon the gas piston and the protrusions can slid within guide slots 122 of the cylinder. The wings can cooperate with the guide slots to maintain a desired orientation of the piston, e.g., to inhibit rotation of the piston. The wings can limit rearward motion of the gas piston. The wings can limit rearward motion of piston by abutting a forward end of backbone. The wings also facilitate easy installation and removal of the gas piston within the cylinder. A stop or other mechanism can similarly be used to limit rearward motion of the gas piston.

According to an embodiment, the gas piston is not attached to an operating rod. The gas system of the firearm can be configured such that a rear surface of the gas piston strikes a forward surface of the bolt carrier so as to cause the bolt carrier to move rearward during cycling of the firearm. Since the gas piston is not attached to an operating rod, the gas piston, as well as the rings thereof, is easy to change. That is, the gas piston does not have to be removed from a connecting rod in order to change the gas piston and/or the rings of the gas piston.

According to an embodiment, the slots within which the wings move also define gas vents that exhaust gas from the cylinder to the atmosphere. Cover plates formed upon the forward end of the backbone can define a gas port flash suppressor that can obscure flash from the slots so as to make such flash less visible and also so as to mitigate the potential for injury from the exhausted hot gas.

The gas port flash suppressor can be defined by two flanges that substantially cover the slots. The flanges can also guide the new barrel as the new barrel is being installed, such as during a barrel change. The flanges can guide the cylinder (which is attached to the barrel) toward the backbone as the new barrel is attached to the firearm.

According to an embodiment, a selector mechanism can be used to select between closed bolt operation and open bolt operation in the semi-automatic rifle and in the semi-automatic rifle/machine gun. The machine gun can be configured to fire from the open bolt only.

The selector mechanism can be configured such that changing the selection from closed bolt to open bolt merely involves moving a selector lever. The selector mechanism can be configured such that changing the selection from open bolt to closed bolt requires an extra step. For example, changing the selection from open bolt to closed bolt can require that a button be depressed. The button can be part of the selector switch or can be separate therefrom. For example, the button can be in the middle of the selector switch.

Requiring that an extra step be performed in order to change from open bolt operation to closed bolt operation helps to assure that proper consideration is given regarding the propriety of this change. As those skilled in the art will appreciate, changing from open bolt operation to closed holt operation can result in a dangerous cookoff if a round is chambered while the chamber is hot. For example, a cookoff can occur if a round is chambered before the chamber has cooled adequately after sustained rapid firing of the firearm. Cookoffs are not likely to occur during open bolt operation since the cartridge is fired as soon as it is chambered. Thus, this extra step when changing from open bolt operation to closed bolt operation is a desirable safety feature. The extra step can cause a user to more carefully consider whether or not the chamber has had adequate time to cool.

It is common practice to pull the trigger of a firearm and to ease the bolt forward so as to avoid making noise that may alert an enemy to the user's presence. For example, a soldier using the M16 may be taught this technique. According to an embodiment, when firing from a closed bolt, the user can pull trigger to ease bolt forward. Thus, the user can ease the bolt forward in a manner that more quietly chambers a round so as to make detection by an enemy less likely.

However, it may not be appropriate to move the bolt from an open position to a closed position, as discussed herein. According to an embodiment, when firing from the open bolt the trigger cannot be pulled to ease bolt forward unless a button pushed. When firing from an open bolt, the bolt should remain open (rearward) so as to readily facilitate firing of the firearm and so as to better facilitate cooling of the chamber.

According to an embodiment, a main spring guide contains and/or at least partially defines an anti-bounce mechanism that mitigates undesirable bouncing of the bolt backwards after the bolt chambers a round. As those skilled in the art will appreciate, bouncing of the bolt is undesirable because bouncing of the bolt may allow the hammer to strike the firing pin when the bolt is not fully forward, thus resulting in a light strike and a potential misfire.

A weight of the main spring guide can strike the bolt in a manner that tends to mitigate bouncing thereof. The main spring can push the weight forward, along with the bolt carrier. For example, the weight can strike the bolt and push the bolt forward just after the bolt chambers a round, e.g. just after the bolt has started to bounce. In this manner, the bolt is inhibited from bouncing rearward as far as it otherwise would. The weight can be held rearward prior to the bolt chambering a round by an anti-bounce weight spring (different from the main spring).

The weight can be configured to slide along a portion, e.g., proximate the forward end, of the main spring guide. The weight can generally surround the main spring guide. The weight can be disposed between the main spring and the anti-bounce weight spring such that the main spring biases the weight forward and the anti-bounce weigh spring biases the weight rearward.

Thus, the main spring serves two functions. The main spring pushes the bolt carrier forward during cycling of the firearm and the main spring pushes the anti-bounce weight forward, as well. Putting the anti-bounce weight on the main spring guide solve the problem of where to put the anti-bounce weight and allows the main spring and main spring guide to serve two functions, i.e., cycling the bolt carrier and inhibiting undesirable bouncing of the bolt.

A gap can be provided between the anti-bounce weight and a stop formed on the spring guide. The length of this gap and the strength of the anti-bounce weight spring can define the time at which the anti-bounce weight strikes the stop (and thus effectively strikes the bolt). Thus, the gap can be configured so as to minimize undesirable bolt bounce. One or more, e.g., two, tabs can retain the anti-bounce weight spring in place upon the spring guide.

According to an embodiment, a hammer assembly has a link. One end of the link is pivotally attached to the lower receiver and other end of the link is attached to the hammer. A spring guide can be pivotally attached to lower receiver and received within a bore of hammer such that a spring on the spring guide biases the hammer to actuated position (a position that result in a round being fired).

The use of the link provides a configuration wherein the hammer has a comparatively long travel and a comparatively long reach. This long travel and long reach allows the hammer to move over last round stop 4011 (FIG. 11J). This long travel and a long reach allow the bolt to be positioned more forward when a round is chambered.

As bolt carrier retracts (such as when cocking or shooting the firearm), the bolt carrier pushes the hammer rearward to cock the hammer. At a point in the rearward travel of the bolt carrier, the bolt carrier pushes the hammer downward and then the bolt carrier rides over the hammer. As the bolt carrier moves forward when gun is fired, the bolt carrier uncovers hammer. The hammer does not begin to move (to fire the round) until bolt carrier is almost all the way forward. The hammer strikes the firing pin at approximately the same time as the bolt is locked or after the bolt is locked.

Since the bolt carrier rides upon the hammer and holds the hammer down and under the bolt carrier, the bolt carrier does not have to continually push the hammer down to maintain this cocked position. Rather, the hammer is trapped beneath the bolt carrier and cannot move (so as to fire a chambered cartridge) until the bolt first moves forward. When the holt moves forward, the hammer swings over the last round stop, with the hammer motion being at least partially constrained and defined by the hammer link.

The hammer can be an aluminum hammer having a steel face. The hammer can be all steel. The hammer can be comprised of aluminum, titanium, steel, or any combination thereof. The hammer can be made of any desired material.

The hammer can be hard anodized where the bolt carrier slides against the hammer. The hammer can be hardened or treated as desired where the bolt carrier slides against the hammer or on any other part or surface thereof.

According to an embodiment, a stock has grooves formed in the butt thereof to define a handle. The grooves can define a hand grip that enhances a user's ability to securely hold the stock when firing the firearm with a bipod from a prone position. For example, one or more horizontal grooves formed in the butt can substantially inhibit vertical movement of stock with respect to a user's hand. That is, such grooves can inhibit undesirable slipping of the butt when the butt is grasped while shooting of the firearm.

For example, one of the grooves can be formed to define a handle and so as to receive a user's thumb when firing the firearm with a bipod from a prone position. Grasping the butt of the firearm with the user's thumb in the groove can be done such that the groove substantially inhibits undesirable slipping of the user's thumb therefrom.

The stock can be a folding stock, a collapsible stock, and/or a removable stock. The stock can be a rigid stock that does not fold or collapse and that is not readily removable. The stock can be any desired type of stock.

According to an embodiment, a metered gas port is provided. The metered gas port can be separate from the gas port formed in the barrel. The metered gas port, rather than the gas port formed in the barrel, determines the amount of gas that is used to cycle the firearm. Thus, as the gas port that is formed in the barrel enlarges over time due to the erosive effects of the hot gases thereon, operation of the firearm, such as cycling time, is not substantially affected. The metered gas port can be in a gas block that is part of the sight mount of the firearm, for example.

The metered gas port can be adjustable, so as to compensate for erosion of the gas port in the barrel and so as to provide some degree of control of the firearm's operation, e.g., the cyclic rate of the firearm. The metered gas port can be easily changeable. A gas port rebuild kit that includes a new metered gas port can be provided. Thus, more uniform cycling and enhanced reliability of the firearm can be provided.

According to an embodiment, the metered gas port can comprise two tubular members that interlock within a gas block of the firearm. For example, the metered gas port can comprise a first tubular member that is inserted into the gas block and a second tubular member that is inserted into the gas block and into the first tubular member.

A screw, such as a set screw, can be screwed into the first tubular member to lock the first tubular member to the second tubular member and to lock the first tubular member and the second tubular member into the gas block. Turning the screw adjusts gas flow.

According to an embodiment, a heavy duty extractor can be used to extract spent cartridges from the chamber. The heavy duty extractor can grip more of the spent cartridge that a contemporary extractor. The heavy duty extractor can be thicker, heavier, and wider than a contemporary extractor. The heavy duty extractor can have two pins and two springs that bias the extractor in position for gripping a spent cartridge, as opposed to the single pin and spring that is common in contemporary firearms. Thus, more reliable extraction is facilitated.

According to an embodiment, a bar extends substantially along the backbone above the bolt carrier. The bar can prevent disassembly, i.e., takedown of the firearm with main spring fully compressed. The bar can prevent takedown by interfering with operation of the takedown lever when the bolt is in the open position (and thus when the main spring is fully compressed). As those skilled in the art will appreciate, takedown of a firearm with the main spring fully compressed can result the main spring quickly and unexpectedly extending in a manner than can cause injury.

A downwardly extending tab formed proximate a front end of the bar can extend downwardly into a groove formed on the bolt carrier when the bolt carrier is near the forwardmost position thereof (and the main spring is thus not fully compressed). When the bolt carrier moves further forward, the tab can abut the end of the groove and the bolt carrier can pull the bar forward such that the bar no longer interferes with the operation of the takedown lever. Thus, when the bolt carrier is fully forward, the takedown lever can be actuated to effect disassembly of the firearm.

More particularly, a surface of the bar can contact a flat surface of the takedown lever pin when the bar is at a rearmost position thereof. When the flat surface of the bar contacts the flat surface of the takedown lever, the takedown lever is prevented from rotating to the takedown position thereof. That is, when the bolt carrier is forward, the bar is pulled forward by the bolt carrier to pull it away from the flat on the takedown latch pin.

The semi-automatic rifle and the rifle/machine gun can fire from the closed bolt (if closed bolt operation is selected). The semi-automatic rifle and the rifle/machine gun can have a hammer to facilitate firing from the closed bolt. The bar can be configured to prevent the hammer from being released until the bolt is all of the way forward or almost all of the way forward, so as to assure that the bolt is locked when the firearm fires. During semi-automatic fire, the bar can allow the bolt to lock before the hammer strikes the firing pin. During fully automatic fire, the trigger may remain in the pulled position while the firearm continues to shoot, so the bar delays the hammer until the bolt has moved forward sufficiently.

The same bar can perform both functions. Thus, the same bar can prevent disassembly of the firearm when the main spring is fully compressed and can prevent the hammer from being released prematurely.

According to an embodiment, the takedown lever has safety lock pin to prevent inadvertent turning of the takedown lever to takedown position thereof and has safety lock pin to prevent inadvertently turning of the takedown lever to the non-takedown position thereof before firearm is reassembled. Both of these functions can be performed by same safety lock pin.

According to an embodiment, recoil can be mitigated as described in U.S. Pat. No. 4,475,438 issued to Leroy J. Sullivan on Oct. 9, 1984. According to this method, the impulse caused by shooting the firearm is extended in time so as to substantially extend throughout an entire cycle period of the firearm.

A dust cover can open approximately 7 degrees to allow the charging handle to move backwards. Moving the charging handle backwards, e.g., cocking the firearm, can cause the dust cover to open. If the charging handle is not in its forwardmost position, the trigger cannot be pulled.

According to an embodiment, the machine gun does not have a hammer. The machine gun can have a firing pin retaining pin that is configured to facilitate removal of the fire pin and is configured to transfer forward movement of the bolt carrier to the fire pin to cause a cartridge to fire. Removal of the firing pin retaining pin allows the firing pin to be removed. When the bolt carrier moves forward, the firing pin retainer pin causes the firing pin to move forward.

According to an embodiment, the cam pin can have a vertical hole formed therein that receives the firing pin tip to aid in removal of the cam pin. Thus, the cam pin can be removed by putting the tip of the firing pin in the hole in the cam pin. The tip of the firing pin can be put into the cam pin hole to aid in assembly, as well.

According to an embodiment, for the machine gun, the camming surface of the open bolt arm can be driven against the disconnector camming surface by the bolt carrier acting on the sear. This can be done while the open bolt arm is still being driven by the bolt carrier.

Features from one type of firearm described herein can be used in another type of firearm described herein, as desired. Additional features can be added to any of the types of firearms described herein. Features can be removed, disabled, or not used in any desired type of firearm described herein. Thus, the features describe in conjunction with each type of firearm can be mixed and matched as desired and are by way of example only, and not by way of limitation.

Embodiments described above illustrate, but do not limit, the invention. It should also be understood that numerous modifications and variations are possible in accordance with the principles of the present invention. Accordingly, the scope of the invention is defined only by the following claims.

One or more embodiments provide a magazine fed, gas operated auto cycling firearm which operates generally as follows. Like all breach loading repeaters, they must perform eight ammunition handling functions between one shot and the next. It must feed, chamber, lock, fire, unlock, extract, eject the ammunition cartridge and cock the gun ready for the next cycle. The bolt group is involved in all eight of these functions. As a main spring drives the bolt group forward it completes the feed by pushing the top cartridge forward out of the magazine and tilting the forward bullet end up a feed ramp and into the barrel chamber and by rotating the bolt head to lock it and the cartridge into the barrel and then fires the cartridge. That completes the forward moving half of the bolt cycle.

As the bullet moves through the barrel it passes a gas port hole drilled in the barrel wall through which high pressure gas enters the cylinder and drives the piston rearward, thus throwing the bolt carrier rearward and compressing the main spring. During the bolt carrier's first rearward motion a helical cam in the carrier rotates the bolt head to unlock the bolt head from the barrel and then pulls the bolt head rearward for the rest of their combined rearward cycle. An extractor claw on the bolt head pulls the fired cartridge case from the barrel chamber and an ejector strikes or pushes on the cartridge base opposite the extractor, pivoting the cartridge around the extractor and out through an eject port in the gun structure. The combined bolt head and bolt carrier's continued rearward motion uncovers the new top cartridge in the magazine which feeds it upward into the bolt head's return path while the rearward moving carrier and bolt cocks the spring loaded firing hammer and moves beyond (rearward of) a bolt stop which is lifted up by the magazine follower after the last cartridge has fed from the magazine and which catches and holds the bolt and carrier group rearward so that the empty magazine can then be removed and replaced with a full one ready to resume fire without hand cocking the gun. A cocking handle can be provided in case of a misfire or other cycle malfunction.

One or more embodiments provide a tubular backbone that guides the fore and aft motion of the bolt, aligns the bolt and its locking lugs with the barrel and barrel lugs, and prevents locking motion (in this case the bolts rotation) until the bolt has reached lock position and then allows the bolt to lock to the barrel. The backbone differs from contemporary receivers, for example, in that the does not contain or surround the bolt it is guiding. Instead both the bolt and the barrel assemblies are outside and below the backbone, which at least partially contains and at least partially guides the bolt carrier. As viewed from the rear, the bolt carrier can be configured as a thin wasted "figure 8".

As seen from the side, the upper part of the bolt carrier's "figure 8" is a long tubular section with fore and aft contact points that center it within the backbone. This upper section of the bolt carrier slides fore and aft within the backbone and contains the main spring.

A guide slot in the bottom of the backbone can be cut from the rear to approximately the middle of the Backbone. This slot is the passage way for the bolt carrier waist, which is connected to the bolt carrier's lower section. The slot permits the bolt carrier to slide, while keeping the lower section of the bolt carrier substantially in line with the barrel.

The lower section of the bolt carrier can be shorter than the upper section. The lower section of the bolt carrier can contain the bolt and can maintain the bolt in line with the barrel.

A cam pin in the bolt can extends upward through a helical cam slot in the lower carrier section. The top of the cam pin can be the same width as the carrier waist and slides fore and aft in the backbone's guide slot, which can prevents the cam from rotating the bolt until the cam pin reaches the cutout. At that position, the bolt lugs can have entered between the barrel lugs and the bolt can be released by the cutout and rotated to lock by the helical angle of the cam as the carrier completes its forward motion until stopped by the rear most surface of the barrel.

According to an embodiment, a backbone structure that facilitates precise quick barrel change is provided. When in place the barrel is below the backbone and the rearmost surface of the barrel is approximately midpoint on the length of the Backbone.

A barrel cross pin (FIG. 52C) can be permanently aligned parallel with the barrel lugs and held in place by a strap (shown simplified in FIGS. 52 and 53)

A swinging wedge (FIGS. 52A-53B) can draw the cross pin and barrel upward tight into v-blocks (FIG. 52C) and can draw a barrel lock flange up into a lock notch (FIGS. 52C and 53C). The backbone and barrel assembly shown in FIGS. 53A-53C are thus held in a substantially "precise" location with respect to one another. "Precise" in this case means that any individual barrel assembly can be repeatedly installed and removed from one gun assembly and will return to substantially the same position on that gun. Each barrel has a front sight adjustment and a gas port adjustment so any number of barrels can be installed and "zeroed" to a gun and all will remain on target and will properly operate that particular gun if exchanged with one another. In that way, any particular gun can have many dedicated barrels in both 5.56 and 6.8 and in different weights and lengths, some with, some without attachments like suppressors or 40 mm launchers. The barrel, once installed, cannot move up, down or sideways, cannot shift fore and aft, and cannot rotate. The locking lug patterns of both the bolt and barrel are thus aligned within the combined tolerance of positioning surface on the backbone, bolt and barrel. Adequate clearances are provided in the lug patterns to accommodate the tolerances plus heat expansion.

Two spring assemblies consisting of a plunger, spring and plug are housed in the two accessory rails that are fastened to either side of the backbone. The accessory rails have a clearance slot to accommodate the swinging wedge arms, which reach through to engage both ends of the barrel cross pin. The angled wedge surfaces on the swinging wedge are driven forward by the force of the spring assemblies to draw the cross pin and barrel upward and tight into the v-blocks.

If the bolt group is forward with the bolt locked to the barrel, then the swinging wedge blocker would hit the top of the upper bolt carrier so that the swinging wedge can't be swung to release or to load a barrel assembly. The swinging wedge can only be operated if the bolt group is locked rearward as it is in the open bolt fire position or when the bolt catch is activated automatically by the magazine follower as the last round is fired. Thus without further attention the user can exchange hot barrels for cool ones for maximum sustained fire. All the user needs to do is hit the top plate of the swing wedge, such as with a "karate chop" like motion, and the hot barrel is ejected. No tools or protective gear are needed (such as to prevent burns).

The barrel assembly is designed for machine gun firepower. This means that 1500° F. barrel heat and the precise tight fit of the v-blocks and the swinging wedge holding the cross pin can still accommodate the barrels increased size from heat expansion which will grow 0.009" bigger in diameter and 0.057" in length between the v-blocks. If the strap shown in FIGS. 52 and 53 is used, either the strap, cross pin, swing wedge, backbone, or barrel would be bent or severely damaged by heat expansion.

The tensioner shown in FIGS. 54A-55D can be subject to the bending from such expansion. The tensioner can be a spring that is strong enough (when its force adjustment screw is initially set to 700 lbs. of preload) to keep the barrel tight in the v-blocks, thus accommodating the vibration and shock of firing and the off-center force of the gas system. Thereafter, the tensioner's flexibility as the barrel expands downward increases the force by 1100 lbs., which is far too low of a force to permanently bend or damage the parts involved.

The swinging wedge can contact the bottom of the pin at an angle of approximately 8 degrees. Thus the further the wedge swings, the higher it lifts the pin and barrel until the barrel is drawn up tight against its "V" blocks. The wedge can thus provide a tight fit for any dimensional tolerances variations in any number of barrels so it achieves a precision fit for rifle accuracy without the cost of extraordinary precise manufacturing tolerances and without the loss of interchangeability.

Gas operated firearms are undesirably subject to failures to extract. When a failure to extract occurs, a fired cartridge is not extracted completely from a chamber of the firearm. Such failures to extract prevent the next round from being chambered and thus jam the firearm.

In some firearms, the bolt can strip the next cartridge from a magazine and can ram the next unfired cartridge into the chambered or partially chambered cartridge. In an open bolt blowback operated firearm with fixed firing pin such as a submachine gun, this can result in a dangerous slam fire of the next cartridge when it is blocked from entering the chamber.

Such failures to extract can be caused by insufficient spring force to keep the extractor closed. Such failures can also be caused by breakage of the extractor. For example, repeated use of the extractor can cause a stress crack to form in the extractor or its associated spring. The stress crack can propagate until the extractor or spring is weak enough to break. This problem is particularly prevalent in fully automatic firearms, due to the high number of cycles and more extreme heat experienced thereby.

One problem is that there is insufficient spring force to keep the extractor closed due to extreme vibration common in fully automatic firearms. According to an embodiment, the extractor can be wider, have a wider claw, and can have more spring force that biases the extractor in a closed position so as to more firmly grasp a cartridge being removed from the barrel.

FIGS. 58-61 show an extractor 9100, in accordance with an embodiment. The extractor 9100 has a generally "L" shape defined by an upper portion 9101 and a lower portion 9102. The extractor 9100 also has a heel 9103, a claw 9104, and a bump 9105.

The extractor 9100 has a closed position and an open position. The extractor 9100 is generally in the closed position when the claw 9104 is not engaging an absent cartridge.

Spring force applied to the heel 9103 in the direction indicated by arrow 9106 can cause the extractor 9100 to pivot about the bump 9105. The spring force can be applied by two springs 9501, 9502 (FIG. 67) that cooperate with two plungers 9503, 9504 (FIG. 67), so as to bias the extractor 9100 in the closed position thereof. This biasing force causes the claw 9104 to more firmly grab or engage a cartridge.

The extractor 9100 can also have a cutout 9107 that is configured to abut an extractor stop pin 9506 (FIG. 67) to limit rearward movement of the extractor 9100, as discussed herein.

The extractor 9100 can also have a width, Dimension W, that is substantially greater that the width of a contemporary extractor. For example, the width, Dimension W, of the extractor 9100 can be increased by approximately 28% as compared to a contemporary extractor. For example, the width, Dimension W, can be between approximately 6 mm and 8 mm and can be approximately 7.77 mm. Thus, the extractor 9100 can be stronger, more robust, and less susceptible to failures to extract with respect to contemporary extractors.

Figure 62:
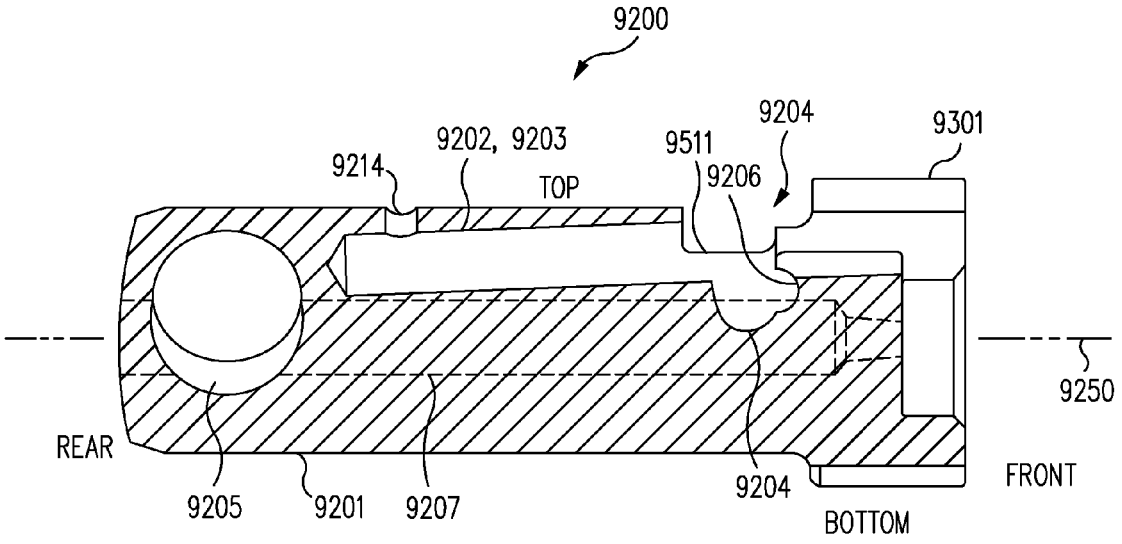
Figure 63:
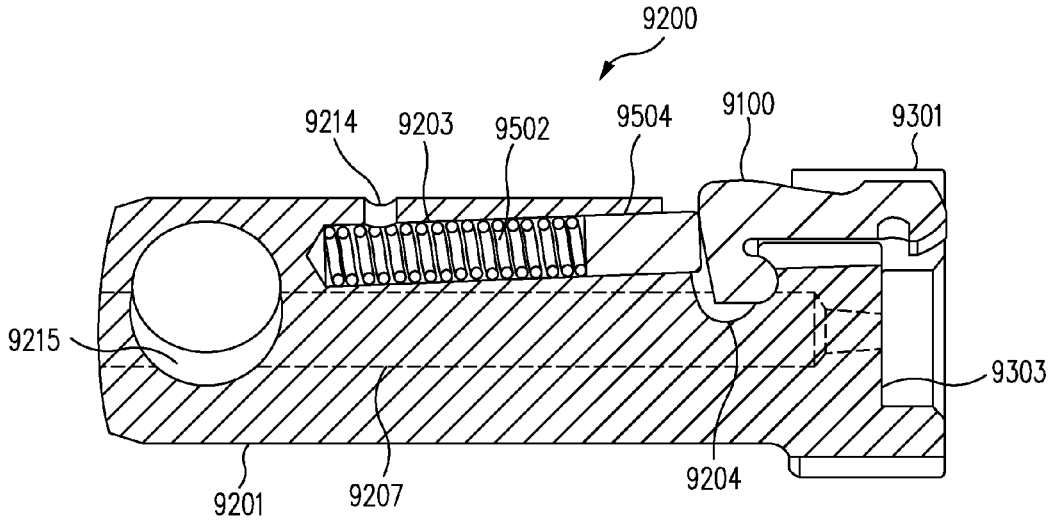

FIGS. 62 and 63 show a bolt 9200, in accordance with an embodiment. The bolt 9200 can have a body 9201 within which is formed two spring holes 9202 and 9203. Each spring hole 9202, 9203 can receive and retain one of the springs 9501, 9502 and one of the plungers 9503, 9504.

Thus, the bolt 9200 can have two springs 9501, 9502 in a side-by-side and generally parallel configuration. The two springs 9501, 9502 can apply force to the heel 9103 of the extractor 9100 to bias the extractor 9100 into the closed position thereof.

The two springs 9501, 9502 can apply greater force (as compared to a single such spring) to the extractor 9100 so as to cause the extractor 9100 to better engage the rim of a cartridge. Thus, the use of two springs 9501, 9502 can mitigate failures to extract.

The bolt 9200 can have a cavity 9204 formed therein. The cavity 9204 can at least partially receive and retain the extractor 9100. The cavity 9204 can facilitate installation of the springs 9501, 9502 and the plungers 9503, 9504 into the spring holes 9202, 9203.

The cavity 9204 can be open on the top thereof. The cavity 9204 can be open on one side thereof and closed on another side thereof. For example, the cavity 9204 can have a wall 9511 on one side thereof and can lack such a wall on the other side thereof. Having the cavity 9204 open on one side and closed on another side thereof more readily facilitates manufacturing of the bolt 9200 while maintaining a greater strength around the cavity 9204 than would exist without the wall 9511.

The cavity 9204 can have a groove 9206 formed therein. The groove 9206 can receive the bump 9105 of the extractor. The bump 9105 can cooperate with the groove 9206 to define a pivot about which the extractor 9100 (particularly the claw 9104 thereof) can rotate several degrees.

The spring holes 9202, 9203 can be formed behind the cavity 9204. The spring holes 9202, 9203 can be approximately parallel with respect to one another. The spring holes 9202, 9203 can be approximately parallel with respect to a firing pin hole 9207, at least to within approximately 5°.

Figure 64:
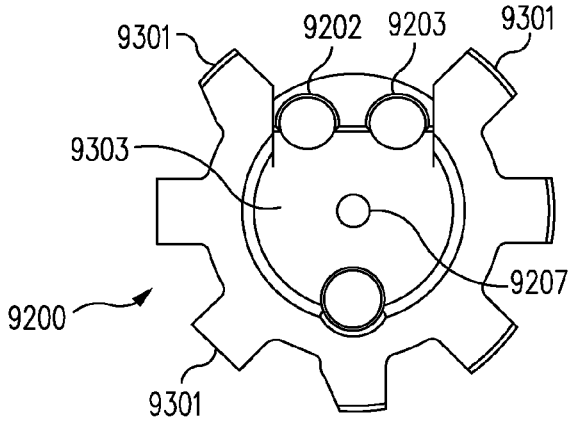

FIG. 64 show an end view of the bolt 9200, in accordance with an embodiment. The bolt 9200 can have a bolt face 9303 formed at a front thereof. The bolt 9200 can have a plurality, e.g., seven, lugs 9301 formed thereon. The lugs 9301 can rotate to lock the bolt 9200 to a corresponding plurality of lugs in the barrel prior to firing a cartridge.

For example, the bolt 9200 can have an eight lug pattern with one lug (the lug that would have been at the top of the pattern shown in FIG. 64) removed so as to accommodate the width of the extractor 9100 and to facilitate drilling of the two spring holes 9202, 9203 side-by-side without their intermediate wall being compromised, e.g., being so thin as to break though. Removal of the lug can also better accommodate the installation of the springs 9501, 9502 and the plungers 9503, 9504 in the spring holes 9202, 9203.

Figure 65:
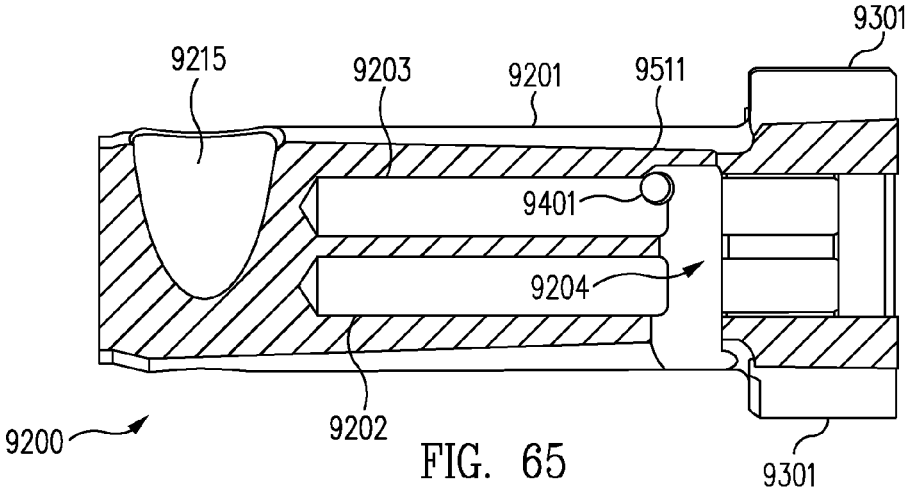
Figure 66:
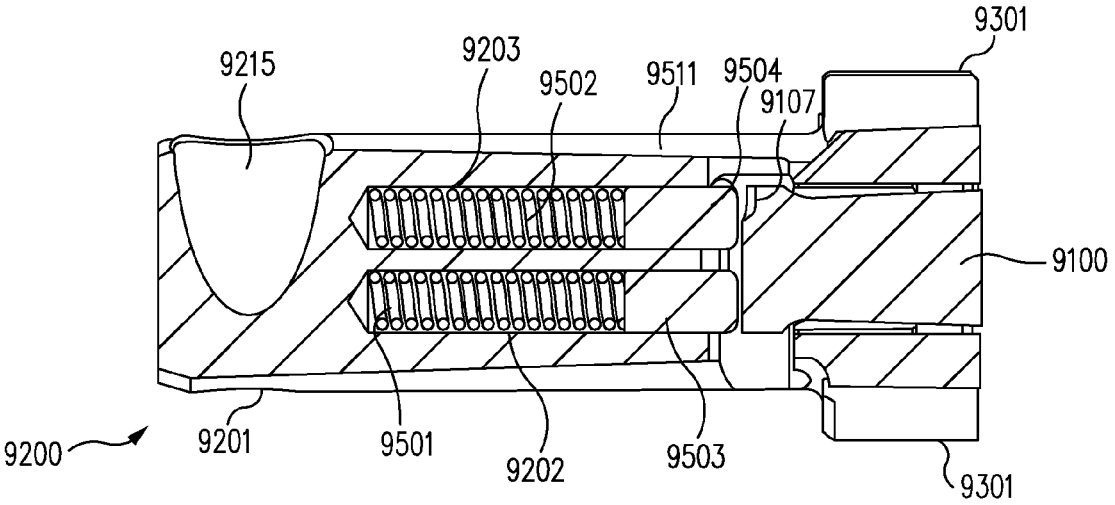
Figure 67:
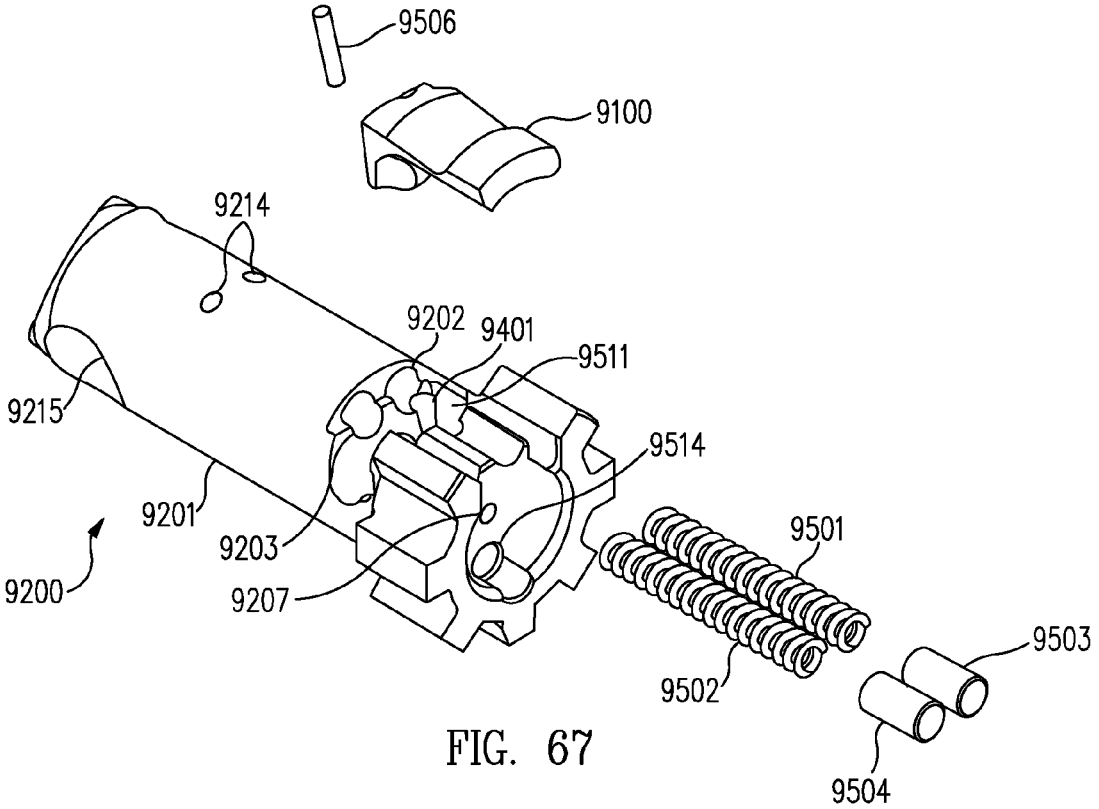

FIGS. 65 and 66 show cross-sectional views of the bolt 9200, in accordance with an embodiment. An extractor stop pin hole 9401 can be configured to receive an extractor stop pin 9506 (FIG. 67). The extractor stop pin hole 9401 can be formed at least partially within the cavity 9204. The extractor stop pin hole 9401 can be formed proximate a rear of the cavity 9204.

The extractor stop pin 9506 can limit rearward movement of the extractor 9100. For example, the extractor stop pin 9506 can limit rearward movement of the extractor 9100 sufficiently to prevent the pivot bump 9105 from escaping from the groove 9206.

The claw 9104 defines a cam or ramp 9111 (FIG. 61) on a front surface thereof. For firearms having cartridges with deep extractor recesses, a comparatively steep ramp 9111 is required to lift the claw 9104 up and over the rim. As the ramp 9111 becomes more steep, it becomes more likely that the extractor 9100 will move rearward rather than have the claw 9104 lift up, over the cartridge rim, when the cartridge rim is pressed into the bolt face 9303 (FIG. 64). By placing the extractor stop pin 9506 in the extractor stop pin hole 9401, this undesirable rearward movement of the extractor 9100 can be mitigated. Thus, the extractor stop pin 9506 can help maintain the extractor 9100 in place during operation of the firearm.

The extractor stop pin 9506 can be installed in those bolts 9200 where it is needed, e.g., where a steep ramp 9111 is present. The extractor stop pin 9506 can be left out in those bolts 9200 where it is not needed, e.g., where a steep ramp 9111 is not present. In either instance, the extractor stop pin hole 9401 can be provided so that the extractor stop pin 9506 can be installed as needed.

A recess 9107 can be formed in the extractor 9100 to partially receive the extractor stop pin 9506. The size, e.g. depth, of the recess 9107 can define the limit of rearward movement of the extractor 9100.

Figure 68:
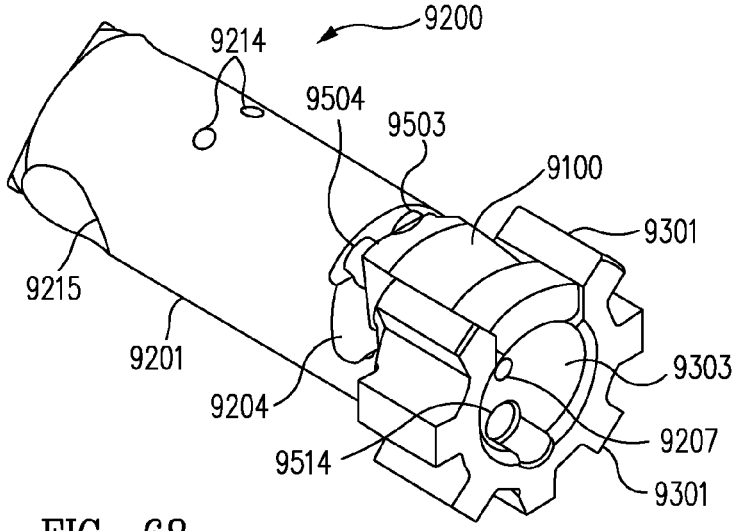

FIGS. 67 and 68 show perspective views of the bolt 9200, in accordance with an embodiment. As can be seen, each spring 9501, 9502 has a plunger 9503, 9504 in front thereof and the plunger 9503, 9504 can bear upon the heel 9103 of the extractor 9100. The force applied by the plungers 9503, 9504 can bias the extractor 9100 into a closed position wherein the claw 9104 of the extractor 9100 is closest to a centerline 9250 (FIG. 62) of the bolt 9200. The open position of the extractor 9100 can be considered to be a position wherein the claw 9104 is not closest to a centerline 9250, such as when the claw 9104 of the extractor 9100 is engaging a rim of a cartridge.

The biasing force applied the springs 9501, 9502 urges the bump 9105 of the extractor 9100 forward, into the groove 9206. The biasing force applied the springs 9501, 9502 also urges the claw 9104 to pivot downwardly, such as into a recess defined in a cartridge by the rim of the cartridge. Thus, when a cartridge has been chambered and the locking lugs 9301 of the bolt 9200 are fully engaged (the bolt 9200 is locked), then the claw 9104 of the extractor 9100 is engaged with the cartridge. The biasing force urges the extractor 9100 from an open position to a closed position thereof.

An ejector hole 9514 can contain an ejector (not shown) for pushing a fired cartridge from the lower receiver 102 of the firearm 9600 (FIG. 6) as the bolt moves rearward.

Drain holes 9214 facilitate the draining of fluids from the spring holes 9202, 9203. If the assembled bolt 9200 is soaked in cleaning fluid, for example, then the cleaning fluid can be drained from the spring holes 9202, 9203 via the drain holes 9214. Otherwise, the incompressible cleaning fluid may interfere with proper operation of the extractor 9100.

A camming surface 9215 can facilitate clocking or rotation of the bolt 9200 to engage the lugs 9301. This can be done according to well known principles.

FIG. 69 is a flow chart showing operation of the firearm in accordance with an embodiment. The firearm can be cycled by either cocking the firearm or by firing the firearm, as indicated in block 9701. When the firearm is cycled, a new cartridge can be stripped from its magazine.

The ramp 9111 of the claw 9104 of the extractor 9100 can ramp over a rim of the cartridge, as indicated in block 9702. The extractor stop pin 9506 can limit rearward movement of the extractor 9100 as the cartridge is chambered. The extractor stop pin 9506 can be either installed or omitted, as needed for a particular firearm.

The two springs 9501, 9502 can apply force to the extractor 9703 as the cartridge is extracted after firing the firearm, as indicated in block 9703. The cycle can then repeat.

The use of a wider extractor provides enhanced engagement of the extractor with the rim of a cartridge to mitigate the occurrence of failures to extract. The use of two springs better facilitates forceful engagement of a claw of the extractor with a rim of a cartridge so as mitigate the occurrence of failures to extract.

FIGS. 70 and 71 show two gas piston rings 7001, according to an embodiment. Each piston ring 7001 has a key 7002 formed thereon. The key 7002 is configured to be received within a gap of a piston ring 7001. Two piston rings 7001 can be nested or positioned next to one another such that the key 7002 of each piston ring 7001 is received within the gap 7003 of each other piston ring 7002.

Since the two piston rings 7001 can only rotate substantially in unison with one another, the gaps 7003 of the two piston rings 7001 cannot align with one another. Therefore, gas cannot easily flow past the two piston rings 7001 and an enhanced gas seal is provided thereby.

FIGS. 72-74 show the gas metering port 7502, according to an embodiment. The gas metering port 7502 can comprise a first tubular member 7511 that passes through a second tubular member 7512, wherein the first tubular member 5711 and the second tubular member 7512 are held within the gas block 7503 via a screw 7513 that screws into the second tubular member 7512. The screw 7513 can expand a portion of the second tubular member 7512 as the screw 7513 is tightened so as to cause the second tubular member 7512 to frictionally engage the gas block 7502. The amount of gas provided by the gas metering port 7502 can be set by adjusting the screw 7513. Turning the screw 7513 can vary the size of an opening 7515 though which the gas flows in the first tubular member 7511.

Gas flows from the barrel 105 through the barrel gas port 7501, through passage 7561 formed in the gas block 7503, and into the first tubular member 5711. Gas flows though the opening 7515, past the screw 7513, and into the cylinder 7004, where the gas can act upon the piston 7003.

Since the gas metering port is disposed outside of the barrel 105, the gas metering port 7502 is not subject to erosion the way that the barrel gas port 7501 is subject to erosion. Thus, the use of a gas metering port 7502 better assures uniform operation of the firearm over an extended time period.

FIGS. 75-81 show a tensioner 8083 for providing a preload for the attachment of the barrel 105 to the backbone 103. This preload is the amount of force with which the barrel 105 is held to the backbone 103. The preload assures that the barrel 105 is held tightly to the backbone 103.

FIG. 75 is a side view of a barrel 105 positioned for attachment to a backbone 103, according to an embodiment. The barrel 105 can be attached to the backbone 103 by pressing the barrel latch 113 downwardly (as indicated by the downward arrow) so as to move the swinging wedge 8253 to the left such that the swinging wedge 8253 can receive the pin 8254. The barrel latch 113 and the swinging wedge 8253 can rotate against spring tension about pivot pin 7581 (as indicated by the counterclockwise curved arrow) when the level 113 is pressed downwardly. After the barrel latch 113 is pressed, the barrel 105 can be moved generally upwardly (as indicated by the upward arrows). The ramp 8252 can function as a guide for the proximal end of the barrel 105 during installation of the barrel 105. Distal end of the barrel 105, e.g. the barrel extension 8606, can be seated prior to the pin 8254 being received by the swinging wedge 8253.

FIG. 76 is a side view of a barrel 105 attached to a backbone 103, according to an embodiment. Once the barrel 105 is within the rear v-block 8081 and the front v-block 8082 and once the flange 8087 of the barrel extension 8088 is within the groove 8086 of the rear v-block 8081, then the barrel latch 113 can be released such that spring tension causes the swinging wedge 8253 to engage the pin 8254 so as to attach the barrel 105 to the backbone 103.

FIG. 77 is a cross-sectional side view of the barrel 105 and backbone 103 taken along line 77 of FIG. 76, according to an embodiment. The rear v-block 8081 contacts the barrel 105 over an arc of approximately 120° on the top portion of the barrel 105. FIG. 78 is a cross-sectional side view showing the barrel 105 and backbone 103 of FIG. 77 exploded apart from one another, according to an embodiment.

FIG. 79 is a cross-sectional side view of the barrel 105, backbone 103, swinging wedge 8253, and tensioner 8083 taken along line 79 of FIG. 76, according to an embodiment. Once the barrel 105 has been attached to the backbone 103, the tensioner 8083 maintains a preload that holds the barrel 105 securely to the backbone 103. For example, the tensioner 8083 can provide a preload of approximately 700 pounds that holds the barrel 105 to the backbone 103.

With particular reference to FIGS. 77-82, the tensioner 8083 can have a yoke 7901 that extends downwardly from the pin 8254. In response to the pin 8254 being pulled upwardly by the swinging wedge 8253, the yoke 7901 can pull upwardly to compress spring washers 7902 when the barrel 105 is attached to the backbone 103. The compressed spring washers 7902 push upwardly against a threaded collar or flange 7903. The threaded flange 7903 has a screw 7904 threaded therethrough and contacting the barrel 105. The screw 7903 bears upon the barrel 105 and applies a preload generated by the compressed spring washers 7901 to the barrel 105. The amount of the preload is adjustable by turning the screw 7904.

A screw 7921 can attach the fore grip 106 to the tensioner 8083 and thus to the firearm. The screw 7921 can thread into an extension 7922 that hangs downwardly from the tensioner 8083.

FIG. 83 shows which of the three firearms various different features can be found on. For example, open bolt full auto operation can be found on the machine gun 100 and the rifle/machine gun 8000, as indicated in line one of the chart. Features of the machine gun 100, the semi-auto rifle 1000, and the rifle/machine 8000 can be used on one another and on other firearms. Such features can be use alone, or on any desired combination, on any firearm. For example, the metered gas port 7602 and the extractor 9100 can be used on other firearms, such as the M16 and M4.

The term "firearm" as used herein can refer to the machine gun 100, the semi-auto rifle 1000, and the rifle/machine 8000. The term "firearm" as used herein can refer to other firearms, such as contemporary firearms.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

A firearm can comprise: a bolt carrier; a backbone configured to guide the bolt carrier; a lower receiver within which the bolt carrier is at least partially disposed, wherein the backbone is removably attached to the lower receiver; a barrel latch attached to the backbone; a barrel configured to disengage from the backbone when the barrel latch is pushed; a trigger block assembly configured to drop into the lower receiver; a gas piston having a plurality of piston rings configured to only rotate substantially in unison with one another, wherein the gas piston is configured to move the bolt carrier when a cartridge is discharged; a metered gas port disposed out of the barrel for metering gas from the barrel to the gas piston; a spring guide having a main spring disposed thereon for biasing the bolt carrier in a forward position; an anti-bounce weight at least partially contained within the spring guide; a bolt carried by the bolt carrier; an extractor attached to the bolt; two springs disposed within the bolt for biasing the extractor toward a closed position of the extractor; a bar inhibiting separation of the lower receiver and the backbone when the main spring is compressed; a firing pin disposed within the bolt; one of: a firing pin retaining pin configured to facilitate removal of the firing pin and configured to transfer forward movement of the bolt carrier to the firing pin to cause a cartridge to fire and a hammer assembly disposed within the lower receiver and having a hammer and a link with one end of the link attached to the hammer and another end of the link attached to the lower receiver such that the hammer has a rearward position that is below the bolt when the bolt is in a rearward position and the hammer has a forward position where the hammer strikes the firing pin when the bolt is in a forward position and wherein the link is configured such that the hammer has sufficient throw to travel over a last round stop as the hammer moves from the rearward position to the forward position wherein the link, not the hammer, has the notches actuated by a trigger motion; a takedown lever configured to inhibit separation of the backbone and the lower receiver, the takedown lever having a safety lock pin to inhibit inadvertent movement of the takedown lever; a charging handle configured to move rearward to move the bolt carrier from a closed bolt position to an open bolt position; a dust cover configured to open partially to allow the charging handle to move rearward and to block bolt release from open bolt position until the cocking handle has returned forward; a gas port flash suppressor configured to guide the barrel during mating of the barrel to the backbone; and a stock having a handle formed therein, wherein a projection is configured to inhibit vertical movement of a stock.

A firearm can comprise: a bolt carrier; a backbone configured to guide the bolt carrier; a lower receiver within which the bolt carrier is at least partially disposed, wherein the backbone is removably attached to the lower receiver; a barrel latch attached to the backbone; a barrel configured to disengage from the backbone when the barrel latch is pushed; and a trigger block assembly configured to drop into the lower receiver.

A device can comprise: a bolt carrier for a firearm; a backbone configured to at least partially guide the bolt carrier as the bolt carrier moves forward and backward during a firing cycle of the firearm; and wherein the bolt carrier is not completely contained within the backbone; wherein a portion of the bolt carrier is contained within the backbone and a portion of the bolt carrier is not contained within the backbone; wherein part of the bolt carrier hangs below the backbone; wherein part of the bolt carrier is slidably disposed within the backbone; wherein: the backbone is generally tubular and has a slot formed longitudinally therein; the bolt carrier has an upper portion contained within the backbone, a lower portion not contained within the backbone, and a waist interconnecting the upper portion and the lower portion; and wherein the waist is disposed within the slot and the upper portion moves longitudinally within the backbone; can comprise: a bolt having a cam pin extending therefrom; wherein: the bolt carrier comprises a cam for rotating the bolt by camming the cam pin; the backbone comprises a cutout extending from one side of the slot; and a portion of the cam pin extends into the slot to inhibit rotation of the bolt when the bolt carrier is in a rearward position, the portion of the cam pin moves from the slot into the cutout to facilitate camming of the cam pin and rotation of the bolt when the bolt is in a forward position, and the cam pin moves from the cutout into the slot when the carrier moves rearward; wherein the device is a firearm.

A firearm can comprise: a backbone disposed within the receiver; a bolt carrier; and wherein movement of the bolt carrier is constrained by the backbone and is not constrained by the receiver.

A method can comprise: placing a portion of a bolt carrier within a backbone while leaving another portion of the bolt carrier out of the backbone; and wherein the backbone is configured to at least partially guide the bolt carrier as the bolt carrier moves forward and backward during a firing cycle of a firearm.

A method can comprise: at least partially guiding a bolt carrier with a backbone as the bolt carrier moves forward and backward during a firing cycle of a firearm; and wherein the bolt is not contained within the backbone.

A device can comprise: a bolt carrier for a firearm, the bolt carrier having a generally tubular upper portion, a generally rectangular lower portion, and a waist interconnecting the upper portion and the lower portion; and wherein the upper portion is substantially longer than the lower portion; wherein a front of the upper portion is forward of the lower portion; wherein the bolt carrier has four surfaces for contacting a backbone that are forward on the bolt carrier and has four surface for contacting the backbone that are aft on the bolt carrier; wherein device comprises a firearm.

A method can comprise: forming a bolt carrier for a firearm to have a generally tubular upper portion, a generally rectangular lower portion, and a waist interconnecting the upper portion and the lower portion; and wherein the upper portion is substantially longer than the lower portion.

A method can comprise: chambering a cartridge in a firearm using a bolt carrier having a generally tubular upper portion, a generally rectangular lower portion, and a waist interconnecting the upper portion and the lower portion; and wherein the upper portion is substantially longer than the lower portion.

According to an embodiment, a firearm can have a barrel, a lower receiver, a backbone and two v-blocks with a spring loaded 2-armed swinging wedge located halfway between them and attached to the backbone to hold the barrel pulled up tight and precisely centered in the v-blocks with the flange of the barrel extension in a fore and aft locking groove in the rear v-block.

The rear v-block bears on and centers the body diameter of the barrel extension while the top 120° of the flange of the barrel extension fits up into a locking groove in that v-block. The close fit of the flange and locking groove combined with the upward pull of the swinging wedge on the barrel cross pin holds the barrel centered in the v-blocks, locks the barrel to the backbone and securely blocks any fore and aft movement of the barrel breech in relation to the backbone structure.

For longitudinal heat expansion the barrel slides fore or aft in the front v-block and the swinging wedge follows that motion without releasing its wedging force.

For radial heat expansion the two upper arms of a "Y" shaped yoke fit around both sides of the barrel and have a cross pin fastened through them across the top of the barrel. The ends of the cross pin extend beyond the outer sides of the two arms so that the 2-armed swinging wedge pulls upward on the two ends of the cross pin. In the crotch of the yoke an adjustable set screw bears on the bottom of the barrel and is factory adjusted to push downward on a flanged threaded tube compressing high force spring washers holding the yoke and cross pin downward with an initial force of approximately 700 pounds. As the approximately 1" barrel diameter expands from the heat of firing, the angled walls of the v-block force the barrel diameter downward, the center of which moves downward about 0.0045 inches while the bottom compresses the spring washers about 0.009 inches increasing the force to approximately 1200 pounds as the barrel temperature reaches approximately 1500° F. The barrel remains centered with no longitudinal breach movement.

The bottom stem of the yoke is fastened through a fore grip.

To install a barrel it is lifted upward and pulled rearward by its fore grip. Guide surfaces bring the barrel extension into alignment with the locking groove and the cross pin into engagement with the swinging wedge which snaps onto the pin drawing the barrel tight upward into its V-blocks and locked into the groove.

To remove a barrel the barrel latch is hit downward. The same guide surfaces that directed it into position guide it out and downward on a path that prevents it from hitting or damaging a magazine. That path is also not obstructed by the weapon's bipod.

A firearm can comprise: a backbone; a barrel removably attached to the backbone; a barrel latch attached to the backbone; a swinging wedge defining part of the barrel latch; a pin attached to the barrel; and wherein the swinging wedge is configured to facilitate attachment of the barrel to the backbone via the pin such that moving the barrel latch allows the barrel to detach from the backbone; wherein the swinging wedge is configured such that approximately the same force is applied to the barrel regardless of where along the swinging wedge the pin contacts the swinging wedge; wherein the swinging wedge is curved; wherein the swinging wedge is curved and a pivot of the swinging wedge is not concentric with a radius of the swinging wedge; wherein the swinging wedge is curved and a pivot of the swinging wedge is offset with respect to a radius of the swinging wedge by an angle of approximately 8°; can comprise: a tensioner for providing a preload of the pin with respect to the swinging wedge; and wherein the tensioner accommodates radial thermal expansion of the barrel; can comprise a tensioner for providing a preload of approximately 700 lbs. for the pin with respect to the swinging wedge; can comprise: two V-blocks attached to the backbone into which the barrel is pulled by the swinging wedge; and wherein the V-blocks maintain alignment of the barrel with respect to the backbone while the a tensioner accommodates thermal expansion of the barrel; can comprise: a first guide cam configured to move the barrel forward beyond a front of the lower receiver to release the barrel from the backbone when a proximal end of the barrel latch is moved; and a second guide configured to swing the barrel forward of a magazine of the firearm so the barrel can drop away from the firearm without contacting the magazine; wherein the swinging wedge is defined by wedge surfaces formed in paws that are moved by a lever end of the barrel latch.

A method can comprise: attaching a barrel latch to a backbone of a firearm, the backbone having a swinging wedge attached thereto; attaching a barrel to the backbone via a pin attached to the barrel that is captured by the swinging wedge; and wherein the swinging wedge is configured to facilitate detachment of the barrel from the backbone by moving the barrel latch.

A method can comprise: moving a swinging wedge of a firearm; and wherein moving the swinging wedge facilitates detachment of a barrel from a backbone of the firearm.

A device can comprise: a trigger block assembly for a firearm; and wherein the trigger block assembly is configured to drop into the firearm; wherein the device is a firearm.

A method can comprise: assembling a trigger block assembly for a firearm; providing a lower receiver for the firearm; and assembling the trigger block assembly to the lower receiver by dropping the trigger block assembly into the lower receiver.

A method can comprise: firing a firearm by pulling a trigger of the firearm; wherein the trigger is part of a trigger block assembly; and wherein the trigger block assembly is configured to drop into a receiver of the firearm during assembly of the firearm.

A device can comprise: a piston for a gas operated firearm; and two protrusions formed upon the piston and configured to limit rearward movement of the piston when the firearm is discharged; can comprise: a cylinder in which the piston is slidably disposed; two slots formed in the cylinder receiving the two protrusions; and wherein the two slots define gas vents from which gas escapes after the firearm is discharged; wherein the piston is not attached to the bolt carrier; can comprise: a plurality of rings disposed about the piston; and wherein the rings are configured to only rotate substantially in unison with one another; wherein the device comprises a firearm.

A method can comprise: placing a piston into a cylinder of a gas operated firearm; and wherein the piston has two protrusions formed thereon and the protrusions are slidably disposed in two slots formed in the cylinder such that the protrusions limit movement of the piston.

A method can comprise: firing a gas operated firearm to provide gas to a piston of the firearm; wherein the piston moves in response to pressure provided by the gas; and wherein movement of the piston is limited by two protrusions formed upon the piston.

A device can comprise: a recoil spring configured to be compressed by rearward movement of a bolt carrier when a firearm is discharged; a spring guide for limiting movement of the recoil spring; an anti-bounce weight defined by at least a portion of the spring guide; and wherein the anti-bounce weight is configured to inhibit bouncing of a bolt carrier of the firearm; wherein: the spring guide comprises a rod and a sleeve surrounding a portion of the rod; and timing for the anti-bounce weight is at least partially determined by a distance between the front end of the anti-bounce weight and the inside of the front cap of the bolt carrier; where the device is a firearm.

A method can comprise: assembling a spring guide for a firearm; defining an anti-bounce weight with at least a portion of the spring guide; and wherein the anti-bounce weight is configured to inhibit bouncing of a bolt carrier of the firearm.

A method can comprise: firing a firearm; guiding a recoil spring of the firearm with a spring guide; and inhibiting bouncing of a bolt carrier of the firearm with an anti-bounce weight defined by at least a portion of the spring guide.

A device can comprise: a lower receiver for a firearm; a bolt having a forward position and a reward position; a firing pin disposed substantially within the bolt; a hammer assembly disposed within the lower receiver and having a hollow tubular hammer and a link; and wherein one end of the link is pivotally attached to the hammer and another end of the link is pivotally attached to the lower receiver such that the hammer has a rearward position that is below the bolt when the bolt is in the rearward position and the hammer has a forward position where the hammer strikes the firing pin when the bolt is in a forward position and the link is configured such that the hammer has sufficient throw to travel over a last round stop as the hammer moves from the rearward position to the forward position and wherein the link, not the hammer, has sear notches held and released by the trigger motion; can comprise: a spring guide pivotally attached to the lower receiver and received within a bore of hammer; a spring disposed upon the spring guide; and wherein the spring biases the hammer toward the forward position; wherein the device is a firearm.

A method can comprise: installing a hammer assembly within a lower receiver of a firearm, the hammer assembly having a hammer and a link; and wherein one end of the link is pivotally attached to the hammer and another end of the link is pivotally attached to a lower receiver such that the hammer has a rearward position that is below a bolt when the bolt is in a rearward position and the hammer has a forward position where the hammer strikes a firing pin when the bolt is in a forward position and the link is configured such that the hammer has sufficient throw to travel over a last round stop as the hammer moves from the rearward position to the forward position.

A method can comprise: pulling a trigger to discharge a firearm; striking a firing pin with a hammer in response to pulling the trigger; and wherein one end of a link is pivotally attached to the hammer and another end of the link is pivotally attached to a lower receiver such that the hammer has a rearward position that is below a bolt when the bolt is in the rearward position and the hammer has a forward position where the hammer strikes the firing pin when the bolt is in a forward position and the link is configured such that the hammer has sufficient throw to travel over a last round stop as the hammer moves from the rearward position to the forward position.

A device can comprise: a stock for a firearm; a butt formed on a distal end of the stock; and a handle formed in the butt and configured to inhibit vertical movement of the stock when a hand is grasping the stock; wherein the device is a firearm.

A method can comprise: forming a generally horizontal handle in a butt at the distal end of a stock for a firearm; and wherein the generally horizontal handle is configured to inhibit vertical movement of the stock when a hand is grasping the butt.

A method can comprise: discharging a firearm; and grasping a butt of a stock of the firearm with a hand while the firearm is being discharged; and wherein a generally horizontal handle formed in the butt inhibits vertical movement of the stock.

A gas operated firearm can comprise: a barrel; a barrel gas port formed in the barrel; a gas system; a metered gas port not disposed in the barrel and configured to metered gas from the barrel to the gas system; and wherein the metered gas port tends to maintain a substantially uniform quantity of gas to the gas system as the barrel gas port enlarges due to wear; wherein the metered gas port comprises an adjustment screw for varying the quantity of gas to the gas system; wherein the metered gas port comprises: a first tubular member; a second tubular member interlocking with the first tubular member; and wherein gas flows through the first tubular member and the second tubular member; can comprise: a gas block; wherein the metered gas port comprises: a first tubular member; a second tubular member interlocking with the first tubular member; and wherein the first tubular member is inserted into the gas block of the firearm and the second tubular member is subsequently inserted into the gas block and into the first tubular member; can comprise: a gas block; herein the metered gas port comprises: a first tubular member; a second tubular member interlocking with the first tubular member; wherein the first tubular member is inserted into the gas block of the firearm and the second tubular member is subsequently inserted into the gas block and into the first tubular member; and a screw that screws into the first tubular member to lock the first tubular member to the second tubular member and to lock the first tubular member and the second tubular member into the gas block.

A method can comprise: forming a barrel gas port in a barrel of a firearm; attaching a metered gas port to the firearm at a location not in the barrel; wherein the metered gas port is configured to meter gas from the barrel to a gas system; and wherein the metered gas port tends to maintain a substantially uniform quantity of gas to the gas system as the barrel gas port enlarges due to wear.

A method can comprise: metering gas to the gas system of a firearm using a metered gas port; wherein the metered gas port is not disposed in a barrel of the firearm; and wherein the metered gas port tends to maintain a substantially uniform quantity of gas from the barrel to the gas system as the barrel gas port enlarges due to wear.

A device can comprise: an extractor for a firearm, wherein the extractor has a closed position and an open position; two springs for biasing the extractor toward the closed position; and wherein the extractor is sufficiently wide to be biased by the two springs; can comprise: a bolt for a firearm, the bolt can comprise: a body; a firing pin hole formed in the body; a firing pin disposed in the firing pin hole; and two spring holes formed in the body approximately parallel with respect to the firing pin hole, wherein each spring hole contains one of the two springs; wherein the two spring holes are within approximately 5° of being parallel with respect to the firing pin hole; wherein the two spring holes are proximate one another and are parallel with respect to one another; can comprise: an extractor stop pin hole formed in the body; and an extractor stop pin disposed in the extractor stop pin hole such that the extractor stop pin limits rearward movement the extractor with respect to the body; can comprise: a pivot bump formed upon the extractor; a retaining groove within which the pivot bump is at least partially disposed; an extractor stop pin hole formed in the body; and an extractor stop pin disposed in the extractor stop pin hole such that the extractor stop pin prevents the extractor from moving rearward enough for the pivot bump to move out of the retaining groove; can comprise: an extractor cavity formed in the body and configured to contain at least a portion of the extractor; and wherein the extractor cavity is open on one side thereof and is closed on another side thereof; wherein the device is a firearm.

A method can comprise: inserting two springs into a bolt for a firearm; attaching an extractor to the bolt; and wherein the two springs bias the extractor toward a closed position of the extractor.

A method can comprise: discharging a firearm; biasing an extractor of the firearm toward a closed position of the extractor with two springs; and extracting a cartridge case from a chamber of the firearm with the extractor.

A device can comprise: a recoil spring for a firearm; a bolt carrier having a forward position and a rearward position, wherein the recoil spring biases the bolt carrier in the forward position; a bar configured to be pulled forward by the bolt carrier as the bolt carrier chambers a cartridge; and wherein the bar is configured to inhibit takedown of the firearm when the bolt carrier is in the rearward position thereof and the recoil spring is compressed; wherein the bar releases a hammer of the firearm when the bolt of the firearm is substantially fully forward; wherein the bar releases a hammer of the firearm to strike a firing pin when the bolt of the firearm is locked; herein the device is a firearm.

A method can comprise: installing a recoil spring in a firearm; installing a bolt carrier in the firearm such that the recoil spring biases the bolt carrier in a forward position of the bolt carrier; installing a bar in the firearm, the bar being configured to be pulled forward by the bolt carrier as the bolt carrier chambers a cartridge; and wherein the bar is configured to inhibit takedown of the firearm when the bolt carrier is in a rearward position thereof and the recoil spring is compressed.

A method can comprise: biasing a bolt carrier in a forward position with a recoil spring; discharging the firearm to move the bolt carrier to a rearward position and then back to a forward position; pulling a bar forward by the bolt carrier as the bolt carrier chambers a cartridge; and wherein the bar is configured to inhibit takedown of the firearm when the bolt carrier is in the rearward position thereof and the recoil spring is compressed.

A device can comprise: a backbone for a firearm; a lower receiver for the firearm; a takedown lever having a first position and a second position, wherein when the takedown lever is in the first position separation of the backbone from the lower receiver is facilitated and when the takedown lever is in the second position separation of the backbone from the lower receiver is inhibited; and a safety lock pin inhibiting inadvertent movement of the takedown lever from the first position to the second position and inhibiting inadvertent movement of the takedown lever from the second position to the first position; wherein the device is a firearm.

A method can comprise: assembling a takedown lever to a firearm, the takedown lever having a first position and a second position, wherein when the takedown lever is in the first position separation of the backbone from the lower receiver is facilitated and when the takedown lever is in the second position separation of the backbone from the lower receiver is inhibited; and assembling a safety lock pin to the firearm, the safety lock pin inhibiting inadvertent movement of the takedown lever from the first position to the second position and inhibiting inadvertent movement of the takedown lever from the second position to the first position.

A method can comprise: moving a safety lock pin of a firearm to facilitate movement of a takedown lever of the firearm; moving the takedown lever from a first position thereof to a second position thereof to facilitate disassembly of the firearm; and wherein the safety lock pin inhibits inadvertent movement of the takedown lever from the first position to the second position and inhibits inadvertent movement of the takedown lever from the second position to the first position.

A device can comprise: a charging handle for a firearm; and a dust cover configured to open approximately 7° to allow the charging handle to move rearwards as the firearm is cocked; wherein the device is a firearm.

A method can comprise: assembling a charging handle to a firearm; assembling a dust cover to the firearm; and wherein the dust cover configured to open approximately 7° to allow the charging handle to move rearwards as the firearm is cocked.

A device can comprise: a firing pin; a firing pin retaining pin configured to retain the firing pin in a bolt of a firearm; and wherein the firing pin retaining pin is configured to transfer forward movement of a bolt carrier to the firing pin to cause the firearm to discharge; wherein the device is a firearm.

A method can comprise: assembling a firing pin into a bolt of a firearm; retaining the firing pin within the bolt with a firing pin retaining pin; and wherein the firing pin retaining pin is configured to transfer forward movement of a bolt carrier to the firing pin to cause the firearm to discharge.

A method can comprise: pulling a trigger of a firearm; moving a bolt carrier forward in response to the trigger being pulled; and transferring forward movement of the bolt carrier to a firing pin via a firing pin retaining pin that is configured to retain the firing pin within a bolt.

A device can comprise: a cylinder disposed in a backbone of a gas operated firearm; a gas exhaust port formed in the cylinder for exhausting gas from the cylinder; and a gas exhaust port flash suppressor configured to guide a barrel to the backbone to facilitate attachment of the barrel to the backbone; wherein the device is a firearm.

A method can comprise: assembling a cylinder into a backbone of a gas operated firearm, wherein the cylinder has a gas exhaust port for exhausting gas from the cylinder; attaching a gas exhaust port flash suppressor to the backbone; and wherein the gas exhaust port flash suppressor is configured to guide a barrel to the backbone to facilitate attachment of the barrel to the backbone.

A method can comprise: exhausting gas from a gas exhaust port of a cylinder of a gas operated firearm; and suppressing flash from the gas exhaust port with a flash suppressor configured to guide a barrel to the backbone to facilitate attachment of the barrel to the backbone.

A device can comprise: a semi-automatic firearm configured for both closed bolt operation and open bolt operation; and wherein the firearm comprises a selector mechanism configured to select between closed bolt operation and open bolt operation of the firearm.

A device can comprise: a firearm having a bolt and configured for both closed bolt operation and open bolt operation; wherein the firearm comprises a trigger mechanism configured such that: during open bolt operation when the bolt is rearward, pulling the trigger only allows the bolt to move forward when a cocking handle is forward; and only in closed bolt operation can the bolt be manually eased forward using the cocking handle.

A firearm can comprise: a lower receiver; a backbone; wherein the lower receiver is attached to the backbone via two hook pivots; wherein the lower receiver can pivot downward approximately 40° from two backbone studs attached to the backbone; and wherein the lower receiver can be detached from the backbone when pivoted down approximately 20° or halfway where a gap in the hook pivot allows the lower receiver to be lifted up and off the backbone studs.

The invention claimed is:

1. A firearm comprising:

a bolt carrier;

a backbone configured to guide the bolt carrier;

a lower receiver within which the bolt carrier is at least partially disposed, wherein the backbone is removably attached to the lower receiver;

a barrel latch attached to the backbone;

a barrel configured to disengage from the backbone when the barrel latch is pushed;

a trigger block assembly configured to drop into the lower receiver;

a gas piston having a plurality of piston rings configured to only rotate substantially in unison with one another, wherein the gas piston is configured to move the bolt carrier when a cartridge is discharged;

a metered gas port disposed out of the barrel for metering gas from the barrel to the gas piston;

a spring guide having a main spring disposed thereon for biasing the bolt carrier in a forward position;

an anti-bounce weight at least partially contained within the spring guide;

a bolt carried by the bolt carrier;

an extractor attached to the bolt;

two springs disposed within the bolt for biasing the extractor toward a closed position of the extractor;

a bar inhibiting separation of the lower receiver and the backbone when the main spring is compressed;

a firing pin disposed within the bolt;

a takedown lever configured to inhibit separation of the backbone and the lower receiver, the takedown lever having a safety lock pin to inhibit inadvertent movement of the takedown lever;

a charging handle configured to move rearward to move the bolt carrier from a closed bolt position to an open bolt position;

a dust cover configured to open partially to allow the charging handle to move rearward and to block bolt release from open bolt position until the cocking handle has returned forward;

a gas port flash suppressor configured to guide the barrel during mating of the barrel to the backbone; and a stock having a handle formed therein, wherein a projection is configured to inhibit vertical movement of a stock; and at least one of:

a firing pin retaining pin configured to facilitate removal of the firing pin and configured to transfer forward movement of the bolt carrier to the firing pin to cause a cartridge to fire; and/or a hammer assembly disposed within the lower receiver and having a hammer and a link with one end of the link attached to the hammer and another end of the link attached to the lower receiver such that the hammer has a rearward position that is below the bolt when the bolt is in a rearward position and the hammer has a forward position where the hammer strikes the firing pin when the bolt is in a forward position and wherein the link is configured such that the hammer has sufficient throw to travel over a last round stop as the hammer moves from the rearward position to the forward position wherein the link, not the hammer, has notches actuated by a trigger motion.

2. The firearm of claim 1, further comprising:

a barrel extension; and a swinging wedge configured to engage a cross pin on the barrel to pull the barrel upward into a plurality of v-blocks on the backbone and to pull a flange on the barrel extension upward into a groove in the backbone to center the barrel and lock the barrel extension from fore and aft motion in relation to the backbone.

3. The firearm of claim 2, wherein the cross pin passes through both sides of an open top of a U-shaped yoke with a closed bottom that passes under the barrel and supports a compressed spring configured to push upward on the barrel while pulling the cross pin downward tight against the barrel to allow the barrel to expand due to heat generated by fully automatic sustained fire to allow an expanding diameter of the barrel in the v-blocks to move downward to further compress the spring without disturbing a position or a hold of the swinging wedge on the cross pin.

4. A firearm comprising:

a bolt carrier;

a backbone configured to guide the bolt carrier;

a lower receiver within which the bolt carrier is at least partially disposed, wherein the backbone is removably attached to the lower receiver;

a barrel having a barrel extension and a cross pin;

a swinging wedge configured to engage the cross pin on the barrel to pull the barrel upward into a plurality of v-blocks on the backbone and to pull a flange on the barrel extension upward into a groove in the backbone to center the barrel and lock the barrel extension from fore and aft motion in relation to the backbone; and a trigger block assembly configured to drop into the lower receiver.

5. The firearm as recited in claim 4, wherein the backbone is configured to at least partially guide the bolt carrier as the bolt carrier moves forward and backward during a firing cycle of the firearm.

6. The firearm as recited in claim 4, wherein a portion of the bolt carrier is contained within the backbone and a portion of the bolt carrier is not contained within the backbone.

7. The firearm as recited in claim 4, wherein part of the bolt carrier hangs below the backbone.

8. The firearm as recited in claim 4, wherein part of the bolt carrier is slidably disposed within the backbone.

9. The firearm as recited in claim 4, wherein:

the backbone is generally tubular and has a slot formed longitudinally therein;

the bolt carrier has an upper portion contained within the backbone, a lower portion not contained within the backbone, and a waist interconnecting the upper portion and the lower portion; and the waist is disposed within the slot and the upper portion moves longitudinally within the backbone.

10. The firearm as recited in claim 4, further comprising:

a bolt having a cam pin extending therefrom;

wherein:

the bolt carrier comprises a cam for rotating the bolt by camming the cam pin;

the backbone comprises a cutout extending from one side of the slot; and a portion of the cam pin extends into the slot to inhibit rotation of the bolt when the bolt carrier is in a rearward position, the portion of the cam pin moves from the slot into the cutout to facilitate camming of the cam pin and rotation of the bolt when the bolt is in a forward position, and the cam pin moves from the cutout into the slot when the bolt carrier moves rearward.

11. The firearm as recited in claim 4, wherein the firearm is a fully automatic firearm.

12. The firearm as recited in claim 4, wherein:

the bolt carrier has a generally tubular upper portion, a generally rectangular lower portion, and a waist interconnecting the upper portion and the lower portion; and the upper portion is substantially longer than the lower portion.

13. The firearm of claim 4, wherein the firearm comprises the firing pin and a hammer assembly.

14. The firearm of claim 4, wherein the cross pin passes through both sides of an open top of a U-shaped yoke with a closed bottom that passes under the barrel and supports a compressed spring configured to push upward on the barrel while pulling the cross pin downward tight against the barrel to allow the barrel to expand due to heat generated by fully automatic sustained fire to allow an expanding diameter of the barrel in the v-blocks to move downward to further compress the spring without disturbing a position or a hold of the swinging wedge on the cross pin.

15. A firearm comprising:

a backbone disposed within a receiver and having a slot formed therein;

a barrel having a barrel extension and a cross pin; and a swinging wedge configured to engage the cross pin on the barrel to pull the barrel upward into a plurality of v-blocks on the backbone and to pull a flange on the barrel extension upward into a groove in the backbone to center the barrel and lock the barrel extension from fore and aft motion in relation to the backbone.

16. The firearm as recited in claim 15, wherein the backbone is configured to at least partially guide a bolt carrier as the bolt carrier moves forward and backward during a firing cycle of a firearm.

17. The firearm as recited in claim 15 wherein:

the backbone at least partially guides a bolt carrier as the bolt carrier moves forward and backward during a firing cycle of a firearm; and the bolt is not contained within the backbone.

18. The firearm as recited in claim 15, further comprising:

a bolt carrier that has a generally tubular upper portion and a generally rectangular lower portion; and wherein the upper portion is substantially longer than the lower portion.

19. The firearm as recited in claim 15, further comprising a bolt carrier having an upper portion and a lower portion, wherein a front of the upper portion is forward of the lower portion.

20. The firearm as recited in claim 15, further comprising a bolt carrier, wherein the bolt carrier has four surfaces for contacting the backbone that are forward on the bolt carrier and has four surfaces for contacting the backbone that are aft on the bolt carrier.

21. The firearm as recited in claim 15, wherein the firearm comprises a fully automatic firearm.

22. The firearm of claim 15, wherein the cross pin passes through both sides of an open top of a U-shaped yoke with a closed bottom that passes under the barrel and supports a compressed spring configured to push upward on the barrel while pulling the cross pin downward tight against the barrel to allow the barrel to expand due to heat generated by fully automatic sustained fire to allow an expanding diameter of the barrel in the v-blocks to move downward to further compress the spring without disturbing a position or a hold of the swinging wedge on the cross pin.

* * * * *